US006291151B1

(12) United States Patent
Yoneyama et al.

(10) Patent No.: US 6,291,151 B1
(45) Date of Patent: Sep. 18, 2001

(54) SILVER HALIDE PHOTOGRAPHIC LIGHT-SENSITIVE MATERIAL AND IMAGE FORMING METHOD

(75) Inventors: Hiroyuki Yoneyama; Katsuhisa Ohzeki; Yasuaki Deguchi; Katsuyuki Takada, all of Minami-ashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/493,281

(22) Filed: Jan. 28, 2000

(30) Foreign Application Priority Data

| | | |
|---|---|---|
| Jan. 29, 1999 | (JP) | 11-022904 |
| Jan. 29, 1999 | (JP) | 11-022951 |
| Jan. 29, 1999 | (JP) | 11-023318 |
| May 7, 1999 | (JP) | 11-127612 |

(51) Int. Cl.[7] ..... G03C 1/047
(52) U.S. Cl. ..... 430/547; 430/503; 430/377
(58) Field of Search ..... 430/503, 567, 430/547

(56) References Cited

U.S. PATENT DOCUMENTS

| | | | | |
|---|---|---|---|---|
| 5,077,188 | * | 12/1991 | Tanji et al. | 430/546 |
| 5,082,764 | | 1/1992 | Takahashi | 430/567 |
| 5,104,774 | | 4/1992 | Ohki et al. | 430/372 |
| 5,354,649 | | 10/1994 | Bell et al. | 430/543 |
| 5,360,704 | | 11/1994 | Brennecke | 430/506 |
| 5,618,656 | * | 4/1997 | Szajewski et al. | 430/567 |
| 5,674,674 | | 10/1997 | Edwards et al. | 430/567 |
| 5,744,290 | | 4/1998 | Szajewski et al. | 430/503 |
| 5,871,894 | | 2/1999 | Takahashi et al. | 430/538 |
| 5,958,661 | | 9/1999 | Rieger et al. | 430/543 |
| 6,048,682 | | 4/2000 | Ohzeki et al. | 430/567 |

FOREIGN PATENT DOCUMENTS

| | | |
|---|---|---|
| 0747765A1 | 11/1996 | (EP) . |
| 7239538 | 9/1995 | (JP) . |
| 7239539 | 9/1995 | (JP) . |

OTHER PUBLICATIONS

Abstract of Japanese Publication JP 07–239538, Sep. 12, 1995.
Abstract of Japanese Publication JP 07–239539, Sep. 12, 1995.

* cited by examiner

*Primary Examiner*—Hoa Van Le
(74) *Attorney, Agent, or Firm*—Birch, Stewart, Kolasch & Birch, LLP

(57) ABSTRACT

There is disclosed a silver halide photographic light-sensitive material comprising at least a silver halide emulsion layer containing a yellow dye-forming coupler, a silver halide emulsion layer containing a magenta dye-forming coupler and a silver halide emulsion layer containing a cyan dye-forming coupler, on a support, wherein: the silver halide emulsion layer containing a yellow dye-forming coupler is located more apart from the support than at least one of the silver halide emulsion layer containing a magenta dye-forming coupler and the silver halide emulsion layer containing a cyan dye-forming coupler, and silver halide grains contained in the silver halide emulsion layer containing a yellow dye-forming coupler comprises a high silver chloride emulsion in which the content of silver halide is 80 mol % or more. There is also disclosed a method of forming an image using the light-sensitive material.

64 Claims, No Drawings

SILVER HALIDE PHOTOGRAPHIC LIGHT-SENSITIVE MATERIAL AND IMAGE FORMING METHOD

FIELD OF THE INVENTION

The present invention relates to a silver halide photographic light-sensitive material having excellent rapid processing suitability, and to a method of forming an image using the same. More specifically, the present invention relates to a silver halide color photographic light-sensitive material that comprises grains comprising a tabular silver chloride, or silver chlorobromide, silver chloroiodide, or silver chloroiodobromide, each of which has a high silver chloride content, thereby enabling reduction of each of image-forming time at color development, bleach-fixing time, and washing time, and to a method of forming an image using the light-sensitive material.

Further, the present invention relates to a silver halide photographic light-sensitive material that can reduce each of image-forming time at color development, bleach-fixing time, and washing time, without any harmful influence; a silver halide photographic light-sensitive material having excellent image fastness (stability), and a method of forming an image using the same.

BACKGROUND OF THE INVENTION

Recently, in the field of photographic processing service, a high-image-quality light-sensitive material that can be rapidly processed, is desired as a part of improving service to users in order to reduce, for example, customer's waiting time, and also as means of increasing production efficiency. For this purpose, several technologies have been proposed using silver halide grains having a high silver chloride content, so-called "high silver chloride grains," which means silver halide grains having a silver chloride content of 80% or more (hereinafter referred to as high silver chloride grains). The use of high silver chloride grains gives such advantages as that developing speed is accelerated, and the reusability or recycling property of a processing solution is increased. Presently, a light-sensitive material of the type using high silver chloride grains is dominant in the light-sensitive materials for print, such as color photographic printing paper. A processing system in which a light-sensitive material containing a high silver chloride emulsion is processed at a color-developing time of 45 seconds, and a total processing time of less than 4 minutes, is generally used (for example, the color processing system CP-45X, tradename, manufactured by FUJI PHOTO FILM CO., LTD.). However, it is difficult to say that the level of total processing time required for such a system is wholly satisfactory, compared with other color systems (for example, an electrostatic transfer system, a thermal transfer system, and an inkjet system). There is a demand for ultra-rapid processing at a level in which the total processing time is less than 1 minute.

In order to achieve the above-described ultra-rapid processing, various kinds of investigations have been carried out with respect to two aspects: the processing solution and the light-sensitive material.

In order to achieve ultra-rapid processing, it is necessary to shorten each of steps of ① color development, ② bleach-fixing, and ③ washing/stabilization. With respect to color development, some attempts have been made, such as use of high temperature, high pH, and high-concentration color-developing agent. Further, addition of additives, such as a development accelerator, is also known. Examples of the development accelerator include 1-phenyl-3-pyrazolidone, described in British Patent No. 811,185; N-methyl-p-aminophenol, described in U.S. Pat. No. 2,417,514; and N,N,N',N'-tetramethyl-p-phenylenediamine, described in JP-A-50-15554 ("JP-A" means an unexamined published Japanese patent application). However, satisfactory rapidity cannot be achieved by these methods. Rather, deterioration of properties, such as increased fogging, often occurs.

Further, some attempts have been made to reduce bleach-fixing time, that is, making desalting to be rapid, by use of such as high-temperature, low pH, and high-concentration bleach ingredients. However, some problems occur, such as that the stability of a bleaching solution deteriorates, that cyan dye density is lowered by reduction of the cyan dye to a leuco base (Blix discoloration), and that insufficiency of washing bleach ingredients (primarily an iron salt of ethylenediamine tetracetic acid, and the like) occurs.

Further, at the step of washing, usually the final bath is replenished, and countercurrent-type multistage washing is used. Further, it is practically carried out to improve efficiency of washing by reducing the salt density in water using an ion-exchanged water, and/or by increasing the temperature of washing water. However, even though rapidity has been achieved to some extent, there are still many insufficiencies, in that an irradiation neutralizing dye, a sensitizing dye, a developing agent, ingredients of a Blix processing solution, and the like are sometimes incompletely washed out due to a shortage of processing time.

On the other hand, from the viewpoint of a light-sensitive material having ultra-rapid processing suitability, investigations have been made with respect to the use of a high-activity coupler and a coupler having a high extinction coefficient, reducing the amount of gelatin, and the like. However, the present existing light-sensitive materials fail to satisfy various properties required for a light-sensitive material.

Further, JP-A-7-239538 and JP-A-7-239539 describe that a silver halide emulsion layer containing a yellow coupler is coated on the same side but further from (apart from) a support than at least any one layer of a silver halide emulsion layer containing a magenta coupler and a silver halide emulsion layer containing a cyan coupler, each being coated on the support, to thereby achieve advance in color development speed. However, according to the method described in these publications, there are such disadvantages that fog stripes of an emulsion at the yellow-coloring layer are induced by pressure when processed using a roller conveyance type autoprocessor, processing color contamination becomes worse, or a cyan-colored density is lowered by Blix discoloration. Accordingly, further advanced technologies have been required. Further, there is also such a problem that at the time of processing by means of a roller conveyance type autoprocessor, if a curl of the light-sensitive material is large, formation of the fog stripes becomes larger.

Meantime, the high silver chloride grains having an excellent rapid processing suitability tend to form grains whose exterior faces (planes) are {100} faces (hereinafter referred to as {100} grains) under usual production conditions. In fact, the practically used grains are cubic. Recently, tabular {100} grains having a large specific surface area (the ratio of a surface area to a volume), thereby enabling an effective spectral sensitization, have been developed. Examples of these tabular grains are disclosed in, for example, U.S. Pat. Nos. 5,320,938, 5,264,337 and 5,292,632.

However, the high silver chloride {100} grains have a problem that they are easily fogged, when compared to commonly used silver bromide grains. In order to overcome this problem, the use of high silver chloride grains whose exterior faces are {111} faces (hereinafter referred to as {111} grains) has been proposed, as disclosed in JP-A-6-138619.

Special means are necessary to produce the high silver chloride {111} grains. In U.S. Pat. No. 4,399,215, Way discloses a method of producing high silver chloride tabular grains, which comprises using ammonia. However, it was difficult to produce practically useful small size grains by this method which comprises using ammonia, thereby producing silver chloride grains having high solubility under the conditions of higher solubility. Further, this method has a disadvantage that fogging easily occurs because the pH at the time of the production is as high as 8 to 10. In U.S. Pat. No. 5,061,617, Maskasky discloses high silver chloride {111} type grains produced using a thiocyanate. The thiocyanate increases the solubility of silver chloride as well as ammonia. There are known methods of adding additives (crystal habit controlling agents) at the time of the grains formation in order to form high silver chloride grains whose exterior faces are {111} faces, without increasing solubility thereof. These methods are listed below:

| Patent No. | crystal habit controlling agent | Inventor |
|---|---|---|
| U.S. Pat. No. 4400463 | Azaindenes + thioether peptizer | Maskasky |
| U.S. Pat. No. 4783398 | 2-4-diazolidinon | Milune et al. |
| U.S. Pat. No. 4713323 | Aminopyrazolopyrimidine | Maskasky |
| U.S. Pat. No. 4983508 | Bispyridinium salt | Ishiguro et al. |
| U.S. Pat. No. 5185239 | Triaminopyrimidine | Maskasky |
| U.S. Pat. No. 5178997 | 7-Azaindole-seris compound | Maskasky |
| U.S. Pat. No. 5178998 | Xanthine | Maskasky |
| JP-A-64-70741 | Dyes | Nishikawa et al. |
| JP-A-3-212639 | Aminothioether | Ishiguro |
| JP-A-4-283742 | Thiourea derivative | Ishiguro |
| JP-A-4-335632 | Triazolium salt | Ishiguro |
| JP-A-2-32 | Bispyridinium salt | Ishiguro et al. |
| Japanese patent application No. 7-146891 | Monopyridinium salt | Ozeki et al. |

As shown above, development of such techniques was made.

The tabular grains are preferred for spectral sensitization from the viewpoint that they have a high ratio of surface area to volume (specific surface area), so that they can absorb a large amount of a spectral sensitizing dye. On the other hand, washing out of the sensitizing dye becomes the more difficult, so that the problem of coloration due to the sensitizing dye remaining after the processing (remaining (or residual) color) becomes serious.

Techniques of improving these problems in which {100} high silver chloride grains and {111} high silver chloride grains are involved, are disclosed in U.S. Pat. No. 5,674,674, and Japanese Patent Application No. 10-123789, respectively. However, there is a demand for techniques of enabling more rapidly to wash out the sensitizing dye, to thereby control fogging due to remaining color.

Further, in order to improve an ultra-rapid processing suitability in color photographic light-sensitive materials, the following means can be mentioned: ① Employment of a highly activated coupler; ② Reduction in a coating amount of organic materials owing to, for example, the employment of a coupler which forms a colored dye exhibiting a large molecular extinction coefficient; ③ Reduction in a coating amount of a hydrophilic binder and Enhancement of a thin layer for the total of isphotographic constitutional layers, due to ②; and ④ Employment of a silver halide emulsion exhibiting a high developing speed. In order to improve the suitability of a light-sensitive material to advances in an ultra-rapid processing speed in color development and desilvering, such an effort has been made in this technical field that reduction in a coating silver amount of a light-sensitive material is carried out by, for example, the employment of a coupler which forms a dye exhibiting a high molecular extinction coefficient. Further, it is known that an advantage to rapidity of development can be also obtained by coating a silver halide emulsion layer exhibiting the largest average grain size (the yellow coupler-containing layer of conventional many color printing materials corresponds to this layer) in the position farther-most from a support among light-sensitive emulsion layers. This advantage can be attained by the methods as described in, for example, JP-A-7-239538 and JP-A-7-239539.

On the other hand, in the bleach-fixing processing, when a bleach-fixing solution having a low pH value is used in order to enhance advances in desilvering speed, a dye formed by a cyan coupler tends to become a colorless leuco dye, which results in reduction of a cyan density (this phenomenon is hereinafter called a blix discoloration). After processing, the leuco dye is oxidized by oxygen in the air and gradually returns to an original cyan dye in several months (leuco dye reciprocity). This means that a color balance just after the processing gradually breaks, and consequently the image quantity is deteriorated.

As an improved technique to prevent a light-sensitive material from the blix discoloration, known are method of improving the blix discoloration by the use of dispersion oils exhibiting a high viscosity, and the use of specific hydroquinone compounds or quinone compounds, as described in, for example, JP-A-3-144442 and JP-A-2-267548, or the use of a cyan coupler dispersion containing a high boiling organic solvent together with a water-insoluble and organic solvent-soluble polymer, as described in JP-A-2-43541. Further, JP-A-9-171240 and JP-A-9-329861 each describe a method of improving the blix discoloration by the incorporation of specific water-soluble polymers or polymer latexes into a cyan coupler-containing layer.

Further, for example, JP-A-3-144442 describes that the blix discoloration can be improved by a method of dispersing a coupler in a coupler solvent exhibiting a relatively high viscosity, and adjusting the average grain diameter of the resulting emulsion dispersion to a relatively large region. However, it is known that even this method causes reduction in colorability as a reverse effect on increase in the average grain size.

As described above, methods of improving the blix discoloration has been investigated up to now in this field of technology. In the present time, the conventional methods however are not satisfactory under such circumstances that processing conditions are becoming more and more severe, such as a processing with a bleach-fixing solution exhibiting a low pH value by which the desilvering speed could be enhanced, and increase in the accumulated density of a color-developing agent owing to a low replenishment.

Conventional silver halide color photographic light-sensitive materials (hereinafter referred to as a light-sensitive material according to the occasion) have several problems from the viewpoint of obtaining a high quality image, when a processing time is reduced. That is, when the conventional light-sensitive materials are subjected to a color developing process and desilvering process for such a short time as about 10 seconds respectively, a satisfactory coloring density cannot be obtained, and improvement in the blix discoloration is difficult to reach a satisfactory level.

For the object to obtain a high coloring density among the above-described problems to be solved, it may be effective means to use a layer structure in which a silver halide emulsion layer exhibiting the lowest speed of development is positioned over the other silver halide emulsion layers, and/or to render the total of photographic constitutional layers thinner. However, our investigation has made clear that the layer structure in which among a yellow-coloring silver halide emulsion layer, a magenta-coloring silver halide emulsion layer, and a cyan-coloring silver halide emulsion layer, the yellow-coloring silver halide emulsion layer, which contains a silver halide emulsion exhibiting the largest average grain size, is positioned farther-most from a support (i.e., as an upper layer of the other two light-sensitive emulsion layers), provides a relatively high coloring density even when the color developing time is reduced, but on the other hand it causes such a problem that the blix discoloration becomes worse.

SUMMARY OF THE INVENTION

An object of the present invention is to provide a silver halide color photographic light-sensitive material having an excellent rapid processing suitability. Another object of the present invention is to provide a method of forming an image using the same.

Still another object of the present invention is to provide a silver halide color photographic light-sensitive material that comprises grains comprising a tabular silver chloride, or silver chlorobromide, silver chloroiodide, or silver chloroiodobromide, each of which has a high silver chloride content, thereby enabling to remarkably reduce an image-forming time at color development, a bleach-fixing time, and a washing time. Another object of the present invention is to provide a method of forming an image using the light-sensitive material.

Further another object of the present invention is to provide a silver halide color photographic light-sensitive material that can reduce an image-forming time at color development, a bleach-fixing time, and a washing time without any harmful influence. Another object of the present invention is to provide a silver halide color photographic light-sensitive material having an excellent image fastness (stability). Still another object of the present invention is to provide a method of forming an image using the above light-sensitive materials.

Further, another object of the present invention is to provide a silver halide color photographic light-sensitive material having improved a problem concerning a curl.

Further, still another object of the present invention is to provide a silver halide color photographic light-sensitive material by which a processed light-sensitive material having a high coloring density is obtained even when the color developing time is sharply reduced, and having improved a change in the image quality due to a fluctuation of the cyan dye density during a storage of the processed light-sensitive material (particularly a print). Another object of the present invention is to provide a method of forming an image using the above-mentioned silver halide color photographic light-sensitive material.

Other and further objects, features, and advantages of the invention will appear more fully from the following description.

DETAILED DESCRIPTION OF THE INVENTION

As a result of an intensive investigation, the present inventors have discovered that the above-described objects can be achieved by the following light-sensitive materials and methods of forming an image:

(1) A silver halide photographic light-sensitive material comprising at least a silver halide emulsion layer containing a yellow dye-forming coupler, a silver halide emulsion layer containing a magenta dye-forming coupler and a silver halide emulsion layer containing a cyan dye-forming coupler, on a support, wherein:

the silver halide emulsion layer containing a yellow dye-forming coupler is located more apart from the support than at least one of the silver halide emulsion layer containing a magenta dye-forming coupler or the silver halide emulsion layer containing a cyan dye-forming coupler, and silver halide grains contained in the silver halide emulsion layer containing a yellow dye-forming coupler comprises a high silver chloride emulsion in which the content of silver halide is 80 mol % or more;

(2) The silver halide photographic light-sensitive material as stated in the above (1), which comprises:

the silver halide emulsion layer containing a yellow dye-forming coupler, the silver halide emulsion layer containing a magenta dye-forming coupler, and the silver halide emulsion layer containing a cyan dye-forming coupler, on the support, with the silver halide grains of the respective silver halide emulsions of said silver halide emulsion layers, having different color sensitivities from each other, wherein the silver halide grains comprise a high silver chloride emulsion in which the content of silver chloride is 95 mole or more;

(3) The silver halide photographic light-sensitive material as stated in the above (1), wherein the total amount of a hydrophilic binder contained in the photographic constituent (constitutional) layers of the light-sensitive material is 7.4 $g/m^2$ or less;

(4) The silver halide photographic light-sensitive material as stated in the above (2), wherein the total amount of a hydrophilic binder contained in the photographic constituent layers of the light-sensitive material is 7.4 $g/m^2$ or less;

(5) The silver halide photographic light-sensitive material as stated in the above (4), wherein the silver halide emulsion layer containing a yellow dye-forming coupler is a silver halide emulsion layer located apart-most from the support;

(6) The silver halide photographic light-sensitive material as stated in the above (2), wherein the silver halide emulsion contained in the silver halide emulsion layer containing a yellow dye-forming coupler is a tabular silver halide emulsion having 95 mol % or more of silver chloride content;

(7) The silver halide photographic light-sensitive material as stated in the above (4), wherein the silver halide emulsion contained in the silver halide emulsion layer containing a yellow dye-forming coupler is a tabular silver halide emulsion having 95 mol % or more of silver chloride content;

(8) The silver halide photographic light-sensitive material as stated in the above (1), wherein 50% or more of the total silver halide grain in terms of projected area contained in the silver halide emulsion layer containing a yellow dye-forming coupler is accounted for by tabular grains exhibiting an average aspect ratio of 2 or more and a silver chloride content of 80 mol % or more;

(9) The silver halide photographic light-sensitive material as stated in the above (4), wherein the ratio of [amount of hydrophilic binder/thickness of silver halide emulsion] of the yellow dye-forming coupler-containing layer is 1.50 or more;

(10) The silver halide photographic light-sensitive material as stated in the above (6), wherein the ratio of [amount of hydrophilic binder/thickness of silver halide emulsion] of the yellow dye-forming coupler-containing layer is 1.50 or more;

(11) The silver halide photographic light-sensitive material as stated in the above (7), wherein the ratio of [amount of hydrophilic binder/thickness of silver halide emulsion] of the yellow dye-forming coupler-containing layer is 1.50 or more;

(12) The silver halide photographic light-sensitive material as stated in the above (9), (10), or (11), wherein the silver halide emulsion layer containing a yellow dye-forming coupler is a silver halide emulsion layer located in the further-most position from the support;

(13) The silver halide photographic light-sensitive material as stated in any one of the above (9) to (12), wherein the total amount of a hydrophilic binder of the photographic constituent layers is 6.0 g/m$^2$ or less;

(14) The silver halide photographic light-sensitive material as stated in any one of the above (9) to (13), wherein the total amount of oil-soluble materials in the photographic constituent layers is 4.5 g/m$^2$ or less;

(15) The silver halide photographic light-sensitive material as stated in any one of the above (9) to (14), wherein a film thickness of the photographic constituent layers is 8.0 $\mu$m or less;

(16) The silver halide photographic light-sensitive material as stated in any one of the above (9) to (15), wherein the silver halide emulsion layer containing a cyan dye-forming coupler contains at least one cyan dye-forming coupler represented by formula [I]:

formula [I]

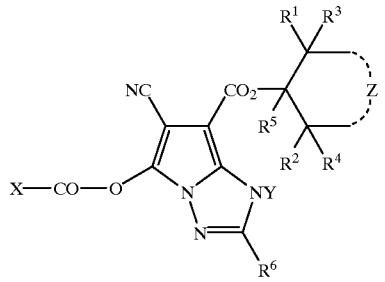

wherein $R^1$ and $R^2$ each independently represent an alkyl group, or an aryl group; $R^3$, $R^4$ and $R^5$ each independently represent a hydrogen atom, an alkyl group, or an aryl group; Z represents a group of non-metallic atoms necessary to form a saturated ring; $R^6$ represents a substituent; X represents a heterocyclic group, a substituted amino group, or an aryl group; and Y represents a hydrogen atom, or a group capable of being split-off in a process of color development;

(17) The silver halide photographic light-sensitive material as stated in any one of the above (9) to (16), wherein the ratio of [amount of hydrophilic binder/thickness of silver halide emulsion] of the yellow coupler-containing layer is 6.0 or more;

(18) The silver halide photographic light-sensitive material as stated in any one of the above (9) to (15), wherein a layer adjacent to the cyan dye-forming coupler-containing layer on the side further from the support, contains at least one cyan dye-forming coupler represented by formula [ADF]:

formula [ADF]

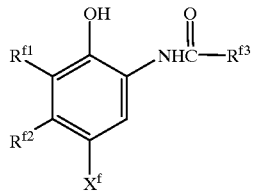

wherein $X^f$ represents a hydrogen atom, or a group capable of being split-off in a process of color development; $R^{f1}$ and $R^{f2}$, which may be the same or different from each other, each represent a hydrogen atom, or a substituent, $R^{f3}$ represents an alkyl group, an aryl group, an alkylamino group, or an arylamino group, $R^{f1}$ and $R^{f2}$ may bond together to form a 5- or 6-membered ring, with the proviso that at least one of the $R^{f1}$ to $R^{f3}$ groups contains 8 or more carbon atoms;

(19) The silver halide photographic light-sensitive material as stated in the above (16) or (17), wherein a layer adjacent to the cyan dye-forming coupler-containing layer on the side further from the support, contains at least one cyan dye-forming coupler represented by formula [ADF]:

formula [ADF]

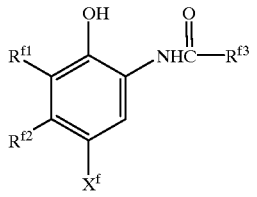

wherein $X^f$ represents a hydrogen atom, or a group capable of being split-off in a process of color development; $R^{f1}$ and $R^{f2}$, which may be the same or different from each other, each represent a hydrogen atom, or a substituent, $R^{f3}$ represents an alkyl group, an aryl group, an alkylamino group, or an arylamino group, $R^{f1}$ and $R^{f2}$ may bond together to form a 5- or 6-membered ring, with the proviso that at least one of the $R^{f1}$ to $R^{f3}$ groups contains 8 or more carbon atoms;

(20) The silver halide photographic light-sensitive material as stated in the above (19), wherein the silver halide emulsion layer closest to the support, contains at least one cyan dye-forming coupler represented by the above-described formula [I];

(21) The silver halide photographic light-sensitive material as stated in any one of the above (9) to (20), further comprising at least one layer of a biaxially stretched polyolefin sheet having microscopic pores, between the support and the silver halide emulsion layers.

(22) The silver halide photographic light-sensitive material as stated in the above (4), wherein the silver halide emulsion layer containing a cyan dye-forming coupler contains a dispersion of lipophilic fine particles comprising at least one cyan dye-forming coupler and at least one high boiling organic solvent having a viscosity of 200 cp or more at 25° C.;

(23) The silver halide photographic light-sensitive material as stated in the above (4), wherein the silver halide emulsion layer containing a cyan dye-forming coupler contains at least one cyan dye-forming coupler and at least one polymer which is insoluble in water and soluble in an organic solvent;

(24) The silver halide photographic light-sensitive material as stated in the above (22), wherein the silver halide emulsion layer containing a yellow dye-forming coupler is a silver halide emulsion layer farther-most from the support, and at least one of cyan dye-forming couplers contained in the silver halide emulsion layer containing a cyan dye-forming coupler is a cyan dye-forming coupler represented by formula [C-I]:

formula [C–I]

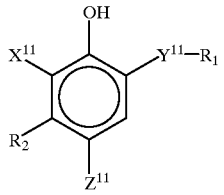

wherein, $Y^{11}$ represents —NHCO— or —CONH—; $R_1$ represents an alkyl group, an aryl group, a heterocyclic group, or an amino group; $X^{11}$ represents a hydrogen atom, a halogen atom, an alkoxy group, or an acylamino group; $R_2$ represents an alkyl group or an acylamino group; or $X^{11}$ and $R_2$ may be a group of nonmetallic atoms bound together to form a 5- to 7-membered ring, and $Z^{11}$ represents a hydrogen atom or a group capable of being split-off in the coupling reaction with an oxidized product of a developing agent;

(25) The silver halide photographic light-sensitive material as stated in the above (24), wherein the ratio of [amount of hydrophilic binder/thickness of silver halide emulsion] of the yellow dye-forming coupler-containing layer is in the range of 1.5 to 15, and the total amount of a hydrophilic binder contained in the photographic constitutional layers is in the range of 3.5 $g/m^2$ to 6.0 $g/m^2$;

(26) The silver halide photographic light-sensitive material as stated in the above (24) or (25), wherein the dispersion of lipophilic fine particles containing a cyan dye-forming coupler comprises at least one compound represented by the following formula [II] or [III]:

formula [II]

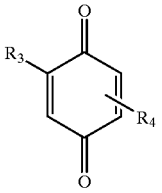

formula [III]

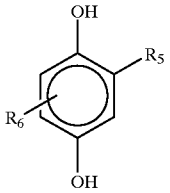

wherein $R_3$ and $R_5$ each represent a halogen atom, an acyl group, a sulfonyl group, an alkoxycarbonyl group, an aryloxycarbonyl group, a carbamoyl group, a sulfamoyl group, a sulfoxide group, a cyano group, a nitro group, or an alkyl group having at least one halogen atom at the α-position thereof; $R_4$ and $R_5$ each represent a hydrogen atom, an alkyl group, an aryl group, an alkoxy group, an aryloxy group, an alkylthio group, an arylthio group, or an amido group; and the total sum of carbon atoms of $R_3$ and $R_4$ is at least 8, and that of $R_5$ and $R_6$ is also at least 8;

(27) The silver halide photographic light-sensitive material as stated in any of the above (24) to (26), wherein the dispersion of lipophilic fine particles containing a cyan dye-forming coupler contains at least one polymer which is insoluble in water and soluble in an organic solvent;

(28) The silver halide photographic light-sensitive material as stated in the above (27), wherein the ratio [Ag/Cp] of a coating amount ($mol/m^2$) of the silver halide emulsion in terms of silver to a coating amount ($mol/m^2$) of the cyan dye-forming coupler, both of which are contained in a red-sensitive silver halide emulsion layer, is in the range of 1.5 to 4.0;

(29) The silver halide photographic light-sensitive material as stated in any one of the above (24) to (28), wherein the red-sensitive silver halide emulsion layer contains a polymer represented by the following formula [P]:

formula [P]

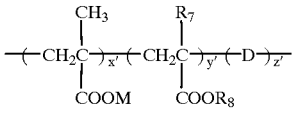

wherein, $R_7$ represents a hydrogen atom or a methyl group, $R_8$ represents an alkyl group having 1 to 10 carbon atoms, D represents a repeating unit derived from an ethylenically unsaturated monomer; x', y', and z' each represent a weight percent of the particular component in which x' is 20 to 80, y' is 80 to 20, and z' is 0 to 30, and x'+Y'+z'=100; and M represents a hydrogen atom or a cation.

(30) The silver halide photographic light-sensitive material as stated in any one of the above (24) to (29), comprising, as at least one cyan dye-forming coupler, the cyan dye-forming coupler represented by the formula [C-I] as described in the above (24) and/or a cyan dye-forming coupler represented by formula [I]:

formula [I]

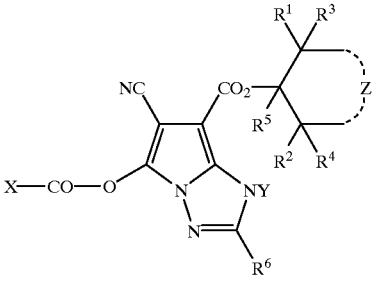

wherein $R^1$ and $R^2$ each independently represent an alkyl group, or an aryl group; $R^3$, $R^4$ and $R^5$ each independently represent a hydrogen atom, an alkyl group, or an aryl group; Z represents a group of non-metallic atoms necessary to form a saturated ring; $R^6$ represents a substituent; X represents a heterocyclic group, a substituted amino group, or an aryl group; Y represents a hydrogen atom, or a group capable of being split-off in a process of color development;

(31) The silver halide photographic light-sensitive material as stated in any one of the above (24) to (30), wherein the total amount of a hydrophilic binder contained in the photographic constituent layers of the light-sensitive material is 3.0 g/m$^2$ or more, but 7.4 g/m$^2$ or less;

(32) The silver halide photographic light-sensitive material as stated in the above (23), wherein the silver halide emulsion layer containing a yellow dye-forming coupler is a silver halide emulsion layer located most apart from the support, and at least one cyan dye-forming coupler contained in the silver halide emulsion layer containing a cyan dye-forming coupler is a cyan dye-forming coupler represented by the following formula [I]:

formula [I]

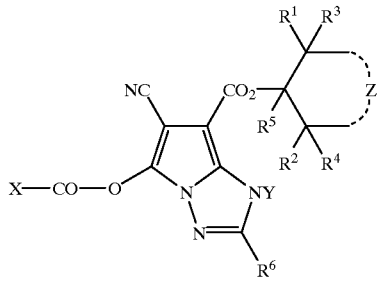

wherein $R^1$ and $R^2$ each independently represent an alkyl group or an aryl group, $R^3$, $R^4$ and $R^5$ each independently represent a hydrogen atom, an alkyl group or an aryl group, Z represents a group of non-metallic atoms required to form a saturated ring, $R^6$ represents a substituent, X represents a heterocyclic group, a substituted amino group or an aryl group, and Y represents a hydrogen atom or a group capable of being split-off in a process of color development.

(33) The silver halide photographic light-sensitive material as stated in the above (32), wherein the polymer which is insoluble in water and soluble in an organic solvent is a compound represented by the following formula [PP]:

$$-(A)_x-(B)_y- \qquad \text{Formula [PP]}$$

wherein A represents a repeating unit derived from at least one ethylenically unsaturated monomer having at least one —COOM (M represents a hydrogen atom or a cation atom) group in its molecule, B represents a repeating unit derived from at least one ethylenically unsaturated monomer having no —COOM group, and x and y each represent a percentage ratio by weight of A and B, respectively, in which x is 20 to 80 and y is 80 to 20, provided that x+y=100.

(34) The silver halide photographic light-sensitive material as stated in the above (33), wherein the compound represented by formula [PP] is a compound represented by the following formula [P]:

formula [P]

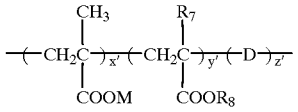

wherein $R_7$ represents a hydrogen atom or a methyl group, $R_8$ represents an alkyl group having 1 to 10 carbon atoms, D represents a repeating unit derived from an ethylenically unsaturated monomer; x', y', and z' each represent a weight percent of the particular component, in which x' is 20 to 80, y' is 80 to 20, and z' is 0 to 30, and x'+Y'+z=100; and M represents a hydrogen atom or a cation;

(35) The silver halide photographic light-sensitive material as stated in the above (8), wherein said tabular grains have {111} major faces;

(36) The silver halide photographic light-sensitive material as stated in the above (8), wherein said tabular grains have {100} major faces;

(37) The silver halide photographic light-sensitive material as stated in the above (36), wherein the total amount of a hydrophilic binder contained in photographic constituent layers of the light-sensitive material is 7.4 g/m$^2$ or less;

(38) The silver halide photographic light-sensitive material as stated in the above (35), wherein said tabular grains contains at least 0.1 mol % of silver iodide based on total silver;

(39) The silver halide photographic light-sensitive material as stated in the above (36), wherein said tabular grains contains at least 0.1 mol % of silver iodide based on total silver;

(40) The silver halide photographic light-sensitive material as stated in the above (38), wherein an average diameter of the tabular silver halide grains is 0.6 $\mu$m or less, in which the diameter is a diameter of a sphere corresponding to the volume of an individual silver halide grain;

(41) The silver halide photographic light-sensitive material as stated in the above (39), wherein an average diameter of the tabular silver halide grains is 0.6 $\mu$m or less, in which the diameter is a diameter of a sphere corresponding to the volume of an individual silver halide grain;

(42) The silver halide photographic light-sensitive material as stated in the above (4), wherein the silver halide emulsion layer containing a cyan dye-forming coupler is located nearer to the support than at least one of the silver halide emulsion layer containing a yellow dye-forming coupler or the silver halide emulsion layer containing a magenta dye-forming coupler;

(43) The silver halide photographic light-sensitive material as stated in the above (42), wherein at least one cyan dye-forming coupler represented by formula [C-I] is contained in the silver halide emulsion layer containing a cyan dye-forming coupler:

formula [C–I]

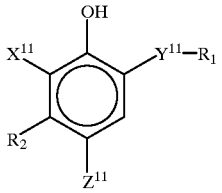

wherein, Y represents —NHCO— or —CONH—; $R_1$ represents an alkyl group, an aryl group, a heterocyclic group, or an amino group; $X^{11}$ represents a hydrogen atom, a halogen atom, an alkoxy group, or an acylamino group; $R_2$ represents an alkyl group or an acylamino group; or $X^{11}$ and $R_2$ may be a group of nonmetallic atoms bound together to form a 5- to 7-membered ring, and $Z^{11}$ represents a hydrogen atom or a group capable of being split-off in the coupling reaction with an oxidized product of a developing agent;

(44) The silver halide photographic light-sensitive material as stated in the above (43), wherein the silver halide emulsion layer containing a cyan dye-forming coupler contains a dispersion of lipophilic fine particles comprising at least one cyan dye-forming coupler and at least one high boiling organic solvent having a viscosity of 200 cp or more at 25° C.;

(45) The silver halide photographic light-sensitive material as stated in the above (43), wherein the dispersion of lipophilic fine particles containing a cyan dye-forming coupler comprises at least one compound represented by the following formula [II] or [III]:

formula [II]

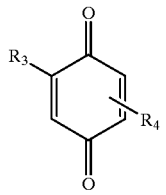

formula [III]

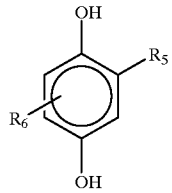

wherein $R_3$ and $R_5$ each represent a halogen atom, an acyl group, a sulfonyl group, an alkoxycarbonyl group, an aryloxycarbonyl group, a carbamoyl group, a sulfamoyl group, a sulfoxide group, a cyano group, a nitro group, or an alkyl group having at least one halogen atom at the $\alpha$-position thereof; $R_4$ and $R_5$ each represent a hydrogen atom, an alkyl group, an aryl group, an alkoxy group, an aryloxy group, an alkylthio group, an arylthio group, or an amido group; and the total sum of carbon atoms of $R_3$ and $R_4$ is at least 8, and that of $R_5$ and $R_6$ is also at least 8;

(46) The silver halide photographic light-sensitive material as stated in the above (43), wherein at least one compound represented by the following formula [PP] is contained in the silver halide emulsion layer containing a cyan dye-forming coupler:

$$-(A)_x-(B)_y- \qquad \text{Formula [PP]}$$

wherein A represents a repeating unit derived from at least one ethylenically unsaturated monomer having at least one —COOM (M represents a hydrogen atom or a cation atom) group in its molecule, B represents a repeating unit derived from at least one ethylenically unsaturated monomer having no —COOM group, and x and y each represent a percentage ratio by weight of A and B, respectively, in which x is 20 to 80 and y is 80 to 20, provided that x+y=100;

(47) The silver halide photographic light-sensitive material as stated in the above (42), wherein at least one of cyan dye-forming couplers represented by the following formula [I] is contained in the silver halide emulsion layer containing a cyan dye-forming coupler:

formula [I]

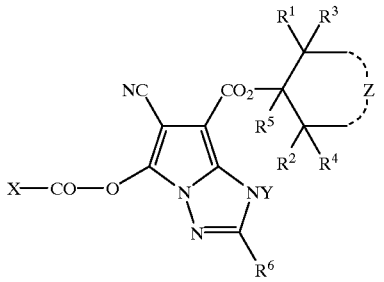

wherein $R^1$ and $R^2$ each independently represent an alkyl group, or an aryl group; $R^3$, $R^4$ and $R^5$ each independently represent a hydrogen atom, an alkyl group, or an aryl group; Z represents a group of non-metallic atoms necessary to form a saturated ring; $R^6$ represents a substituent; X represents a heterocyclic group, a substituted amino group, or an aryl group; and Y represents a hydrogen atom, or a group capable of being split-off in a process of color development;

(48) A method of forming an image, comprising the steps of subjecting a silver halide photographic light-sensitive material to exposure, and subjecting the light-sensitive material to developing treatment, wherein the silver halide photographic light-sensitive material as stated in any one of the above (1) to (47) is subjected to scanning exposure with a light beam modulated based on image information, followed by developing treatment;

(49) A method of forming an image, comprising the steps of subjecting a silver halide photographic light-sensitive material to exposure, and subjecting the light-sensitive material to developing treatment, wherein the silver halide photographic light-sensitive material as stated in any one of the above (1) to (47) is subjected to exposure, followed by performing developing treatment in the period of processing time of 25 seconds or less for color development;

(50) The method of forming an image as stated in the above (49), wherein the developing treatment is performed in the periods of time of 5 to 25 seconds for the color development step, 5 to 25 seconds for the bleach-fixing step, 10 to 45 seconds for the water-washing and/or stabilization step, and 5 to 15 seconds for the drying step;

(51) The method of forming an image as stated in the above (49), wherein the developing treatment is performed in the period of processing time of 20 seconds or less for color development;

(52) The method of forming an image as stated in the above (50), wherein the pH of a treating solution in a bleach-fixing step is in a range between 4.5 and 6.0.

Herein, the photographic light-sensitive materials as stated in the above (8), and (35) to (41), and the methods of forming an image as stated in the above (48) to (52), with the proviso that the methods are limited to those related to the photographic light-sensitive materials in the above (8) and dependent thereon, are referred to as the first embodiment of the present invention.

Further, the photographic light-sensitive materials as stated in the above (7), (9), and (11) to (21), and the methods of forming an image as stated in the above (48) to (52), with the proviso that the methods are limited to those related to the photographic light-sensitive materials in the above (7) or (9), and dependent thereon, are referred to as the second embodiment of the present invention.

Further, the photographic light-sensitive materials as stated in the above (22) to (34), (42) to (47), and the methods of forming an image as stated in the above (48) to (52), with the proviso that the methods are limited to those related to the photographic light-sensitive materials in the above (22), (23) or (42), and dependent thereon, are referred to as the third embodiment of the present invention.

In the description hereinbelow, the present invention means to include all of the above first, second, and third embodiments including the light-sensitive materials as stated in the above (1) to (6), and (10), unless otherwise specified.

Herein, in the present specification and claims, a group on a compound includes both a group having a substituent thereon and a group having no substituent (i.e. an unsubstituted group), unless otherwise specified.

The silver halide photographic light-sensitive material in the above (1) of the present invention is excellent in rapid processing suitability, by locating the silver halide emulsion layer containing a yellow dye-forming coupler more apart from the support than at least one of the silver halide emulsion layer containing a magenta dye-forming coupler or the silver halide emulsion layer containing a cyan dye-forming coupler, and by making the silver halide grains contained in the silver halide emulsion layer containing a yellow dye-forming coupler to comprise a particular high-silver chloride emulsion.

This silver halide photographic light-sensitive material can take each of the following embodiments.

The photographic light-sensitive material of (1) can attain high sensitivity even when processed rapidly, and can suppress increase of fog, by making silver halide grains that are contained in the silver halide emulsion layer containing a yellow dye-forming coupler, to contain specific tabular grains comprising a high silver chloride in a particular ratio.

The photographic light-sensitive material of (1) can further attain an image improved in fastness, in addition to the improvement of rapid processing suitability, by controlling the ratio of [amount of hydrophilic binder/thickness of silver halide emulsion] of the yellow dye-forming coupler-containing layer within a specific value range, and by controlling the total amount of a hydrophilic binder in the photographic constitutional layers within a specific value range. This photographic light-sensitive material can also reduce pressure-induced fog and moisture dependent curl, by further having a polyolefin sheet layer having microscopic pores.

The photographic light-sensitive material of (1) can attain such excellent effects that it is free from insufficiency of the maximum density due to blix discoloration and color development inadequacy, in addition to the improvement in rapid processability, by containing a cyan coupler, together with a high boiling organic solvent having a particular viscosity, a polymer having a particular solubility, or any one of hydroquinone derivatives or quinone derivatives, in the silver halide emulsion layer containing the cyan dye-forming coupler, or by containing a cyan coupler of the type of a particular pyrrolotriazole cyan coupler;

in addition to providing the silver halide emulsion layer containing the yellow dye-forming coupler at the above-stated position (the particular order among the light-sensitive AgX emulsion layers).

The silver halide color photographic light-sensitive material of the present invention is explained below in detail.

In the silver halide color photographic light-sensitive material according to the present invention, gelatin is used as a hydrophilic binder. As occasion demands, gelatin may be used in combination with hydrophilic colloids, for example, other gelatin derivatives, graft polymers of gelatin and another polymer, proteins other than gelatin, sugar derivatives, cellulose derivatives, and synthetic hydrophilic macromolecular materials such as homo- or co-polymers.

Gelatin which is used in a silver halide color hotographic light-sensitive material according to the present invention, may be a lime-processed gelatin, or an acid-processed gelatin. Alternatively, a gelatin made from any of raw materials such as a cattle (beef) bone, a calfskin, and a pig skin, also may be used. Preferred is a lime-processed gelatin made from a cattle bone, or a pig skin as a raw material.

In the present invention, the total amount of a hydrophilic binder, which is incorporated in light-sensitive silver halide emulsion layers and non-light-sensitive hydrophilic colloid layers, which are all the hydrophilic colloid layers coated on a support in the silver halide emulsion layer-coated side including the hydrophilic colloid layer farther-most from the support, is preferably 7.4 $g/m^2$ or less, and it is preferably 3.0 $g/m^2$ or more. Further, the total amount is preferably 6.0 $g/m^2$ or less but 3.5 $g/m^2$ or more, and most preferably 5.5 $g/m^2$ or less and 4.0 $g/m^2$ or more. If the amount of a hydrophilic binder is too large, there is a case that the following problems make it difficult to obtain the effect of the present invention: Rapidly of the color processing is deteriorated; Blix discoloration worsens; Rapid processing suitability at the wash processing step is deteriorated, and the like. On the other hand, if the amount of a hydrophilic binder is too small, such a bad effect caused by insufficiency of a film strength, as pressure-induced fog streaks (stripes) tends to occur.

Particularly, according to the second embodiment of he present invention, a curl occurring due to a change in humidity of a light-sensitive material during storage before and after processing, can be minimized by setting an amount of a hydrophilic binder to the preferable range specified above.

In the present invention, the term "the silver halide emulsion layer located in the farther-most position from the support" means the layer located farther-most from a support among layers each containing a silver halide emulsion capable of substantially contributing dye formation occurring due to a reaction between a coupler and a developed silver halide emulsion incorporated in the same layer. Accordingly, a layer containing a fine grain emulsion having substantially no sensitivity, or a colloidal silver, and free from a coupler, does not fall under the definition of the above-mentioned silver halide emulsion layer.

In the present invention, a silver halide emulsion layer containing a yellow dye-forming coupler is coated on a support in the position further from the support than at least one layer of a silver halide emulsion layer containing a magenta dye-forming coupler or a silver halide emulsion layer containing a cyan dye-forming coupler.

Further, the embodiment that a silver halide emulsion layer containing a yellow coupler is coated on the position further-most from a support than any other silver halide emulsion layers, is more preferred from viewpoints of rapidity of color development and desilvering, and reduction of residual color occurring due to a remaining sensitizing dye.

In the present invention, it is preferable that a cyan coupler-containing silver halide emulsion layer is positioned between a yellow coupler-containing silver halide emulsion layer and a magenta coupler-containing silver halide emulsion layer from a viewpoint of preventing reduction in a cyan density due to the blix discoloration, whereas the cyan coupler-containing silver halide emulsion layer is at the position closest to a support from a viewpoint of improving a light fading. Further, each of the yellow coupler-containing silver halide emulsion layer, the magenta coupler-containing silver halide emulsion layer and the cyan coupler-containing silver halide emulsion layer may be composed of two or three layers. It is also preferable that a coupler-containing layer free from a silver halide emulsion be applied adjacent to a silver halide emulsion layer to form a coloring layer, as described in, for example, JP-A-4-75055, JP-A-9-114035, JP-A-10-246940, and U.S. Pat. No. 5,576,159. One of preferable embodiments of the present invention is a construction in which double layered-silver halide emulsion layers each containing a cyan coupler are applied at the position nearest to the support, or alternatively a construction in which a cyan coupler-containing silver halide emulsion layer nearest to the support, and a cyan coupler-containing light-insensitive layer adjacent thereto are associated.

When the silver halide emulsion layer containing a yellow coupler is represented by "Y", the silver halide emulsion layer containing a magenta coupler is represented a by "M", and the silver halide emulsion layer containing a cyan coupler is represented by "C", the layer constitution of the light-sensitive material of the present invention is preferably CMY, CYM and MCY, and more preferably CMY or MCY, in the order of from the support side to the upper layer side.

In the present invention, preferably the ratio of [amount of hydrophilic binder/thickness of silver halide (emulsion)] in the yellow coupler-containing silver halide emulsion layer further-most from a support, is in the range of 1.5 to 15. The ratio in the present invention is hereinafter referred to as the [B/AgX].

In this specification, the term "an amount of a hydrophilic binder" means an amount ($g/m^2$) of a hydrophilic binder per $m^2$ of the silver halide emulsion layer. The amount of a hydrophilic binder divided by its specific gravity means a thickness. Accordingly, the amount of a hydrophilic binder referred to in the present invention is in proportion to the thickness.

On the other hand, the term "thickness of silver halide emulsion" means a thickness ($\mu$m) at which silver halide emulsion grains in the silver halide emulsion layer occupy in the direction perpendicular to a support. That is, the thickness of silver halide emulsion is a value defined by a thickness of said silver halide emulsion layer multiplied by a volume percentage of silver halide grains in the layer. Assuming that a silver halide emulsion layer is ideally coated in the present invention, a side length ($\mu$m) of the cube (when the silver halide grains are cubic), and a thickness ($\mu$m) in the direction perpendicular to main planes (when the silver halide grains are tabular), are defined as a thickness of silver halide emulsion, respectively. Further, when two or more kinds of silver halide emulsion grains having a different grain size from each other is used in mixture, a weight average value of individual grains is defined as the thickness of a silver halide emulsion. For example, assuming that a coated weight of silver halide emulsion grains having the thickness of A ($\mu$m) is Xa ($g/m^2$), a coated weight of silver halide emulsion grains having the thickness of B ($\mu$m) is Xb ($g/m^2$), a coated weight of silver halide emulsion grains having the thickness of C ($\mu$m) is Xc ($g/m^2$) - - - , the thickness (AgX) of silver halide emulsion at the time when these grains are used in mixture is defined as follows:

$$AgX=A\cdot Xa/(Xa+Xb+Xc+ - - - )+B\cdot Xb/(Xa+Xb+Xc+ - - - )+C\cdot Xc/(Xa+Xb+Xc+ - - - )+ - - - .$$

As is apparent from the above-mentioned definition; the ratio of [B/AgX] in the present invention means that the bigger the value is, the relatively smaller the thickness of an emulsion in the emulsion layer is. From the viewpoints of restraint of pressure-induced fog streaks and reduction in processing color contamination (color mix), the ratio of [B/AgX] in the present invention is preferably in the range of 1.5 to 15, more preferably in the range of 2.0 to 12, and most preferably in the range of 5.0 to 10.

The amount of a hydrophilic binder in the silver halide emulsion layer containing a yellow coupler further-most from a support according to the present invention, is preferably in the range of 1.35 $g/m^2$ to 0.30 $g/m^2$, and more preferably in the range of 1.25 $g/m^2$ to 0.60 $g/m^2$. Further, with respect to the thickness of a silver halide emulsion, when cubic grains are used, the side length of the grains is preferably in the range of 0.80 $\mu$m to 0.10 $\mu$m, and more preferably in the range of 0.70 $\mu$m to 0.30 $\mu$m. When tabular grains are used, the side length of the grains is preferably in the range of 0.40 $\mu$m to 0.02 $\mu$m, and more preferably in the range of 0.30 $\mu$m to 0.10 $\mu$m. The aspect ratio of the tabular grains is preferably in the range of 2 to 20, and more preferably in the range of 3 to 15. Further, two or more kinds of silver halide emulsions having a different grains size and/or grain shape from each other are preferably used in mixture, in order to control photographic speed, gradation and other photographic properties.

Silver halide emulsions which can be used in the present invention, are preferred to contain silver chloride, silver chlorobromide, silver iodide, or silver chloroiodobromide, each of which has a silver chloride content of 95 mol % or more, from the viewpoint of the rapidity in color development. Further, the use of tabular grains whose main planes have a (111) face or a (100) face, is preferred in the present invention, because they make the ratio of [B/AgX] larger, allowing color development to be rapidly carried out, and processing color mix to be reduced. The tabular high silver chloride emulsion grains whose main planes have a (111) face, or a (100) face, can be prepared by the methods disclosed in, for example, JP-A-6-138619, U.S. Pat. Nos. 4,399,215, 5,061,617, 5,320,938, 5,264,337, 5,292,632, 5,314,798, and 5,413,904, and WO 94/22051.

Next, tabular silver halide grains preferably used in the present invention are explained in detail. A pair of parallel planes crossing at a right angle to the thickness direction of an individual tabular grain is called major faces.

The {111} tabular grains are tabular grains whose major faces are {111} faces. For the formation of {111} tabular grains, methods of using various kinds of crystal habit (appearance of crystal) controlling agents are disclosed as listed in the above-described table. Of these agents, preferred are compounds described in JP-A-2-32 (exemplified compounds 1 to 42). In particular, crystal habit controlling agents 1 to 29 described in Japanese Patent Application No. 6-333780, are preferred. However, the present invention should not be limited to these compounds.

The {111} tabular grains can be obtained by forming two parallel twin planes. A formation of the twin plane is affected by a temperature, a medium (gelatin), a halogen concentration, and the like. So, suitable conditions for them should be chosen. In the case where a crystal habit controlling agent exists at the time of nucleation, a gelatin concentration is preferably in the range of 0.1% to 10%. A chloride concentration is generally 0.01 mol/l or more, and preferably 0.03 mol/l or more.

Further, JP-A-8-184931 discloses that it is preferred that none of the crystal habit controlling agent at the time of nucleation be used in order to obtain. monodispersed grains. On the other hand, in the case where none of the appearance of crystal-controlling agent exists at the time of nucleation, the gelatin concentration is generally in the range of 0.03% to 10%, and preferably in the range of 0.05% to 1.0%. The chloride concentration is generally in the range of 0.001 mol/l to 1 mol/l, and preferably in the range of 0.003 mol/l to 0.1 mol/l. A nucleation temperature may be any of the temperature ranging from 2° C. to 90° C., preferably from 5° C. to 80° C., and particularly preferably from 5° C. to 40° C.

At the first stage of nucleation, nuclei of tabular grains are formed. However, just after the nucleation, a lot of nuclei other than tabular grains exist in a reaction vessel. Consequently, it is necessary to use a technique by which a ripening step following nucleation is carried out so that only tabular grains remain, whereas other grains disappear. If usual Ostwald ripening is carried out, the nuclei of the tabular grains are dissolved and disappeared, so that the number of the nuclei of the tabular grains reduces. As a result, the size of the resultant tabular grains increases. In order to prevent the tabular grains from increase in size, a crystal habit controlling agent is added to the reactor. Particularly, an effect obtained by the crystal habit controlling agent is increased using a phthalated gelatin in combination therewith, so that dissolution of the tabular grains can be prevented. The pAg during the ripening step is particularly important, and the value is preferably in the range of 60 mV to 130 mV, versus a silver/silver chloride electrode.

In the next stage, the nuclei thus formed are grown by physical ripening and an addition of a silver salt and a halide, in the presence of a crystal habit controlling agent. At this time, a chloride concentration is generally 5 mol/l or less, and preferably in the range of 0.05 mol/l to 1 mol/l. A temperature at the time of grain growth may be selected from the range of generally 10° C. to 90° C., preferably 30° C. to 80° C.

The total amount of the crystal habit controlling agent to be used is preferably in the range of $6\times10^{-5}$ mol or more, particularly preferably in the range of $3\times10^{-4}$ mol to $6\times10^{-2}$, per mol of silver halide in the finished emulsion. The timing of the crystal habit controlling agent for addition may be at any stage of nucleation of silver halide grains, physical ripening and grain growth. Formation of the {111} face is triggered by addition thereof. The crystal habit controlling agent may have been placed in a reaction vessel before reaction. In order to produce small sized tabular grains, it is preferred that the crystal habit controlling agent be added into the reaction vessel such that its concentration will increase as the grains grow.

If the amount to a dispersion medium employed at the time of nucleation becomes insufficient for the growth of the nuclei, replenishment of the medium by addition is necessary. For this growth, it is preferred that gelatin in an amount of 10 g/l to 100 g/l be present. Preferable gelatin for replenishment is a phthalated gelatin or a trimellit gelatin.

The pH at the time when the nuclei are formed is not limited in particular, and preferably it is in the range of neutral to acidic.

Next, {100} tabular grains are explained. The {100} tabular grains are tabular grains whose major faces are {100} faces. Examples of the shape of said major face include a right-angled parallelogram, or a triangle to pentagon which corresponds to the said right-angled parallelogram except that any one of corners is rounded off (the shape of the rounded off port means a right-angled triangular part which is formed by sides around the corner which positions as an apex), and a tetragon to octagon which corresponds to the right-angled parallelogram in which two to four "rounded off parts" exist.

The right-angled parallelogram supplemented (restored) with its "rounded off part(s)" is herein referred to a supplemented tetragon. The ratio of the lengths of neighboring sides (i.e. length of long side/length of short side) of said right-angled parallelogram and said supplemented tetragon is generally in the range of 1 to 6, preferably in the range of 1 to 4, and more preferably in the range of 1 to 2.

Tabular silver halide emulsion grains having {100} main planes can be formed by adding and mixing with stirring, an aqueous silver salt solution and an aqueous halide salt solution into a dispersion medium such as an aqueous gelatin solution. For example, JP-A-6-301129, JP-A-6-347929, JP-A-9-34045 and JP-A-9-96881 each disclose a method of forming tabular grains, which comprises carrying out the above nucleation in the presence of silver iodide or an iodide ion, and/or silver bromide or a bromide ion, thereby generating in the silver halide nuclei a strain occurring due to a difference in size of crystal lattice between silver chloride and silver iodide or silver bromide, and consequently introducing therein crystal defects which allow anisotropic growth such as a helical (spiral) dislocation. If said helical dislocation is introduced, a formation of two-dimensional nucleus at the dislocation face under low supersaturation conditions is not a rate-determining step, and therefore crystallization at the face proceeds. As a result, tabular grain are formed by introduction of the helical dislocation. Herein, the term "low supersaturation conditions" means preferably 35% or less, more preferably 2 to 20%, based on the critical addition amount. Even though it is not established that said crystal defects are a helical dislocation, it is considered that the probability of a helical dislocation would be high from the viewpoints of the direction in which the dislocation is introduced, or allowance of anisotropic growth to the grains. JP-A-8-122954 and JP-A-9-189977 each disclose that maintenance of the dislocation thus introduced is preferred in order to make the tabular grains thinner.

Further, JP-A-6-347928 and JP-A-8-339044 disclose methods of forming {100} tabular grains, by adding a {100} face-forming accelerator such as imidazoles, 3,5-diaminotriazoles each of which are disclosed in the former publication, and polyvinyl alcohols which are disclosed in the latter. However, the present invention should not be limited to them.

In the present invention, the term "high silver chloride grains" means grains having the silver chloride content of 80 mol % or more, preferably 95 mol % or more. The grains for use in the present invention preferably have a so-called core/shell structure which is composed of a shell part and a core part which is to be covered with the shell part. The core part is preferably composed of silver chloride accounting for 90 mol % or more. Further, the core part may be composed of at least two parts each having a different halogen composition. The shell part preferably accounts for 50% or less of total grain volume, and particularly preferably 20% or less of total grain volume. The shell part is preferably composed of silver iodochloride or silver iodobromochloride. The shell part preferably has an iodine content of 0.5 mol % to 13 mol %, particularly preferably 1 mol % to 13 mol %. The silver iodide content of total grain is preferably 5 mol % or less, particularly preferably 1 mol % or less.

Preferably the silver bromide content is also higher in the shell part than in the core part. The silver bromide content is preferably 20 mol % or less, particularly preferably 5 mol % or less.

An average grain size (an average diameter of a sphere corresponding to the volume of an individual grain) of the silver halide grains for use in the present invention is not limited in particular, but the average grain size is preferably in the range of 0.1 μm to 0.8 μm, particularly preferably in the range of 0.1 μm to 0.6 μm.

A diameter of the silver halide tabular grain for use in the present invention, in terms of a diameter corresponding to an equivalent circle, is preferably in the range of 0.2 to 1.0 μm. Herein, the term "a diameter of the silver halide grain" means a diameter of the circle having an area equivalent to the projected area of an individual grain in photographs taken by means of an electron microscope. Further, a thickness of the tabular grain is generally 0.2 μm or less, preferably 0.1 μm or less, and particularly preferably 0.06 μm or less. In the present invention, preferably, 50% or more of total silver halide grain projected area contained in the silver halide emulsion layer containing a yellow dye-forming coupler is accounted for by tabular grains exhibiting the average aspect ratio (a ratio of diameter/thickness of the grain) of 2 or more, and further preferably 5 or more, but 20 or less.

Generally, the tabular grain is of the plane having two parallel faces. Accordingly, the term "thickness" in the present invention is defined by a distance between two parallel faces constituting the tabular grain.

The grain size distribution of the silver halide grains for use in the present invention may be a polydispersion, or a monodispersion, but the latter is more preferred. Particularly, coefficient of variation of diameters of equivalent circles of the tabular grains according for 50% or more of total grain projected area, is preferably 20% or less, and ideally 0%.

The presence of the crystal habit controlling agent on grain surfaces after grain formation, adversely influences adsorption of sensitizing dyes and development. Therefore, it is preferred to remove the crystal habit controlling agent after the grain formation. However, if the crystal habit controlling agent is removed, it is difficult for the high silver chloride {111} tabular grains to maintain the {111} faces under normal conditions. Consequently, it is preferred to maintain the shape of the grains by replacing the crystal habit controlling agent with a sensitizing dye or other photographically useful compounds. This method is described in, for example, JP-A-9-80656, JP-A-9-106026, U.S. Pat. Nos. 5,221,602, 5,286,452, 5,298,387, 5,298,388, and 5,176,992.

The crystal habit controlling agent can be desorbed from the grains by the above-described method. The desorbed crystal habit controlling agent is preferably removed from the emulsion by means of washing. The temperature for washing may be a temperature which does not cause coagulation of the gelatin usually employed as a protective colloid. The method for washing may be a known technique such as a flocculation method and an ultrafiltration method. The washing temperature is preferably 40° C. or more.

A lower pH value accelerates the desorption of the crystal habit controlling agent from the grains. Therefore, the use of a lower pH in the washing stage is preferred so long as the grains are not excessively flocculated.

Silver halide grains for use in the present invention may incorporate metals belonging to the Group VIII of the Periodic Table, i.e., ions of metals selected from a group consisting of osmium, iridium, rhodium, platinum, ruthenium, palladium, cobalt, nickel, and iron, or their complex ions, in a single use or a combination use. Further, two or more kinds of these metals may be used together.

The above-described metal ion-donating compounds may be contained in the silver halide grains for use in the present invention, by adding them to an aqueous gelatin solution which is to be a dispersion medium, and aqueous halide solution, an aqueous silver salt solution, or other aqueous solution, at the step of forming the silver halide grains, or alternatively by adding in the form of fine silver halide grains previously having metal ion(s) contained therein, to a silver halide emulsion, followed by dissolution of the emulsion. Further, incorporation of metal ion(s) into the grains may be effected before, during, or just after the formation of grains. The time when the incorporation is effected may be determined, depending on the position and amount in the grain into which the metal ion shall be incorporated.

It is preferred that 50 mol % or more (preferably at least 80 mol %, more preferably 100%) of the metal ion-donating compound incorporated in the silver halide grains for use in the present invention, be locally located in a surface layer which is a surface region equivalent to 50% or less of total grain volume from the grain surface. The value of said surface layer is preferably 30% or less. Localization of metal ion(s) in the surface layer is of advantage to restraint of increase in the internal sensitivity, which results in attainment of high sensitivity. For example, the concetrical incorporation of a metal ion-donating compound into a surface layer of the silver halide grain as mentioned above, can be achieved by forming an initial part (core) of the silver halide grain from which a surface layer is excluded, and thereafter applying a metal ion-donating compound in time to an addition of a water-soluble silver salt solution and an aqueous halide solution which are used to form a surface layer.

Into the silver halide emulsion for use in the present invention, various kinds of polyvalent metal ion impurities in addition to the Group VIII metal, can be incorporated in the stage of formation of grains in the emulsion, or a physical ripening. An amount of these compounds to be added widely ranges in accordance with the purpose of these compounds to be added, with a preferred range of $10^{-9}$ mol to $10^{-2}$ mol per mol of silver halide.

The silver halide emulsion for use in the present invention is generally subjected to chemical sensitization. The chemical sensitization include, for example, so-called gold sensitization using gold compounds (for example, U.S. Pat. Nos. 2,448,060, 3,320,069), sensitization using metals such as iridium, platinum, rhodium, and paradium (for example, U.S. Pat. Nos. 2,448,060, 2,566,245, 2,556,263), sulfur sensitization using sulfur-containing compounds (for example, U.S. Pat. No. 2,222,264), selenium sensitization using selenium compounds, tellurium sensitization using tellurium compounds, and reduction sensitization using, for example, thin salts, thiourea dioxide, and polyamines (for example, U.S. Pat. Nos. 2,487,850, 2,518,698, 2,521,925). These sensitization may be employed singly or in combination.

The silver halide emulsion for use in the present invention is preferably subjected to gold sensitization known in this technical field. Because, the use of gold sensitization can minimize a change in photographic properties, caused by a scanning exposure to laser light or the like. The gold sensitization can be carried out using compounds such as chloroauric acid or its salt, gold thiocyanate salts, and gold thiosulfate salts. An amount of these compounds to be added may vary in accordance with occasion, but generally it is $5\times10^{-7}$ to $5\times10^{-2}$ mol, preferably $1\times10^{-6}$ to $1\times10^{-3}$ mol, per mol of silver halide. The timing of these compounds for addition is no later than the time when the chemical sensitization for use in the present invention is completed.

In the present invention, the gold sensitization is also preferably carried out in combination with other sensitizations, such as sulfur sensitization, selenium sensitization, tellurium sensitization, reduction sensitization, or noble metal sensitization using a noble metal compound except for a gold compound.

To the silver halide emulsion for use in the present invention, various compounds or their precursors can be added for the purpose of preventing fogging during the production process, storage, or the photographic processing of the photographic material, or for the purpose of stabilizing the photographic performance. Specific examples of these compounds are described in JP-A-62-215272, pages 39 to 72, which compounds are preferably used. The emulsion for use in the present invention is preferably a so-called surface latent image-type emulsion, wherein a latent image is mainly formed on the grain surface.

A coating amount of the silver halide emulsion for use in the present invention is preferably 0.60 g/m$^2$ or less, and it is preferably 0.10 g/m$^2$ or more, more preferably it is in the range of 0.55 g/m$^2$ to 0.20 g/m$^2$. and most preferably in the range of 0.50 g/m$^2$ to 0.25 g/m$^2$ Silver halide emulsion grains which are used in a cyan color-forming layer and a magenta color-forming layer for use in the present invention, may be tabular grains as described above, but preferably, they are cubic. In this case, the side length of the cubic grains is preferably 0.50 $\mu$m or less, and it is preferably 0.05 $\mu$m or more, and more preferably it is in the range of 0.40 $\mu$m to 0.10 $\mu$m.

The term "oil-soluble materials in the photographic constituent layers" referred to in the present invention, means lipophilic ingredients remaining in the processed light-sensitive material. Specific examples of the ingredients include a high boiling point organic solvent, a coupler, a color-mix inhibitor, an ultra violet absorber, lipophilic additives, a lipophilic polymer or polymer latex, a matte agent, and a sliding (slipping) agent. In other words, such ingredients are those usually added into the photographic constituent layers as a lipophilic fine article. Accordingly, a water-soluble dyestuff, a hardening agent, water-soluble additives, a silver halide emulsion, and the like do not fall under the definition of the oil-soluble material. Further, a surface active agent is usually used, when such lipophilic fine particles are prepared. However, the surface active agent is not dealt with the oil-soluble material in the present invention. The total amount of the oil-soluble material in the present invention is preferably 4.5 g/m$^2$ or less, and it is preferably 2.0 g/m$^2$ or more, more preferably it is in the range of 4.0 g/m$^2$ to 2.5 g/m$^2$, and most preferably in the range of 3.8 g/m$^2$ to 3.0 g/m$^2$.

The ratio of the amount of oil-soluble materials to the amount of a hydrophilic binder in the photographic constituent layers may be optionally determined in the present invention. A weight ratio for the photographic constituent layers except for a protective layer is preferably in the range of 0.05 to 1.50, more preferably in the range of 0.10 to 1.40, and most preferably in the range of 0.20 to 1.30. Optimization of the ratio for each of the layers allows a film strength, a scratch resistance, and curl characteristics to be adjusted.

A film thickness of the photographic constituent layers in the present invention is preferably 9.0 μm or less, and it is preferably 1.0 μm or more, more preferably it is in the range of 8.0 μm to 2.0 μm, and most preferably in the range of 7.0 μm to 3.5 μm. The term "film thickness of the photographic constituent layers" in the present invention means a total thickness of photographic constituent layers above a support before processing. Specifically, the thickness can be measured by any one of the following methods. First, a silver halide color photographic light-sensitive material is cut at right angles to a support, and the resultant cut section is measured using an electron microscope. The second method is a method in which a film thickness can be calculated based on both a total coating amount ($g/m^2$) of ingredients in the photographic constituent layers and specific gravity of each of the ingredients. Specific gravity of a typical gelatin for use in photography is 1.34 g/ml, and that of silver chloride grains is 5.59 g/ml. Specific gravity of each of other oleophilic additives can also be measured. Consequently a film thickness can be calculated according to the second method.

In the present invention, a cyan coupler which can be preferably used from the viewpoints of both rapid processing and color reproduction is a pyrroloazole type coupler, particularly pyrroloazole couplers described in, for example, JP-A-5-313324 and JP-A-6-347960. More specifically, they are couplers represented by formula (I) or (II) of the above-mentioned JP-A-5-313324, and couplers represented by formula (I) of the above-mentioned JP-A-6-347960. Further, couplers represented by formula (I) described in JP-A-9-189988 can be mentioned. Of these couplers, are preferably used couplers represented by formula [I] as shown below, because they have excellent coloring property and fastness of the resultant image.

formula [I]

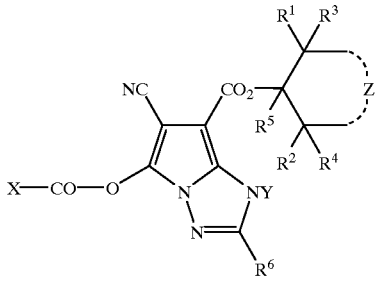

In formula [I], $R^1$ and $R^2$ each independently represent an alkyl group, or an aryl group; $R^3$, $R^4$ and $R^5$ each independently represent a hydrogen atom, an alkyl group, or an aryl group; Z represents a group of non-metallic atoms necessary to form a saturated ring; $R^6$ represents a substituent; X represents a heterocyclic group, a substituted amino group, or an aryl group; and Y represents a hydrogen atom, or a group capable of being split-off in a process of color development.

In formula [I], the alkyl group represented by $R^1$ to $R^5$ is a straight-chain, branched, or cyclic alkyl group having 1 to 36 carbon atoms, preferably a straight-chain, branched, or cyclic alkyl group having 1 to 22 carbon atoms, and especially preferably a straight-chain, or branched alkyl group having 1 to 8 carbon atoms. Specific examples thereof include methyl, ethyl, n-propyl, isopropyl, t-butyl, t-amyl, t-octyl, decyl, dodecyl, cetyl, stearyl, cyclohexyl, and 2-ethylhexyl.

In formula [I], the aryl group represented by $R^1$ to $R^5$ is an aryl group having 6 to 20 carbon atoms, preferably an aryl group having 6 to 14 carbon atoms, and especially preferably an aryl group having 6 to 10 carbon atoms. Specific examples thereof include phenyl, 1-naphthyl, 2-naphthyl, and 2-phenanthryl.

In formula [I], the group of non-metallic atoms necessary to from a saturated ring, represented by Z, is a group of non-metallic atoms necessary to form a 5- to 8-membered ring which may have a substituent, or which may be condensed with a saturated ring or an unsaturated ring. The ring-forming non-metallic atom may be a carbon atom, an oxygen atom, a nitrogen atom, or a sulfur atom. The ring is preferably a 6-membered saturated carbon ring, and especially preferably a cyclohexane ring which is substituted with an alkyl group having 1 to 24 carbon atoms at the 4-position thereof.

In formula [1], examples of the substituent represented by $R^6$ include, for example, a halogen atom (e.g., a fluorine atom, a chlorine atom,.and a bromine atom), an aliphatic group (e.g., a straight-chain or branched-chain alkyl group, an aralkyl group, an alkenyl group, an alkynyl group, a cycloalkyl group, and a cycloalkenyl group, each having 1 to 36 carbon atoms, and specifically, for example, methyl, ethyl, propyl, isopropyl, t-butyl, tridecyl, t-amyl, t-octyl, 2-methanesulfonylethyl, 3-(3-pentadecylphenoxy)propyl, 3-{4-{2-[4-(4-hydroxyphenylsulfonyl)phenoxy]dodecaneamido}-phenyl}propyl, 2-ethoxytridecyl, trifluoromethyl, cyclopentyl, and 3-(2,4-di-t-amylphenoxy)propyl), an aryl group (e.g., an aryl group having 6 to 36 carbon toms, for example, phenyl, 4-t-butylphenyl, 2,4-di-t-amylphenyl, 4-tetradecaneamidophenyl, 2-methoxyphenyl), a heterocyclic group (e.g., a heterocyclic group having 1 to 36 carbon atoms, for example, 2-furyl, 2-thienyl, 2-pyrimidinyl, and 2-benzothiazolyl), a cyano group, a hydroxyl group, a nitro group, a carboxy group, an amino group, an alkoxy group (e.g., a straight-chain, branched-chain or cyclic alkoxy group having 1 to 36 carbon atoms, for example, methoxy, ethoxy, butoxy, 2-methoxyethoxy, 2-dodecyloxyethoxy, and 2-methanesulfonylethoxy), an aryloxy group (e.g., an aryloxy group having 6 to 36 carbon atoms, for example, phenoxy, 2-methylphenoxy, 4-t-butylphenoxy, 3-nitrophenoxy, 3-t-butyloxycarbamoylphenoxy, and 3-methoxycarbamoyl), an acylamino group (e.g., an acylamino group having 2 to 36 carbon atoms, for example, acetamido, benzamido, tetradecaneamido, 2-(2,4-di-t-amylphenoxy)butaneamido, 4-(3-t-butyl-4-hydroxyphenoxy)butaneamido, and 2-{4-(4-hydroxyphenylsulfonyl)phenoxy}decaneamido), an alkylamino group (e.g., an alkylamino group having 1 to 36 carbon atoms, for example, methylamino, butylamino, dodecylamino, diethylamino, and methylbutylamino), an anilino group (e.g., an anilino group having 6 to 36 carbon atoms, for example, phenylamino, 2-chloroanilino, 2-chloro-5-tetradecaneaminoanilino, 2-chloro-5-dodecyloxycarbonylanilino, N-acetylanilino, and 2-chloro-5-{2-(3-t-butyl-4-hydroxyphenoxy)dodecaneamido}anilino), a ureido group (e.g., a ureido group having 2 to 36 carbon atoms, for example, phenylureido, methylureido, and N,N-dibutylureido), a sulfamoylamino group (e.g., a sulfamoylamino group having 1 to 36 carbon atoms, for example, N,N-dipropylsulfamoylamino and N-methyl-N-decylsulfamoylamino), an alkylthio group (e.g., an alkylthio group having 1 to 36 carbon atoms, for example, methylthio, octylthio, tetradecylthio, 2-phenoxyethylthio, 3-phenoxypropylthio, and 3-(4-t-butylphenoxy)propylthio), an arylthio group (e.g., an aylthio group having 6 to 36 carbon atoms, for example, phenylthio, 2-butoxy-5-t-octylphenylthio, 3-pentadecylphenylthio, 2-carboxyphenylthio, and 4-tetradecaneamidophenylthio), an alkoxycarbonylamino group (e.g., an alkoxycarbonylamino group having 2 to 36 carbon atoms, for example, methoxycarbonylamino and tetradecyloxycarbonylamino), a sulfonamido group (e.g., an alkyl- or aryl-sulfonamido group having 1 to 36 carbon atoms, for example, methanesulfonamido, butanesulfonamido, octanesulfonamido, hexadecanesulfonamido, benzenesulfonamido, p-toluenesulfonamido, octadecanesulfonamido, and 2-methoxy-5-t-butylbenzenesulfonamido), a carbamoyl group (e.g., a carbamoyl group having 1 to 36 carbon atoms, for example, N-ethylcarbamoyl, N,N-dibutylcarbamoyl, N-(2-dodecyloxyethyl)carbamoyl, N-methyl-N-dodecylcarbamoyl, and N-{3-(2,4-di-t-amylphenoxy) propyl}carbamoyl), a sulfamoyl group (e.g., a sulfamoyl group having 1 to 36 carbon atoms, for example, N-ethylsulfamoyl, N,N-dipropylsufamoyl, N-(2-dodecyloxyethyl)sulfamoyl, N-ethyl-N-dodecylsulfamoyl, and N,N-diethylsulfamoyl), a sulfonyl group (e.g., an alkyl- or aryl- sulfonyl group having 1 to 36 carbon atoms, for example, methanesulfonyl, octanesulfonyl, benzenesulfonyl, and toluenesulfonyl), an alkoxycarbonyl group (e.g., an alkoxycarbonyl group having 1 to 36 carbon atoms, for example, methoxycarbonyl, butyloxycarbonyl, dodecyloxycarbonyl, and octadecyloxycarbonyl), a heterocyclic oxy group (e.g., a heterocyclic oxy group having 1 to 36 carbon atoms, for example, 1-phenyltetrazole-5-oxy and 2-tetrahydropyranyloxy), an azo group (e.g., phenylazo, 4-methoxyphenylazo, 4-pivaroylaminophenylazo, and 2-hydroxy-4-propanoylphenylazo), an acyloxy group (e.g., an acyloxy group having 2 to 36 carbon atoms, for example, acetoxy), a carbamoyloxy group (e.g., a carbamoyloxy group having 1 to 36 carbon atoms, for example, N-methylcarbamoyloxy and N-phenylcarbamoyloxy), a silyloxy group (e.g., silyloxy group having 3 to 36 carbon atoms, for example, trimethylsilyloxy and dibutylmethylsilyloxy), an aryloxycarbonylamino group (e.g., an aryloxycarbonyl amino group having 7 to 36 carbon atoms, for example, phenoxycarbonylamino), an imido group (e.g., an imido group having 4 to 36 carbon atoms, for example, N-succinimido, N-phthalimido, and 3-octadecenylsuccinimido), a heterocyclic thio group (e.g., a heterocyclic thio group having 1 to 36 carbon atoms, for example, 2-benzothiazolylthio, 2,4-di-phenoxy-1,3,5-tirazole-6-thio, and 2-pyridylthio), a sulfinyl group (e.g., a sulfinyl group having 1 to 36 carbon atoms, for example, dodecanesulfinyl, 3-pentadecylphenylsulfinyl, and 3-phenoxypropylsulfinyl), an alkyl-, an aryl-, or heterocyclic oxy carbonyl group (e.g., methoxycarbonyl, butoxycarbonyl, dodecyloxycarbonyl, octadecyloxycarbonyl, phenyloxycarbonyl, and 2-pentadecyloxycarbonyl), an alkyl-, an aryl- or heterocyclic oxy carbonylamino group (e.g., methoxycarbonylamino, tetradecyloxycarbonylamino, phenyloxycarbonylamino, and 2,4-di-tert-butylphenoxycarbonylamino), a sulfonamido group (e.g., methanesulfonamido, hexadecanesulfonamido, benzenesulfonamido, p-toluenesulfonamido, octadecanesulfonamido, and 2-methoxy-5-t-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, and N-{3-(2,4-di-t-amylphenoxy) propyl}carbamoyl), a sulfamoyl group (e.g., N-ethylsulfamoyl, N,N-dipropylsufamoyl, N-(2-dodecyloxyethyl)sulfamoyl, N-ethyl-N-dodecylsulfamoyl, and N,N-diethylsulfamoyl), a phosphonyl group (e.g., phenoxyphosphonyl, octyloxyphosphonyl, and phenylphosphonyl), a sulfamido group (e.g. dipropylsulfamoylamino), an imido group (e.g., N-succinimido, hydantoinyl, N-phthalimido, and 3-octadecenylsuccinimido), an azolyl group (e.g., imidazolyl, pyrazolyl, 3-chloro-pyrazol-1-yl, and triazolyl), a hydroxyl group, a cyano group, a carbonyl group, a nitro group, a sulfo group, a unsubstituted amino group.

As $R^6$, preferably can be mentioned an alkyl group, an aryl group, a heterocyclic group, a cyano group, a nitro group, an acylamino group, an arylamino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, an aryloxycarbonyl group, a heterocyclic oxy group, an acyloxy group, a carbamoyloxy group, an aryloxycarbonylamino group, an imido group, a heterocyclic thio group, a sulfinyl group, a phosphonyl group, an acyl group, and an azolyl group.

Further preferably an alkyl group or an aryl group, and more preferably an aryl group whose at least p-position is substituted by an alkyl group are mentioned.

X represents a heterocyclic ring, a substituted amino group, or an aryl group. As the heterocyclic ring, a 5- to 8-membered ring having a nitrogen atom(s), an oxygen atom(s), or a sulfur atom(s) and 1 to 36 carbon atoms is preferable. A 5- or 6-membered ring bonded through a nitrogen atom is more preferable, with particular preference given to a 6-membered ring.

As specific examples, imidazole, pyrazole, triazole, lactam compounds, piperidine, pyrrolidine, pyrrole, morpholine, pyrazolidine, thiazolidine, pyrazoline, and the like can be mentioned, with preference given to morpholine and piperidine and particular preference to morpholine.

As the substituent of the substituted amino group, an aliphatic group, an aryl group, or a heterocyclic group can be mentioned. As the aliphatic group, the substituents represented by $R^6$ as mentioned above can be mentioned, which may further be substituted by a cyano group, an alkoxy group (e.g., methoxy), an alkoxycarbonyl group (e.g., ethoxycarbonyl), a chlorine atom, a hydroxyl group, a carboxyl group, or the like. As the substituted amino group, a di-substituted amino group is more preferred than a mono-substituted amino group. As the aryl group, one having 6 to 36 carbon atoms is preferable, and a single ring is more preferable. As specific examples, phenyl, 4-t-butylphenyl, 2-methylphenyl, 2,4,6-trimethylphenyl, 2-methoxyphenyl, 4-methoxyphenyl, 2,6-dichlorophenyl, 2-chlorophenyl, 2,4-dichlorophenyl, and the like can be mentioned.

Y is a hydrogen atom, or a group capable of being split-off in a process of color development. Examples of the group represented by Y include a group which can be split-off under the alkaline condition, as described in, for example, JP-A-61-228444, or a group which can be split-off by a coupling reaction with a developing agent, as described in JP-A-56-133734. Y is preferably a hydrogen atom.

The coupler represented by formula [I] may be a dimer or more polymeric compound wherein R contains a residual group formed from the coupler represented by formula [I], or may be a homopolymer or copolymer wherein $R^6$ contains a macromolecular chain. Typical examples of the homopolymer or copolymer containing a macromolecular chain are homo- or co-polymers of addition polymerization ethylenically unsaturated compounds having a residual group formed from the coupler represented by formula [I]. At least one of the cyan dye-forming repeating unit having a residual group formed from the coupler represented by formula [I] may be contained in these polymers. Further, the copolymer may contain as a copolymer ingredient, one or more kinds of a repeating unit derived from a non-coloring ethylenically monomer which does not couple with the oxidation product of an aromatic primary amine developing agent, such as acrylic acid esters, methacrylic acid esters, and maleic acid esters.

Specific examples of the coupler for use in the present invention are shown below. However, the present invention is not limited to these compounds.

(1)

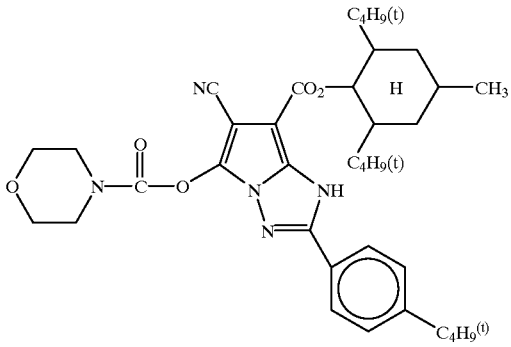

(2)

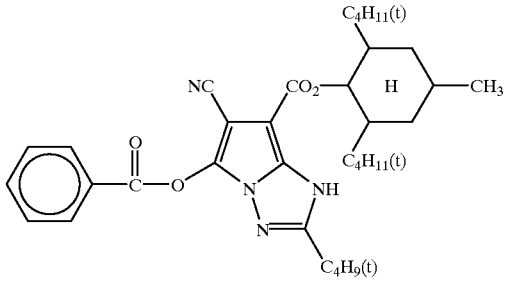

(3)

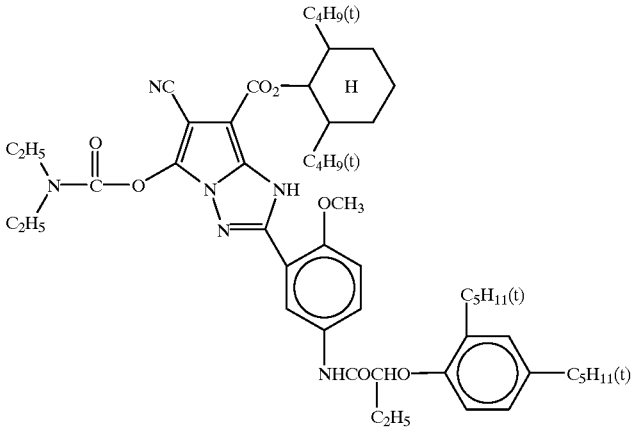

(4)

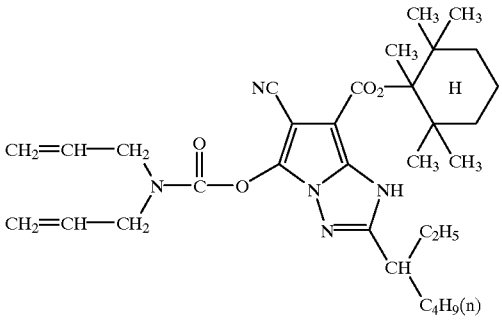

-continued
(5)
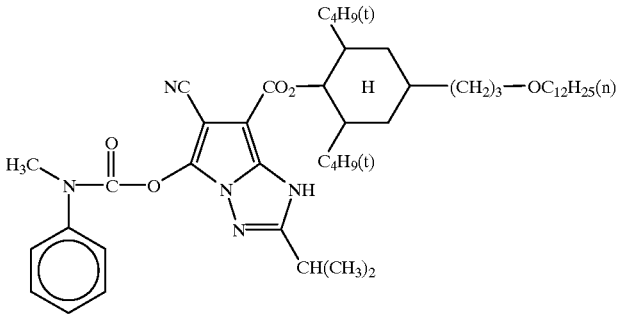
(6)
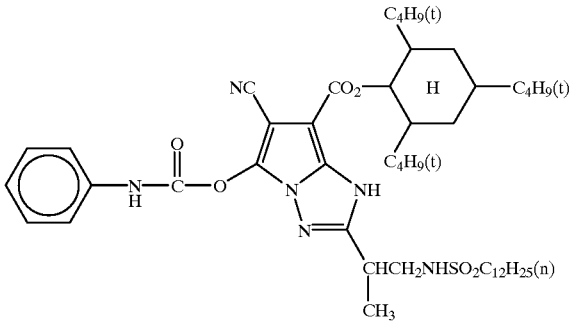
(7)
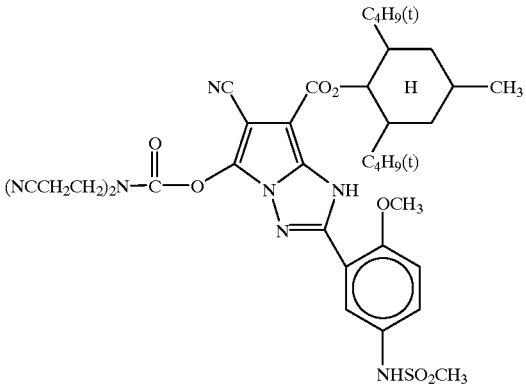
(8)
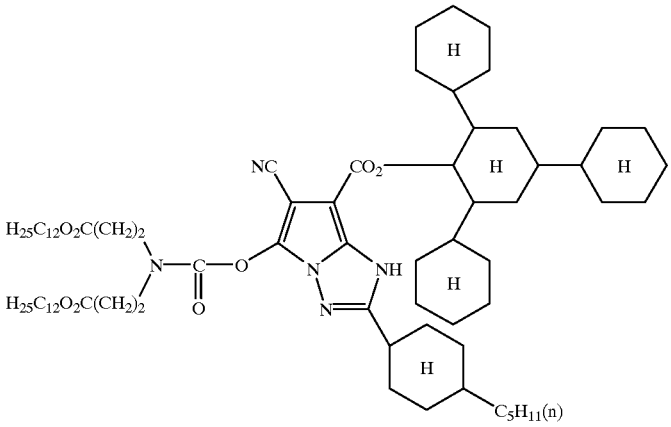

-continued
(9)
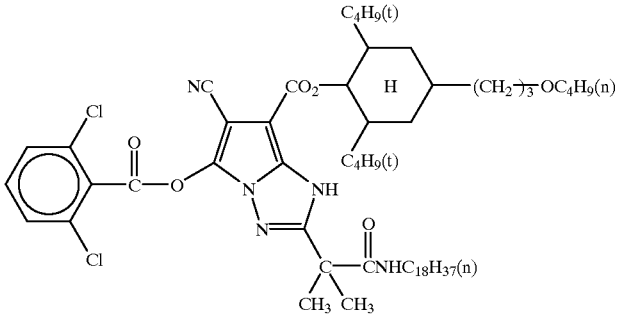
(10)
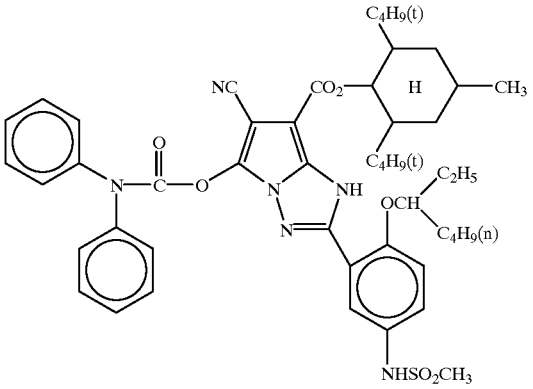
(11)
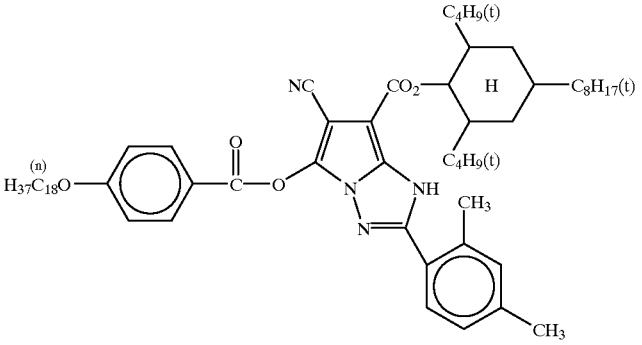
(12)
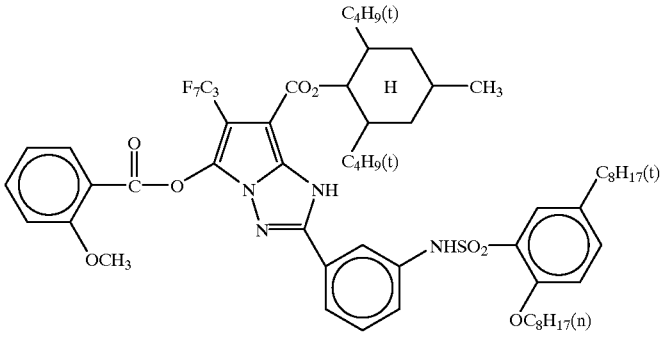

-continued
(13)
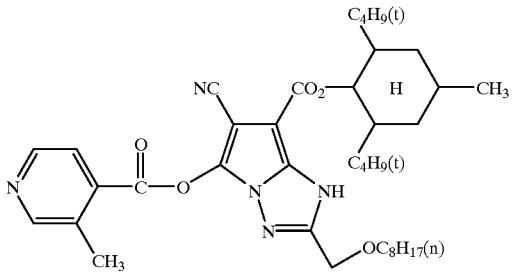
(14)
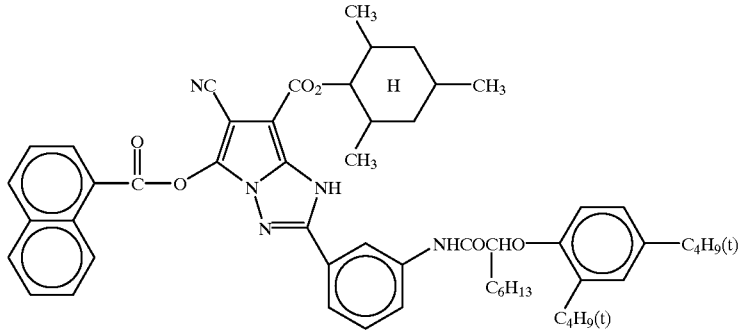
(15)
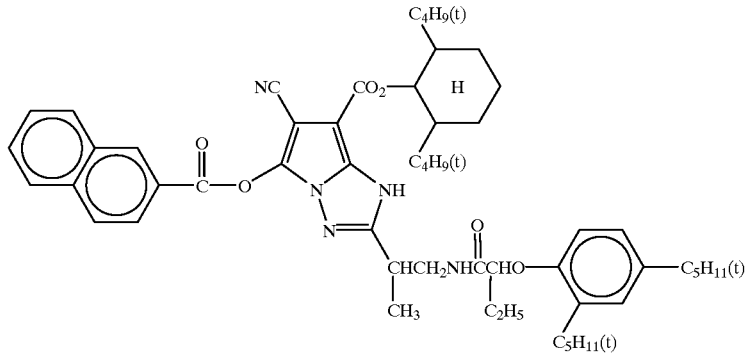
(16)
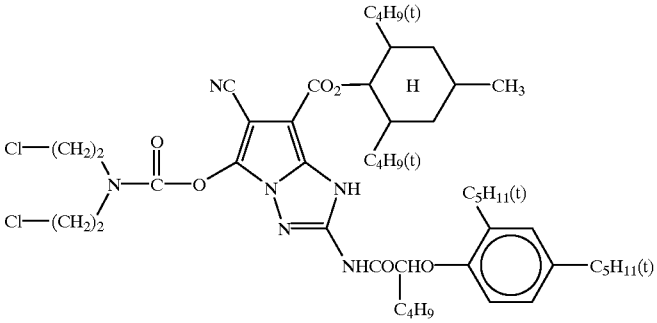

-continued
(17)
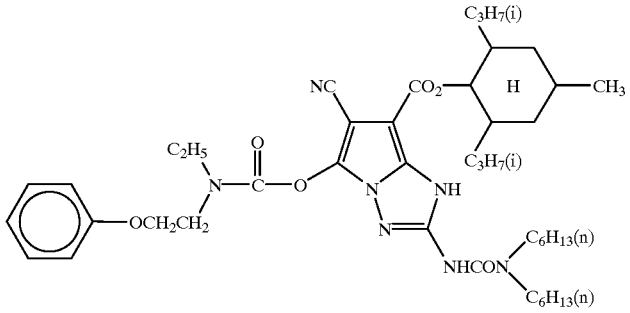
(18)
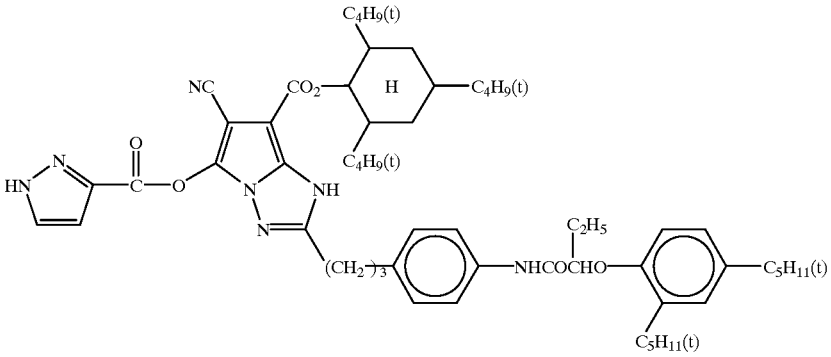
(19)
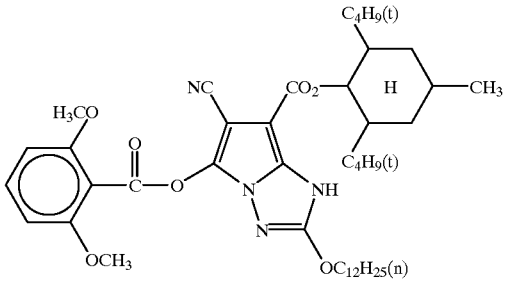
(20)
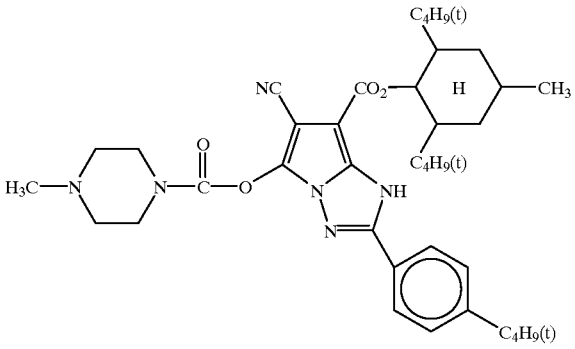

-continued
(21)
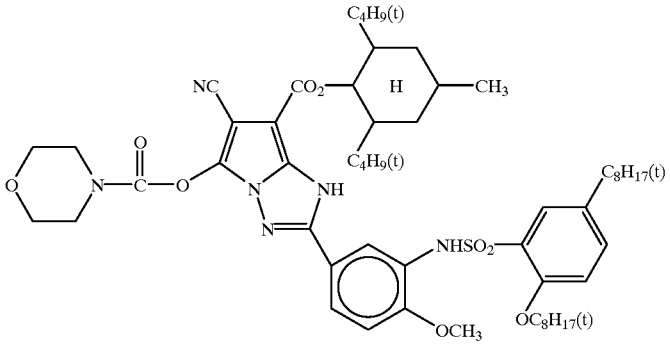
(22)
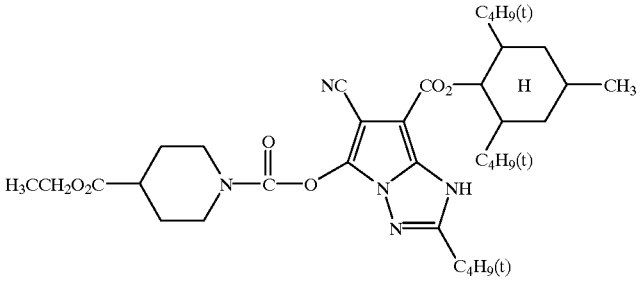
(23)
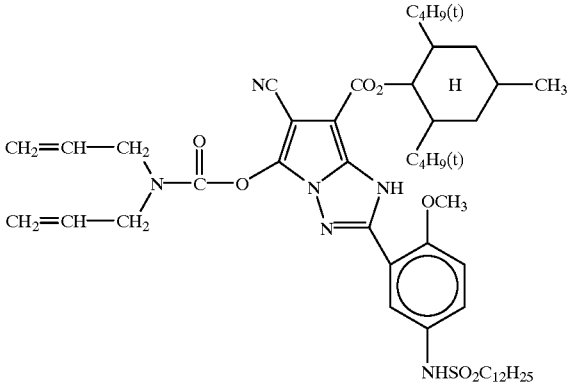
(24)
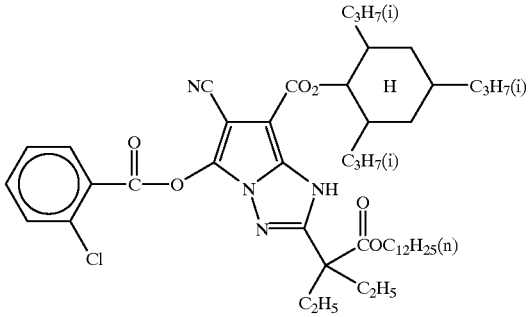

-continued
(25)
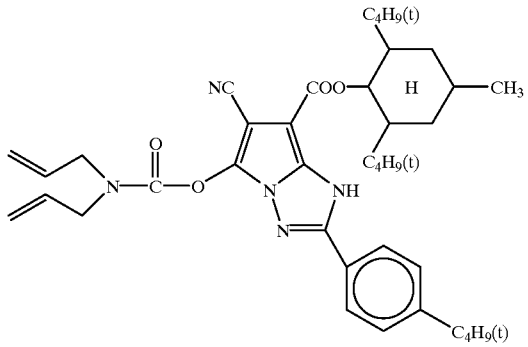
(26)
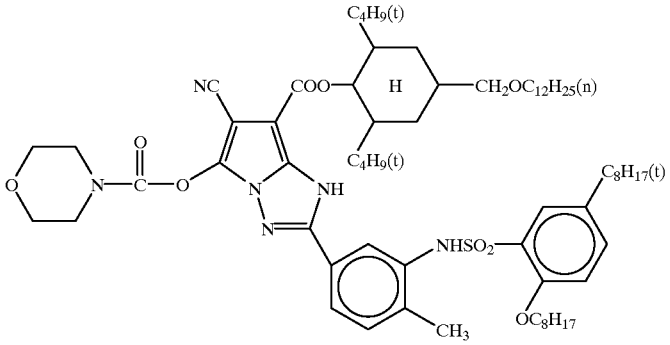
(27)
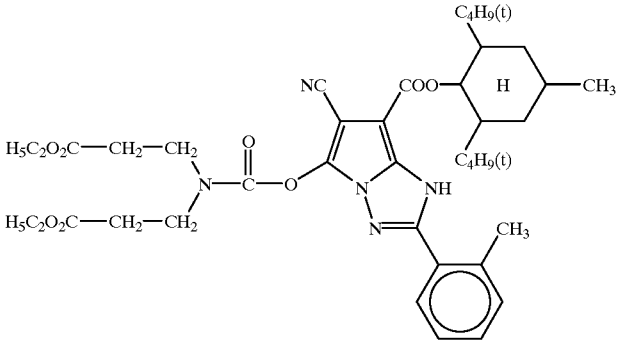
(28)
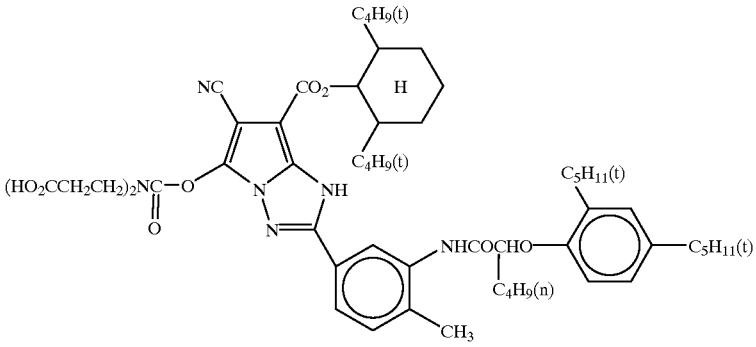

-continued (29)

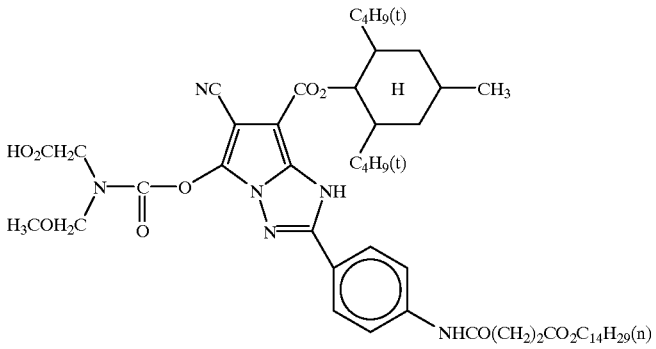

(30)

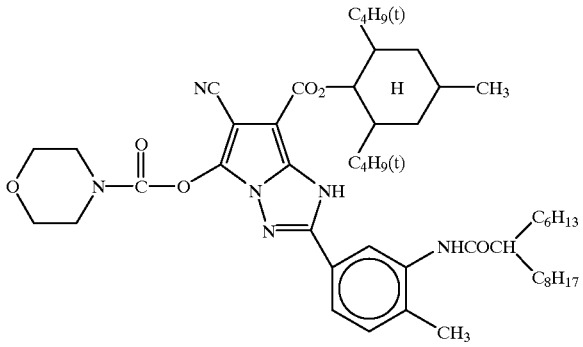

(31)

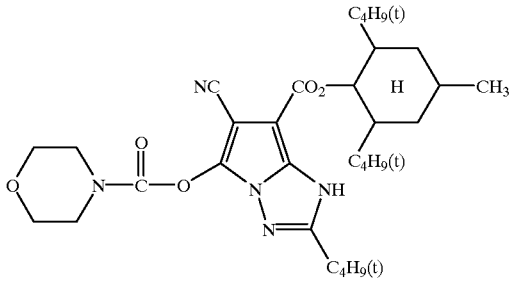

The compound represented by formula [I] for use in the present invention can be synthesized by the known method, for example, by methods described in JP-A-5-255333, JP-A-5-202004, JP-A-7-48376, and JP-A-8-110623.

Further, in the second embodiment of the present invention, it is preferable to use a cyan coupler represented by the following formula [ADF] in combination with the coupler represented by formula [I].

formula [ADF]

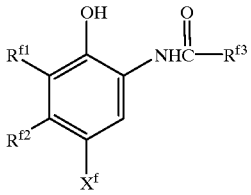

In formula [ADF], $X^f$ represents a hydrogen atom, or a group which can be split-off upon a coupling reaction with the oxidation product of an aromatic amine developing agent. $R^{f1}$ and $R^{f2}$, which may be the same or different, each represent a hydrogen atom, or a substituent. $R^{f3}$ represents an alkyl group, an aryl group, an alkylamino group, or an arylamino group. Each of these groups may be substituted with a substituent. Preferable examples of the substituent are those exemplified for $R^6$ in formula [I]. $R^{f1}$ and $R^{f2}$ may bond together to form a 5- or 6-membered ring. At least one of the groups $R^{f1}$ to $R^{f3}$ has 8 or more carbon atoms. $R^{f1}$ is preferably a hydrogen atom, an alkyl group, or a halogen atom. $R^{f2}$ is preferably an alkyl group, an acylamino group, or a ureido group. $X^f$ is preferably a halogen atom, or a hydrogen atom.

Specific examples of the compound represented by formula [ADF] are shown below, but the present invention is not limited to those.

(ADF-1)

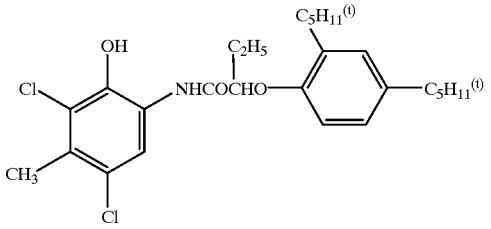

(ADF-2)

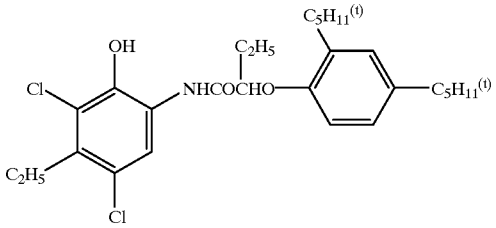

(ADF-3)

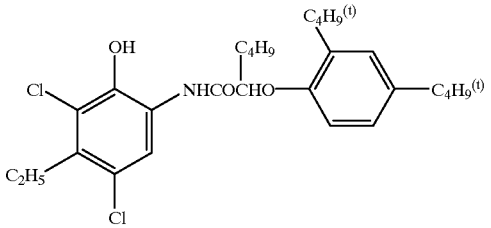

(ADF-4)

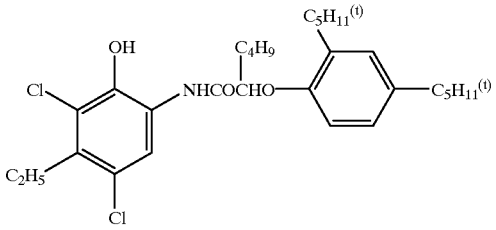

(ADF-5)

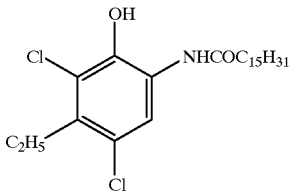

(ADF-6)

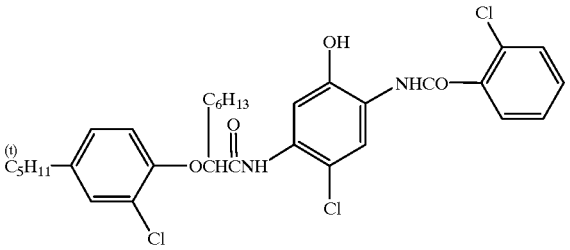

-continued (ADF-7)

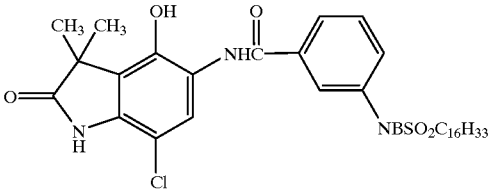

(ADF-8)

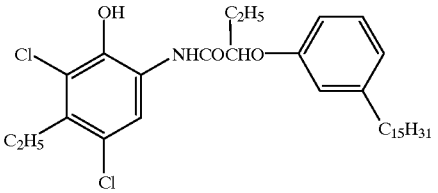

(ADF-9)

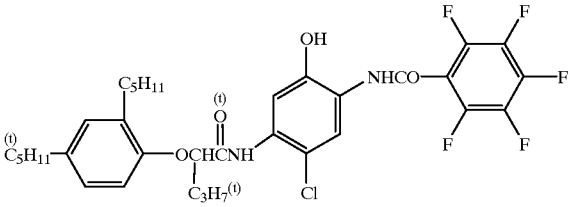

(ADF-10)

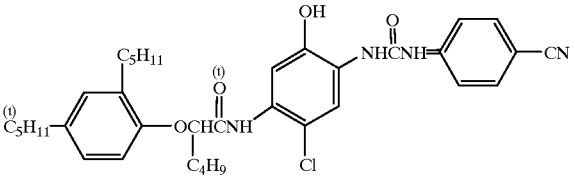

Preferably the cyan coupler represented by formula [I] is added to a silver halide emulsion layer closest to a support. The content of a cyan coupler represented by formula [I] in a light-sensitive material is generally in the range of $1\times10^{-3}$ mol to 1 mol, and preferably in the range of $2\times10^{-3}$ mol to $3\times10^{-1}$ mol, per mol of silver halide in the same layer. Further, the cyan coupler represented by formula [ADF] is preferably added to the same layer in which a cyan coupler represented by formula [I] is incorporated. The cyan coupler of formula [ADF] is preferably used in an amount of 1 mol % to 100 mol %, more preferably 2 mol % to 50 mol %, and most preferably 2 mol % to 30 mol %, based on the cyan coupler of formula [I].

The cyan coupler represented by formula [I] may be used with known additives for the purpose of hue adjustment, improvement in dye stability (fastness of image), processing stability, or the like.

Preferred examples of the additives include those described in, for example, JP-A-10-221825, Japanese Patent Application Nos. 9-20816, 9-181487, 9-181488, 9-197992, 9-243371, 9-282821, 10-76596, and 10-80368.

The cyan coupler represented by formula [ADF] may be added to a hydrophilic colloid layer adjacent to a silver halide emulsion layer containing a cyan coupler represented by formula [I]. At this embodiment, said hydrophilic colloid layer may or may not contain a silver halide emulsion, but a smaller content of the silver halide emulsion is preferred from the viewpoints of both color reproduction and blix discoloration-resistance. Further, it is preferred to add to the above-said hydrophilic colloid layer, polymers described in JP-A-9-171240 and JP-A-9-329861, from the restraint of blix discoloration viewpoint.

Next, the cyan coupler represented by formula [C-1], compounds represented by formula [II] or [III] for use in the third embodiment of the present invention, are explained.

In formula [C-1], $R_1$ represents an alkyl group (preferably a straight-chain, branched-chain or cyclic alkyl group having 1 to 32 carbon atoms, e.g., methyl, butyl, pentadecyl, and cyclohexyl), an aryl group (e.g., a phenyl and naphthyl), a heterocyclic group (e.g., 2-pyridyl, 3-pyridyl, 2-furanyl, and 2-oxazolyl), or an amino group. Preferably, these each are further substituted by a substituent selected from an alkyl group, an aryl group, an alkyloxy or aryloxy group (e.g., methoxy, dodecyloxy, methoxyethoxy, phenyloxy, 2,4-di-tert-amylphenoxy, 3-tert-butyl-4-hydroxyphenyloxy, and naphthyloxy), a carboxyl group, an alkylcarbonyl or arylcarbonyl group (e.g., acetyl, tetradecanoyl, and benzoyl), an alkyloxycarbonyl or aryloxycarbonyl group (e.g., methoxycarbonyl, benzyloxycarbonyl, and phenoxycarbonyl), an acyloxy group (e.g., acetyl, benzoyloxy, and phenylcaronyloxy), a sulfamoyl group (e.g., N-ethylsulfamoyl and N-octadecylsulfamoyl), a carbamoyl group (e.g., N-cathylcarbamoyl and N-methyldodecylcarbamoyl), a sulfonamido group (e.g., methanesulfonamido and benzenesulfonamido), an acylamino group (e.g., acetylamino, benzamido, ethoxycarbonylamino, and phenylaminocarbonylamino), an imido group (e.g., succinimido and hydantoinyl), a sulfonyl group (e.g., methanesulfonyl), a hydroxyl group, a cyano group, a nitro group, and a halogen atom.

In formula [C-1], $R_2$ preferably represents an alkyl group having 1 to 20 carbon atoms (e.g., methyl, ethyl, butyl, and pentadecyl) or an acylamino group (e.g., tetradecanoylamino, benzoylamino, and 2-(2,4-di-tert-amylphenoxy)butanamido). The alkyl group designated by $R_2$ may be substituted by a substituent shown for $R_1$.

In formula [C-1], $X^{11}$ represents a hydrogen atom, a halogen atom, an alkoxy group (e.g., methoxy and butoxy), or an acylamino group (e.g., acetamido).

The compound represented by formula [C-I] is a phenol-series cyan coupler as shown above, and a condensed ring-series cyan coupler that includes a 5- to 7-membered ring formed by bonding $R_2$ and $X^{11}$ is also preferable, and as the above condensed ring-type cyan coupler, an oxyindole-series cyan coupler and an imidazole-2-one-series cyan coupler are particularly preferable.

In formula [C-1], $Z^{11}$ represents a hydrogen atom or a coupling split-off group, and examples include a halogen atom (e.g. fluorine atom, chlorine atom, and bromine atom), an alkoxy group (e.g. ethoxy, dodecyloxy, methoxyethylcarbamoylmethoxy, carboxypropyloxy, and methanesulfonylethoxy), an aryloxy group (e.g. 4-chlorophenoxy, 4-methoxyphenoxy, and 4-carboxyphenoxy), an acyloxy group (e.g. acetoxy, tetradecanoyloxy, and benzoyloxy), a sulfonyloxy group (e.g. methansulfonyloxy, and toluenesulfonyloxy), an amido group (e.g. dichloroacetylamino, heptabutylylamino, methanesulfonylamino, and toluenesufonylamino), an alkoxycarbonyloxy group (e.g. ethoxycarbonyloxy and benzyloxycarbonyloxy), an aryloxycarbonyloxy group (e.g. phenoxycarbonyloxy), an aliphatic thio, aromatic thio, or heterocyclic thio group (e.g. ethylthio, phenylthio, and tetrazolylthio), an imido group (e.g. succinimido and hydantoinyl), a nitrogen-containing heterocyclic group (e.g. 1-pyrazolyl and 1-benztriazolyl), and an aromatic azo group (e.g. phenylazo). Further, these split-off group may contain a photographically useful group.

In formulas [II] and [III], $R_3$ and $R_5$ each represent a halogen atom (specifically F, Cl, Br, I), an acyl group (acyl groups preferably having 2 to 40 carbon atoms; e.g., acetyl, benzoyl, hexadecanoyl), a sulfonyl group (aliphatic or aromatic sulfonyl groups preferably having 1 to 40 carbon atoms; e.g., methanesulfonyl, benzenesulfonyl, 4-dodecyloxybenzenesulfonyl), an alkoxycarbonyl group (alkoxy carbonyl groups preferably having 2 to 40 carbon atoms; e.g., methoxycarbonyl, hexyloxycarbonyl), an aryloxycarbonyl group (aryloxycarbonyl groups preferably having 7 to 40 carbon atoms; e.g., phenoxycarbonyl), a carbamoyl group (carbamoyl groups preferably having 1 to 40 carbon atoms; e.g., N-dodecyl carbamoyl, N,N-diphenyl carbamoyl), a sulfamoyl group (sulfamoyl groups preferably having 0 to 40 carbon atoms; e.g., N,N-dipropylsulfamoyl, N-phenylsulfamoyl), a sulfoxide group (sulfoxide groups preferably having 1 to 40 carbon atoms; e.g., methanesulfoxide, octanesulfoxide), a cyano group, a nitro group, or an alkyl group having at least one halogen atom at the $\alpha$-position thereof (such alkyl groups preferably having 1 to 40 carbon atoms; e.g., trifluoromethyl, 1,1-dichloroethyl).

$R_4$ and $R_6$ each represent a hydrogen atom, an alkyl group (alkyl groups preferably having 1 to 40 carbon atoms and the alkyl group may be a straight chain or branched alkyl group; e.g., methyl, t-butyl, hexyl, t-octyl, sec-dodecyl, sec-eicosyl), an aryl group (aryl groups preferably having 6 to 40 carbon atoms; e.g., phenyl, p-tolyl), an alkoxy group (alkoxy groups preferably having 1 to 40 carbon atoms; e.g., methoxy, hexyloxy, tetradecyloxy), an aryloxy group (aryloxy groups preferably having 6 to 40 carbon atoms; e.g., phenoxy, p-acetamidophenoxy), an alkylthio group (alkylthio groups preferably having 1 to 40 carbon atoms; e.g., butylthio, dodecylthio, octadecylthio), an arylthio group (arylthio groups preferably having 6 to 40 carbon atoms; e.g., phenylthio), or an amido group (amido groups preferably having 2 to 40 carbon atoms; e.g. acetamido, benzoylamido, hexadecanamido). Similarly to $R_1$, these groups may be further substituted with a substituent. The total sum of carbon atoms of $R_3$ and $R_4$ is at least 8, and the total sum of carbon atoms of $R_5$ and $R_6$ is also at least 8.

The compounds represented by formula [II] or [III] may be a bis form, a tris form, an oligomer, or a polymer.

In formula [C-I], $Y^{11}$ is preferably —NHCO—, $R_1$ is preferably an alkyl group or an aryl group, and most preferably $R_1$ is an alkyl group.

In formula [C-I], $R_2$ is preferably an alkyl group having 1 to 15 carbon atoms, more preferably 1 to 4 carbon atoms.

In formula [C-I], $Z^{11}$ is preferably a hydrogen atom, or a halogen atom, particularly preferably a halogen atom.

In formula [C-I], $X^{11}$ is preferably a halogen atom, or alternatively $X^{11}$ preferably forms a hetero ring with $R_2$.

In formulas [II] and [III], $R_3$ and $R_5$ each are preferably a halogen atom, an acyl group, a sulfonyl group, or a carbamoyl group, more preferably a halogen atom, or a sulfonyl group, most preferably a halogen atom.

In formulas [II] and [III], $R_4$ and $R_6$ each are preferably a hydrogen atom, an alkyl group, an alkylthio group, or an amido group, and most preferably an alkyl group.

$R_3$ and $R_4$ in formula [II], and $R_5$ and $R_6$ in formula [III], each are preferably on the relation of 2,5-substitution, respectively. It is preferable that at least one of $R_3$ and $R_4$, or at least one of $R_5$ and $R_6$ be a lipophilic (hydrophobic) group.

Specific compounds represented by formula [C-I], [II] or [III], which are within the present invention, are illustrated below. However, the present invention should not be limited to these compounds.
(C-1)
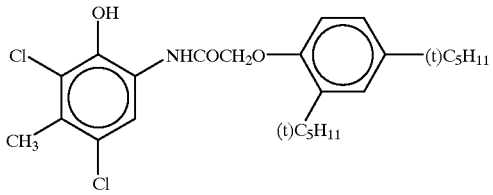
(C-2)
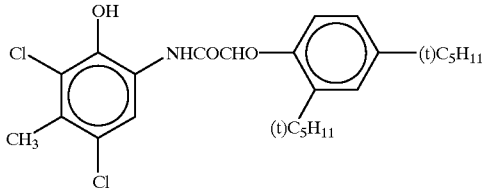
(C-3)
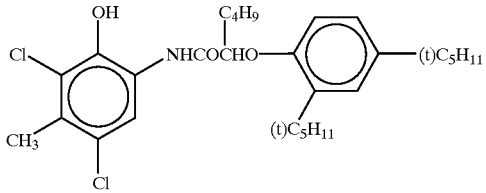
(C-4)
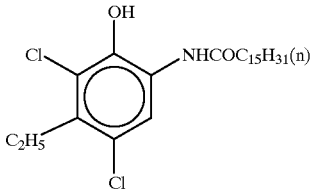
(C-5)
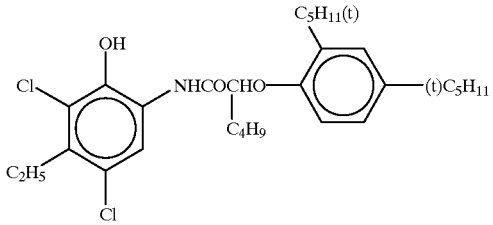
(C-6)
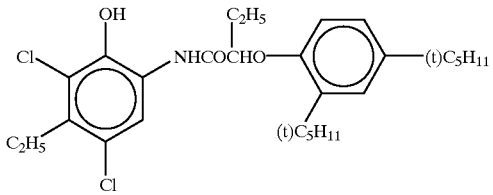
-continued
(C-7)
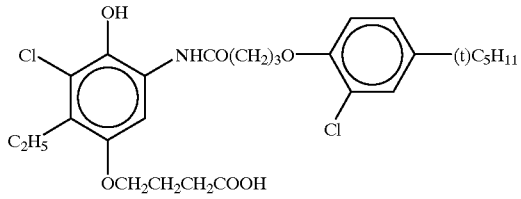
(C-8)
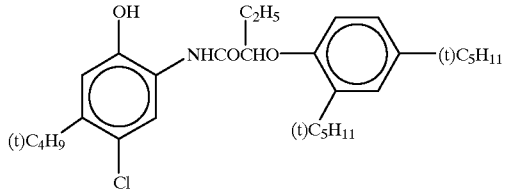
(C-9)
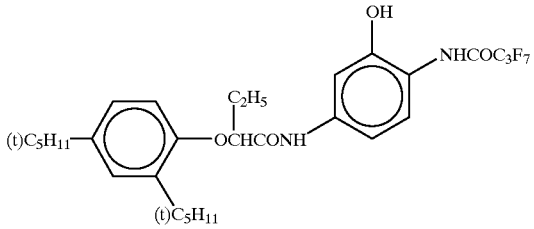
(C-10)
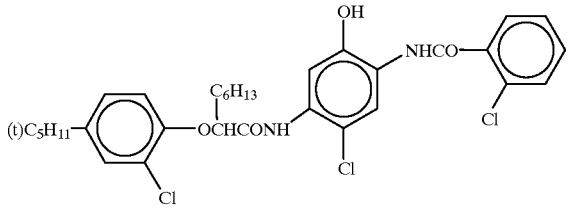
(C-11)
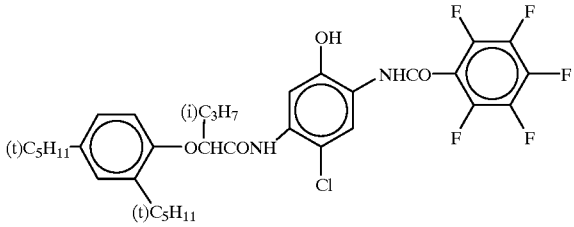
(C-12)
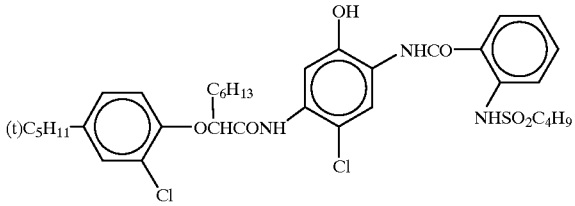

-continued
(C-13)
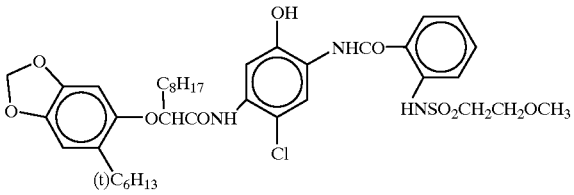
(C-14)
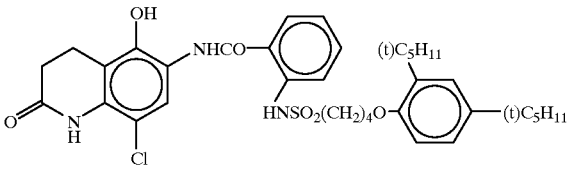
(C-15)
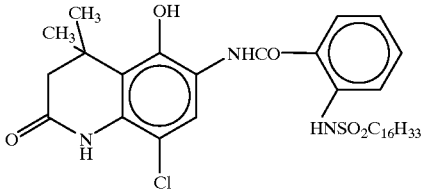
(C-16)
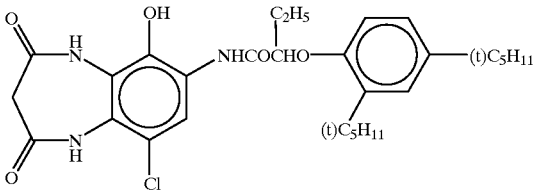
(C-17)
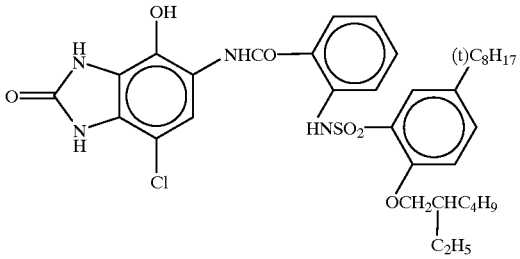
(C-18)
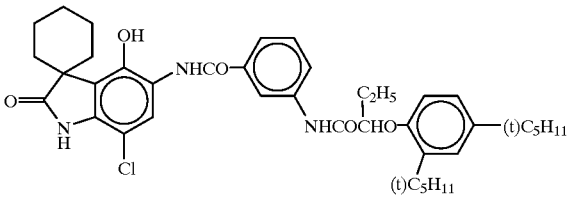
-continued
(C-19)
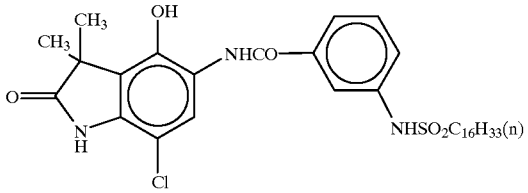
(C-20)
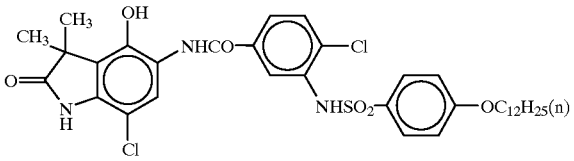
(C-21)
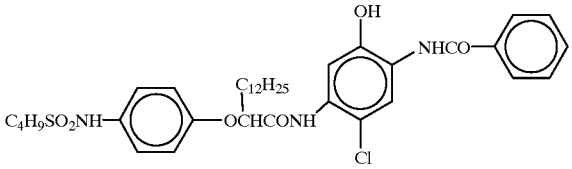
(C-22)
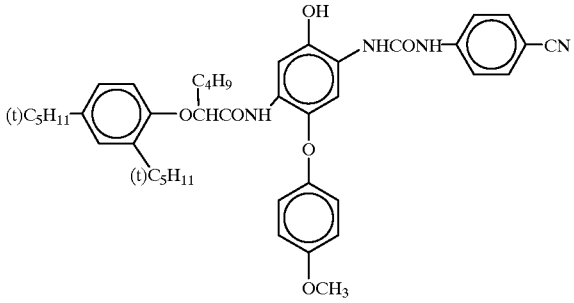
(C-23)
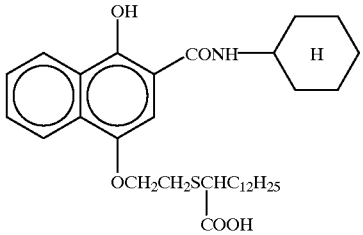
(C-24)
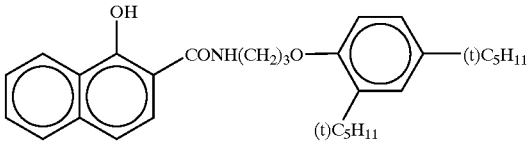
(C-25)
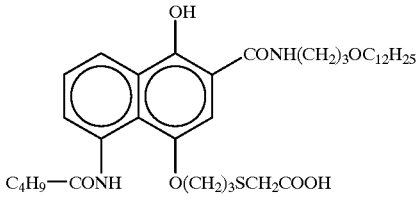

-continued
(C-26)
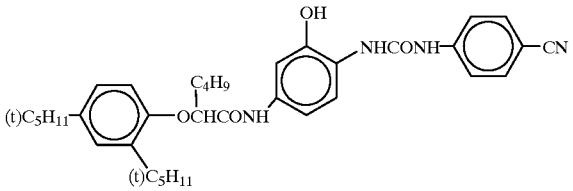
(II-1)
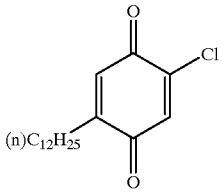
(II-2)
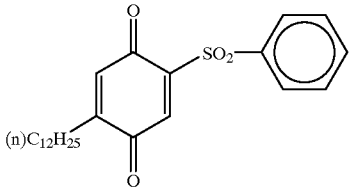
(II-3)
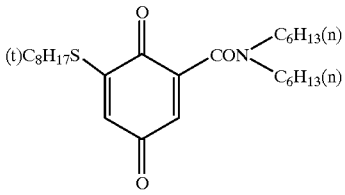
(II-4)
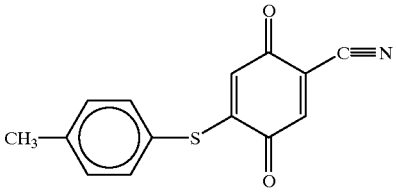
(II-5)
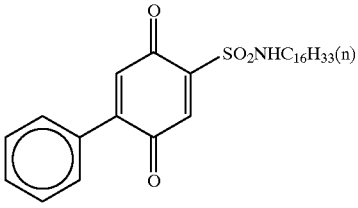
(II-6)
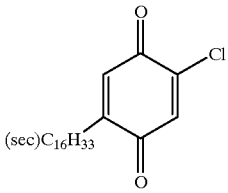
-continued
(II-7)
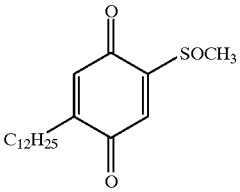
(II-8)
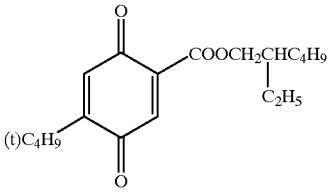
(II-9)
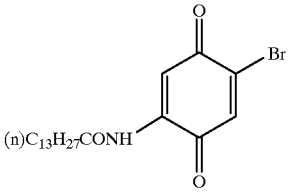
(II-10)
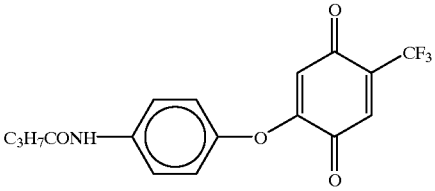
(II-11)
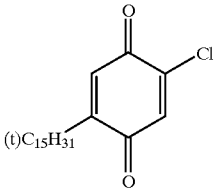
(II-12)
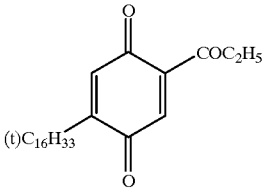
(II-13)
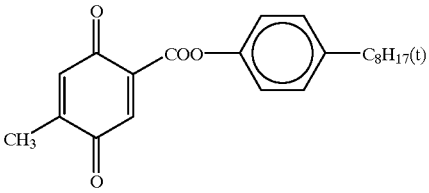

-continued
(II-14)
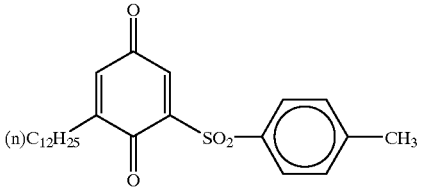
(II-15)
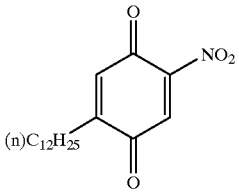
(III-1)
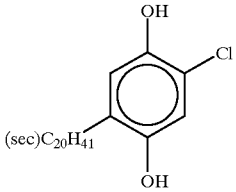
(III-2)
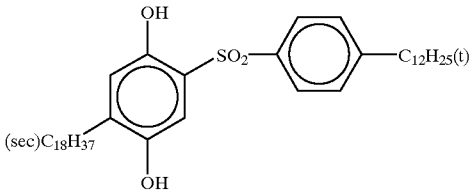
(III-3)
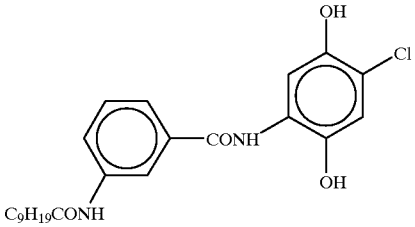
(III-4)
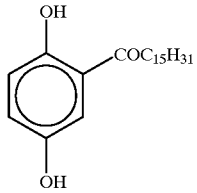
(III-5)
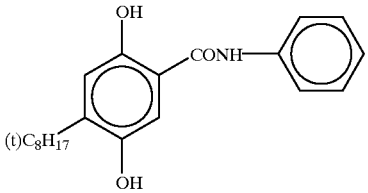
-continued
(III-6)
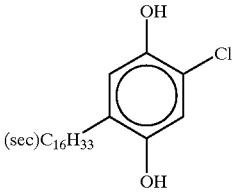
(III-7)
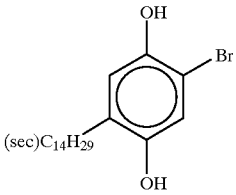
(III-8)
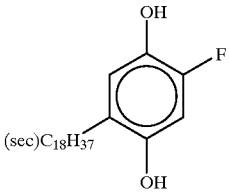
(III-9)
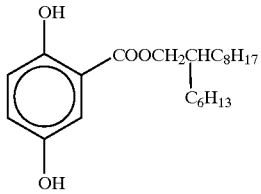
(III-10)
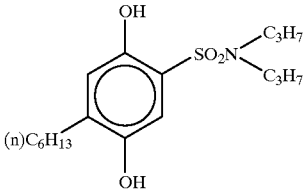
(III-11)
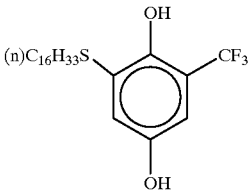
(III-12)
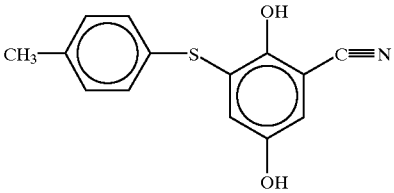

-continued (III-13)

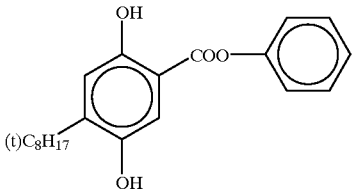

(III-14)

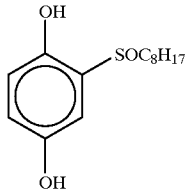

(III-15)

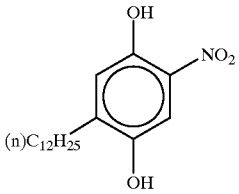

(III-16)

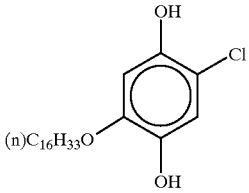

(III-17)

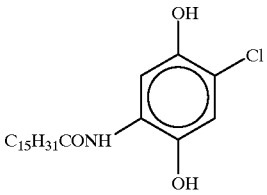

(III-18)

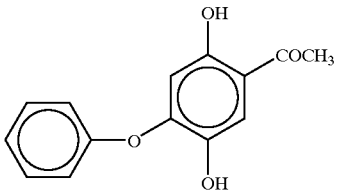

(III-19)

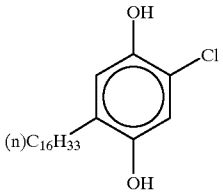

-continued (III-20)

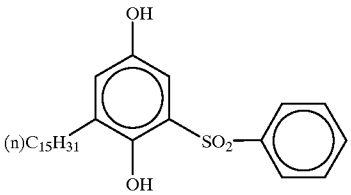

(III-21)

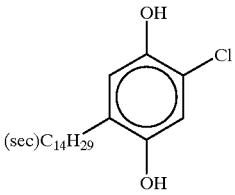

(III-22)

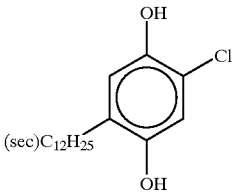

(III-23)

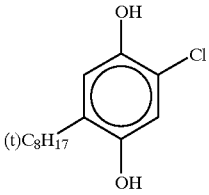

A detailed explanation relating to a method of synthesizing a cyan coupler, quinones and hydroquinones represented by formula [II] or [III], and a method of preparing an emulsified dispersion, all of which are used in the present invention, are described in, for example, JP-A-2-267548, and JP-A-3-144442.

Quinones of formula [II] and hydroquinones of formula [III], for use in the present invention, are used in an amount of generally 0.1 to 100 mol %, preferably 0.5 to 30 mol %, and most preferably 2 to 25 mol %, per mol of the cyan coupler.

Further, compounds represented by formula [II] or formula [III], for use in the present invention, can be synthesized according to publicly known methods. For example, they can be synthesized according to the methods described in JP-A-2-267548, JP-A-57-22237, and JP-A-56-109344.

Yellow couplers and magenta couplers that can be used in the present invention are not limited in particular. Therefore, usual couplers can be used. Examples of these couplers include those described in patents recited in the Table shown below.

Particularly, a yellow coupler for use in the third embodiment of the present invention is preferably acetoanilide type yellow couplers, and those having a 1-alkyl-cycloalkane ring, or an indoline ring, described in U.S. Pat. No. 5,338,651, are also preferable.

In the present invention, to introduce the cyan coupler and other photographically useful compounds into a silver halide light-sensitive material, a known dispersion method, such as a latex dispersion method and an oil-in-water dispersion method using a high-boiling organic solvent described later, can be used.

In the oil-in-water dispersion method, the cyan coupler and other photographically useful compounds can be dissolved in a high-boiling organic solvent, and they can be emulsified and dispersed together with a dispersant, such as a surfactant, into a hydrophilic colloid, preferably into an aqueous gelatin solution, to form fine particles by a known apparatus, such as an ultrasonic, a colloid mill, a homogenizer, a Manton-Gaulin, and a high-speed dissolver.

Further, in dissolving the coupler and photographically useful compound, an auxiliary solvent may be used. Herein, the term "an auxiliary solvent" means an organic solvent useful in emulsifying and dispersing, which can finally be removed substantially from the light-sensitive material after the drying step at the time of applying. Examples of the auxiliary organic solvent include acetates of a lower alcohol, such as ethyl acetate and butyl acetate; ethyl propionate, secondary butyl alcohol, methyl ethyl ketone, methyl isobutyl ketone, β-ethoxyethyl acetate, methyl cellosolve acetate, methyl carbitol acetate, methyl carbitol propionate, and cyclohexanone.

Further, if necessary, an organic solvent that completely admix with water, such as methyl alcohol, ethyl alcohol, acetone, tetrahydrofuran, and dimethylformamide, can be additionally used as a part of the auxiliary solvent. These organic solvents can be used in combination with two or more.

For the purpose of, for example, improving stability with time at storage in the state of an emulsified dispersion, and improving stability with time and inhibiting the change of photographic property of the end-composition for coating (applying) that is mixed with an emulsion, if necessary, from the thus-prepared emulsified dispersion, the auxiliary solvent may be removed in its entirety or part of it, for example, by distillation under reduced pressure, noodle washing, or ultrafiltration.

Preferably, the average particle size of the lipophilic fine particle dispersion obtained in this way is 0.04 to 0.50 μm, more preferably 0.05 to 0.30 μm, and most preferably 0.08 to 0.20 μm. The average particle size can be measured by using Coulter Submicron Particle Analyzer Model N4 (tradename, manufactured by Coulter Electronics Co.) or the like.

The average grain diameter of a dispersion of lipophilic fine particles that contains a cyan coupler preferably represented by formula [C-I] or [I] in the cyan coupler-containing layer for use in the present invention, is preferably 0.05 μm to 0.40 μm, more preferably 0.10 μm to 0.35 μm, and most preferably 0.15 μm to 0.30 μm. If the average grain diameter is too large, color generation efficiency reduces and therefore it is necessary to increase a coating amount of the cyan coupler and a light-sensitive layer containing the same, in accordance with the reduction in color generation. Consequently, sometimes such a too large average grain diameter would not enable to attain a rapid color development by a rapid processing. On the other hand, if the average grain diameter is too small, sometimes it would be difficult to maintain the image quality at such a level that the blix discoloration would not become a problem in the practical use.

In the present invention, the ratio [Ag/Cp] of a coating amount (mol/m$^2$) of the silver halide emulsion in terms of silver to a coating amount (mol/m$^2$) of the cyan coupler, both of which are incorporated in the cyan coupler-containing layer is generally from 1.0 to 6.0, preferably 1.5 to 5.0, and most preferably 1.8 to 4.0. If the [Ag/Cp] value is to small, sometimes a sufficient cyan maximum density would not be obtained. Further, if the [Ag/Cp] value is too large, sometimes it would be difficult to maintain the image quality at such a level that the blix discoloration would not become a problem in the practical use.

A smaller amount to be used of a high boiling point organic solvent and other photographically useful compounds is preferred, from the viewpoint of enforcing a rapid washing. The weight ratio of a total of these compounds to a coupler is preferably in the range of 0.05 to 8.0, more preferably in the range of 0.1 to 3.0, and most preferably in the range of 0.1 to 2.5. Further, the employment of a high activity coupler also enables to use absolutely no high boiling point organic solvent.

Examples of high boiling point organic solvents which can be preferably used in the present invention, are described in, for example, U.S. Pat. No. 2,322,027 and JP-A-10-221825. Specific examples of the high boiling point organic solvents which are preferred from the viewpoints of coloring properties, color reproduction, and image fastness, are shown below.

1.

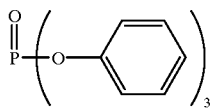

2.

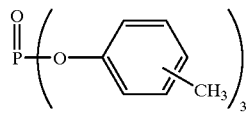

3.

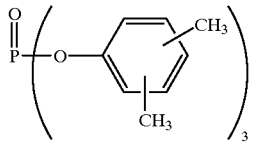

4.

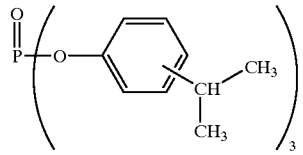

5.

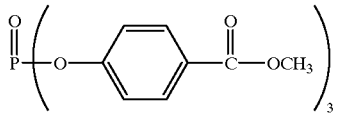

6.

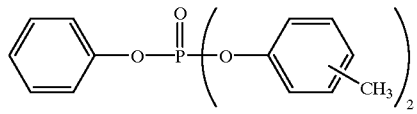

-continued
7.
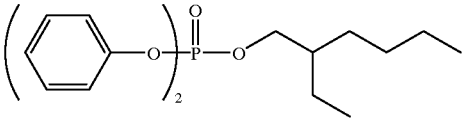
8.
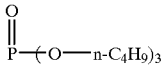
9.
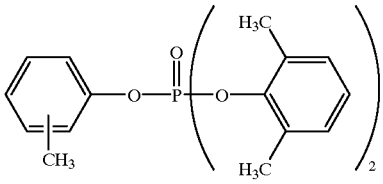
10.
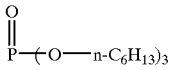
11.
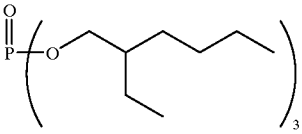
12.
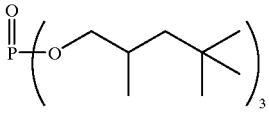
13.
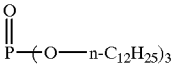
14.
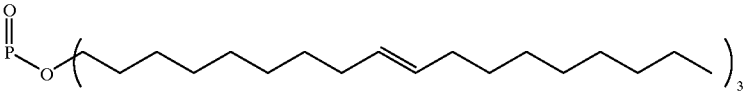
15.
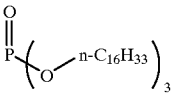
16.
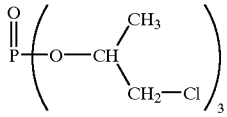
17.
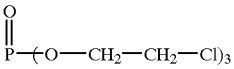
18.
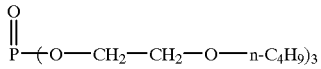
19.
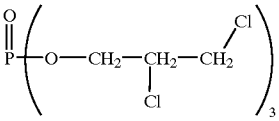
20.
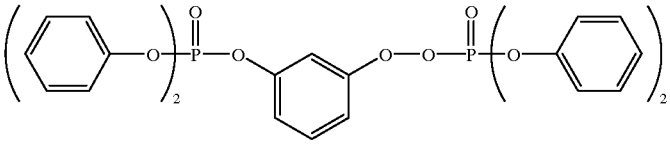
21.
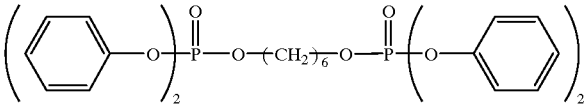
22.
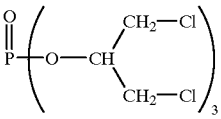
23.
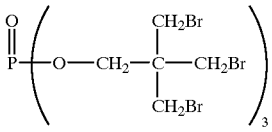

-continued
24.
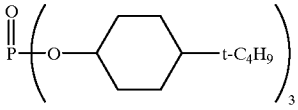
25.
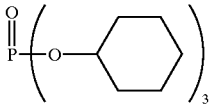
26.
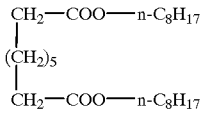
27.
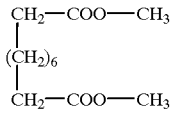
28.
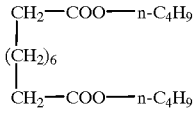
29.
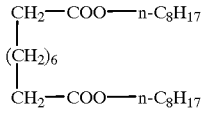
30.
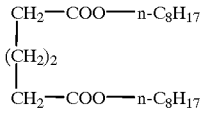
31.
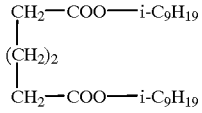
32.
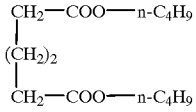
33.
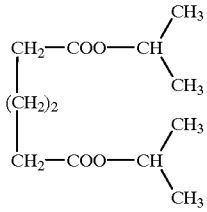
34.
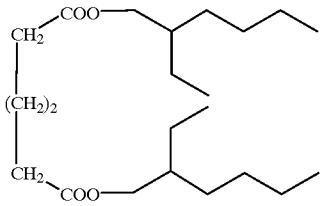
35.
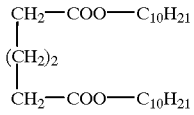
36.
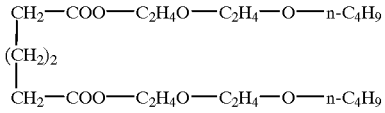
37.
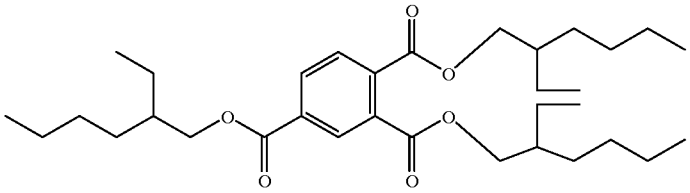
38.
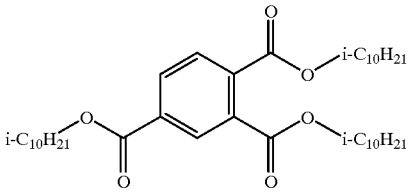
39.
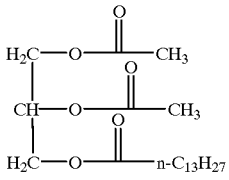

-continued
40.
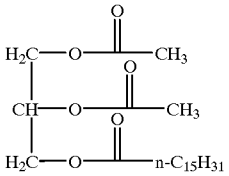
41.
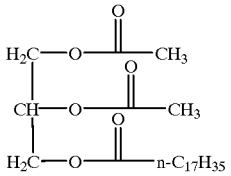
42.
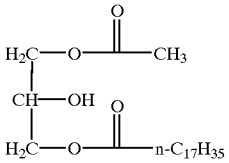
43.
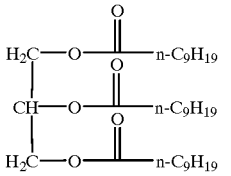
44.
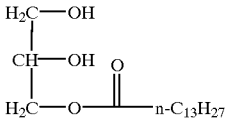
45.
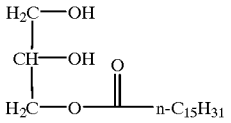
46.
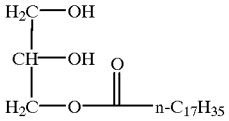
47.
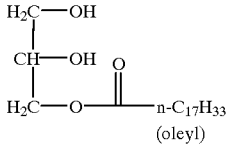
48.
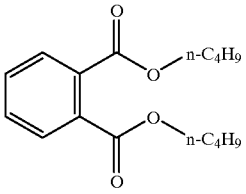
49.
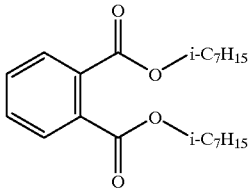
50.
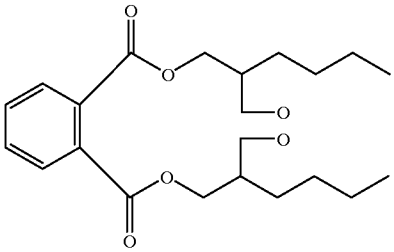
51.
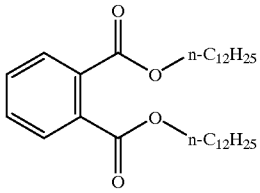
52.
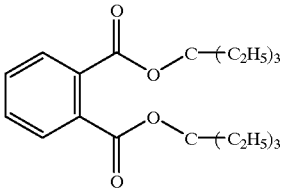
53.
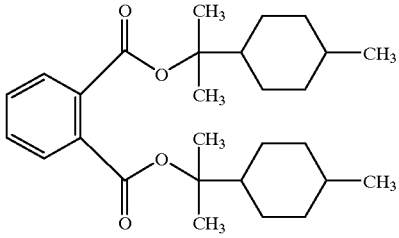

-continued
54.
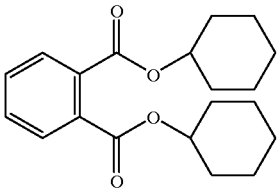
55.
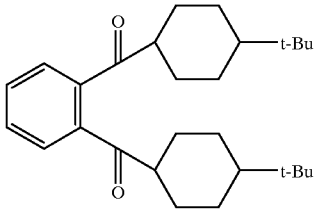
56.
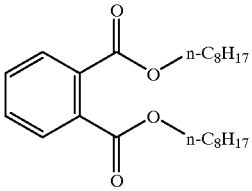
57.
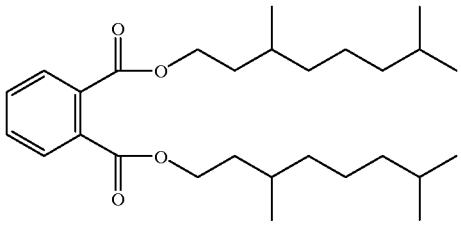
58.
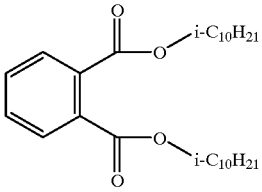
59.
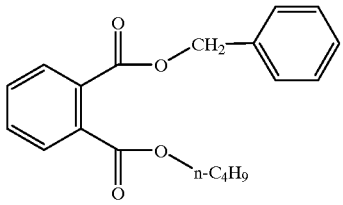
60.
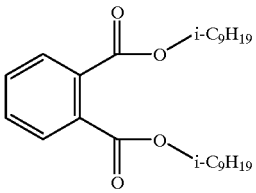
61.
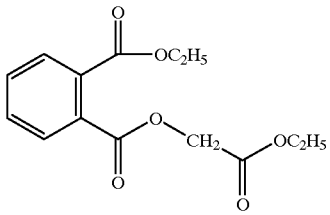
62.
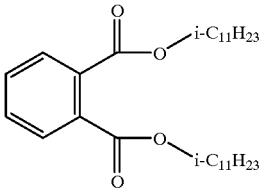
63.
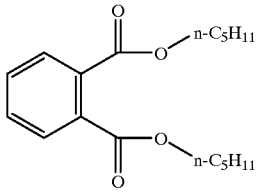
64.
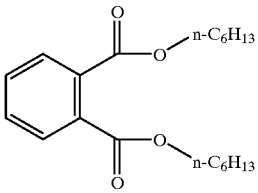
65.
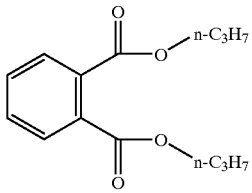

-continued
66.
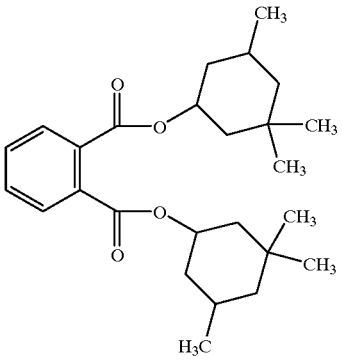
67.
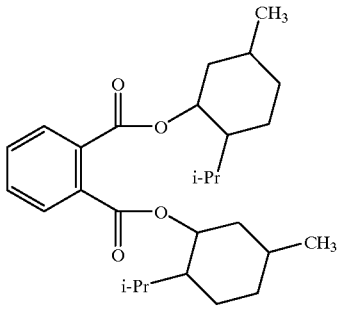
68.
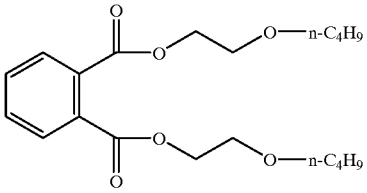
69.
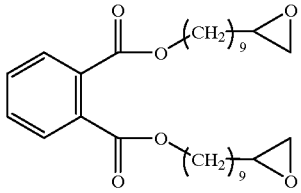
70.
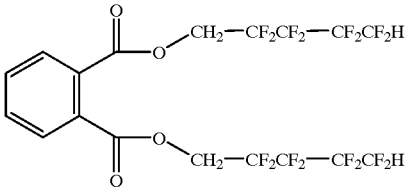
71.
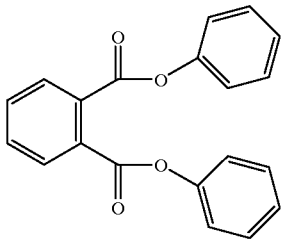
72.
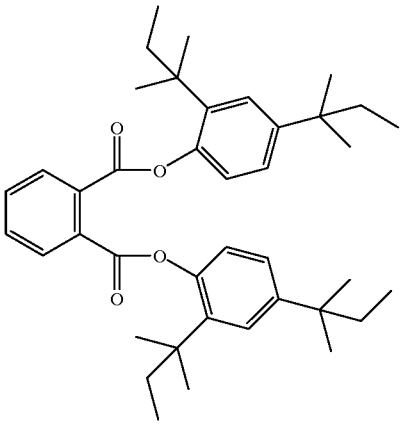
73.
$n\text{-}C_{17}H_{33}—COO—n\text{-}C_4H_9$
74.
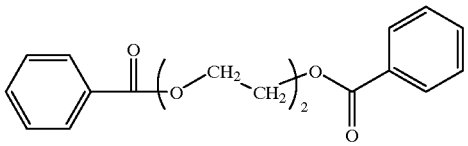
75.
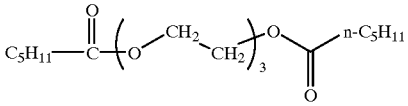

-continued
76.
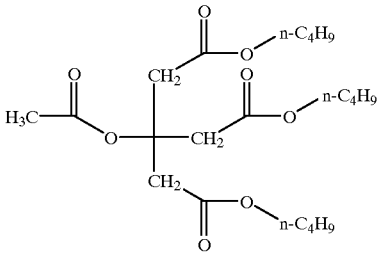
77.
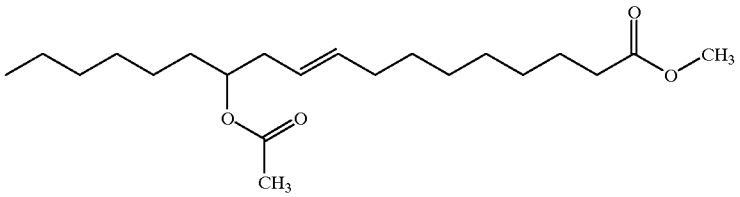
78.
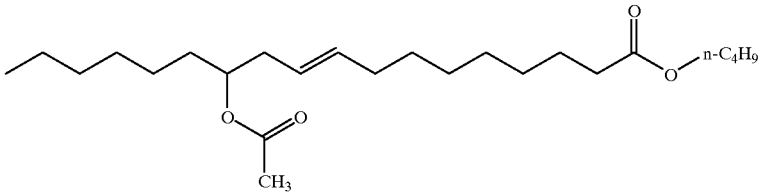
79.
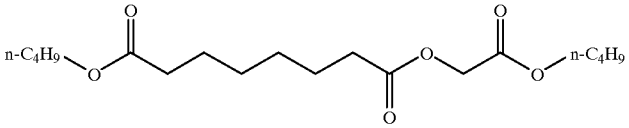
80.
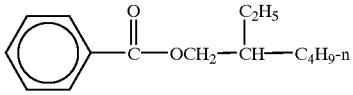
81.
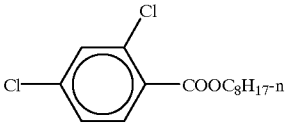
82.
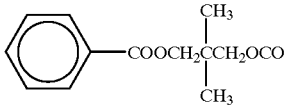
83.
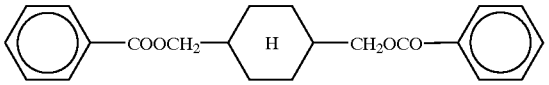
84.
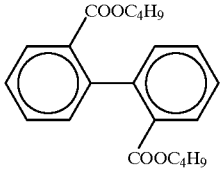
85.
$n\text{-}C_{15}H_{31}COOC_{16}H_{33}\text{-}n$
86.
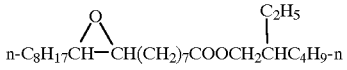
87.
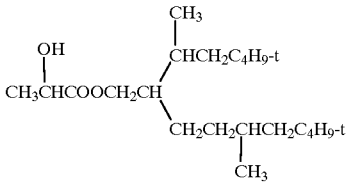

-continued
88.
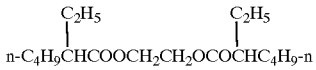
89.
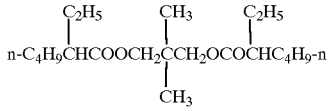
90.
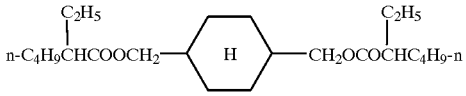
91.
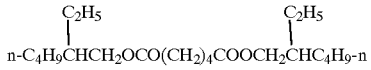
92.
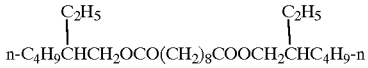
93.
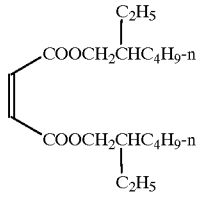
94.
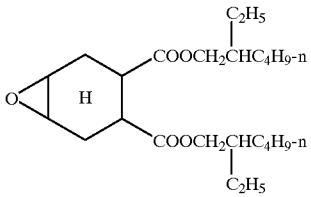
95.
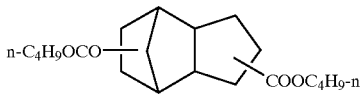
96.
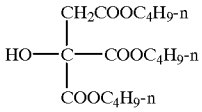
97.
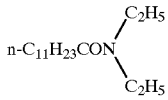
98.
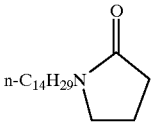
99.
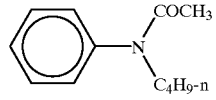
100.
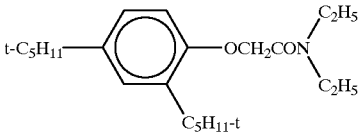
101.
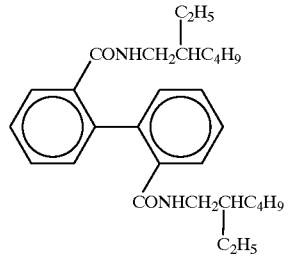
102.
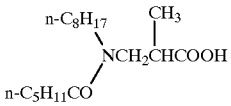
103.
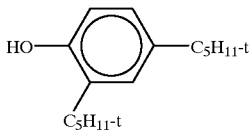
104.
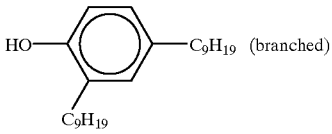
105.
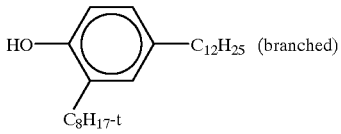

-continued
106.
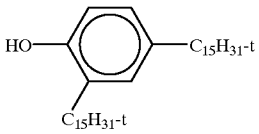
107.
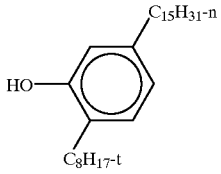
108.
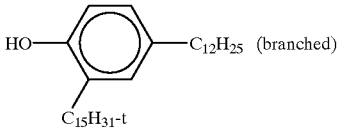
109.
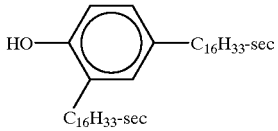
110.
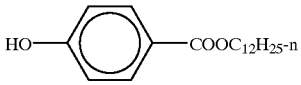
111.
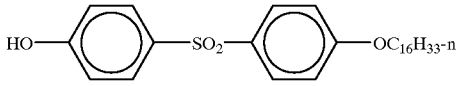
112.
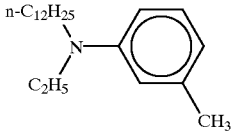
113.
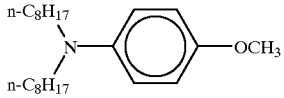
114.
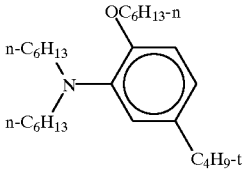
115.
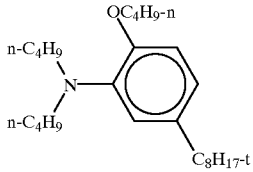
116.
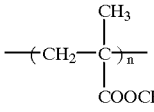
(average molecular weight 20,000)
117.
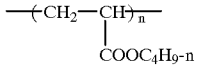
(average molecular weight 50,000)
118.
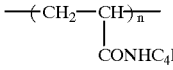
(average molecular weight 60,000)
119.
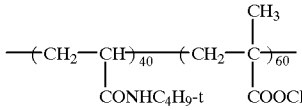
(average molecular weight 40,000)
120.
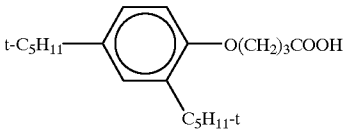
121.
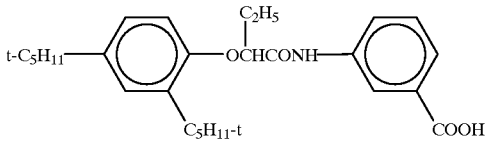
122.
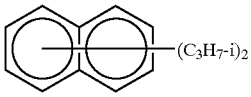
123.
$C_nH_{2n+2}$
(A mixture of normal paraffin n = 14, 15)
124.
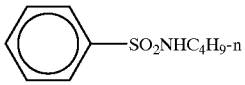
125.
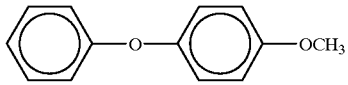
126.
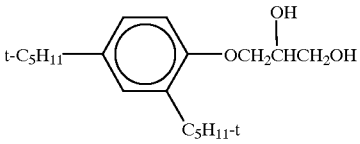
127.
Chlorinated paraffin
(average composition $C_{14}H_{24}Cl_6$)

-continued

128.

Chlorinated paraffin
(average composition $C_{12}H_{18}Cl_8$)

129.

Poly(chlorotrifluoroethylene)
(average molecular weight 900)

130.

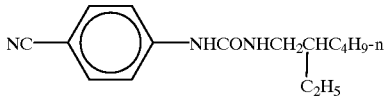

131.

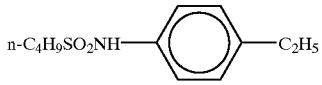

132.

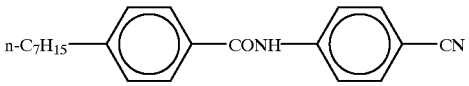

133.

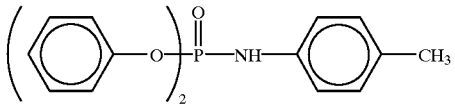

The average grain diameter of an emulsion dispersion of lipophilic fine particles containing a cyan coupler, quinones and hydroquinones, and further a high boiling point organic solvent exhibiting a viscosity of 200 cp or more, for use in the third embodiment of the present invention, is preferably 0.10 $\mu$m to 0.35 $\mu$m, more preferably 0.15 $\mu$m to 0.30 $\mu$m. If the average grain diameter is too small, the blix discoloration may become worse. On the other hand, if the average grain diameter is too large, a coloring density may reduce. Further, the quinones and the hydroquinones for use in the present invention are preferably used in combination with other reducing agents. Examples of the reducing agent include compounds (X-1) to (X-37) described in JP-A-3-14442. These reducing agents are preferably used in an amount of 0 to 10 mol %, based on the cyan coupler.

Next, the high boiling point organic solvent exhibiting the viscosity of 200 cp or more (at 25° C.), which can be used in the third embodiment of the present invention, are explained.

Preferably, the high boiling point organic solvents for use in the third embodiment of the present invention are selected from the compounds represented by formula [$II_s$], [$III_s$], [$IV_s$], [$V_s$], [$VI_s$], or [$VII_s$]:

formula (II s)

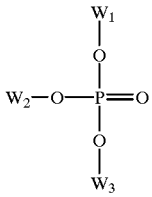

formula (III s)

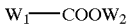

formula (IV s)

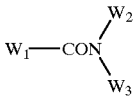

formula [$V_s$]

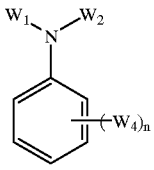

formula [$VI_s$]

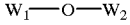

-continued formula [$VII_s$]

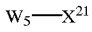

wherein $W_1$, $W_2$ and $W_3$ each represent a substituted or unsubstituted, alkyl, cycloalkyl, alkenyl, aryl, or heterocyclic group; $W_4$ represent $W_1$, O—$W_1$, or S—$W_1$; n is an integer of 0 to 5, with the proviso that when n is 2 or greater, $W_4$'s are the same, or different from each other; $W_1$ and $W_2$ in formula [$VI_s$] may connect together to form a condensed ring; $W_5$ represents a substituted or unsubstituted, alkyl, cycloalkyl, or aryl group; the total number of carbon atoms of $W_5$ are at least 12; and $X^{21}$ represents a halogen atom.

In the case where the above-described groups of $W_1$, $W_2$, $W_3$ and $W_5$ have a substituent, the said substituent may be a group having one or at least two condensation groups selected from

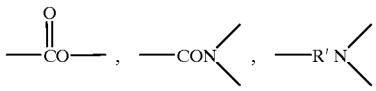

(R' represents a 2- to 6-valence group which is formed by removing a hydrogen atom from a phenyl group) and —O—.

The alkyl group represented by $W_1$, $W_2$, $W_3$, $W_4$ and $W_5$ may be a straight-chain, or branched alkyl group. Examples of the alkyl group include methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, and eicosyl groups.

The substituents suitable for these alkyl groups are explained. Exemplary substituents are a halogen atom, a cycloalkyl group, an aryl group, and an ester group. Further, specific examples of these substituted alkyl groups include those substituted with a halogen (F, Cl, Br) (e.g., —$C_2HF_4$, —$C_3H_3F_4$, —$C_9H_3F_{16}$, —$C_2H_4Cl$, —$C_3H_6Cl$, —$C_3H_5Cl_2$, —$C_3H_5ClBr$, —$C_3H_5Br_2$), those substituted with a cycloalkyl group (e.g.,

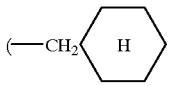

), those substituted with an aryl group (e.g.,

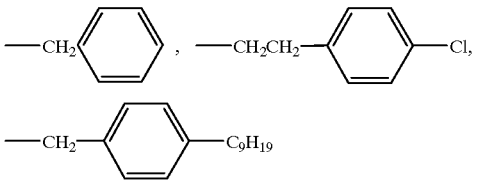

), a substituent which gives a dibasic acid ester (e.g.,

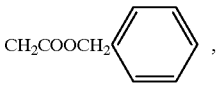

$—CH_2CH_2COOC_{12}H_{25}$, $—(CH_2)_4COOC_{10}H_{21}$, $—(CH_2)_4COOCH_2(CF_2CF_2)_2H$, $—(CH_2)_7COOC_4H_9$, $—(CH_2)_8COOC_{12}H_{35}$

), a substituent which gives lactates and the like (e.g.

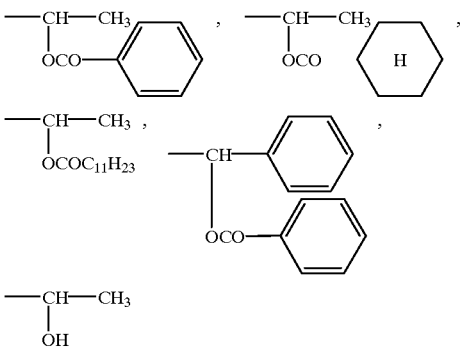

), a substituent which gives citric acid esters and the like (e.g.,

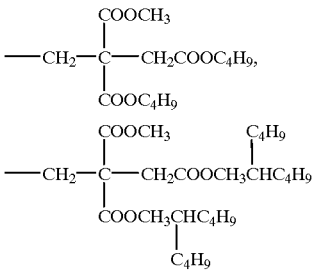

), a substituent which gives inalic acid esters and the like (e.g., $—CH_2CH(OH)COOC_6H_{12}$, $—CH_2CH(OH)COOC_{12}H$ ), a substituent which gives tartaric acid esters and the like (e.g., $—CH(OH)CH(OH)COOC_4H_{17}$, $—CH(OH)CH(OH)COOC_{12}H_{37}$,

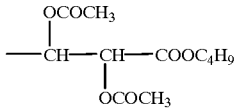

), and

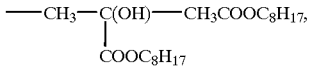

and the like.

Further, in formula [$VI_s$], $W_1$ and $W_2$ may be combined to form an oxirane, oxorane, or oxan ring, which may has a condensed ring.

Examples of the cycloalkyl group represented by $W_1$, $W_2$, $W_3$, $W_4$ or $W_5$ include

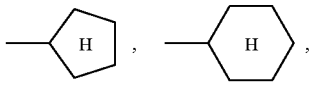

and the like, and examples of the substituted cyclohexyl group include

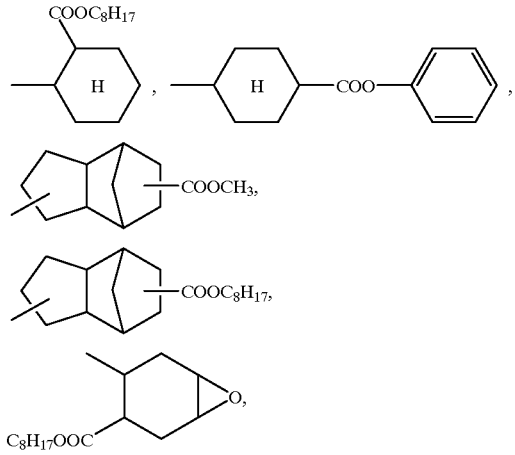

and the like.

Examples of the aryl group represented by $W_1$, $W_2$, $W_3$, $W_4$ or $W_5$ include

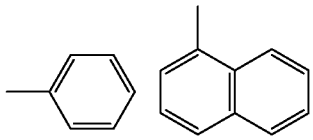

and examples of the substituted aryl group include

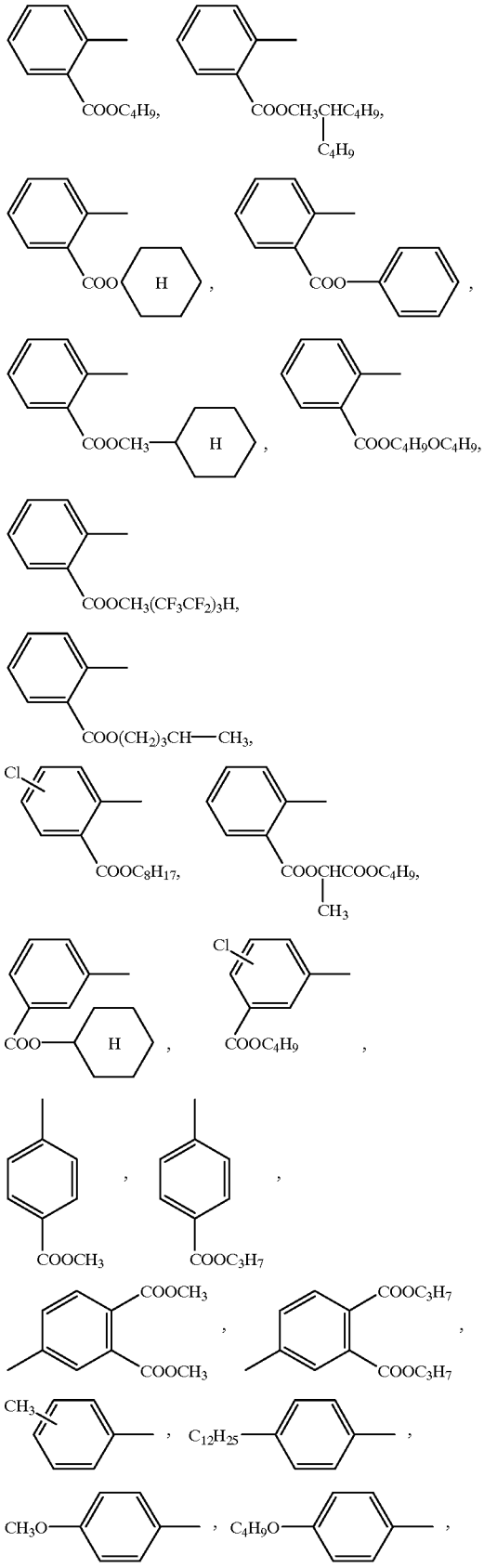

-continued

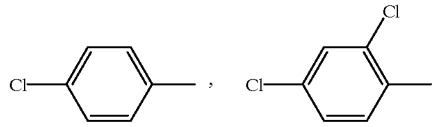

and the like.

Examples of the alkenyl group include $—C_4H_7$, $—C_5H_9$, $—C_6H_{11}$, $—C_7H_{13}$, $—C_8H_{15}$, $—C_{10}H_{19}$, $—C_{12}H_{23}$, and $—C_{18}H_{35}$.

Examples of the substituted alkenyl group include alkenyl groups substituted with a halogen atom (F, Cl, Br), $—OC_8H_{17}$,

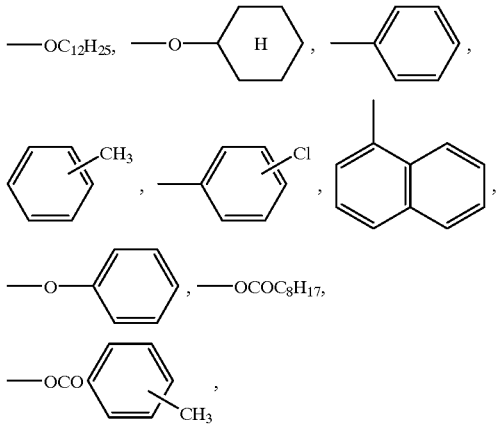

or the like, specifically

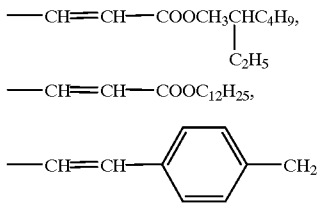

and the like.

A boiling point of the high boiling point organic solvent for use in the third embodiment of the present invention is preferably at least 140° C., more preferably at least 160° C. The $W_1$ to $W_5$ in this compound each are preferably an alkyl group having the total number of carbon atoms of 8 or more.

Generally, the term "an organic solvent" indicates that the substance is liquid, whereas, in the present invention, the term "an organic solvent exhibiting the viscosity of 200 cp or more measured at 25° C." means that such an organic solvent includes a solid material, and preferably exhibits at least 500 cp, more preferably at least 700 cp, and furthermore preferably they are a solid and are selected from compounds which exhibit the melting point of 25° C. or more and are represented by any one of formulae [IIs] to [VIIs]. Of these compounds, preferred are those represented by formula [IIs] or [IIIs]. Dialkyl (secondary or tertiary alkyl) or dicycloalkyl ester of phosphoric acid or phthalic acid are especially preferred. Among these esters, most preferred is dicycloalkyl ester of phthalic acid. The viscosity can be measured by means of a corn plate type rotational viscometer (VISCOMISEMD, tradename, manufactured by TOKYO KEIKI K.K.).

The amount of the above-described high boiling point organic solvent to be used may be properly changed in accordance with both the kind and amount of the cyan coupler to be used in the third embodiment of the present invention, but it is preferable that the weight ratio of the high boiling point organic solvent to the cyan coupler be in the range of 0.05 to 20.

The high boiling point organic solvent for use in the present invention may be used singly or in a mixture of plural solvents, or in a combination with a previously known another high boiling point organic solvent, as long as it can attain the object of the invention. Examples of these previously known high boiling point organic solvents include phosphoric acid ester-series solvents such as tricresyl phosphate, tri-2-ethylhexyl phosphate, 7-methyl octyl phosphate, and tricyclohexyl phosphate, and phenol-series solvents such as 2,5-di-tert-amylphenol, and 2,5-di-sec-amylphenol.

Specific examples of the high viscosity high boiling point organic solvent for use in the third embodiment of the present invention are illustrated below. However, the present invention is not limited to them.

| No.*1 | Formula | Remarks |
|---|---|---|
| S-1 | 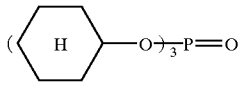 | Solid (mp*2 60° C.) |
| S-2 | 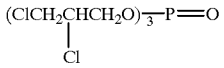 | Solid (mp 26.8° C.) |
| S-3 | 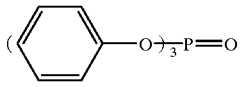 | Solid (mp 48.5° C.) |
| S-4 | 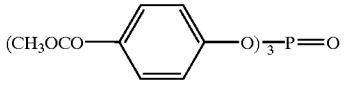 | Solid (mp 101°~ 103° C.) |
| S-5 | 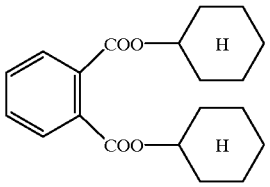 | Solid (mp 58°~ 65° C.) |
| S-6 | 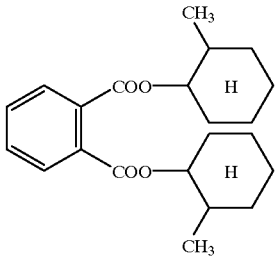 | Solid |
| S-7 | 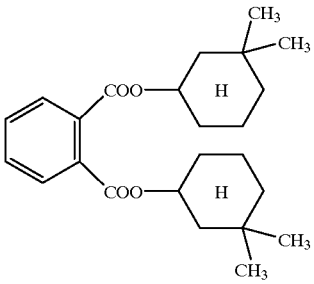 | Solid |

-continued
| No.*1 | Formula | Remarks |
|---|---|---|
| S-8 | 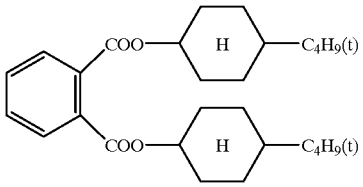 | Solid |
| S-9 | 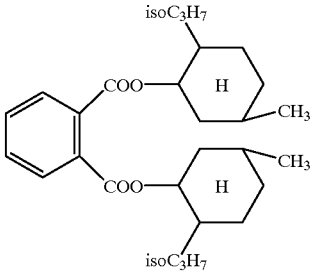 | Solid (mp 129°~130 ° C.) |
| S-10 | 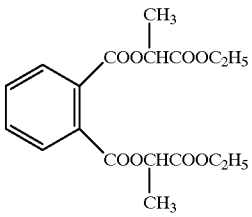 | Solid (mp 50°~53° C.) |
| S-11 | 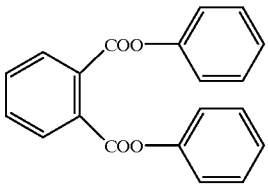 | Solid (mp 69° C.) |
| S-12 | 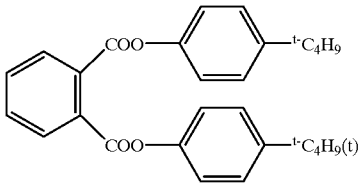 | Solid (mp 142° C.) |
| S-13 | 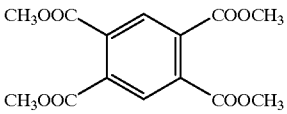 | Solid (mp 144° C.) |
| S-14 | 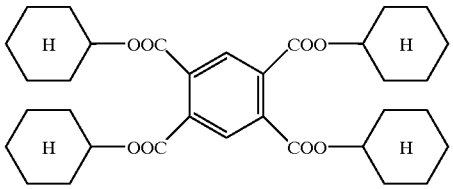 | Solid (mp 148° C.) |

-continued
| No.*1 | Formula | Remarks |
|---|---|---|
| S-15 | 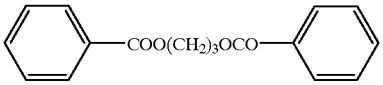 | Solid (mp 47° C.) |
| S-16 | 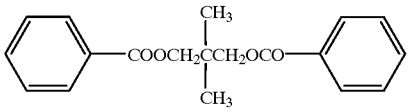 | Solid (mp 49° C.) |
| S-17 | 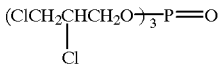 | 1500 cp |
| S-18 | 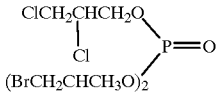 | 4260 cp |
| S-19 | 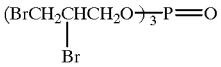 | 6810 cp |
| S-20 | 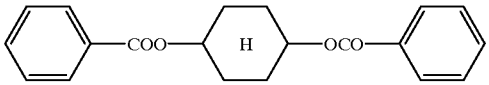 | Solid (mp 113° C.) |
| S-21 | 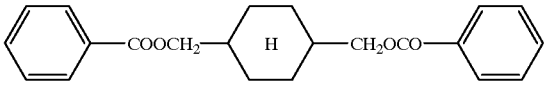 | Solid (mp 124° C.) |
| S-22 | 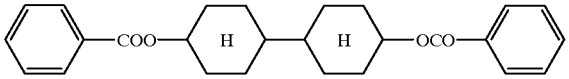 | Solid (mp 194° C.) |
| S-23 | 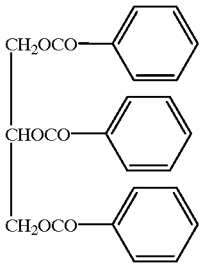 | Solid (mp 71° C.) |
| S-24 | 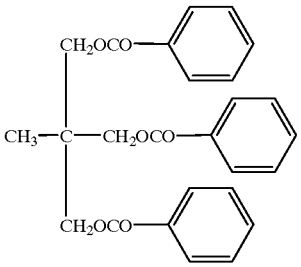 | Solid (mp 81° C.) |

-continued
| No.*1 | Formula | Remarks |
|---|---|---|
| S-25 | 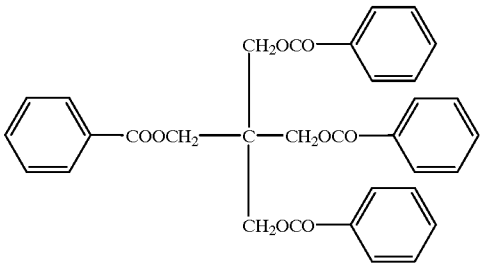 | Solid (mp 99° C.) |
| S-26 | 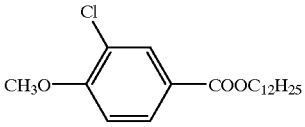 | Solid (mp 43° C.) |
| S-27 | $C_{15}H_{31}COOC_{18}H_{37}$ | Solid (mp 58° C.) |
| S-28 | n-$C_{17}H_{35}COOCH_3$ | Solid (mp 38° C.) |
| S-29 | $C_{17}H_{35}COOC_{16}H_{33}$ | Solid (mp 58° C.) |
| S-30 | $CH_2OCOC_{11}H_{23}$-n<br>\|<br>$CHOCOC_{11}H_{23}$-n<br>\|<br>$CH_2OCOC_{11}H_{23}$-n | Solid (mp 47° C.) |
| S-31 | 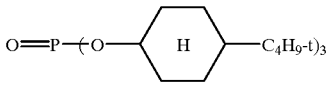 | Solid |
| S-32 | $O{=}P{-}(OC_{14}H_{29})_3$ | Solid |
| S-33 | $O{=}P{-}(OC_{16}H_{33})_3$ | Solid |
| S-34 | 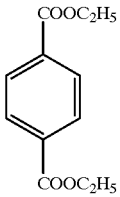 | Solid |
| S-35 | 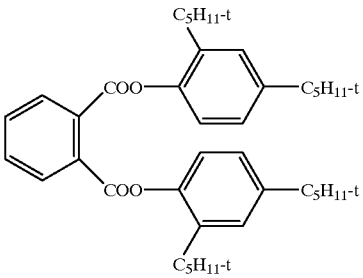 | Solid |

-continued
| No.*1 | Formula | Remarks |
|---|---|---|
| S-36 | 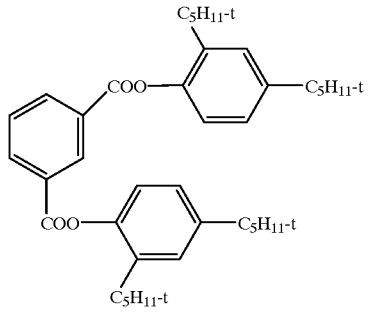 | Solid |
| S-37 | 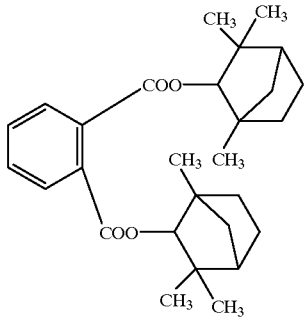 | Solid |
| S-38 | 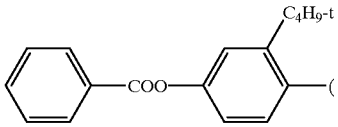 | Solid |
| S-39 | 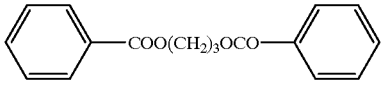 | Solid |
| S-40 | 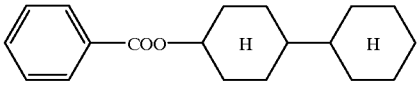 | Solid |
| S-41 | 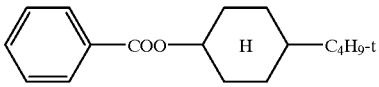 | Solid |
| S-42 | 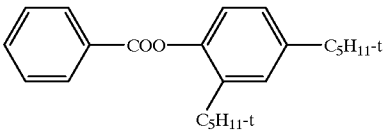 | Solid |
| S-43 | 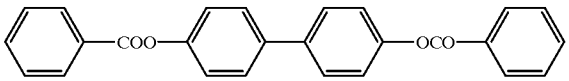 | Solid |
| S-44 | 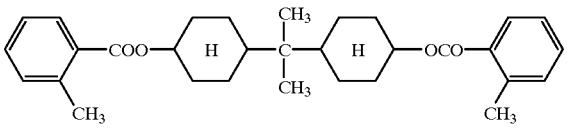 | Solid |

-continued
| No.*1 | Formula | Remarks |
|---|---|---|
| S-45 | 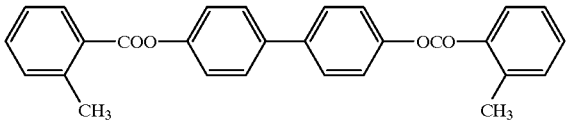 | Solid |
| S-46 | 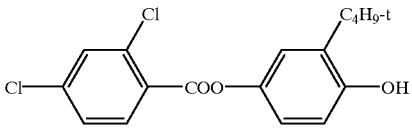 | Solid |
| S-47 | 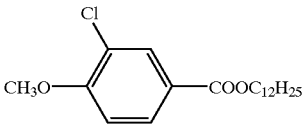 | Solid |
| S-48 | $C_{15}H_{31}COOC_{16}H_{33}$ | Solid |
| S-49 | $CH_2OCOC_{17}H_{35}$<br>\|<br>$CHOCOC_{17}H_{35}$<br>\|<br>$CH_2OCO_{17}H_{35}$ | Solid |
| S-50 | $C_8H_{17}CH{=}CH(CH_2)_7CONH_2$ | Solid |
| S-51 | 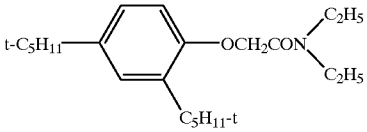 | Solid |
| S-52 | 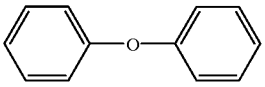 | Solid |
| S-53 | 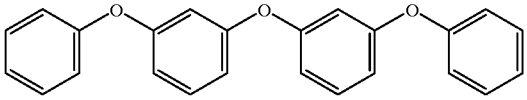 | Solid |
| S-54 | 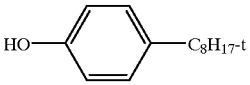 | Solid |
| S-55 | 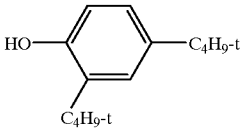 | Solid |
| S-56 | $C_{24}H_{29}Cl_{31}$ (chlorinated paraffin) | Solid |
| S-57 | 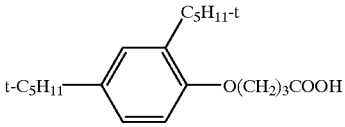 | Solid |

-continued

| No.*1 | Formula | Remarks |
|---|---|---|
| S-58 | 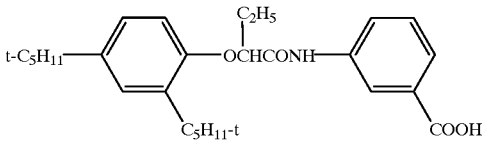 | Solid |
| S-59 | 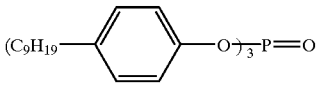 | 15,600 cp |
| S-60 | 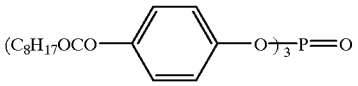 | 20,800 cp |
| S-61 | 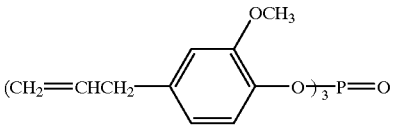 | 21,600 cp |
| S-62 | 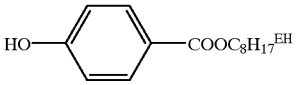 | 14,300 cp |
| S-63 | 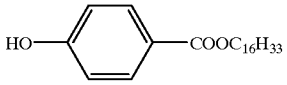 | Solid |

Note:
*1Number of compounds
*2mp = melting point

Among the compounds represented by formula [$III_s$], other preferable high-boiling organic solvents are those represented by formula [$III_s$-1] or [$III_s$-2].

[$III_s$-1]

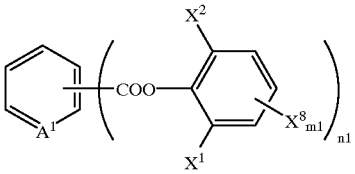

In formula, $A^1$ represents CH or N; $X^1$, $X^2$ and $X^3$ each independently represent —H, halogen, —R, —CH═NOR, —COR, —$SO_2$R, —$Y^{21}$R, —$Y^{21}$COR, —CO$Y^{21}$R, —$Y^{21}SO_2$R, or —$SO_2Y^{21}$R; $Y^{21}$ represents O, S, or $NR^{11}$; $R^{11}$ represents H or R, or two X groups may be combined to form a carbocyclic ring, or a heterocyclic ring; R represents a substituted or unsubstituted alkyl group having 1 to 20 carbon atoms (e.g., methyl, ethyl, isopropyl, s-butyl, t-butyl, t-pentyl, 2-ethylhexyl, or octadecyl), a substituted or unsubstituted aryl group having 6 to 20 carbon atoms (e.g., phenyl, m-tolyl, p-tolyl, p-hydroxyphenyl, or α-naphthyl), or a substituted or unsubstituted heterocyclic group having 2 to 20 carbon atoms (e.g., pyrazolyl, benzoxazolyl, benzothiazolyl, benzotriazol, or phenyltetrazolyl); n1 represents 2, 3, or 4; each of m1's represents 1, 2, or 3, with the proviso that at least one pair of $X^1$ and $X^2$ each bonding to the same benzene ring must contain at least two non-hydrogen atoms.

In the present invention, it is more preferable that n1 is 2 or 4; m1 is 1; A is CH; $X^1$ represents an alkyl group having 1 to 6 carbon atoms, a heterocyclic group, or —$COR^{21}$ ($R^{21}$ represents a phenyl group, or $COOR^{22}$, wherein $R^{22}$ represents an alkyl group having 1 to 6 carbon atoms); $X^2$ represents H or an alkyl group having 1 to 6 carbon atoms; $X^3$ represents H, a methoxy group, or an alkyl group having 2 to 6 carbon atoms.

Further, it is particularly preferable that both $X^1$ and $X^2$ be a bulky (ballasting) group bulky in three dimensions.

Specific examples of the compounds represented by formula [IIIs-1] for use in the third embodiment of the present invention are shown below, but the present invention is not limited to these.

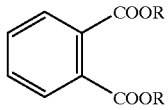

In the above formula, R is as follows:
(S-64)
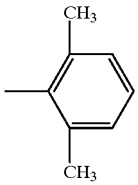
(S-65)
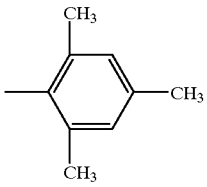
(S-66)
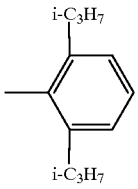
(S-67)
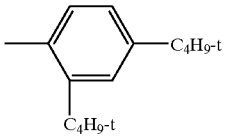
(S-68)
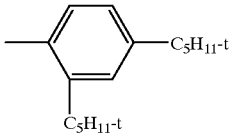
(S-69)
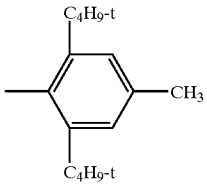
(S-70)
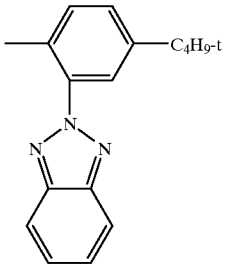
-continued
(S-71)
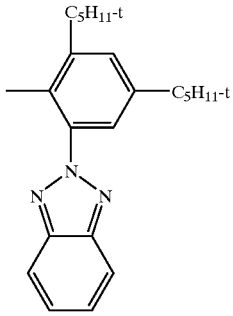
(S-72)
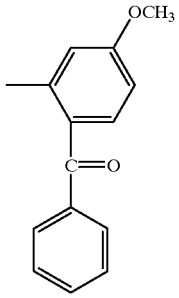
(S-73)
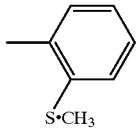
(S-74)
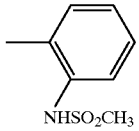
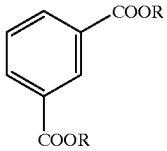
In the above formula, R is as follows:
(S-75)
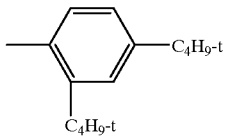
(S-76)
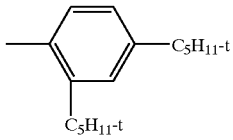

-continued
(S-77)
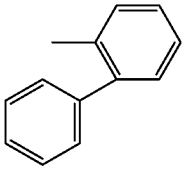
(S-78)
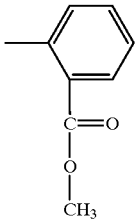
(S-79)
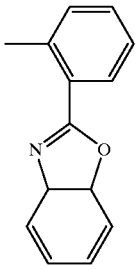
(S-80)
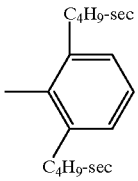
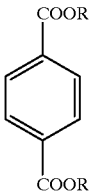
In the above formula, R is as follows:
(S-81)
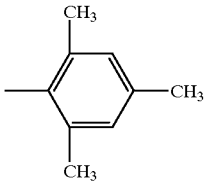
-continued
(S-82)
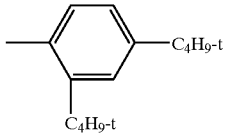
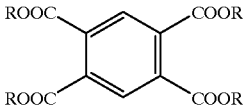
In the Cove formula, R is as follows:
(S-83)
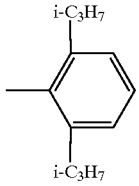
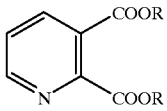
In the above formula, R is as follows:
(S-84)
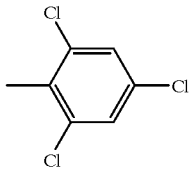
(S-85)
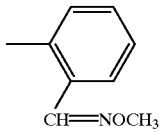
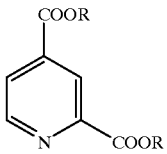

In the above formula, R is as follows:

(S-86)

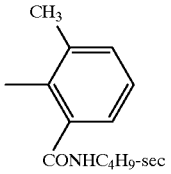

(S-87)

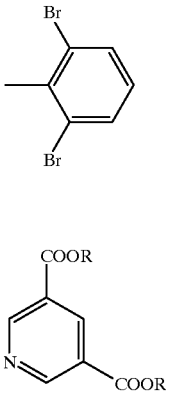

In the above formula, R is as follows:

(S-88)

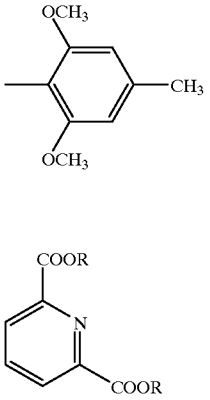

pIn the above formula, R is as follows:

(S-89)

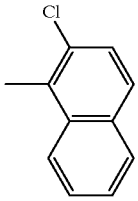

(S-90)

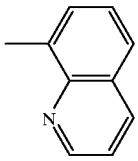

-continued (S-91)

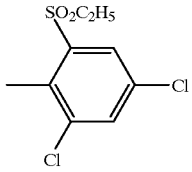

(S-87)

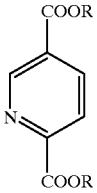

In the above formula, R is as follows:

(S-92)

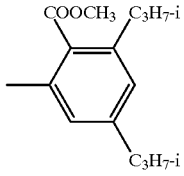

(S-93)

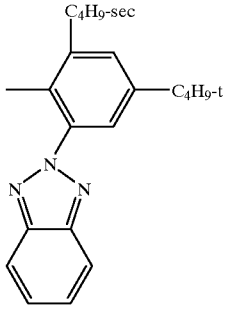

(S-94)

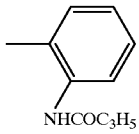

The above-mentioned compounds for use in the present invention are commercially available, or they can be synthesized by a method described in, for example, JP-A-62-134642.

Formula [IIIs-2] is explained below.

[$III_s$-2]

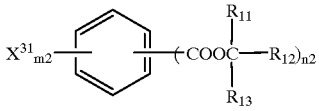

In formula [IIIs-2], $X^{31}$ represents a halogen atom (fluorine, chlorine, bromine, and iodine), an alkyl group having 1 to 20 carbon atoms, an alkoxy group having 1 to carbon atoms, or an alkoxy carbonyl group having 2 to 21 carbon atoms; m2 represents an integer of 0 to 5; $R_{11}$, $R_{12}$ and $R_{13}$ each independently represent a straight-chain or branched chain alkyl group having 1 to 12 carbon atoms, a cycloalkyl group having 3 to 12 carbon atoms, an aralkyl group having 7 to 20 carbon atoms, an aryl group having 6 to 20 carbon atoms, or a heterocyclic group having 3 to 12 carbon atoms; and n2 represents an integer of 1 to 4, with the proviso that the total sum of m1 and n2 is 6 or less. When m2 is plural, $X^{31}$s may be the same or different from each other. When n2 is plural,

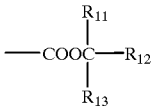

may be the same or different from each other. Further, $R_{11}$ may be a hydrogen atom. $R_{12}$ and $R_{13}$ may bond together to form a ring.

The compounds represented by formula [$III_s$-2] are described in detail below.

In formula [$III_s$-2], specific examples of $X^{31}$ include not only the above-described halogen atom, but also an alkyl group (e.g., methyl, ethyl, isopropyl, t-butyl, cyclopentyl, cyclohexyl, 2-ethylhexyl, dodecyl, benzyl, trifluoromethyl), an alkoxy group (e.g., methoxy, ethoxy, 2-ethylhexyloxy, benzyloxy, dodecyloxy, methoxyethoxy), and an alkoxycarbonyl group (e.g., methoxycarbonyl, ethoxycarbonyl, butoxycarbonyl, hexadecyloxycarbonyl).

In formula [$III_s$-2], specific examples of $R_{11}$, $R_{12}$ and $R_{13}$ include a straight chain or branched chain alkyl group (e.g., methyl, ethyl, trifluoromethyl, isopropyl, sec-butyl, n-propyl, n-butyl, isopentyl, isobutyl, sec-pentyl, isohexyl, sec-decyl), a cycloalkyl group (e.g., cyclopropyl, cyclobutyl, cyclopentyl, cyclohexyl, 4-methylcyclohexyl, 4-methylcyclohexenyl, 4-t-butylcyclohexyl, cycloheptyl, menthyl, bornyl, bicyclo[2,2,1]heptane-2-yl), an aralkyl group (e.g., benzyl, 4-methoxybenzyl, 1-naphthylmethyl, phenethyl), an aryl group (e.g., phenyl, 4-methoxyphenyl, 2,4-dichlorophenyl, p-toryl, 1-naphthyl) and a heterocyclic group (e.g., furyl, thienyl, pyridyl, N-methylimidazolyl, N-methylpyrrolyl, tetrahydrofurfuryl, N-ethylindolyl, quinolyl).

In formula [IIIs-2], when $R_{12}$ and $R_{13}$ bond together to form a ring as exemplified by

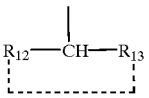

specific examples of the above ring include cyclopentyl, cyclohexyl, menthyl, fenchyl, bornyl, and bicyclo[2,2-1] heptane-2-yl.

Of the compounds represented by formula [$III_s$-2], preferred compounds for use in the present invention meet the following conditions (1) or (2):

(1) The total sum of α-hydrogen atoms of $R_{11}$, $R_{12}$ and $R_{13}$ is up to 7 (not more than 7).

(2) When $R_{11}$ is a hydrogen atom, any one of the conditions (a) and (b) described below is fulfilled:

(a) When $R_{12}$ and $R_{13}$ bond together to form a ring, the total sum of an a-hydrogen atom of $R_{12}$ and $R_{13}$ is up to 1, and (b) When $R_{12}$ and $R_{13}$ do not form a ring, any one of the α-positions of $R_{12}$ and $R_{13}$ is substituted with two different substituents.

Of the compounds represented by formula [$III_s$-2], more preferred are those wherein m2 is 0 and n2 is 2. Particularly preferable compounds are those represented by formula [$III_s$-3] or [$III_s$-4] shown below.

[$III_s$-3]

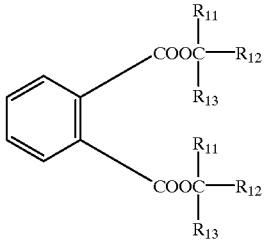

[$III_s$-4]

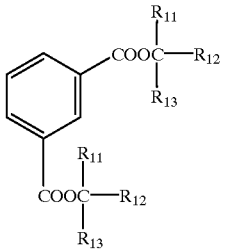

Each of the $R_{11}$, $R_{12}$, and $R_{13}$ in formulas [$III_s$-3] and [$III_s$-4] has the same meaning as defined in the above formula [$III_s$-2].

Especially preferably, in formula [$III_s$-2], the following

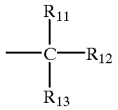

meet the following conditions (3) or (4):

(3) Each of $R_{11}$, $R_{12}$ and $R_{13}$ represents an alkyl group including a cycloalkyl group and an aralkyl group, with the proviso that each of $R_{11}$, $R_{12}$ and $R_{13}$ is not a methyl group at the same time.

(4) $R_{11}$ represents a hydrogen atom, or an alkyl group, and $R_{12}$ and $R_{13}$ bond together to form a substituted or unsubstituted cyclohexane, or cycloheptane ring.

Specific examples of the group:

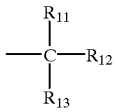

in formula [$III_s$-2] are shown below.

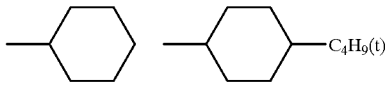

-continued
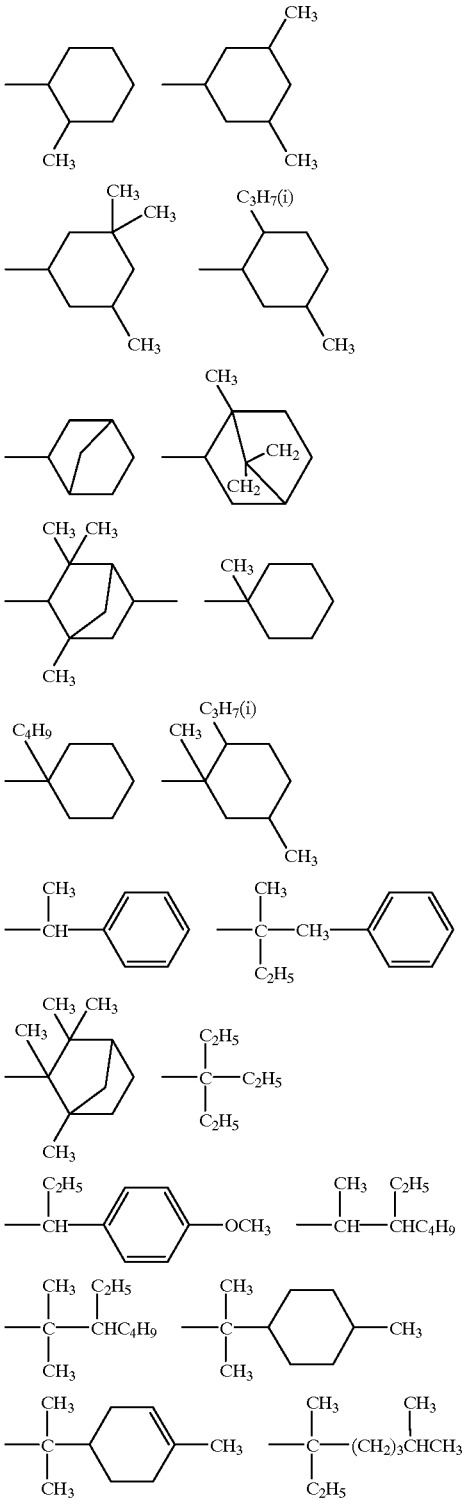
Specific examples of the compound represented by formula [$III_s$-2] are shown below, but the present invention is not limited to these.
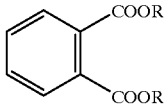
(S-95)
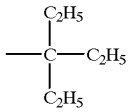
(S-96)
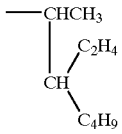
(S-97)
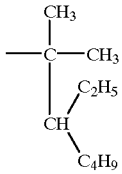
(S-98)
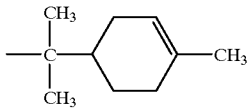
(S-99)
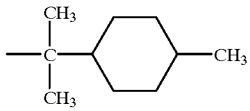
(S-100)
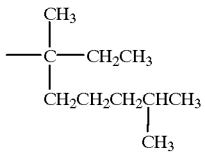
(S-101)
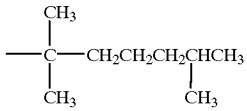
(S-107)
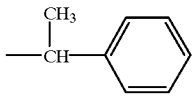
(S-108)
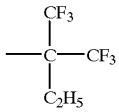

-continued
(S-109)
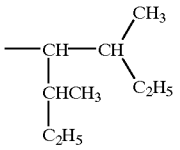
(S-110)
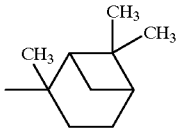
(S-111)
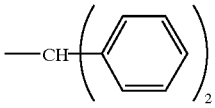
(S-112)
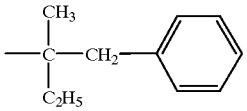
(S-113)
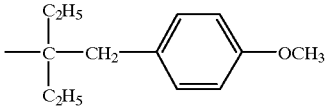
(S-114)
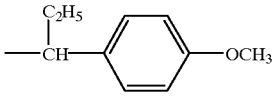
(S-115)
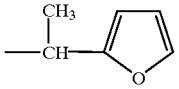
(S-116)
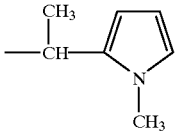
R
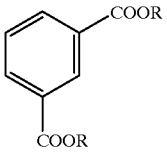
(S-117)
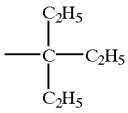
-continued
(S-118)
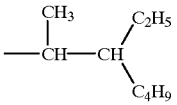
(S-119)
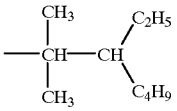
(S-120)
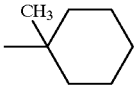
(S-121)
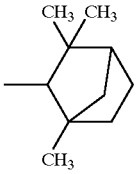
(S-122)
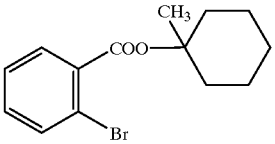
(S-123)
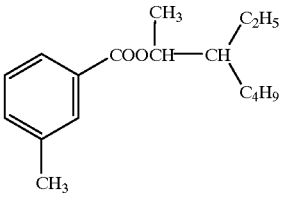
(S-124)
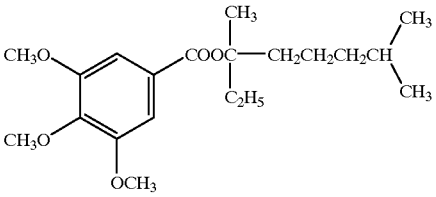
(S-125)
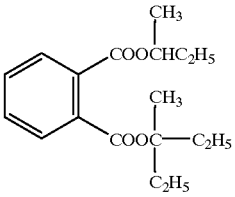
(S-126)
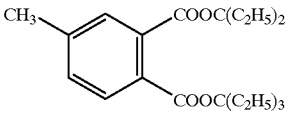

-continued
(S-127)
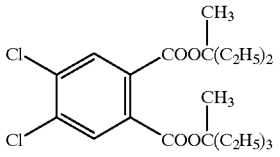
(S-128)
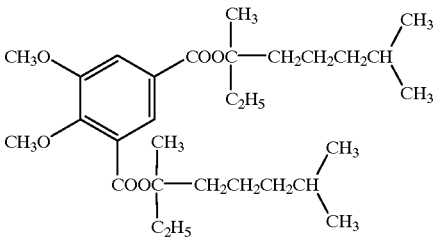
(S-129)
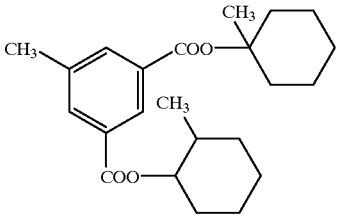
(S-130)
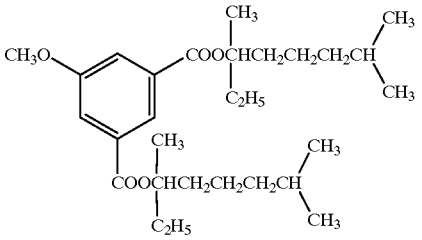
(S-131)
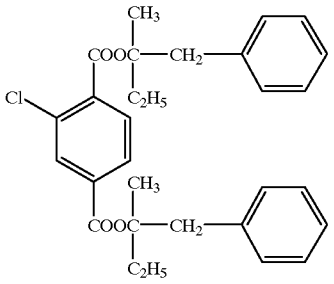
(S-132)
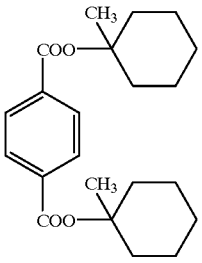
-continued
(S-133)
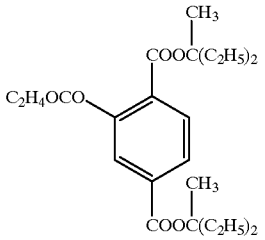
(S-134)
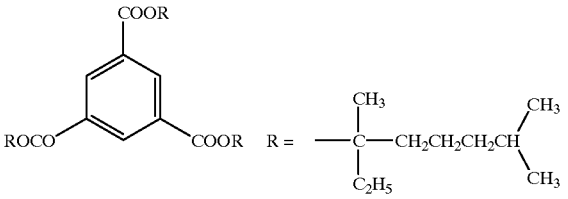
(S-135)
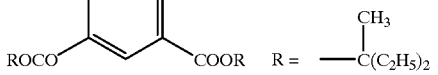
As specific examples of another compound that is included in the compound represented by formula [$III_s$-2] for use in the present invention, the compounds shown below can be mentioned.
(S-136)
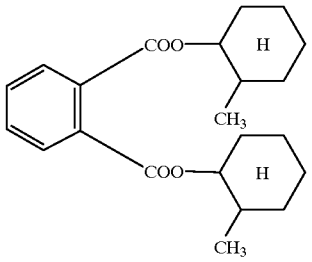
(S-137)
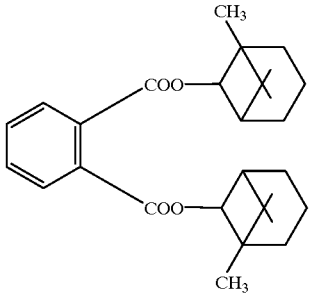

-continued (S-138)

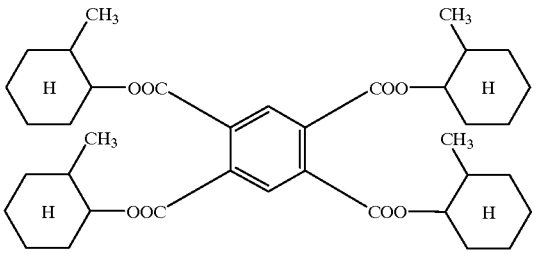

(S-139)

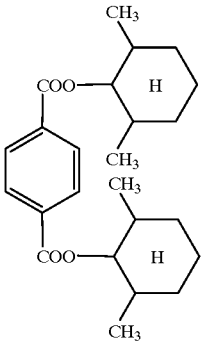

(S-140)

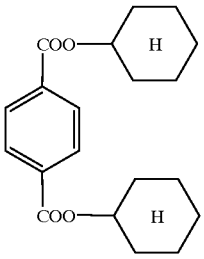

(S-141)

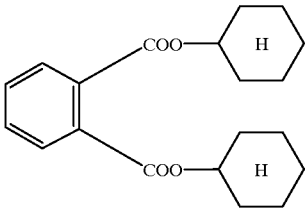

(S-142)

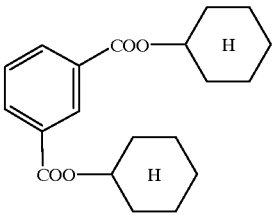

-continued (S-143)

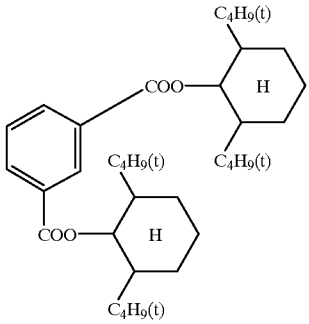

These compounds represented by formula [$III_s$-2] can be synthesized according to the following synthetic method.

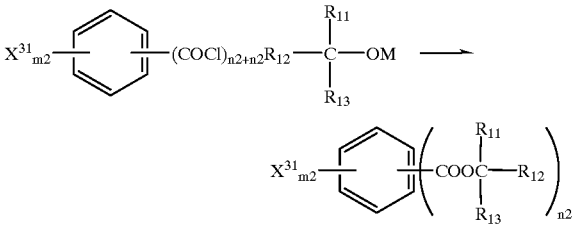

In the formula, M represents a hydrogen atom, Li, Na, or K. When M is a hydrogen atom, a base such as pyridine, triethylamine, tetramethyl guanidine, DBN, DBU, sodium carbonate, and potassium carbonate may be used. As a reaction solvent, preferred are acetonitrile, dimethylformamide, dimethylacetamide, N,N-dimethylimidazolidinone, sulfolane, dimethylsulfoxide, benzene, toluene, xylene, dioxane, tetrahydrofuran and the like.

Specific examples of the above-illustrated synthesis are described in, for example, European Patent Application Laid-open to Public (EP) No. 228064.

An emulsified dispersion of fine particles comprising a coupler and the above-mentioned high boiling point organic solvent having a specific viscosity, for use in the third embodiment of the present invention, preferably contains a polymer (herein after referred to as "water-insoluble polymer" or "polymer") that is water-insoluble and soluble in an organic solvent, therein. It is especially preferable that an emulsified dispersion of fine particles containing a cyan coupler be subjected to emulsification and dispersion with the water-insoluble polymer.

Further, in the third embodiment of the present invention, use can be made of a cyan coupler and the water-insoluble polymer, to form a silver halide emulsion layer containing these.

In the third embodiment of the present invention, when the dispersion of lipophilic fine particles is used, the cyan coupler represented by formula [C-I] is preferably used as a cyan coupler, and the cyan coupler represented by formula [I] can be additionally used. On the other hand, when the water-insoluble polymer is used, the cyan coupler represented by formula [I] is preferably used as a cyan coupler.

The polymer for use in the third embodiment of the present invention may be a homopolymer or a copolymer. As the polymer (and a monomer forming the polymer), the use can be made of not only vinyl polymers (monomers such as acrylic acid esters, olefins, styrenes, vinylethers and acrylic acids) and polymers produced by a condensation polymerization or polyaddition reaction, but also polymers described in JP-A-3-144442. Of these polymers for use in the present invention, preferred are vinyl polymers (more preferably acryl-series polymers, and furthermore preferably acrylamide-series polymers).

The molecular weight and the polymerization degree of the polymer for use in the third embodiment of the present invention do not have a substantially material influence on the effect obtained by the present invention. However, the polymer in a solution exhibits a higher viscosity with a larger macromolecular weight, so that emulsified dispersion becomes difficult. Therefore, the polymer having a macromolecular weight is not entirely preferable from a viewpoint of production. Accordingly, the viscosity of the polymer for use in the present invention is generally 5000 cp or less, preferably 2000 cp or less, on terms that 30 g of a polymer is dissolved in 100 ml of an auxiliary solvent. Further, the molecular weight of the polymer for use in the present invention is preferably 150,000 or less, more preferably 100,000 or less.

The ratio of the polymer to the auxiliary solvent, which can be used in the present invention, may vary in accordance with not only the kind of said polymer, but also the solubilities of the polymer, a coupler and the like in the auxiliary solvent. Generally, the auxiliary solvent is necessary in an amount enough to dissolve at least three materials of a coupler, a high boiling point solvent for coupler, and a polymer. The ratio of the polymer to the auxiliary solvent is preferably in the range of 1:1 to 1:50 (weight ratio). The ratio of the polymer to the coupler, which can be used in the present invention, is preferably 1:20 to 20:1 (weight ratio).

A part of specific examples of the polymers for use in the third embodiment of the present invention are described below. However, the present invention should not be limited to these compounds.

P-1) Polymethyl methacrylate
P-2) Polyethyl methacrylate
P-3) Polyisoproyl methacrylate
P-4) Polymethyl chloroacrylate
P-5) Poly(2-tert-butylphenyl acrylate)
P-6) Poly(4-tert-butylphenyl acrylate)
P-7) Ethyl methacrylate/n-butyl arylate copolymer (70:30)
P-8) Methyl methacrylate/acrylonitrile copolymer (65:35)
P-9) Methyl methacrylate/styrene copolymer (90:10)
P-10) N-tert-butylmethacrylamide/methyl methacrylate/acrylic acid copolymer (60:30:10)
P-11) Methyl methacrylate/styrene/vinylsulfonamide copolymer (70:20:10)
P-12) Methyl methacrylate/cyclohexyl methacrylate copolymer (50:50)
P-13) Methyl methacrylate/acrylic acid copolymer (95:5)
P-14) Methyl methacrylate/n-butyl methacrylate copolymer (65:35)
P-15) Methyl methacrylate/N-vinyl-2-pyrolidone copolymer (90:10)
P-16) Poly(N-sec-butylacrylamide)
P-17) Poly(N-tert-butylacrylamide)
P-18) Polycyclohexyl methacrylate/methyl methacrylate copolymer (60:40)
P-19) n-Butyl methacrylate/methyl methacrylate/acrylamide copolymer (20:70:10)
P-20) Diacetoneacrylamide/methyl methacrylate copolymer (20:80)
P-21) N-tert-butylacrylamide/methyl methacrylate copolymer (40:60)
P-22) Poly(N-n-butylacrylamide)
P-23) tert-Butyl methacrylate/N-tert-butylacrylamide copolymer (50:50)
P-24) tert-Butyl methacrylate/methyl methacrylate copolymer (70:30)
P-25) Poly(N-tert-butylmethacrylamide)
P-26) N-tert-butylacrylamide/methyl methacrylate copolymer (60:40)
P-27) Methyl methacrylate/acrylonitrile copolymer (70:30)
P-28) Methyl methacrylate/styrene copolymer (75:25)
P-29) Methyl methacrylate/hexyl methacrylate copolymer (70:30)
P-30) Poly(4-biphenyl acrylate)
P-31) Poly(2-chlorophenyl acrylate)
P-32) Poly(4-chlorophenyl acrylate)
P-33) Poly(pentachlorophenyl acrylate)
P-34) Poly(4-ethoxycarbonylphenyl acrylate)
P-35) Poly(4-methoxycarbonylphenyl acrylate)
P-36) Poly(4-cyanophenyl acrylate)
P-37) Poly(4-cethoxyphenyl acrylate)
P-38) Poly(3,5-dimethyladamantyl acrylate)
P-39) Poly(3-dimethylaminophenyl acrylate)
P-40) Poly(2-naphtyl acrylate)
P-41) Poly(phenyl acrylate)
P-42) Poly(N,N-dibutylacrylamide)
P-43) Poly(isohexylacrylamide)
P-44) Poly(isooctylacrylamide)
P-45) Poly(N-methyl-N-phenylacrylamide)
P-46) Poly(adamantyl methacrylate)
P-47) Poly(sec-butyl methyacrylate)
P-48) N-tert-butylacrylamide/acrylic acid copolymer (97:3)
P-49) Poly(2-chloroethyl methacrylate)
P-50) Poly(2-cyanoethyl methacrylate)
P-51) Poly(2-cyanomethyl methacrylate)
P-52) Poly(4-cyanophenyl methacrylate)
P-53) Poly(cyclohexyl methacrylate)
P-54) Poly(2-hydroxypropyl methacrylate)
P-55) Poly(4-methoxycarbonylphenyl methacrylate)
P-56) Poly(3,5-dimethyladamantyl methacrylate)
P-57) Poly(phenyl methacrylate)
P-58) Poly(4-buthoxycarbonoylphenylmethacrylamide)
P-59) Poly(4-carboxyphenylmethacrylamide)
P-60) Poly(4-ethoxycarbonylphenylmethacrylamide)
P-61) Poly(4-methoxycarbonylphenylmethacrylamide)
P-62) Poly(cyclohexyl chloroacrylate)
P-63) Poly(ethyl chloroacrylate)
P-64) Poly(isobutyl chloroacrylate)
P-65) Poly(isopropyl chloroacrylate)

In the third embodiment of the present invention, a copolymer having a carboxylic acid group with a specified acid content is preferably contained in a hydrophilic binder, from viewpoints that the blix discoloration is prevented from becoming worse. Among these polymers, those represented by formula [PP] are preferably used. formula [PP]

$$-(A)_x-(B)_y-$$

wherein A represents a repeating unit derived from at least one ethylenically unsaturated monomer having at least one —COOM (M represents a hydrogen atom or a cation) group in its molecule, B represents a repeating unit derived from at least one ethylenically unsaturated monomer having no —COOM group, and x and y each represent a percentage ratio by weight of A and B, respectively, in which x is 20 to 80 and y is 80 to 20 provided that x+y=100.
Examples of the monomer giving the repeating unit represented by A in the formula [PP] include acrylic acid, methacrylic acid, itaconic acid, crotonic acid, maleic acid,
A-1
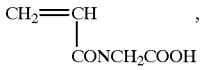
A-2
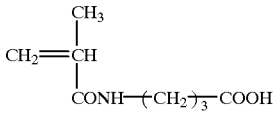
A-3
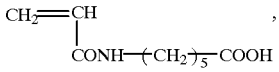
A-4
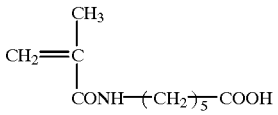
A-5
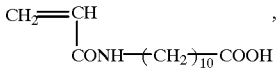
A-6
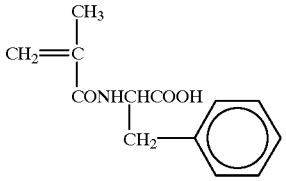
A-7
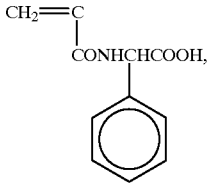
A-8
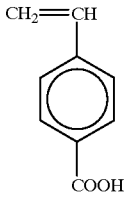
A-9
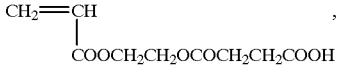
A-10
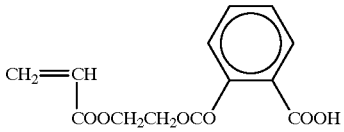
-continued
A-11
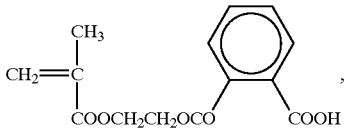
A-12
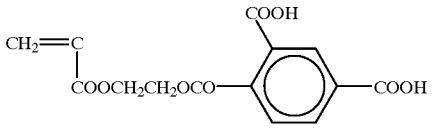
A-13
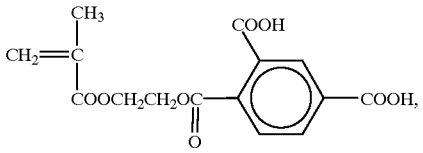
A-14
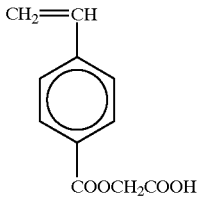
A-15
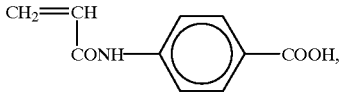
A-16
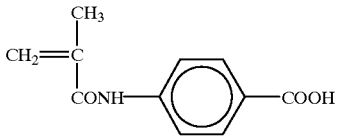
A-17
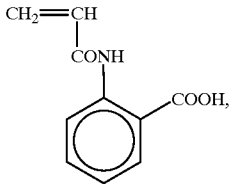
A-18
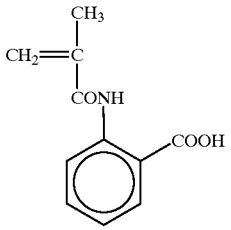
A-19
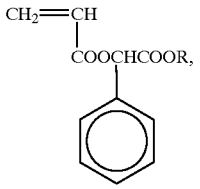

-continued

A-20

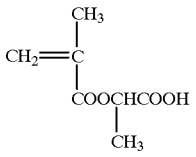

A-21

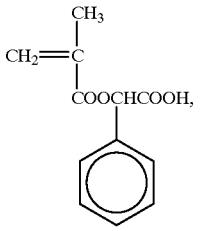

and the like.

Each carboxylic acid group of these monomers may form a salt in the form —COOM to the extent that the resultant copolymer is not dissolved.

Examples of the cation represented by M include metal ions (e.g., sodium and potassium) and ammonium ions (e.g., ammonium, dimethylammonium and triethylammonium).

Examples of the ethylenically unsaturated monomer to give a repeating unit represented by B include acrylates, methacrylates, vinylesters, acrylamides, methacrylamides, olefins and vinyl ethers.

Alternatively, B may also be derived from a monomer having an anionic group (e.g., a sulfonic acid group, a phosphonic acid group, and salts of these acids) other than —COOM.

As the ethylenically unsaturated monomer to give a repeating unit represented by B, monomers whose monopolymers are insoluble in water are preferably used. The monomer whose homopolymer is soluble in water is preferably contained in the repeating unit of B in an amount of about 0 to 20% based on the total polymers. Preferable examples of the above ethylenically unsaturated monomer to give a repeating unit represented by B are an acrylate-series, methacrylate-series and vinylester-series, with particular preferance given to an acrylate-series and methacrylate-series.

The monomers to each give the repeating unit represented by A or B may be respectively used in combinations of two or more.

Preferable ranges of x and y are probably changed depending on the structures of the ethylenically unsaturated monomers to give repeating units represented by A or B. x is preferably 25 to 70% and particularly preferably 25 to 60%, and Y is preferably 75 to 30% and particularly preferably 75 to 40%, provided that x+y=100.

Such a copolymer may be a hydrophilic copolymer, or a polymer latex, and the latter is more preferred. Of said polymer latex, preferred are those described in JP-A-9-329861.

In the third embodiment of the present invention, of the above-described copolymers, especially preferred are those represented by the above-described general formula In formula [P], preferably $R^8$ represents an unsubstituted alkyl group having 1 to 7 carbon atoms and preferably 2 to 6 carbon atoms, a halogen-substituted or phenyl-substituted alkyl group, an unsubstituted cycloalkyl group, or a halogen-substituted cycloalkyl group. Accordingly, preferable examples of $R^8$ include methyl, ethyl, n-propyl, isopropyl, n-butyl, sec-butyl, t-butyl, isobutyl, n-amyl, n-hexyl, cyclopropyl, cyclopentyl, cyclohexyl, benzyl, 3-chloropropyl, and 3-bromopropyl. Out of them, an unsubstituted straight-chain or branched alkyl or cycloalkyl is particularly preferable.

D represents a repeating unit of some other ethylenically unsaturated monomer.

x', y', and z' each represent a preferable weight percentage of the respective component; and x'=20 to 80, y'=80 to 20, and z'=0 to 30, with the proviso that x'+y'+z'=100.

In the polymer latex used in the third embodiment of the present invention, the —COOH group may be neutralized to an extent wherein the latex is not dissolved in water, and the lower the rate of the neutralization is, the more preferable it is, in view of the ability to prevent blix discoloration. Therefore, the rate of neutralization of the —COOH group is preferably 0 to 20%, and particularly preferably 0 to 10%. Herein the rate of neutralization of the carboxylic acid group is defined as COOM (wherein M represents a cation)/[COOH+COOM (wherein M represents a cation)], in the polymer latex (specifically the —$CH_2$—C($CH_3$)COOM component in the above formula [P]).

The term "insoluble in water" mentioned above means that the solubility of the polymer latex is 1 g or less per 100 ml of water (25° C.).

Specific examples of the compound represented by formula [P] used in the present invention are shown below, with ratios in the order of a copolmerization ratio (weight ratio) and a ratio of the —COOH component in the —COOM, but the present invention is not limited to these.

| | | |
|---|---|---|
| P-1 | Methacrylic acid/n-butyl acrylate copolymer (30/70), | M = H/Na (90/10) |
| P-2 | Methacrylic acid/n-butyl acrylate copolymer (40/60), | M = H/Na (90/10) |
| P-3 | Methacrylic acid/n-butyl acrylate copolymer (50/50), | M = H/Na (90/10) |
| P-4 | Methacrylic acid/n-butyl acrylate copolymer (55/45), | M = H (100) |
| P-5 | Methacrylic acid/methyl acrylate copolymer (25/75), | M = H/K (90/10) |
| P-6 | Methacrylic acid/ethyl acrylate copolymer (30/70), | M = H (100) |
| P-7 | Methacrylic acid/ethyl acrylate copolymer (35/65), | M = H (100) |
| P-8 | Methacrylic acid/n-hexyl acrylate copolymer (45/55), | M = H (100) |
| P-9 | Methacrylic acid/cyclohexyl acrylate copolymer (40/60) | M = H (100) |
| P-10 | Methacrylic acid/cyclohexyl methacrylate copolymer (40/60) | M = H (100) |
| P-11 | Methacrylic acid/methyl methacrylate copolymer (30/70), | M = H/Na (80/20) |
| P-12 | Methacrylic acid/ethyl methacrylate copolymer (40/60), | M = H (100) |
| P-13 | Methacrylic acid/n-propyl methacrylate copolymer (40/60) | M = H (100) |
| P-14 | Methacrylic acid/sec-butyl methacrylate copolymer (40/60) | M = H (100) |
| P-15 | Methacrylic acid/t-butyl methacrylate copolymer (50/50), | M = H/K (90/10) |
| P-16 | Acrylic acid/ethyl acrylate copolymer (25/75), | M = H/Na (90/10) |
| P-17 | Acrylic acid/n-butyl acrylate copolymer (35/65), | M = H (100) |
| P-18 | Acrylic acid/methyl methacrylate copolymer (30/70), | M = H/Na (80/20) |
| P-19 | Acrylic acid/ethyl methacrylate copolymer (30/70), | M = H/Na (95/5) |
| P-20 | Methacrylic acid/n-butyl acrylate/methyl acrylate copolymer (40/40/20), | M = H (100) |

-continued

| | | |
|---|---|---|
| P-21 | Acrylic acid/cyclohexyl methaacrylate/ 2-hydroxyethyl methacrylate copolymer (40/50/10), | M = H (100) |
| P-22 | Methacrylic acid/methyl methacrylate/stylene copolymer (40/30/30), | M = H (100) |
| P-23 | Methacrylic acid/acrylic acid/benzyl methacrylate copolymer (20/20/60), | M = H (100) |
| P-24 | Methacrylic acid/n-butyl acrylate/vinyl acetate copolymer (40/20/20), | M = H (100) |
| P-25 | Methacrylic acid/sodium 2-acrylamido-2-methylpropanesulfonic acid/ethyl methacrylate copolymer (30/5/65), | M = H/Na (90/10) |
| P-26 | Methacrylic acid/itaconic acid/n-butyl acrylate copolymer (30/10/60), | M = H/K (95/5) |
| P-27 | A-1/ethyl acrylate copolymer (60/40), | M = H/Na (90/10) |
| P-28 | A-3/methyl acrylate copolymer (60/40), | M = H/Na (80/20) |
| P-29 | A-3/acrylamide/t-butyl acrylate copolymer (40/10/50), | M = H (100) |
| P-30 | A-8/stylene/methyl metacrylate copolymer (60/15/25), | M = H (100) |
| P-31 | A-10/2-hydroxyethyl acrylate/n-butyl acrylate copolymer (60/10/30), | M = H (100) |
| P-32 | A-17/n-butyl methacrylate copolymer (80/20), | M = H (100) |
| P-33 | A-17/sodium 2-acrylamido-2-methylpropane-sulfonate/n-butyl methacrylate copolymer (65/5/30), | M = H/Na (90/10) |
| P-34 | A-1/methacylic acid/n-butyl acrylate copolymer (20/25/55) | M = H (100) |
| P-35 | A-3/methacylicc acid/ethyl acrylate copolymer (30/20/50) | M = H (100) |
| P-36 | A-5/acrylic acid/methyl metacrylate copolymer (50/20/30) | M = H/Na (90/10) |

The particle diameter of the polymer latex is not particularly limited, and in view of the stability and the like it is generally 1.0 $\mu$m or less, preferably 0.7 $\mu$m or less, and particularly preferably 0.5 $\mu$m or less, and the lower limit thereof is preferably 0.00001 $\mu$m or more.

The polymer latex exhibits an excellent effect without respect to its molecular weight, and taking the diffusion into other layers when applied or processed and the viscosity of the coating solution into account, a preferable molecular weight is $5\times10^3$ to $1\times10^7$, more preferably $1\times10^4$ to $5\times10^6$, and particularly preferably $2\times10^4$ to $3\times10^6$, in terms of weight-average molecular weight. Since the obtained polymer itself of the polymer latex is a dispersion of fine particles, the polymer latex may be directly mixed with a hydrophilic colloid, and the mixture in the form of an aqueous medium dispersion may be applied.

As a hydrophilic colloid (binder) that is mixed with polymer latex, gelatin is preferably used. As the gelatin, lime-processed gelatin, as well as an acid-processed gelatin and an enzyme-processed gelatin, may be used, and also a hydrolyzate and an enzymolyzate of gelatin can be used.

Further a hydrophilic colloid other than gelatin can be used, such as a protein, for example albumin and casein; a cellulose derivative, for example hydroxyethyl cellulose, carboxymethyl cellulose, and cellulose sulfate; a saccharide derivative, for example sodium alginate, dextran, and a starch derivative; and a synthetic hydrophilic polymeric substance that includes a homopolymer and a copolymer, for example a polyvinyl alcohol, a polyvinyl alcohol partial acetal, a poly-N-vinyl pyrrolidone, a polyacrylamide, a polyvinylimidazole, and a polyvinylpyrazole.

After mixing the polymer latex with a hydrophilic colloid, when the mixed coating liquid is applied, preferably the pH of the coating liquid is 4.5 to 8.0, more preferably 5.0 to 7.0, and further preferably 5.2 to 6.0.

There is no particular restriction on the ratio of the polymer latex and the hydrophilic colloid (polymer content ratio by weight), and preferably the value of the polymer ratio given by the below-shown formula is 0.01 to 0.30, more preferably 0.02 to 0.20, and further preferably 0.02 to 0.15.

Polymer ratio=(the coating amount of the copolymer for use in the present invention)/(the coating amount of the gelatin)

As the cyan coupler for use in the third embodiment of the present invention, the cyan coupler represented by the above-described formula [I] is also preferably used from the following viewpoints: that the coupler of formula [I] is excellent in blix discoloration even when subjected to rapid desilvering processing in the ultra-rapid processing, and it is excellent in the hue, as a coupler which may be used singly or in combination with the cyan coupler represented by the above-described formula [C-I] in the same layer or a different layer.

In the present invention, the term "color-developing time" means a period of time required from the beginning of dipping of a light-sensitive material into a color developing solution until the light-sensitive material is dipped into a blix solution in the subsequent processing step. In the case where a processing is carried out using, for example, an autoprocessor, the color developing time is the sum total of a time in which a light-sensitive material has been dipped in a color developing solution (so-called "time in the solution") and a time in which the light-sensitive material after departure from the color developing solution has been conveyed in the air toward a bleach-fixing bath in the step subsequent to color development (so-called "time in the air"). Similarly the term "bleach-fixing time" means a period of time required from the beginning of dipping of a light-sensitive material into a bleach-fixing solution until the light-sensitive material is dipped into a washing or stabilizing bath in the subsequent processing step. Further, the term "washing or stabilizing time" means a period of time in which a light-sensitive material is staying in the washing or stabilizing solution until it begins to be conveyed toward a drying step (so-called "time in the solution").

In the ultra-rapid processing which is an object of the present invention to be achieved, the color developing time is preferably 30 seconds or less, more preferably 20 seconds or less, and most preferably in the range of 15 seconds to 6 seconds. Similarly the bleach-fixing time is preferably 30 seconds or less, more preferably 20 seconds or less, and most preferably in the range of 15 seconds to 6 seconds. Further, the washing or stabilizing time is preferably 40 seconds or less, more preferably 30 seconds or less, and most preferably in the range of 20 seconds to 6 seconds.

In the silver halide photographic light-sensitive material of the present invention, other known photographic materials and additives can be used.

With the cyan coupler for use in the present invention, 2-acylamino-5-alkylphenol-type cyan couplers, 2,5-diacylaminophonol-type cyan couplers, and 2-carbamoyl-1-naphthol-type cyan couplers that have been conventionally used can be used in combination. Among these, combination use with 2-acylamino-5-alkylphenol-type cyan couplers is particularly preferable. In this case, the amount to be added of the additional cyan coupler used in combination is in the range of generally 1 to 50 mol %, preferably 5 to 40 mol %, and more preferably 10 to 30 mol %, to the coupler for use in the present invention.

In order to improve the fastness of image from the cyan coupler used in the present invention, a method in which a polymer that is soluble in an organic solvent but insoluble in water is co-dispersed in oil droplets, is also preferably used. In this case, preferably the polymer is a polymer of styrene, acrylamide, methacrylamide, acrylate or methacrylate-series, or a copolymer thereof, and it preferably has a number-average molecular weight in the range of 20,000 to 200,000.

Further, in order to improve the stability of the emulsion, an oligomer molecule having a molecular weight of the order of 500 to 5,000 is preferably used, and a styrene oligomer, an α-methylstyrene oligomer, and the like are preferable. Particularly, an oligomer of styrene and α-methylstyrene is preferable, because of its solubility.

Further, in order to accelerate the color formation, it is also preferable to add an amphiphatic polymer to the coating solution. In this case, a copolymer of acrylic acid or methacrylic acid with acrylates or methacrylates is more preferable. In particular, a copolymer of methacrylic acid with butyl acrylate is a particularly preferable compound, because the effect is great.

The color photographic light-sensitive material of the present invention may be built in (incorporated) a color-developing agent, for the purpose of simplification of the processing and advances in processing speed. For building in, various kinds of precursors of the color developing agent are preferably used. Examples of the precursor include indoaniline-series compounds described in U.S. Pat. No. 3,342,597; Schiff base type compounds described in U.S. Pat. No. 3,342,599, R.D. No. 14850 and ibid. No. 15159; aldol compounds described in R.D. No. 13924; metal complex salts described in U.S. Pat. No. 3,719,492; and urethane-series compounds described in JP-A-53-135628.

The color photographic light-sensitive material of the present invention may be built in various kinds of 1-phenyl-3-pyrazolidones in order to accelerate color development, as occasion demands. Exemplary compounds are described in JP-A-56-64339, JP-A-57-144547, and JP-A-58-115438.

The silver halide photographic light-sensitive material of the present invention can be used, for example, as color negative films, color positive films, color reversal films, color reversal printing papers, and color printing papers, and preferably as color printing papers.

As the photographic base (support) used in the present invention, a transparent-type base or a reflective-type base can be mentioned. As the transparent-type base, a transparent film, such as a cellulose nitrate film, a cellulose triacetate film and a polyethylene terephthalate film; and one wherein a film, for example, of a polyester of 2,6-naphthalenedicarboxylic acid (NDCA) and ethylene glycol (EG) or a polyester of NDCA, terephthalic acid, and EG, is provided with an information recording layer, such as a magnetic layer, are preferably used. As a reflective-type base, particularly, a reflective-type base, wherein a laminate has a plurality of polyethylene layers or polyester layers and wherein at least one of such water-resistant resin layers (laminated layers) contains a white pigment, such as titanium oxide, is preferable.

Further, the above water-resistant resin layers preferably contain a fluorescent whitening agent. Further, a fluorescent whitening agent may be dispersed in the hydrophilic colloid layer of the light-sensitive material. As the fluorescent whitening agent, preferably a benzoxazole-series fluorescent whitening agent, a cumarin-series fluorescent whitening agent, or a pyrazoline-series fluorescent whitening agent can be used, and more preferably a benzoxazolylnaphthalene-series fluorescent whitening agent or a benzoxazolylstilbene-series fluorescent whitening agent is used. Specific examples of the fluorescent whitening agent that is contained in a water-resistant resin layer, include 4,4'-bis(benzoxazolyl)stylbene, 4,4'-bis(5-methylbenzoxazolyl)stylbene, and mixture of these. The amount to be used is not particularly limited, but preferably it is 1 to 100 mg/m$^2$. When it is mixed with a water-resistant resin, preferably the mixing proportion is 0.0005 to 3% by weight, and more preferably 0.001 to 0.5% by weight, to the resin.

The reflective-type base may be one wherein a hydrophilic colloid layer containing a white pigment is applied on a transparent-type base or a reflective-type base described in the above.

Further, the reflective-type base may be a base having a specular reflective- or a second-type diffusion reflective metal surface.

As a more preferable reflective support for use in the second embodiment of the present invention, exemplified is a paper substrate laminated by a polyolefin layer having microscopic pores (fine holes), on the silver halide emulsion layer-coating side of the substrate.

The above-mentioned microscopic pores are explained below.

In order to form microscopic pores, a pore-inducing substance is preferably used. A polymer material is preferred as a pore-inducing substance. As the above-said polymer material, preferred are polymers which not only can be fused and mixed with a polymer capable of forming a core matrix, but also can form a dispersion of spherical particles, when a suspension of the polymer is cooled. An exemplary polymer material is polybutylene terephthalate dispersed in polypropylene. The pore-inducing substance is preferably used in an amount of 5 to 50 wt %, based on a core matrix polymer. Particles of the pore-inducing substance remaining in the completed sheet core preferably have a diameter of 0.1 to 10 μm, and preferably they are spherical. Even though the size of a pore depends on a degree of stretching in both the lengthwise direction and the lateral direction, it is approximately equal to a diameter of the section of a particle of the pore-inducing substance.

Further, the above-described polyolefin layer may be constituted by multi-layers. In this embodiment, it is preferred that the polyolefin (e.g. polypropylene, polyethylene) layer adjacent to a gelatin layer on the silver halide emulsion layer side is free from microscopic pores, whereas a polyolefin (e.g. polypropylene and polyethylene) layer carrying microscopic pores is arranged on the side close to a paper substrate. More preferably, a polyolefin layer carrying microscopic pores is sandwiched between two polyolefin layers free from microscopic pores. The density of these multi- or single polyolefin layer(s) arranged between the paper substrate and photographic constituent layers, is preferably in the range of 0.40 to 1.0 g/cc, and more preferably in the range of 0.50 to 0.70 g/cc. Further, the thickness of these multi- or single polyolefin layer(s) sandwiched between the paper substrate and the photographic constituent layers, is preferably in the range of 10 to 100 μm, and more preferably in the range of 15 to 70 μm. Further, the ratio of the polyolefin layer to the paper substrate in terms of thickness is preferably in the range of 0.05 to 0.8, and more preferably in the range of 0.1 to 0.5. Further, it is also preferred to apply a polyolefin layer on the reverse (backing) surface of the above-described paper substrate opposite to the photographic constituent layers-coating side, from the viewpoint of improvement rigidity of a reflective support. In this embodiment, the polyolefin layer on the back surface preferably comprises polyethylene or polypropylene, whose surface is dull-finished. Polypropylene is more preferred. A thickness of the polyolefin layer on the back surface is preferably in the range of 5 to 50 μm, and more preferably in the range of 10 to 30 μm. In addition, the density of the polyolefin layer is preferably in the range of 0.7 to 1.1 g/cc. In the reflective support for use in the present invention, preferable embodiments of the polyolefin layer applied on a paper substrate are described, for example, in JP-A-10-333277, JP-A-10-333278, JP-A-11-52513, JP-A-11-65024, EP 0 880 065 A1, EP 0 880 066 A1, U.S. Pat. Nos. 5,888,681, 5,888,714, and British Patent No. 2,325,749.

With respect to the above reflective-type base, as silver halide emulsions, as well as different metal ion species to be doped into silver halide grains, antifoggants or storage stabilizers of silver halide emulsions, chemical sensitizing methods (sensitizers), and spectrally sensitizing methods (spectral sensitizers) for silver halide emulsions, additional cyan couplers, magenta or yellow couplers and methods for emulsifying and dispersing the couplers, dye-image-preservability improving agents (antistaining agents and anti-fading agents), dyes (colored layers), gelatins, layer structures of light-sensitive materials, the pH of coatings of light-sensitive materials, and the like, those described in the patents shown in the following Tables can be preferably applied in the present invention.

| Element | JP-A-7-104448 | JP-A-7-77775 | JP-A-7-301895 |
|---|---|---|---|
| Reflective-type bases | Column 7, line 12 to Column 12, line 19 | Column 35, line 43 to Column 44, line 1 | Column 5, line 40 to Column 9, line 26 |
| Silver halide emulsions | Column 72, line 29 to Column 74, line 18 | Column 44, line 36 to Column 46, line 29 | Column 77, line 48 to Column 80, line 28 |
| Different metal ion species | Column 74, lines 19 to 44 | Column 46, line 30 to Column 47, line 5 | Column 80, line 29 to Column 81, line 6 |
| Storage stabilizers or antifoggants | Column 75, lines 9 to 18 | Column 47, lines 20 to 29 | Column 18, line 11 to Column 31, line 37 (Especially, mercaptheterocyclic compounds) |
| Chemical sensitizing methods (Chemical sensitizers) | Column 74, line 45 to Column 75, line 6 | Column 47, lines 7 to 17 | Column 81, lines 9 to 17 |
| Spectrally sensitizing methods (Spectral sensitizers) | Column 75, line 19 to Column 76, line 45 | Column 47, line 30 to Column 49, line 6 | Column 81, line 21 to Column 82, line 48 |
| Cyan couplers | Column 12, line 20 to Column 39, line 49 | Column 62, line 50 to Column 63, line 16 | Column 88, line 49 to Column 89, line 16 |
| Yellow couplers | Column 87, line 40 to Column 88, line 3 | Column 63, lines 17 to 30 | Column 89, lines 17 to 30 |
| Magenta couplers | Column 88, lines 4 to 18 | Column 63, line 3 to Column 64, line 11 | Column 31, line 34 to Column 77, line 44 and column 88, lines 32 to 46 |
| Emulsifying and dispersing methods of couplers | Column 71, line 3 to Column 72, line 11 | Column 61, lines 36 to 49 | Column 87, lines 35 to 48 |
| Dye-image-preservability improving agents (antistaining agents) | Column 39, line 50 to Column 70, line 9 | Column 61, line 50 to Column 62, line 49 | Column 87, line 49 to Column 88, line 48 |
| Anti-fading agents | Column 70, line 10 to Column 71, line 2 | | |
| Dyes (colored layers) | Column 77, line 42 to Column 78, line 41 | Column 7, line 14 to Column 19, line 42, and Column 50, line 3 to Column 51, line 14 | Column 9, line 27 to Column 18, line 10 |
| Gelatins | Column 78, lines 42 to 48 | Column 51, lines 15 to 20 | Column 83, lines 13 to 19 |
| Layer construction of light-sensitive materials | Column 39, lines 11 to 26 | Column 44, lines 2 to 35 | Column 31, line 38 to Column 32, line 33 |
| pH of coatings of light-sensitive material | Column 72, lines 12 to 28 | | |
| Scanning exposure | Column 76, line 6 to Column 77, line 41 | Column 49, line 7 to Column 50, line 2 | Column 82, line 49 to Column 83, line 12 |
| Preservatives in developing solution | Column 88, line 19 to Column 89, line 22 | | |

As the cyan, magenta, and yellow couplers that can be used or additionally used in the present invention, in addition to those described in the above Table, couplers described, for example, in JP-A-62-215272, page 91, right upper column, line 4 to page 121, left upper column, line 6; JP-A-2-33144, page 3, right upper column, line 14 to page 18, left upper column, the last line, and page 30, right upper column, line 6 to page 35, right lower column, line 11; and EP-A-0 355 660 (A2), page 4, line 15 to line 27, page 5, line 30 to page 28, the last line, page 45, line 29 to line 31, and page 47, line 23 to page 63, line 50; JP-A-8-122984, and JP-A-9-222704 are also useful.

Known color-mix inhibitors can be used in the present invention. Of these compounds, preferred are those described in the following patents.

For example, the use can be made of high molecular redox compounds described in JP-A-5-333501; phenidone and hydrazine-series compounds described in, for example, Japanese Patent Application No. 9-140719, and U.S. Pat. No. 4,923,787; and white couplers described in, for example, JP-A-5-249637, JP-A-10-282615, and German Patent No. 19,629,142A1. Particularly, in order to increase the pH of a developing solution and to enable a rapid development, it is also preferred to use redox compounds described in German Patent No. 19,618,786A1, European Patent No. 0 839 623 A1, European Patent No. 0 842 975 A1, German Patent No. 19806846A1 and French Patent No. 276046A1.

In the present invention, it is preferred to use a compound composed of a triazine nucleus having a high molar extinction coefficient, as an ultraviolet ray absorbing agent. For example, use can be made of the compounds described in the following patents: JP-A-46-3335, JP-A-55-152776, JP-A-5-197074, JP-A-5-232630, JP-A-5-307232, JP-A-6-211813, JP-A-8-53427, JP-A-8-234364, JP-A-8-239368, JP-A-9-31067, JP-A-10-115898, JP-A-10-147577, JP-A-10-182621, German Patent No. 19739797A, European Patent No. 0 711 804 A, and JP-T-8-501291 ("JP-T" means a published searched patent publication).

As fungiproofing/mildewproofing agents that can be used in the present invention, those described in JP-A-63-271247 are useful. As a hydrophilic colloid used in photographic layers that constitute the light-sensitive material, gelatin is preferable, and in particular, heavy metals contained as impurities, such as iron, copper, zinc, and manganese are preferably 5 ppm or less and more preferably 3 ppm or less.

A protective layer for use in the present invention may be any layer, so long as under layers can be protected by it. It is preferred to use the protective layers described in U.S. Pat. Nos. 5,856,051 and 5,853,926.

Further, an amount of calcium to be incorporated in a light-sensitive material is preferably 20 mg/m$^2$ or less, more preferably 10 mg/m$^2$ or less, and most preferably 5 mg/m$^2$ or less.

The light-sensitive material of the present invention is not only preferably used for a print system using a usual nega-printer, but also preferably subjected to scanning exposure to light beams modulated according to image information, and then subjected to processing, as described below.

The light-sensitive material of the present invention is also suitable for scanning exposure systems using cathode rays (CRT).

In comparison with apparatuses using lasers, cathode ray tube exposure apparatuses are simple and compact and make the cost low. Further, the adjustment of optical axes and colors is easy.

For the cathode ray tubes used for image exposure, use is made of various emitters that emit light in spectral regions as required. For example, any one of, or a mixture of two or more of, a red emitter, a green emitter, and a blue emitter may be used. The spectral region is not limited to the above red, green, and blue, and an emitter that emits a color in the yellow, orange, purple, or infrared region may also be used. In particular, a cathode ray tube that emits white light by mixing these phosphors is often used.

When the light-sensitive material has multiple light-sensitive layers different in spectral sensitivity distributions, and the cathode ray tube has phosphors that show light emission in multiple spectral regions, multiple colors may be exposed at a time; namely, image signals of multiple colors are inputted into the cathode ray tube, to emit lights from the tube surface. A method in which exposure is made in such a manner that image signals for respective colors are inputted successively, to emit the respective colors successively, and they are passed through films for cutting out other colors (surface-successive exposure), may be employed, and generally the surface-successive exposure is preferred to make image quality high, since a high-resolution cathode ray tube can be used.

The light-sensitive material of the present invention is preferably used for digital scanning exposure system that uses monochromatic high-density light, such as a second harmonic generating light source (SHG) that comprises a combination of a nonlinear optical crystal with a semiconductor laser or a solid state laser using a semiconductor laser as an excitation light source, a gas laser, a light-emitting diode, or a semiconductor laser. To make the system compact and inexpensive, it is preferable to use a semiconductor laser or a second harmonic generating light source (SHG) that comprises a combination of a nonlinear optical crystal with a semiconductor laser or a solid state laser. Particularly, to design an apparatus that is compact, inexpensive, long in life, and high in stability, the use of a semiconductor laser is preferable, and it is preferable to use a semiconductor laser for at least one of the exposure light sources.

If such a scanning exposure light source is used, the spectral sensitivity maximum wavelength of the light-sensitive material of the present invention can arbitrarily be set by the wavelength of the light source for the scanning exposure to be used. In an SHG light source obtained by combining a nonlinear optical crystal with a semiconductor laser or a solid state laser that uses a semiconductor laser as an excitation light source, since the emitting wavelength of the laser can be halved, blue light and green light can be obtained. Therefore, the spectral sensitivity maximum of the light-sensitive material can be present in each of the usual three wavelength regions, the blue region, the green region and the red region.

If the exposure time in this scanning exposure is defined as the time for which a picture element size is exposed to light with the density of the picture element being 400 dpi, preferably the exposure time is $10^{-4}$ sec or less, more preferably $10^{-6}$ sec or less.

Preferable scanning exposure systems that can be applied to the present invention are described in detail in the patents listed in the above Tables.

Further, to process the light-sensitive material of the present invention, processing materials and processing methods described in JP-A-2-207250, page 26, right lower column, line 1, to page 34, right upper column, line 9, and in JP-A-4-97355, page 5, left upper column, line 17, to page 18, right lower column, line 20, are preferably applied. Further, as the preservative used for this developing solution, compounds described in the patents listed in the above Tables are preferably used.

As the systems for developing the light-sensitive material of the present invention after the exposure thereof, a wet system, such as the conventional method, in which development is carried out by using a developing solution containing an alkali agent and a developing agent, and a method in which a developing agent is built in the light-sensitive material and the development is carried out by using an activator solution, such as an alkali solution, free from any developing agent, as well as a heat development system that does not use a processing solution, can be used. Particularly, since the activator method does not contain a developing agent in the processing solution, the control and the handling of the processing solution are easy, and the load at the time of waste liquor treatment is less, which makes the activator method preferable in view of environmental conservation.

In the activator method, as the developing agent or its precursor to be built in the light-sensitive material, hydrazine-type compounds described, for example, in JP-A-8-234388, 9-152686, 9-152693, Japanese Patent Application No. 7-334197, and JP-A-9-160193 are preferable.

Further, a development method in which the coated amount of silver in the light-sensitive material is decreased, and an image intensification processing (intensification processing) is carried out using hydrogen peroxide, is also preferably used. Particularly, it is preferable to use this method for the activator method. Specifically, preferably use is made of image-forming methods described in JP-A-8-297354 and JP-A-9-152695, wherein an activator solution containing hydrogen peroxide is used.

Although, in the activator method, after the processing with an activator solution, a desilvering process is generally carried out, in the image intensifying process in which a light-sensitive material with the amount of silver lowered is used, the desilvering process can be omitted, and a simple process, such as a washing process or a stabilizing process, can be carried out. Further, in a system in which image information is read from a light-sensitive material by a scanner or the like, a processing mode without requiring a desilvering process can be employed, even when a light-sensitive material having a large amount of silver, such as a light-sensitive material for shooting (photographing), is used.

As the activator solution, the desilvering solution (bleach/fix solution), the processing material of washing and stabilizing solution, and the processing method that are used in the present invention, known ones can be used. Preferably, those described in Research Disclosure Item 36544 (September 1994), pages 536 to 541, and JP-A-8-234388, can be used.

Next, the processing steps of color development, desilvering, and washing and/or stabilizing in the color image forming method of the present invention are explained.

[Development]

As the color developer that can be used in the developing step in the color image forming method according to the present invention, can be mentioned those described in JP-A-3-33847, page 9, left upper column, line 6, to page 11, right lower column, line 6, and JP-A-5-197107.

As the color-developing agent in a color-developing step, known aromatic primary amine color-developing agents can be employed, and preferably p-phenylenediamine-series compounds are used. Representative examples thereof include 3-methyl-4-amino-N,N-diethylaniline, 3-methyl-4-amino-N-ethyl-N-β-hydroxyethylaminline, 3-methyl-4-amino-N-ethyl-N-β-methanesulfoneamidoethylaniline, 3-methyl-4-amino-N-ethyl-β-methoxyethylaniline, 4-amino-3-methyl-N-methyl-N-(3-hydroxypropyl)aniline, 4-amino-3-methyl-N-ethyl-N-(3-hydroxypropyl)aniline, 4-amino-3-methyl-N-ethyl-N-(2-hydroxypropyl)aniline, 4-amino-3-ethyl-N-ethyl-N-(3-hydroxypropyl)aniline, 4-amino-3-methyl-N-propyl-N-(3-hydroxypropyl)aniline, 4-amino-3-propyl-N-methyl-N-(3-hydroxypropyl)aniline, 4-amino-3-methyl-N-methyl-N-(4-hydroxybutyl)aniline, 4-amino-3-methyl-N-ethyl-N-(4-hydroxybutyl)aniline, 4-amino-3-methyl-N-propyl-N-(4-hydroxybutyl)aniline, 4-amino-3-ethyl-N-ethyl-N-(3-hydroxy-2-methylpropyl) aniline, 4-amino-3-methyl-N,N-bis(4-hydroxybutyl)aniline, 4-amino-3-methyl-N,N-bis(5-hydroxypentyl)aniline, 4-amino-3-methyl-N-(5-hydroxypentyl)-N-(4-hydroxybutyl)aniline, 4-amino-3-methoxy-N-ethyl-N-(4-hydroxybutyl)aniline, 4-amino-3-ethoxy-N,N-bis(5-hydroxypentyl)aniline, and 4-amino-3-propyl-N-(4-hydroxybutyl)aniline, and their sulfates, hydrochlorides or p-toluenesulfonates. Among these, particularly, 3-methyl-4-amino-N-ethyl-N-β-hydroxyethylaniline, 4-amino-3-methyl-N-ethyl-N-(3-hydroxypropyl)aniline, and 4-amino-3-methyl-N-ethyl-N-(4-hydroxybutyl)aniline, and their hydrochlorides, p-toluenesulfonates or sulfates are preferred. According to the purpose, two or more of these compounds can be used in combination.

Those described in EP-A-410 450, JP-A-4-11255, etc., can also be used preferably.

Further, these p-phenylenediamine derivatives and sulfates, hydrochlorides, sulfites, and salts of naphthalenedisulfonic acid or p-toluenesulfonic acid may also be used. The amount of the aromatic primary amine developing agent to be used is preferably 0.0002 to 0.2 mol, and more preferably 0.001 to 0.1 mol, per liter of the color developer.

Further, if necessary, to the color developer, can be added a sulfite, such as sodium sulfite, potassium sulfite, sodium bisulfite, potassium bisulfite, sodium metasulfite, and potassium metasulfite, or a carbonyl sulfite adduct, as a preservative.

In the color developer, if necessary, an arbitrary development accelerator can be added.

Examples of the development accelerator include the following compounds: thioether compounds described, for example, in U.S. Pat. No. 3,813,247; p-phenylenediamine compounds described in JP-A-52-49829 and JP-A-50-15554; quaternary ammonium salts described, for example, in JP-B-44-30074 ("JP-B" means an examined Japanese patent publication); amine compounds described, for example, in U.S. Pat. Nos. 2,482,546, 2,596,926, and 3,582,346; polyalkylene oxides described, for example, in U.S. Pat. No. 3,532,501, as well as 1-phenyl-3-pyrazolidons, imidazoles, and the like can be added, if necessary.

In addition, various chelating agents can be used in a color-developing solution, as a precipitation-preventing agent against calcium and magnesium, or as an agent for improving stability of the color-developing solution. Examples include nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediaminetetraacetic acid, 1,2-diaminopropanetetraacetic acid, glycol ether diaminetetraacetic acid, ethylenediamine orthohydroxyphenylacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, and hydroxyethyliminodiacetic acid. Two or more of these chelating agents may be used in combination, if necessary.

With respect to the amount of these chelating agents to be added, preferably the amount is enough to sequester the metal ions in the color-developing solution, for example, in an amount of about 0.1 to 10 g per liter.

In the present invention, if required, an arbitrary antifoggant can be added. As the antifoggant, the alkali metal halide, such as sodium chloride, potassium bromide, and potassium iodide, and an organic antifoggant, can be used. Typical examples of the organic antifoggant include nitrogen-containing heterocyclic compounds, such as benzotriazole, 6-nitrobenzimidazole, 5-nitroisoindazole, 5-methylbenzotriazole, 5-nitrobenzotriazole, 5-chlorobenzotriazole, 2-thiazolyl-benzimidazole, 2-thiazolylmethyl-benzimidazole, indazole, hydroxyazaindolidine, and adenine.

In the present invention, it is preferable to incorporate a chloride ion in a color developing solution in an amount of $3.0\times10^{-2}$ mol/l to 1.5'$10^{-1}$ mol/l, especially preferably $3.5\times10^{-2}$ mol/l to $1.0\times10^{-1}$ mol/l. When the chloride ion concentration is too high, the development may be retarded unfavorably. This may be against the object of the present invention, i.e. to rapidly attain a high maximum density. On the other hand when the chloride ion concentration is too low, that may be of no advantage to the fogging inhibition.

It is preferred in the present invention that the color developing solution contains $0.5\times10^{-5}$ mol/l to $1.3\times10^{-3}$ mol/l of bromide ion. The bromide ion concentration is more preferably $3.0\times10^{-5}$ mol/l to $5\times10^{-4}$ mol/l. When the bromide ion concentration is too high, the development may be retarded and the maximum density and sensitivity may be lowered. When the bromide ion concentration is too low, the fogging cannot be completely inhibited in some cases.

In the present invention, the chloride ion and the bromide ion may be directly added to the color developing solution, or may be contained in the photosensitive material so that they are eluted into the color developing solution during the developing process.

When these are directory added to the color developing solution, as a chloride-ion-supply substance, sodium chloride, potassium chloride, ammonium chloride, lithium chloride, magnesium chloride, or calcium chloride can be mentioned. Further, it may be supplied from a fluorescent-whitening agent contained in the color developing solution. As a bromide-ion-supply substance, sodium bromide, potassium bromide, ammonium bromide, lithium bromide, calcium bromide, or magnesium bromide, can be mentioned.

When the chloride ion and the bromide ion are eluted from the light-sensitive material in the developing process, these ions may be fed by an emulsion or other materials.

Preferably, the color developing solution which is used in the step of development according to the present invention, is substantially free from benzyl alcohol. The term "substantially free from benzyl alcohol" herein indicates that the benzyl alcohol concentration is preferably 2 ml/l or less, further preferably 0.5 ml/l or less, and most preferably no benzyl alcohol is contained.

It is also preferred that the color-developing solution for use in the present invention is substantially free of sulfite ion so as to inhibit a change in the photographic properties due to the continuous processing, and also to obtain the effects of the present invention. The term "substantially free of sulfite ion" herein indicate that the sulfite ion concentration is generally $3.0\times10^{-3}$ mol/l, preferably $1.0\times10^{-3}$ mol/l or less, and most preferably, the developing solution is completely free of sulfite ion, except for a very small amount of the sulfite ion used for inhibiting the oxidation of a processing kit containing the concentrated developing agent to be used for preparing the developing solution.

Further, it is more preferable that the color developing solution for use in the present invention is substantially free of hydroxylamine (namely, the hydroxylamine concentration is not higher than $5.0\times10^{-3}$ mol/l) so as to inhibit the change of the photographic properties due to the change in the concentration of hydroxylamine. Most preferably, the developing solution is completely free of hydroxylamine.

The color developing solution used in the present invention preferably has a pH of 9 to 13, and more preferably 9 to 12.5. In the color developing solution, compounds known as developer substances can be included. To retain the above pH, it is preferable to use various buffers.

Specific examples of these buffers include, sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-suofosalicylate), and potassium 5-sulfo-2-hydroxybenzoate (potassium 5-sulfosalicylate).

The amount of the buffers to be added to the color developing solution, is preferably 0.1 mol/liter or more, and particularly preferably 0.1 to 0.4 mol/liter.

The processing temperature with the color developing solution in the present invention ranges generally from 20 to 55° C., preferably 30 to 55° C. The processing time of the light-sensitive material for photographing is generally 20 sec. to 5 min., preferably 30 sec. to 3 min. and 20 sec., more preferably 1 min. to 2 min. and 30 sec., where as it is generally 3 sec. to 60 sec., preferably 3 sec., to 45 sec., more preferably 5 sec. to 25 sec. for the photographic material for prints.

[Desilvering Step]

Next, the desilvering processing is explained.

The present invention is characterized by adding a compound represented by the above-described formula [A] (hereinafter described in detail) as an accelerator for removing a developing agent in any one of the desilvering step and the washing and/or stabilization step explained below.

In the desilvering, a bleach processing and a fixing processing may be carried out separately, or simultaneously (i.e., bleach-fixing processing). A preferable embodiment of the desilvering step in the present invention is the bleach-fixing processing for a purpose of simplifying the step and shortening the time for processing. For further advances in processing speed, a processing method of carrying out a bleach-fixing processing following the bleach processing may be used. Further the desilvering step may be optionally carried out by a continuous processing with a bleach-fixing bath using two tanks, or by a fixing processing prior to the bleach-fixing processing, or by a bleaching processing following the bleach-fixing processing, as the needs of the case demand.

The desilvering step is generally carried out with appropriately combined steps of a bleaching step, a bleach-fixing step, and a fixing step.

Examples of the bleaching agent in a processing solution having bleaching capacity include compounds of polyvalent metals, such as iron(III), peracids, quinones, and nitro compounds. Examples of the typical bleaching agent include organic complex salts of iron(III), such as iron complex salts of ethylenediaminetetraacetic acid, diethylenetriaminepentaacetic acid, cyclohexandiaminetetraacetic acid, methyliminodiacetic acid, or glycol ether diaminetetraacetic acid; bleaching agents such as 1,3-propylenediaminetetraacetic acid iron complex salt, described in JP-A-4-121739, from page 4, lower right column, to page 5, upper left column; carbamoyl bleaching agents described in JP-A-4-73647; bleaching agents having a heterocyclic ring, described in JP-A-4-174432; bleaching agents described in EP-A-520 457, such as N-(2-carboxyphenyl)iminodiacetic acid ferric complex salt; bleaching agents described in EP-A-530 828 (A1), such as ethylenediamine-N-2-carboxyphenyl-N,N',N'-triacetic acid ferric acetate; bleaching agents described in EP-A-501 479, bleaching agents described in EP-A-567

126, bleaching agents described in JP-A-4-127145, and aminopolycarboxylic acid ferric salts or their salts, as described in JP-A-3-144446, page (11), all of which are not to be construed as limiting the present invention.

Further, to the bleaching solution, the bleach-fix solution, or their preceding bath according to the present invention, are added a bleaching accelerator, a corrosion inhibitor for preventing a processing bath tank from being corroded, a buffer for keeping the pH of the solution, a fluorescent whitening agent, an antifoaming agent, and the like, if necessary.

Examples of the bleaching accelerator that can be used, include, for example, compounds having a mercapto group or a disulfide group, as described in U.S. Pat. No. 3,893,858, German patent No. 1 290 812, British patent No. 1 138 842, JP-A-53-95630, and Research Disclosure No. 17129 (July, 1978); thiazolidine derivatives, as described in JP-A-50-140129; thiourea derivatives, as described in U.S. Pat. No. 3,706,561; iodides, as described in JP-A-58-16235; polyethylene oxides, as described in German patent No. 2 748 430; polyamine compounds, as described in JP-B-45-8836; and bromide ion. Among them, compounds having a mercapto group or a disulfide group are preferable, because they are high in accelerating effect, and specifically, compounds described in U.S. Pat. No. 3,893,858, West Germany patent No. 1,290,812, and JP-A-53-95630 are preferable. Further, compounds described in U.S. Pat. No. 4,552,834 are also preferably used. These bleach-accelerating agents may be added into a light-sensitive material. These bleaching accelerators are particularly effective when bleach-fixing a color light-sensitive material for shooting (photographing). Particularly preferably, the bleaching accelerators are mercapto compounds described in GB-1 138 842 and JP-A-2-190856.

In the bleaching solution and the bleach-fix solution, besides the above-mentioned compounds, it is preferable to contain an organic acid, for the purpose of preventing bleach stain. The particularly preferable organic acid is a compound having an acid dissociation constant (pKa) of 2 to 5.5, and specifically acetic acid, and propionic acid are preferable.

Further, a nitric acid salt is preferably used as a corrosion inhibitor, and examples include ammonium nitrate, sodium nitrate, and potassium nitrate. The amount of the nitric acid salt to be added is generally from 0.01 to 2.0 mol/l, and preferably from 0.05 to 0.5 mol/l.

In recent years, awareness of preservation of the earth's environment has increased, and attempts are being made to decrease nitrogen atoms discharged into the environment. From this point of view, desirably, the processing solution according to the present invention is substantially free from ammonium ions.

In the present invention, the term "substantially free from ammonium ions" means that the concentration of ammonium ions is generally 0.1 mol/liter or less, preferably 0.08 mol/liter or less, more preferably 0.01 mol/liter or less, and particularly preferably no ammonium ion is contained.

To reduce the concentration of ammonium ions to the range for use in the present invention, as an alternative cation species, an alkali metal ion or an alkaline earth metal ion is preferable, and particularly an alkali metal ion is preferable. Among others, a lithium ion, a sodium ion, and a potassium ion are particularly preferable. Specifically, as bleaching agents, sodium salts or potassium salts of organic acid ferric complexes, and, as rehalogenating agents in the processing solution having bleaching capacity, potassium bromide and sodium bromide, as well as potassium nitrate and sodium nitrate, can be mentioned as examples.

Further, as an alkali agent used for adjusting the pH, for example, potassium hydroxide, sodium hydroxide, potassium carbonate, and sodium carbonate are preferable.

In the present invention, the pH of a bleaching solution or bleach-fix solution is generally from 2.0 to 8.0, preferably from 3.0 to 7.5, and more preferably from 4.5 to 6.0.

In the present invention, particularly preferably, the processing solution having bleaching capacity is subjected to aeration at the time of the processing, because such aeration keeps photographic properties extremely stable.

Bleaching or bleach-fixing process can be carried out at a temperature of generally 30° C. to 60° C., and preferably 35° C. to 50° C.

The light-sensitive material processed with a processing solution having a bleaching capacity is fixed or bleach-fixed. When the processing solution having a bleaching capacity is a bleach-fix solution, thereafter a fixing process or a bleach-fix process may or may not be carried out. The fixing solution or the bleach-fix solution is also preferably one described in JP-A-3-33847, page 6, lower right column, line 16, to page 8, upper left column, line 15.

As the fixing agent in the desilvering step, ammonium thiosulfate is generally used, but other known fixing agents, such as meso-ionic compounds, thioether compounds, thioureas, large amounts of iodides, or hipo, may substitute for it. These are described, for example, in JP-A-60-61749, JP-A-60-147735, JP-A-64-21444, JP-A-1-201659, JP-A-1-210951, JP-A-2-44355, and U.S. Pat. No. 4,378,424. Examples include ammonium thiosulfate, sodium thiosulfate, potassium thiosulfate, guanidine thiosulfate, ammonium thiocyanate, sodium thiocyanate, potassium thiocyanate, dihydroxyethyl-thioether, 3,6-dithia-1,8-octanediol, and imidazole. Among these, thiosulfates and meso-ionic compounds are preferable. In view of quick fixability, ammonium thiosulfate is preferable, but if the environmental problem is taken into account as described above to make the processing solution substantially free from ammonium ions, sodium thiosulfate and meso-ionic compounds are further preferable. Furthermore, a combination of two or more fixing agents can be used to perform further rapid fixing. For example, a combination of ammonium thiosulfate or sodium thiosulfate with the above ammonium thiocyanate, imidazole, thiourea, a thioether, or the like is preferably used. In this case, the second fixing agent is preferably added in an amount in the range of 0.01 to 100 mol % to ammonium thiosulfate or sodium thiosulfate.

The amount of the fixing agent is generally 0.1 to 3.0 mol, and preferably 0.5 to 2.0 mol, per liter of the bleach-fix solution or the fixing solution. The pH of the fixing solution varies depending on the type of the fixing agent, and it is generally 3.0 to 9.0. Particularly, when a thiosulfate is used, the pH of the fixing solution is preferably 5.8 to 8.0, because stable fixing performance can be obtained.

A preservative can be added to the bleach-fix solution or the fixing solution, to increase the stability of the solution with the lapse of time. In the case of the bleach-fix solution or fixing solution containing a thiosulfate, as a preservative, a sulfite and/or hydroxylamine, hydrazine, a bisulfite adduct of an aldehyde (e.g. a bisulfite adduct of acetaldehyde, and particularly preferably a bisulfite adduct of an aromatic aldehyde, described in JP-A-1-298935) is effective.

Further, in the present invention, preferably the bleach-fix solution or fixing solution contains at least one sulfinic acid and its salt.

The amount of the sulfinic acid or its salt that will be added to the bleach-fix solution or the fixing solution is generally $1\times10^{-4}$ to 1 mol, preferably $1\times10^{-3}$ to 0.5 mol, and more preferably $1\times10^{-2}$ to 0.1 mol, per liter of the processing solution.

The shorter the total time of the desilvering process including bleach/fix process in the present invention is, the more preferable it is, as long as the shortening of the processing time does not cause defective desilvering. A preferable total time is 5 sec to 1 min, and more preferably 5 sec to 25 sec. Further, the processing temperature is generally 25 to 50° C. and preferably 35 to 45° C. Within the preferable range of the processing temperature, the desilvering rate is increased and the occurrence of stain after the processing can be effectively prevented.

Further, each of the above-described processing solutions for use in the present invention may be applied by a method of injecting (jetting) a solution pushed by a pump, out of a slit or a nozzle set vis-à-vis with the emulsion face, as described in, for example, JP-A-62-183460, page 3 right lower column to page 4 right lower column of Example section.

Further, in the processing according to the present invention, any state of the liquid opening rate [contact area of air ($cm^2$)/liquid volume ($cm^3$)] of any of the baths can exhibit relatively excellent performance than combination of baths different from those used in the present invention, but in view of the stability of the liquid components, preferably the liquid opening rate is 0 to 0.1 $cm^{-1}$. In the continuous processing, from a practical point of view, the liquid opening rate is preferably 0.001 $cm^{-1}$ to 0.05 $cm^{-1}$, and more preferably 0.002 to 0.03 $cm^{-1}$.

[Washing and/or Stabilization]

Next, washing and/or stabilization steps in the method of forming a color image of the present invention, are explained.

As a processing method in the washing and/or stabilization steps, the use can be made of any one of known methods described in JP-A-57-8543, JP-A-58-14834, and JP-A-60-220345. Further, the washing step and the stabilization step may be carried out using a stabilizing bath containing a dye stabilizer and a surface active agent, as a final bath.

The volume of a washing water can be determined variously depending on the characteristics of a light-sensitive material (depending on the kind of materials such as a coupler, which is incorporated therein), the end-use purpose of the light-sensitive material, the temperature of the washing water, the number of washing tanks (the number of stages), the replenishment system such as a countercurrent and a fair current, and other various conditions.

The washing water or stabilizing solution used in the washing and/or stabilizing step may contain various surface-active agents, to prevent the processed light-sensitive material from being dried unevenly due to water droplets. Examples of the surface-active agents include polyethylene glycol-type nonionic surface-active agents, polyhydric alcohol-type nonionic surface-active agents, alkylbenzenesulfonate-type anionic surface-active agents, higher alcohol sulfate-type anionic surface-active agents, alkylnaphthalenesulfonate-type anionic surface-active agents, quaternary ammonium salt-type cationic surface-active agents, amine salt-type cationic surface-active agents, amino acid-type amphoteric surface-active agents, and betaine-type amphoteric surface-active agents. Among these, since ionic surface-active agents sometimes combine with various ions introduced unintentionally along with the processing to form insoluble substances, nonionic surface-active agents are preferably used, with particular preference given to alkylphenol ethylene oxide adducts. The alkylphenol is particularly preferably octylphenol, nonylphenol, dodecylphenol, or dinonylphenol, and the addition molar number of ethylene oxide is particularly preferably 8 to 14 (mol). Further, a silicon-series surface-active agent high in antifoaming effect is also preferably used.

Further, as a dye stabilizer in the stabilizing solution, use can be made of aldehydes such as formaldehyde and glutaraldehyde, N-methylol compounds, hexamethylenetetramine or aldehyde-sulfilic acid adduct, and the like. Further, the stabilizing solution may incorporate a buffer for the pH adjustment such as boric acid and sodium hydroxide; 1-hydroxyethylidene-1,1-diphosphonic acid; a chelating agent such as ethylenediamine tetraacetic acid; an antisulfurizing agent such as Alkanolamine; a fluorescent brightening agent; a mildew-proofing agent; and the like.

Further, the washing water and/or stabilizing solution can contain a variety of bacteria-proofing agents and mildew-proofing agents, to prevent the formation of scale or the existence of mildew occurring on processed light-sensitive materials. As the bacteria-proofing agents and mildew-proofing agents, can be used, for example, one or more of thiazorilbenzimidazole compounds, as described in JP-A-57-157244 and JP-A-58-105145, isothiazolone compounds, as described in JP-A-54-27424 and JP-A-57-8542, and general-purpose mildew-proofing agents described in "Journal Antibacteria and Antifungus Agents," Vol. 1, No. 5, pp 207 to 223 (1983), such as chlorophenol compounds, represented by trichlorophenol; bromophenol compounds, organotin compounds, organozinc compounds, thiocyanic acid compounds, isothiocyanic acid compounds, acid amide compounds, diazine compounds, triazine compounds, thiourea compounds, benzotriazolealkylguanidine compounds, quaternary ammonium salts, represented by benzalkonium chloride; or antibiotics, represented by penicillins. Further, various fungicides described in JP-A-48-83820 can be used.

In order to solve the problems such as the propagation of bacteria and the adhesion stain of suspended matter on the photographic material, due to remarkable reduction of the amount of washing water in multi-stage counter current system, use can be made quite effectively of a method of reducing Mg ions and Ca ions, as described in JP-A-62-288838.

Further, preferably, various chelating agents are additionally used, as long as the addition does not damage the effects of the compounds for use in the present invention. Preferable compounds as the chelating agents include, for example, aminopolycarboxylic acids, such as ethylenediaminetetraacetic acid and diethylenetriaminepentaacetic acid, organic phosphonic acids, such as 1-hydroxyethylidene-1,1-diphosphonic acid and ethylenediamine-N,N,N',N'-tetramethylenephosphonic acid, and hydrolyzates of maleic anhydride polymers described in EP-A-345 172 (A1).

Further, it is preferable to include stabilizers, which can be included in the above fixing solution and bleach-fix solution, in the washing water.

As the water used in the washing step or the stabilizing step, besides tap water, water deionized with ion exchange resins to bring the concentrations of Ca and Mg to 5 mg/liter or below, or water sterilized with a halogen lamp, an ultraviolet germicidal lamp, or the like, is preferably used.

The pH of the washing water is generally 4 to 9, and preferably 5 to 8. The processing time of washing can be widely set according to the property of a light-sensitive material, or in accordance with purpose, and the time is preferably 10 sec to 90 sec, and more preferably 10 sec to 45 sec. The temperature of washing water is preferably 15 to 50° C., and more preferably 35 to 50° C.

The overflow solution associated with the replenishment of the above washing water and/or the stabilizing solution, can be recycled and reused in other processes, such as the desilvering process.

When processing is carried out by using an automatic processor, if each of the processing solutions is concentrated due to evaporation, preferably water is added to compensate for the evaporation.

In the present invention, as washing water and/or stabilizing water, can be used effectively water that has been treated with a reverse osmosis membrane. As the material of the reverse osmosis membrane, for example, cellulose acetates, crosslinked polyamides, polyethers, polysulfons, polyacrylic acids, and polyvinylene carbonates can be used.

The pressure of the forced solution in the use of these membranes is preferably 2 kg/cm$^2$ to 10 kg/cm$^2$, particularly preferably 3 kg/cm$^2$ to 7 kg/cm$^2$, from the viewpoints of a stain-preventing effect and restraint of reduction in the amount of a permeating water.

Preferably washing and/or stabilization are effected by multi-tanks countercurrent cascade system. Especially two to five tanks are preferably used.

A drying in the present invention is effected by any one of previously known methods of rapidly drying a color photographic light-sensitive material. It is preferable from the object of the present invention to dry a color printing photographic material within 20 sec., more preferably within 15 minutes, most preferably in the range of 5 sec. to 10 sec. The drying system may be a contact heating system or a warm air spray system, but a combination of these systems is preferred because higher speed drying can be performed by such combined system, in comparison with any one of these systems. More preferable embodiment of the present invention with respective to a drying method is a system of heating a light-sensitive material by contact on a heat roller, and thereafter drying the light-sensitive material by blast of a warm air blown out thereto from a perforated plate or nozzles. At the air blast drying portion, the mass velocity of a warm air sprayed per unit area of the heating surface of the light-sensitive material is preferably 1000 kg/cm$^2$•hr or more. Further, it is preferable that the shape of an air blast opening be a shape which minimizes pressure loss. Specific examples of the shape of an air blast opening and other things include constructions shown in, for example, JP-A-9-133998 (FIG. 7 to FIG. 15).

The replenishment at the steps of color development, desilvering, washing and/or stabilization in the present invention may be effected not only by replenishing with a replenisher having an unitary composition, but also by replenishing with separated plural replenishers each having a different composition from each other, or by conducting separately the replenishment with a single or plural replenishers or with water, and addition of a solid material comprising a replenishment ingredient. The replenishment rate per one step in the present invention is defined as follows:

When the replenishment is effected using separated plural replenishers, the replenishment rate is indicated by the amount of volume increased by the replenishment, and When the replenishment is effected by conducting separately the replenishment with a single or plural replenishers or with water, and addition of a solid material comprising a replenishment ingredient, the replenishment rate is also indicated by the amount of volume increased by the replenisher(s) and the solid material.

The low replenishment rate condition for the processing in the present invention depends on the type of the photographic material to be processed, and so in a case of adopting the photographic processing for the color photographic material for prints, the replenishment rate based on 1 m$^2$ of the light-sensitive material is preferred by that the replenishment rate for the color developing solution is 10 to 60 ml/m$^2$, more preferably 20 to 45 ml/m$^2$, and at the same time the replenishment rate for the bleach-fixing solution is preferably 20 to 50 ml/m$^2$, and the replenishment rate for the washing and/or stabilizing solution is preferably 50 to 100 ml/m$^2$. Further, the total replenishment rate in all processing steps is preferably 70 to 200 ml/m$^2$, more preferably 90 to 160 ml/m$^2$.

The term "continuous processing" in the present invention indicates a processing of the light-sensitive material, which necessitates a substantial replenishment to a processing solution. More specifically, it means that a development processing is carried out for plural days under such condition that the average replenishment rate per day in the processing for the color prints would be equivalent to 0.1 to 20% of the capacity of the processing tank. Particularly the condition under which the reduction in stains and the stabilization of the photographic properties are effectively obtained in a simple and rapid processing is that the average replenishment rate per day is preferably 0.1 to 20%, more preferably 0.2 to 10%, and most preferably 0.5 to 6%, of the capacity of the development processing tank. At this time, the capacity of the color developing tank, though it is not limited in particular, is generally 50 l or less, preferably 0.2 to 20 l, and most preferably 1 to 10 l. Further, the amount of processing is to be determined by the replenishment rate per square meter of the light-sensitive material and the average replenishment per day. Specifically, in the case of a light-sensitive material for color prints, the average amount per day is preferably 0.1 to 80 m$^2$, more preferably 0.2 to 60 m$^2$, and most preferably 0.1 to 30 m$^2$.

The advances in processing speed in the present invention means to shorten a period of time necessitated after the exposed light-sensitive material is processed and until an image is obtained following the drying step. Specifically, according to a preferable embodiment of the present invention, the total processing time of all the processing steps can be reduced to the period of time ranging generally from 30 sec. to 90 sec., preferably 50 sec. to 90 sec., by shortening the processing time necessitated for at least one of the steps of color development, desilvering, washing/stabilization, and drying. For each of the processing steps, the processing time of each of the development step and the desilvering step is preferably within 30 sec, more preferably 5 to 25 sec. Further, at the same time, it is preferable that the ratio of the processing time of the washing and/or stabilization step ($T_w$) to the processing time of the bleach-fixing step ($T_{bf}$), (i.e. $T_w/T_{bf}$) be 1.3 or less. The term "ultra-rapid type processing" herein means a method of processing a light-sensitive material comprising a silver halide emulsion whose silver chloride content of 95 mol % or more in a preferable total processing time as described above.

The processing time of the steps in the present invention means a period of time required from the start of a processing of the light-sensitive material at a step, to the start of a processing at a subsequent step. In the present invention, the term "the start of the development step" means the time when the light-sensitive material is dipped into a color developing solution, while the term "the end of the drying step" means the time when the light-sensitive material goes on the final conveyor roller at the drying step.

An actual processing time by means of an automatic processor is generally determined by a linear velocity and a capacity of the processing bath. A standard of the linear velocity which can be used in the present invention is generally 400 to 4000 mm/min. Particularly, in the case of a small size processor which is called "mini labo", it is preferably 500 to 2500 mm/min.

In the present invention, the processings of washing and/or stabilization are preferably conducted by a multi-stage counter-current system. At this time, it is more preferable that a light-sensitive material be transferred in a solution from a tank to another not so as to be brought into contact with air. The transfer in the solution between tanks can be carried out by, for example, a method wherein a path-way for the light-sensitive material is made between tanks and said path-way can be opened and shut by means of shutter means. At this time, as the shutter means, it is preferable that a pair of flexible blades be set so that only tips of the blades come into a flexible contact with each other.

In the present invention, at least one of the steps of development, desilvering, and washing and/or stabilization is preferably carried out in the presence of a diaminostilbene-series fluorescent brightening agent. Specifically, preferable examples of the diaminostilbene-series fluorescent brightening agent are compounds described in Tables 1 to 6 of JP-A-6-332127. Of these fluorescent brightening agent, compounds (SR-1) to (SR-16) are particularly preferred. The diaminostilbene-series fluorescent brightening agent, though it can be incorporated in any one of a light-sensitive material and a processing solution, is preferably incorporated in the processing solution. When the fluorescent brightening agent is incorporated in a processing solution, it is preferably incorporated in any one of the processing solutions used in each of the steps of (1) development, (2) desilvering, and (3) washing and/or stabilization. It is more preferable that the fluorescent brightening agent be substantially incorporated in each of the solutions used in plural steps. The term "desilvering step" herein means any one of the steps of bleach, fixing and bleach-fixing, and a combination of these steps.

In the present invention, the amount of a recycle processing solution to be sprayed generally ranges from 1 l/min. to 40 l/min. The amount to be recycled is generally 5 to 30 l/min. and preferably 10 to 25 l/min. in order to attain the above amount to be sprayed. The amount to be recycled is equal to or more than the amount to be sprayed. The recycle amount may be the same as the spray amount. In the present invention, it is necessary that the recycle system be under the above-described conditions at least the time when a light-sensitive material is processed. Further, when a power source of the processor turns on electricity, the recycle system may be under the above-mentioned conditions. The recycle and the spray may be any one of the embodiment wherein the recycle is performed in a processing tank, and the other wherein a recycle solution is sprayed onto the light-sensitive layer side of a light-sensitive material. In the present invention, the recycle solution is sprayed onto at least the light-sensitive layer side of the light-sensitive material. The spray is preferably carried out in a solution. The recycle solution, after filtration through a filter according to a usual manner, is returned to a processing solution tank. The amount of a recycle processing solution to be sprayed is preferably 5 to 25 l/min. The recycle rate of a processing solution is preferably 1.0 to 40 l/min., more preferably 5 to 30 l/min., per a processing tank. When the spray rate is low, the effects of the present invention is hard to be obtained. On the other hand, when the spray rate is too high, deterioration of the processing solution tends to accelerate unpreferably.

It is preferable that the nozzles of the recycled processing solution, which have a diameter of 1 to 4 mm, and also are oriented at right angles to a light-sensitive layer of the light-sensitive material, be set at 10 to 100 places, and also preferably 5 to 50 places in practical view, per a tank. Further, the distance between the nozzle and the light-sensitive layer surface is preferably 1.0 to 50 mm, more preferably 2.0 to 20 mm. Further, the processing solution preferably runs from one nozzle at a speed of 1 to 100 cm/sec. or more, more preferably 5 to 50 cm/sec.

In the present invention, the means of spraying a recycle solution as described above, though it may be set at any one of the processing steps, is preferably set at least in the development step, more preferably in the development step and the washing and/or stabilization step. An embodiment wherein such means are set in all of the steps, is most preferred, because improvement in stain can be effected. Further, a preferable embodiment wherein the spray means is set in the washing and/or stabilization step, is that the washing and/or stabilization step is divided into at least three tanks, and also the means of spraying a recycle solution is set at least onto the final tank, more preferably they are set in both the final tank and the tank preceding thereto, and most preferably they are set onto all of the tanks in the washing and/or stabilization step. Further, the washing and/or stabilization step is preferably divided into 3 to 12 tanks, more preferably 3 to 10 tanks.

Further, as a method of conveying a light-sensitive material between tanks in the divided washing and/or stabilization step, an embodiment wherein the light-sensitive material is allowed to move in a solution via blades set on the wall of the tanks, is preferred from a viewpoint that the time staying in the air can be shortened. Further, it is preferable that the nozzle which is used to spray a recycle solution, be set in between a conveyer roller and a blade equipped between tanks. At this time, the nozzle for a spray may be set only in the light-sensitive layer side of the light-sensitive material. However, in the multi-chamber type washing step, and the like, a method of spraying a solution from both sides of the surfaces of a light-sensitive material, is preferred because troubles such as jamming at the time of conveyance are inhibited thereby.

The silver halide color photographic light-sensitive material of the present invention has an excellent rapid processing suitability. That is, the present invention exhibits excellent effects that not only high sensitivity is obtained but also increase in fogging is suppressed, even when the silver halide color photographic light-sensitive material is subjected to a rapid processing.

The use of the silver halide color photographic light-sensitive material of the present invention enables to reduce an image-forming time at color development, a bleach-fixing time, and a washing time, without any harmful influence, and to form an image excellent in fastness. Further, the light-sensitive material having a polyolefin sheet carrying microscopic pores according to the present invention reduces both a pressure-induced fog and a dependence on humidity of the curl.

The silver halide color photographic light-sensitive material of the present invention can render the color development time extremely short. The color image-forming method of the present invention using said silver halide color photographic light-sensitive material exhibits an excellent effect that a development processing in a quite short period of time can be conducted, without insufficient maximum density due to blix discoloration or failure of color development.

EXAMPLES

The present invention will be described in more detail with reference to examples, but the present invention is not limited to these.

Example 1

(Emulsion a; Preparation of Cubic Silver Chloride)

4.8 g of sodium chloride and 30 g of inert gelatin were added to 1.1 l of water. To the resultant solution kept at 45° C., 18 cc of a 0.35 M silver nitrate solution and 18 cc of a 0.35 M sodium chloride solution were added with stirring over 3 minutes according to a double jet method. After stirring was continued for 10 minutes, 280 cc of a 0.35 M silver nitrate solution and 280 cc of a 0.35 M sodium chloride solution were further added over 18 minutes in the same manner as the above, except for at an accelerated flow rate. Further, 3 minutes later, 595 cc of a 1.18 M silver nitrate solution and 595 cc of a 1.18 M sodium chloride solution containing $2\times10^{-8}$ mol of iridium hexachloride were added over 41 minutes at an accelerated flow rate. Further, 2 minutes later, 170 cc of a 1.18 M silver nitrate solution and 170 cc of a 1.18 M sodium chloride solution, and also simultaneously 38 cc of a 0.0033% potassium ferrocyanide solution were added, over 10 min. From 20 minutes after the beginning of the third addition, the temperature in a reaction vessel was increased from 45° C. to 60° C., over 10 minutes. Thereafter, to the reaction vessel, added were 33.5 cc of a 0.1 N thiocyanic acid solution, 0.24 mmol of Sensitizing dye A, 0.36 mmol of Sensitizing dye B and 0.05 mmol of Sensitizing dye C.

(Sensitizing dye A)

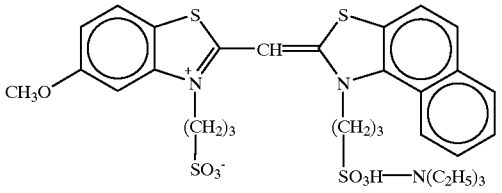

(Sensitizing dye B)

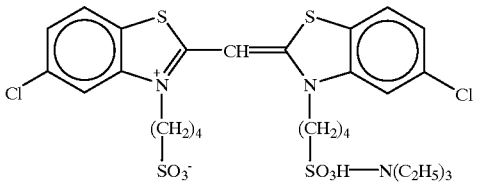

(Sensitizing dye C)

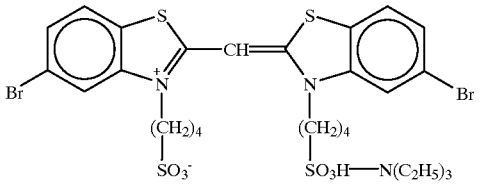

After cooling down to 40° C., desilvering was carried out according to an ordinary flocculation method. After washing, 67 g of gelatin, 80 cc of phenol (5%) and 150 cc of distilled water were added. The pH and pAg of the resultant emulsion were adjusted to 6.2 and 7.5, respectively, using sodium hydroxide and a silver nitrate solution. The obtained grains were cubic grains having a circle-equivalent diameter (a diameter of a circle equivalent to the projected area of an individual grain) of 0.65 $\mu$m.

(Emulsion b; Preparation of Cubic Silver Iodochloride whose Shell Part Contained 0.2 mol % of Iodide Based on Total Silver)

Emulsion b was prepared in the same manner as Emulsion a, except that two mmol of potassium iodide was further added to an aqueous sodium chloride solution to be simultaneously added with silver nitrate of the last addition.

(Emulsion c; Preparation of Cubic Silver Iodochloride whose Shell Part Contained 0.4 mol % of Iodide Based on Total Silver)

Emulsion c was prepared in the same manner as Emulsion a, except that 4 mmol of potassium iodide was further added to an aqueous sodium chloride solution to be simultaneously added with silver nitrate of the last addition.

(Emulsion d. Preparation of {111} high silver chloride abular grains)

2.0 g of sodium chloride and 2.8 g of inert gelatin were added to a container containing 1.2 l of water. To the resultant container with stirring while maintaining at the temperature of 33° C., 45 cc of an aqueous solution of silver nitrate (containing 18 g of silver nitrate) and 45 cc of an aqueous solution of sodium chloride (containing 6.4 g of sodium chloride) were added over one minute according to a double jet method. One minute after the completion of the addition, 0.8 mmol of Crystal habit controlling agent 1 and 560 g of a 10% aqueous solution of phthalated gelatin were added. Further one minute later, 3.0 g of sodium chloride was added. During the next 25 min, the temperature of the container was increased to 60° C. After a ripening of 16 minutes at 60° C., 3 g of sodium chloride and $1\times10^{-5}$ mol of sodium thiosulfonate were added. Thereafter, 295 cc of an aqueous solution of silver nitrate (containing 118 g of silver nitrate), 295 cc of an aqueous solution of sodium chloride (containing 50.3 g of sodium chloride and $2\times10^{-8}$ mol of hexachloro iridium), and 160 cc of an aqueous solution of Crystal habit controlling agent 1 (M/50) were added at an accelerated flow rate, over 13 minutes. Further, two minutes later, an aqueous solution of silver nitrate (containing 34 g of silver nitrate) and an aqueous solution of sodium chloride (containing 11.6 g of sodium chloride, and 1.27 mg of potassium ferrocyanide) were added over 5 minutes. Then, 33.5 cc of a 0.1 N thiocyanic acid solution, 0.32 mmol of Sensitizing dye A, 0.48 mmol of Sensitizing dye B, and 0.05 mmol of Sensitizing dye c were added.

After cooling down to 40° C., desilvering was carried out according to an ordinary flocculation method. After washing, 67 g of gelatin, 80 cc of phenol (5%) and 150 cc of distilled water were added. The pH and pAg of the resultant emulsion were adjusted to 6.2 and 7.5, respectively, using sodium hydroxide and a silver nitrate solution.

Analytical investigation demonstrated that 90% or more of total projected area of the thus-obtained grains were occupied by tabular grains having an average circle-equivalent diameter of 0.71 $\mu$m, an average thickness of 0.13 $\mu$m, and an average sphere-equivalent diameter (an average diameter of a sphere equivalent to the volume of an individual grain) of 0.46 $\mu$m.

Crystal habit controlling agent 1

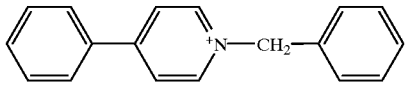

(Emulsion e; {111} Silver Iodochloride Tabular Grains whose Shell Part Contained 0.2 mol % of Iodide Based on Total Silver)

Emulsion e was prepared in the same manner as Emulsion d, except that 2 mmol of potassium iodide was added to an aqueous sodium chloride solution to be simultaneously added with a silver nitrate solution at the third addition. The shape of the grains thus obtained were the same as Emulsion b.

(Emulsion f; {111} Silver Iodochloride Tabular Grains whose Shell Part Contained 0.4 mol % of Iodide Based on Total Silver)

Emulsion f was prepared in the same manner as Emulsion d, except that 4 mmol of potassium iodide was added to an aqueous sodium chloride solution to be simultaneously added with a silver nitrate solution at the third addition. The shape of the grains thus obtained were the same as Emulsion b.

(Emulsion g; Large-size {111} silver chloride tabular grains)

2.0 g of sodium chloride and 2.8 g of inert gelatin were added to a container containing 1.2 l of water. To the resultant container with stirring while maintaining at the temperature of 35° C., 60 cc of an aqueous solution of silver nitrate (containing 9 g of silver nitrate) and 60 cc of an aqueous solution of sodium chloride (containing 3.2 g of sodium chloride) were added over one minute according to a double jet method. One minute after the completion of the addition, 0.8 mmol of Crystal-habit controlling agent 1 was added. Further one minute later, 3.0 g of sodium chloride was added. During the next 25 min, the temperature of the container was increased to 60° C. After ripening of 16 minutes at 60° C., 560 g of an aqueous solution of 10% phthalate gelatin and $1\times10^{-5}$ mole of sodium thiosulfonate were added. Thereafter, 317.5 cc of an aqueous solution of silver nitrate (containing 127 g of silver nitrate), 317.5 cc of an aqueous solution of sodium chloride (containing 54.1 g of sodium chloride and $2\times10^{-8}$ mol of hexachloro iridium), and 160 cc of an aqueous solution of Crystal habit controlling agent 1 (M/50) were added at an accelerated flow rate over 20 minutes. Further, two minutes later, an aqueous solution of silver nitrate (containing 34 g of silver nitrate) and an aqueous solution of sodium chloride (containing 11.6 g of sodium chloride, and 1.27 mg of potassium ferrocyanide) were added over 5 minutes. Then, 33.5 cc of a 0.1 N thiocyanic acid solution, 0.32 mmol of Sensitizing dye A, 0.48 mmol of Sensitizing dye B, and 0.05 mmol. of Sensitizing dye c were added.

After cooling down to 40° C., desalting was carried out according to an ordinary flocculation method. After washing, 67 g of gelatin, 80 cc of phenol (5%) and 150 cc of distilled water were added. The pH and pAg of the resultant emulsion were adjusted to 6.2 and 7.5, respectively, using sodium hydroxide and a silver nitrate solution.

Analytical investigation demonstrated that 90% or more of total projected area of the thus-obtained grains were occupied by tabular grains having an average circle-equivalent diameter of 1.05 μm, an average thickness of 0.14 μm, an average sphere-equivalent diameter of 0.61 μm.

(Emulsion h; {100} Silver chloride tabular grains)

To a reactor, added were 1200 ml of water ($H_2O$), 25 g of gelatin (a deionized alkali-treated bone gelatin whose methionine content was 40 μmol/g), 0.4 g of sodium chloride, and 4.5 ml of a 1N nitric acid solution. The resultant mixture (pH 4.5) was kept at 40° C. Then, an Ag-1 solution (silver nitrate 0.2 g/cc) and an X-1 solution (sodium chloride 0.069 g/cc) were added and mixed with a vigorous stirring over 4 minutes at a flow rate of 48 cc/minute. Fifteen seconds later, 150 ml of an aqueous polyvinyl alcohol solution was added. The above-mentioned aqueous polyvinyl alcohol solution contained 6.7 g of polyvinylalcohol (hereinafter referred to as PVA-1) wherein an average degree of polymerization of vinyl acetate was 1700, and an average ratio of saponification to alcohol was 98% or more, and contained 1 liter of water ($H_2O$).

Further, 12.3 ml of a 1N nitric acid solution was added to adjust the pH to 3.5. After the temperature was increased to 75° C. over 15 minutes, 23 ml of a 1N sodium hydroxide solution was added to adjust the pH to 6.5. Thereafter, 4.0 ml of 1-(5-methylureidophenyl)-5-mercaptotetrazole (0.05%) and 4.0 ml of N,N-dimethylimidazolidine-2-thion (a 1% aqueous solution) were added. After 4 g of sodium chloride was added to adjust the silver electric potential [VS. room temperature saturated calomel electrode] to 100 mV, an Ag-1 solution and an X-1 solution as the course of growth were simultaneously added over 15 minutes, while increasing linear-wise the flow rate from 40 cc/minute to 42 cc/minute, and keeping the silver electric potential at 100 mV. Further, 12.5 ml of a 1N nitric acid solution was added to adjust the pH to 4.0. After 28.8 g of sodium chloride was added to adjust the silver electric potential to 60 mV. Thereafter, 0.38 mmol of Sensitizing dye A, 0.56 mmol of Sensitizing dye B, and 0.06 mmol of Sensitizing dye C were added, and then an Ag-2 solution (0.1 g/cc of silver nitrate) and an X-2 solution (0.0345 g/cc of sodium chloride) were added over 10 minutes at the flow rate of 40 cc/minute. Thereafter, the resultant emulsion was allowed to stand at 75° C. for 10 minutes.

After cooling down to 40° C., sedimentation washing was carried out for desalting. The resultant emulsion to which 79 g of gelatin was further added, was redispersed and the pH and pAg were adjusted to 6.0 and 7.3, respectively. A part of the emulsion was picked and an electron microscopic photographic image (TEM image) of the replica of grains was observed. Such a microscopic analysis demonstrated that 90% of the total projected area of all the AgX grains was tabular grains having main planes of {100} phase, an average sphere-equivalent diameter of 0.47 μm, an average grain thickness of 0.10 μm, an average aspect ratio of 7.8, and an average adjacent side ratio of 1.2.

(Emulsion i; {100} Silver Iodochloride Tabular Grains whose Shell Part Contained 0.2 mol % of Iodide Based on Total Silver)

Emulsion i was prepared in the same manner as Emulsion h, except that following addition of the sensitizing dyes, an aqueous solution (X-3) containing 34.1 g of sodium chloride and 0.98 g of potassium iodide, per liter respectively, was added in place of the solution (X-2) so that an addition amount of iodide would become 0.2 mol % of total silver. Thereafter, after the resulting emulsion was left at 75° C. for 10 minutes, the temperature was lowered to 40° C. The resulting emulsion was subjected to desalting by coagulation washing. The resulting emulsion, to which 79 g of gelatin was further added, was redispersed, and the pH and pAg were adjusted to 6.0 and 7.3, respectively. A part of the resulting emulsion was sampled and an electron microscopic photographic image (TEM image) of replica of the grains was observed. 90 mol % of the total projected area of all the Agx grains was accounted for by tabular grains whose major planes were {100} faces. The average sphere-equivalent diamer of the tabular grains was 0.46 μm, the average grain. thickness was 0.11 μm, the average aspect ratio was 7.2, and the average ratio of the lengths of neighboring side was 1.2.

(Emulsion j; {100} Silver Iodochloride Tabular Grains whose Shell Part Contained 0.4 mol % of Iodide Based on Total Silver)

Emulsion j was prepared in the same manner as Emulsion h, except that following addition of the sensitizing dyes, an aqueous solution (X-4) containing 33.8 g of sodium chloride and 1.95 g of potassium iodide, per liter respectively, was added in place of the solution (X-2) so that an addition amount of iodide would become 0.4 mol % of total silver. Thereafter, after the resulting emulsion was left at 75° C. for 10 minutes, the temperature was lowered to 40° C. The resulting emulsion was subjected to desalting by coagulation washing. The resulting emulsion, to which 79 g of gelatin was further added, was redispersed, and the pH and pAg were adjusted to 6.0 and 7.3, respectively. A part of the resulting emulsion was sampled and an electron microscopic photographic image (TEM image) of replica of the grains was observed. 90 mol % of the total projected area of all the AgX grains was accounted for by tabular grains whose major planes were {100} faces. The average sphere-equivalent diamer of the tabular grains was 0.45 μm, the average grain thickness was 0.11 μm, the average aspect ratio was 7.1, and the average ratio of the lengths of neighboring side was 1.2.

(Emulsion k; {100} Silver Iodochloride Tabular Grains Obtained by Addition of 0.4 mol % of Iodide Based on Total Silver, After 95% Grain Formation)

Emulsion k was prepared in the same manner as Emulsion h, except that after 0.38 nmnol of Sensitizing A, 0.56 mmol of Sensitizing B and 0.06 mmol of Sensitizing C were added, the Ag-2 solution (0.1 g/cc of silver nitrate) and the X-2 solution (0.0345 g/cc of sodium chloride) were added at the flow rate of 40 cc/min, over 7 minutes and 30 seconds. Then, 25 ml of an aqueous solution (X-4) containing 31.2 g of potassium iodide in 1 liter was added over 8 seconds. Further, the Ag-2 solution and the X-2 solution were added at the flow rate of 40 cc/min, over 2 minutes and 30 seconds. Thereafter, after the resulting emulsion was left at 75° C. for 10 minutes, the temperature was lowered to 40° C. The resulting emulsion was subjected to desalting by coagulation washing. The resulting emulsion, to which 79 g of gelatin was further added, was redispersed, and the pH and pAg were adjusted to 6.0 and 7.3, respectively. A part of the resulting emulsion was sampled and an electron microscopic photographic image (TEM image) of replica of the grains was examined. 90 mol % of the total projected area of all the AgX grains was accounted for by tabular grains whose major planes were {100} faces. The average sphere-equivalent diameter of the tabular grains was 0.47 μm, the average grain thickness was 0.10 μm, the average aspect ratio of 7.9, and the average ratio of the lengths of neighboring side was 1.2.

(Chemical Sensitization)

Emulsions a to k each were subjected to an optimum chemical sensitization at 60° C., using sodium thiosulfonate, 1-(5-methylureidophenyl)-5-mercaptotetrazole, sodium thiosulfate and chloroauric acid.

(Preparation of Coated Samples)

A paper base both surfaces of which had been coated with a polyethylene resin, was subjected to surface corona discharge treatment; then it was provided with a gelatin undercoat layer containing sodium dodecylbenzensulfonate, and it was successively coated with the first to seventh photographic constitutional layers, to prepare samples of a silver halide color photographic light-sensitive material T101 to T111 having the layer configuration shown below. The coating solutions for each photographic constitutional layer were prepared as follows.

Preparation of Coating Solution

A coupler, a dye image-stabilizing agent, and an ultraviolet absorbing agent were dissolved in a mixture of a solvent and ethyl acetate. The resulting solution was emulsified and dispersed in a 10 wt % aqueous gelatin solution containing a surface active agent, by means of a high speed agitation emulsifier (Dissolver), to prepare an emulsified dispersion.

The above-described emulsified dispersion and a silver chlorobromide emulsion were mixed and dissolved, and a coating solution was prepared using the resulting mixture solution so as to become the composition described below.

As the gelatin hardener for each layer, H-1, H-2, and H-3 were used.

Further, to each layer, were added Ab-1, Ab-2, Ab-3, and Ab-4, so that the total amounts would be 15.0 mg/m$^2$, 60.0 mg/m$^2$, 5.0 mg/m$^2$, and 10.0 mg/m$^2$, respectively.

(H-1) Hardener

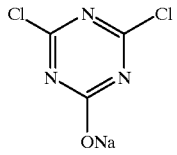

(used in 0.50 wt% per gelatin)

(H-2) Hardener

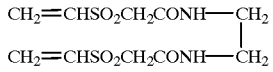

(used in 1.20 wt% per gelatin)

(H-3) Hardener

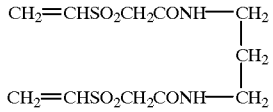

(used in 0.40 wt% per gelatin)

(Ab-1) Antiseptic

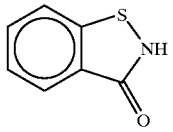

(Ab-2) Antiseptic

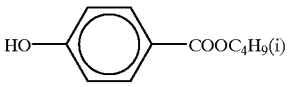

(Ab-3) Antiseptic

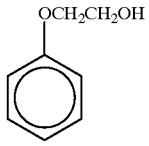

(Ab-4) Antiseptic

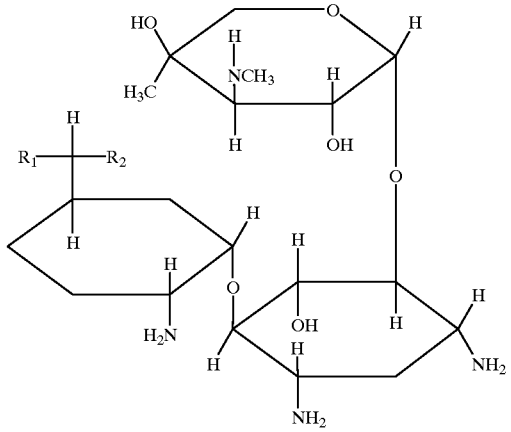

-continued

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

A mixture in 1:1:1:1 (molar ratio) of a, b, c, d

The high-silver chloride emulsions used in each light-sensitive emulsion layer were as follows. Blue-light sensitive emulsion layer Silver chloroiodobromide emulsion A (see Table 1)

TABLE 1

Emulsion A for yellow-coupler-containing layer

| Coated sample | Emulsion | Silver iodide content (mol %) | Diameter corresponding to a circle (μm) |
|---|---|---|---|
| T101 | a | — | 0.65 |
| T102 | b | 0.2 | 0.65 |
| T103 | c | 0.4 | 0.65 |
| T104 | d | — | 0.46 |
| T105 | e | 0.2 | 0.46 |
| T106 | f | 0.4 | 0.46 |
| T107 | g | — | 0.61 |
| T10B | h | — | 0.47 |
| T109 | i | 0.2 | 0.46 |
| T110 | j | 0.4 | 0.45 |
| T111 | k | 0.4 | 0.47 |
| TR101 | a | — | 0.52 |
| TR102 | b | 0.2 | 0.52 |
| TR103 | c | 0.4 | 0.52 |
| TR104 | d | — | 0.46 |
| TR105 | e | 0.2 | 0.46 |
| TR106 | f | 0.4 | 0.46 |
| TR107 | g | — | 0.61 |
| TR108 | h | — | 0.47 |
| TR109 | i | 0.2 | 0.46 |
| TR110 | j | 0.4 | 0.45 |
| TR111 | k | 0.4 | 0.47 |

Green-sensitive Emulsion Layer

To a silver chlorobromide emulsion B (Cubes, a mixture of a large-size emulsion having an average grain size of 0.45 μm, and a small-size emulsion having an average grain size of 0.35 μm (1:3 in terms of mol of silver). The deviation coefficients of the grain size distributions were 0.10 and 0.08, respectively, and each emulsion had 0.4 mol % of AgBr contained locally in part of the grain surface whose substrate was made up of silver chloride), the sensitizing dye D was added to the large-size emulsion in an amount of $3.0\times10^{-4}$ mol per mol of the silver halide, and to the small-size emulsion in an amount of $3.6\times10^{-4}$ mol per mol of the silver halide; further, the sensitizing dye E was added to the large-size emulsion in an amount of $4.0\times10^{-5}$ mol per mol of the silver halide, and to the small-size emulsion in an amount of $2.8\times10^{-4}$ mol per mol of the silver halide.

(Sensitizing dye D)

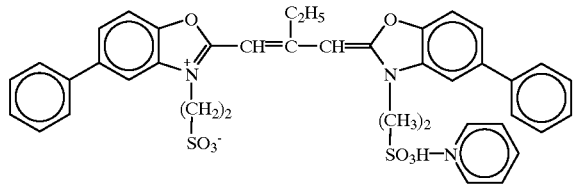

(Sensitizing dye E)

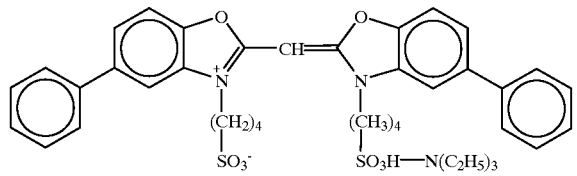

Red-sensitive Emulsion Layer

To a silver chlorobromide emulsion C (Cubes, a mixture of a large-size emulsion having an average grain size of 0.40 μm, and a small-size emulsion having an average grain size of 0.30 μm, (1:1 in terms of mol of silver). The deviation coefficients of the grain size distributions were 0.09 and 0.11, respectively, and each emulsion had 0.5 mol % of AgBr contained locally in part of the grain surface whose substrate was made up of silver chloride), the sensitizing dye G was added to the large-size emulsion in an amount of $9.0\times10^{-5}$ mol per mol of the silver halide, and to the small-size emulsion in an amount of $1.2\times10^{-4}$ mol per mol of the silver halide; further, the sensitizing dye H was added to the large-size emulsion in an amount of $9.0\times10^{-5}$ mol per mol of the silver halide, and to the small-size emulsion in an amount of $1.2\times10^{-4}$ mol per mol of the silver halide.

In addition, the following Compound I was added $3.0\times10^{-3}$ mol per mol of the silver halide.

(Sensitizing dye G)

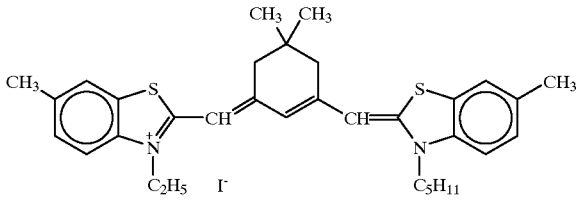

(Sensitizing dye H)

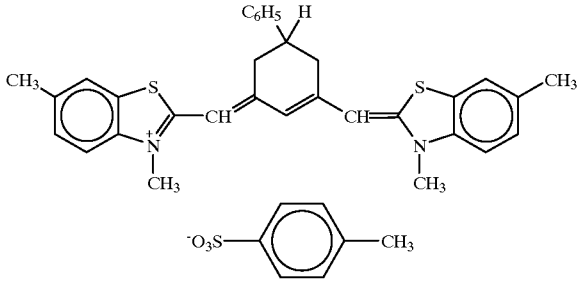

-continued (Compound I)

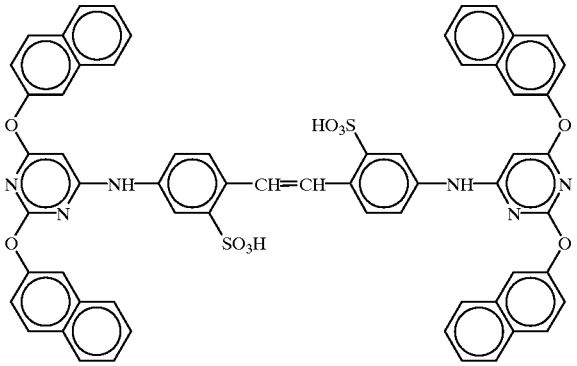

Further, to the blue-sensitive emulsion layer, the green-sensitive emulsion layer, and the red-sensitive emulsion layer, was added 1-(3-methylureidophenyl)-5-mercaptotetrazole in amounts of $3.3\times10^{-4}$ mol, $1.0\times10^{-3}$ mol, and $5.9\times10^{-4}$ mol, per mol of the silver halide, respectively.

Further, to the second layer, the fourth layer, the sixth layer, and the seventh layer, it was added in amounts of 0.2 mg/m$^2$, 0.2 mg/m$^2$, 0.6 mg/m$^2$, and 0.1 mg/m$^2$, respectively.

Further, to the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, per mol of the silver halide.

To the red-sensitive emulsion layer, was added a copolymer of methacrylic acid and butyl acrylate (1:1 in weight ratio; average molecular weight, 200,000 to 400,000) in an amount of 0.05 g/m$^2$.

Further, to the second layer, the fourth layer, and the sixth layer, was added disodium catechol-3,5-disulfonate in amounts of 6 mg/m$^2$, 6 mg/m$^2$, and 18 mg/m$^2$, respectively.

Further, to neutralize irradiation, the following dyes were added to the emulsion layers (the coating amount is shown in parentheses).

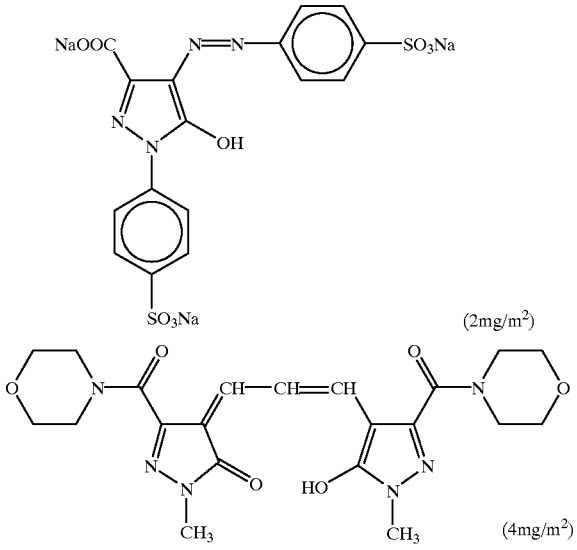

(2mg/m$^2$)

(4mg/m$^2$)

-continued

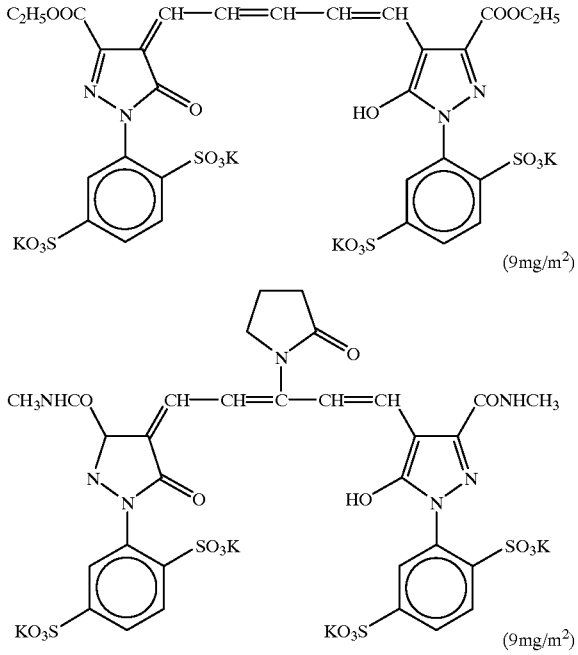

(9mg/m$^2$)

(9mg/m$^2$)

(Layer Constitution)

The composition of each layer is shown below. The numbers show coating amounts (g/m$^2$). In the case of the silver halide emulsion, the coating amount is in terms of silver.

Base

Polyethylene Resin-Laminated Paper

[The polyethylene resin on the first layer side contained a white pigment ($TiO_2$: content of 16 wt %, ZnO: content of 4 wt %), a fluorescent whitening agent (4,4'-bis(5-methylbenzoxazoryl)stilbene: content of 0.03 wt %), and a blue dye (ultramarine)]

First Layer (Blue-Sensitive Emulsion Layer)

| | |
|---|---|
| Emulsion A | 0.24 |
| Gelatin | 1.25 |
| Yellow coupler (ExY) | 0.57 |
| Color-image stabilizer (Cpd-1) | 0.07 |
| Color-image stabilizer (Cpd-2) | 0.04 |
| Color-image stabilizer (Cpd-3) | 0.07 |
| Color-image stabilizer (Cpd-8) | 0.02 |
| Solvent (Solv-1) | 0.21 |

Second Layer (Color-Mixing Inhibiting Layer)

| | |
|---|---|
| Gelatin | 0.60 |
| Color-mixing inhibitor (Cpd-19) | 0.09 |
| Color-image stabilizer (Cpd-5) | 0.007 |
| Color-image stabilizer (Cpd-7) | 0.007 |
| Ultraviolet absorbing agent (UV-C) | 0.05 |
| Solvent (Solv-5) | 0.11 |

Third Layer (Green-Sensitive Emulsion Layer)

| | |
|---|---|
| Emulsion B | 0.14 |
| Gelatin | 0.73 |
| Magenta coupler (ExM) | 0.15 |
| Ultraviolet absorbing agent (UV-A) | 0.05 |
| Color-image stabilizer (Cpd-2) | 0.02 |
| Color-image stabilizer (Cpd-7) | 0.008 |
| Color-image stabilizer (Cpd-8) | 0.07 |
| Color-image stabilizer (Cpd-9) | 0.03 |
| Color-image stabilizer (Cpd-10) | 0.009 |
| Color-image stabilizer (Cpd-11) | 0.0001 |

-continued

| | |
|---|---|
| Solvent (Solv-3) | 0.06 |
| Solvent (Solv-4) | 0.11 |
| Solvent (Solv-5) | 0.06 |
| Fourth Layer (Color-Mixing Inhibiting Layer) | |
| Gelatin | 0.48 |
| Color-mixing inhibitor (Cpd-4) | 0.07 |
| Color-image stabilizer (Cpd-5) | 0.006 |
| Color-image stabilizer (Cpd-7) | 0.006 |
| Ultraviolet absorbing agent (UV-C) | 0.04 |
| Solvent (Solv-5) | 0.09 |
| Fifth Layer (Red-Sensitive Emulsion Layer) | |
| Emulsion C | 0.12 |
| Gelatin | 0.59 |
| Cyan coupler (ExC-1) | 0.13 |
| Cyan coupler (ExC-2) | 0.03 |
| Color-image stabilizer (Cpd-7) | 0.01 |
| Color-image stabilizer (Cpd-9) | 0.04 |
| Color-image stabilizer (Cpd-15) | 0.19 |
| Color-image stabilizer (Cpd-18) | 0.04 |
| Solvent (Solv-5) | 0.09 |
| Sixth Layer (Ultraviolet Absorbing Layer) | |
| Gelatin | 0.32 |
| Ultraviolet absorbing agent (UV-C) | 0.42 |
| Solvent (Solv-7) | 0.08 |
| Seventh Layer (Protective Layer) | |
| Gelatin | 0.70 |
| Acrylic modified copolymer of polyvinyl alcohol (modification degree: 17%) | 0.04 |
| Liquid paraffin | 0.01 |
| Surface-active agent (Cpd-13) | 0.01 |
| Polydimethylsiloxane | 0.01 |
| Silicon dioxide | 0.003 |

(ExY) Yellow coupler

A mixture in 70:30 (molar ratio) of

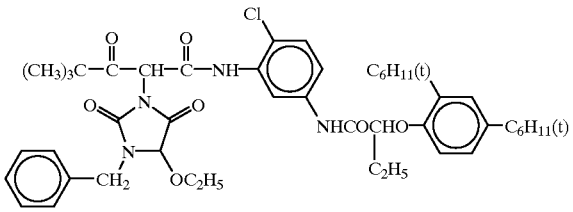

and

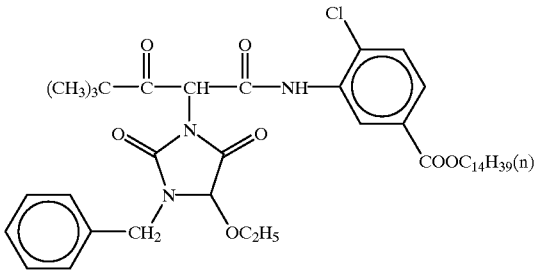

-continued (ExM) Magenta coupler

A mixture in 40:40:20 (molar ratio) of

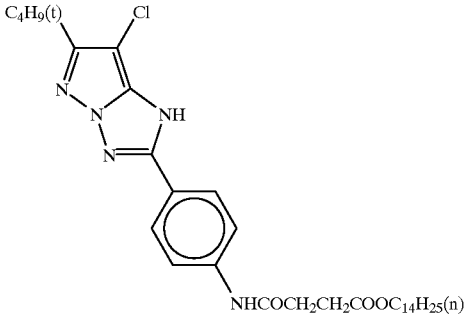

and

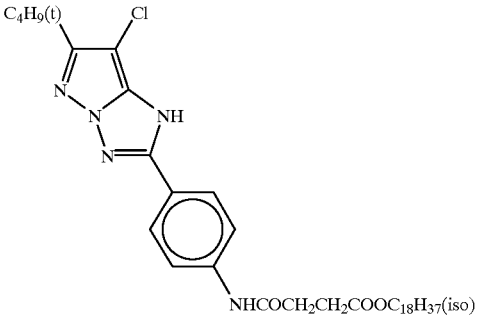

and

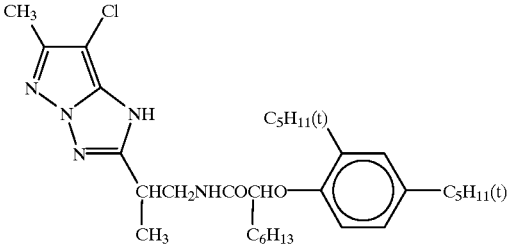

(ExC-1) Cyan coupler

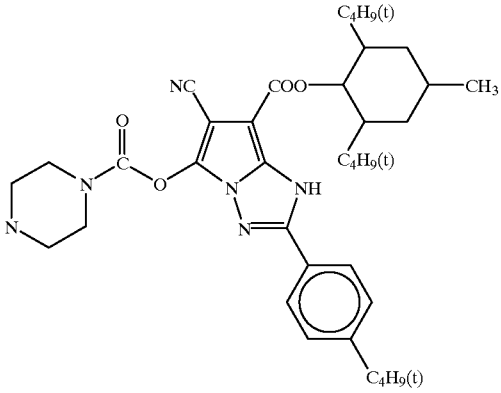

(ExC-2) Cyan coupler

A mixture in 50:25:25 (molar ratio) of

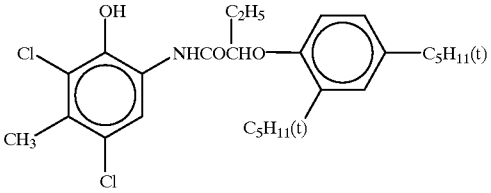

and

-continued

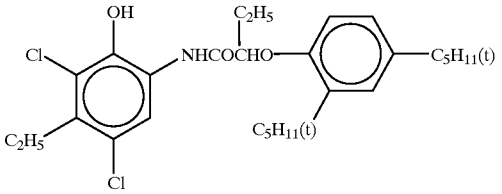

and

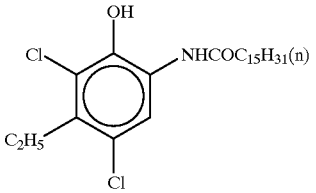

(Cpd-1) Color-image stabilizer

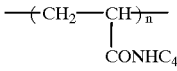

number-average molecular weight 60,000

(Cpd-2) Color-image stabilizer

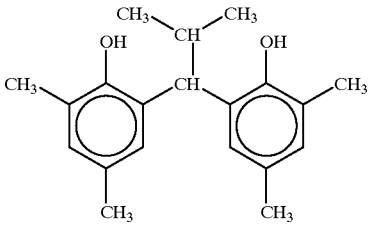

(Cpd-3) Color-image stabilizer

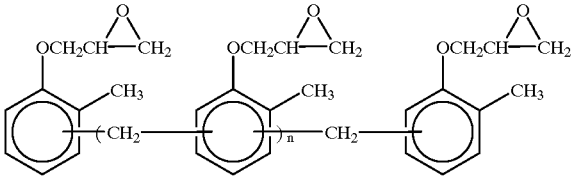

n = 7~8 (average)

(Cpd-4) Color-mixing inhibitor

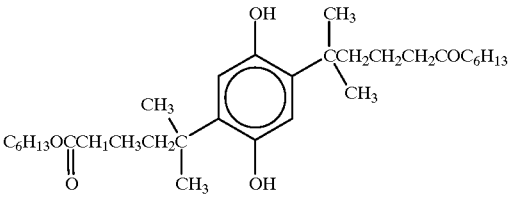

(Cpd-5) Color-mixing inhibitor auxiliary

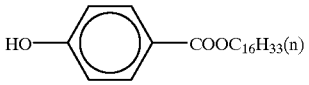

-continued (Cpd-7) Color-mixing inhibitor

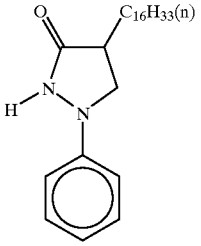

(Cpd-8) Color-image stabilizer

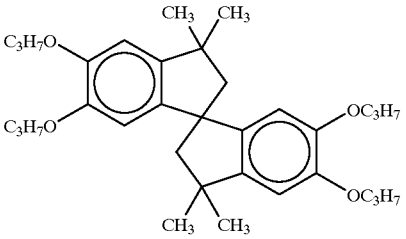

(Cpd-9) Color-image stabilizer

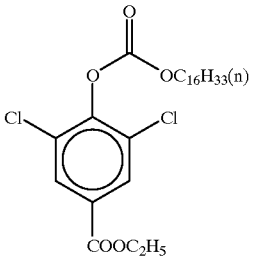

(Cpd-10) Color-image stabilizer

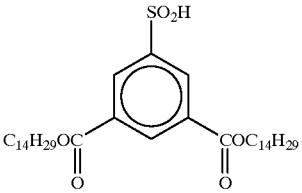

(Cpd-11)

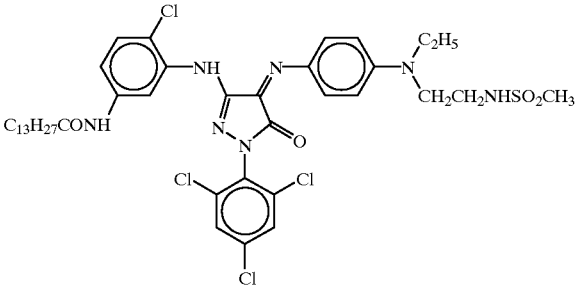

(Cpd-13) Surfactant active agent

A mixture in 7:3 (molar ratio) of

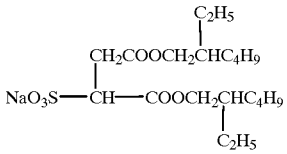

and

-continued
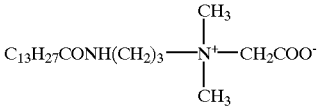
(Cpd-15)
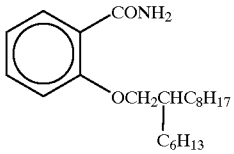
(Cpd-18)
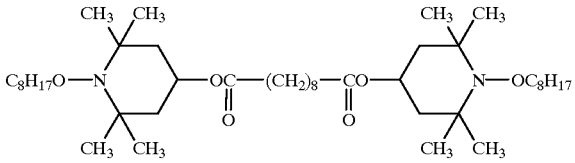
(Cpd-19) Color-mixing inhibitor
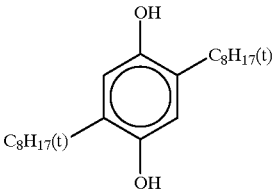
(UV-1) Ultra-violet absorbent
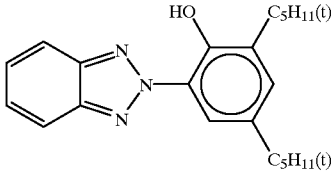
(UV-2) Ultra-violet absorbent
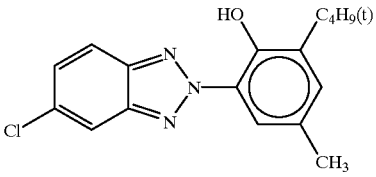
(UV-3) Ultra-violet absorbent
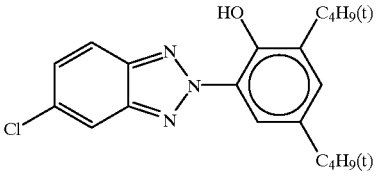
-continued
(UV-4) Ultra-violet absorbent
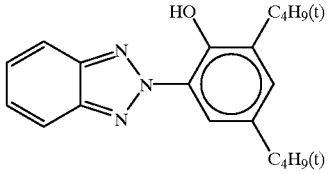
(UV-6) Ultra-violet absorbent
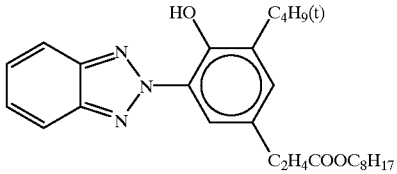
(UV-7) Ultra-violet absorbent
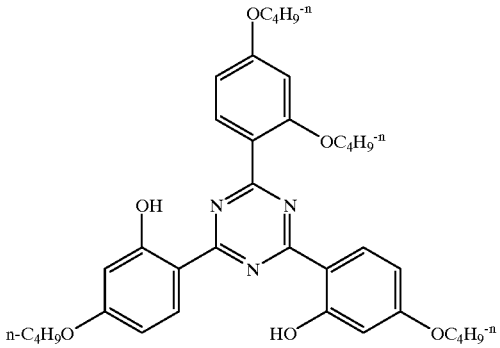
UV-A: A mixture of UV-1/UV-2/UV-3/UV-V4=4/2/2/3 (weight ratio)
UV-C: A mixture of UV-2/UV-3/UV-6/UV-7=1/1/1/2 (weight ratio)
(Solv-1)
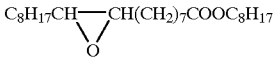
(Solv-2)
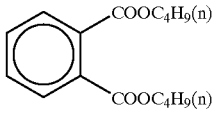
(Solv-3)
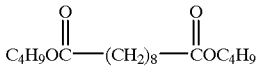
(Solv-4)
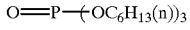
(Solv-5)
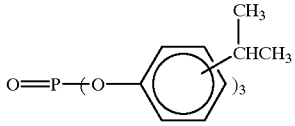

-continued (Solv-6)

A mixture in 1:1 (weight ratio) of

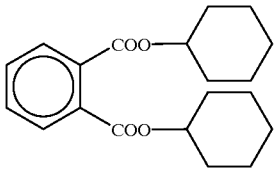

and

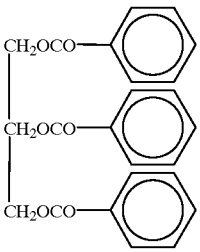

(Solv-7)

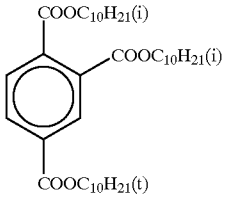

(Solv-8)

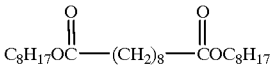

Further, coating samples TR101 to TR111 were prepared in the same manner as coating samples T101 to T111, except that the first layer and the fifth layer were interchanged.

(Exposure to Light)

Three color separation gradation exposure to laser beams of B, G and R was given, by using the exposure device described below. At this time, output of the laser beams was compensated so that an optimum improvement could be obtained by each of the samples.

(Exposure Device)

As the light source, used were a monochromatic light of 473 nm taken out by converting the wavelength of a YAG solid laser (oscillating wavelength; 946 nm) using as an exciting light source a semiconductor laser GaAlAs (oscillating wavelength; 808.5 nm), by a SHG crystal of $LiNbO_3$ having a reversal domain structure; a monochromatic light of 532 nm taken out by converting the wavelength of a $YVO_4$ solid laser (oscillating wavelength; 1064 nm) using as an exciting light source a semiconductor laser GaAlAs (oscillating wavelength; 808.7 nm) by a SHG crystals of $LiNbO_3$ having a reversal domain structure; and AlGaInP (oscillating wavelength; 680 nm: type No. LN9R20, made by Matsushita Electric Industrial Co., Ltd.). The exposure was effected in such a manner that the three color laser beams which had been intensity-modulated by means of AMO, could scan successively a color photographic printing paper moving vertically to the direction of the scanning, through respective rotating polygon mirrors (polyhedrons). The temperature of the semiconductor laser was kept by using a Peltier device to prevent the quantity of light from being changed by temperature. The scanning exposure was carried out at 600 dpi, and each of light beam diameters of B,G, and R measured by means of a light beam diameter measuring instrument [1180GP, manufactured by ABeam Scan Company (U.S.A.)] was 65 μm (the light beams were circular beams each having a difference between a diameter of the primary scanning direction and a diameter of the secondary scanning direction being within 1%.

(Developing process; dry to dry, 60 seconds)

Samples that were exposed to light as described above, were color developed according to the following processing steps and processing solutions.

| Processing step | Temperature | Time | Replenisher | Tank volume |
|---|---|---|---|---|
| Color developing | 45° C. | 15 sec | 35 ml | 2 liters |
| Bleach-Fixing | 40° C. | 15 sec | 38 ml | 1 liter |
| Rinse ① | 40° C. | 10 sec | — | 1 liter |
| Rinse ② | 40° C. | 10 sec | — | 1 liter |
| Rinse ③ | 40° C. | 10 sec | 90 ml | 1 liter |
| Dry | 80° C. | 10 sec | — | — |

(the rinse was conducted in a counter-current system of Rinse ③ → ①)
*Replenishment rates were amounts per $m^2$ of the light-sensitive material processed.

In the above processing, water in Rinsing ③ was pressed so as to penetrate through a reverse osmotic membrane, and the penetrating water was supplied to the Rinsing ③. On the other hand, the condensed water which did not penetrate through the reverse osmotic membrane was sent back to Rinsing ② to reuse. In order to shorten a cross-over time amongst the Rinsing ① to ③, blades were set between tanks so that a light-sensitive material could be passed through them. Further, in each of the steps, a recycle processing solution was blown in a spray amount of 4 to 61/min based on 1 tank, by means of a spray device described in JP-A-8-314088.

The composition of each processing solution was as follows, respectively:

| [Color-developer] | Tank Solution | Replenisher |
|---|---|---|
| Water | 700 ml | 700 ml |
| Sodium triisopropylnaphthalene(β) sulfonate | 0.1 g | 0.1 g |
| Ethylenediaminetetraacetic acid | 3.0 g | 3.0 g |
| Disodium 1,2-dihydroxybenzene-4,6-disulfonate | 0.5 g | 0.5 g |
| Triethanolamine | 12.0 g | 12.0 g |
| Potassium chloride | 15.8 g | — |
| Potassium bromide | 0.04 g | — |
| Potassium carbonate | 27.0 g | 27.0 g |
| Sodium sulfite | 0.1 g | 0.1 g |
| Disodium-N,N-bis(sulfonatoethyl)-hydroxylamine | 18.0 g | 18.0 g |
| N-ethyl-N-(β-methane-sulfonamidoethyl)-3-methyl-4-aminoaniline sulfate | 8.0 g | 23.0 g |
| Sodium-bis(2,4-disulfonatoethyl-1,3,5-triazil-6) diaminostilbene-2,2'-disulfonato | 5.0 g | 6.0 g |
| Water to make | 1000 ml | 1000 ml |
| pH (25° C.) | 10.35 | 12.80 |

The bleach-fix solution was prepared by mixing the following two component replenishers as follows.

| [Bleach-fix solution] | Tank Solution | Reple-nisher* |
|---|---|---|
| 1st replenisher | 260 ml | 18 ml |
| 2nd replenisher | 290 ml | 20 ml |
| Water to make | 1000 ml | |
| pH (25° C.) | 5.0 | |

*The replenisher was the sum of the above 38 ml per $m^2$.

The composition of each of the 1st and 2nd replenisher was as follows.

| | |
|---|---|
| **1st Replenisher** | |
| Water | 150 ml |
| Ethylene bisguanidine nitrate | 30 g |
| Ammonium sulfite · monohydrate | 226 g |
| Ethylenediaminetetraacetic acid | 7.5 g |
| Triazinylaminostilbene-series fluorescent whitening agent | |
| (Hacchol FWA-SF; trade name, manufactured by Showa Chemical Industry Co., Ltd.) | 1.0 g |
| Ammonium bromide | 30 g |
| Ammonium thiosulfate (700 g/l) | 340 ml |
| Water to make | 1000 ml |
| pH (25° C.) | 5.82 |
| **2nd Replenisher** | |
| Water | 140 ml |
| Ethylenediaminetetraacetic acid | 11.0 g |
| Ethylenediaminetetr aacetic acid iron (III) ammonium | 384 g |
| Acetic acid (50%) | 230 ml |
| Water to make | 1000 ml |
| pH (25° C.) | 3.35 |
| **Rinsing solution** | |
| Deionized water (calcium and magnesium each were 3 ppm or below) | |

(Process for Comparison)

For comparison, samples were processed by CP45-X (dry to dry 180 seconds), trade name, manufactured by Fuji Photo Film Co., Ltd.

The reflective density of the thus processed colored samples was measured, using a photodensitometer TCD Model made by Fuji Photo Film Co., Ltd. The sensitivity was defined by an exposure amount necessary to give a color density higher by 1.0 than a fog density. In this test, the sensitivity of a blue-sensitive layer was measured and it was indicated by a relative value, assuming that the sensitivity of sample T101 having been obtained by a 180 second processing is 100. The results thus obtained are shown in Table 2.

TABLE 2

| Coated sample | 180-sec processing | | 60-sec processing | |
|---|---|---|---|---|
| No | Fog | Sensitivity | Fog | Sensitivity |
| T101 | 0.03 | 100 | 0.05 | 58 |
| T102 | 0.04 | 211 | 0.06 | 136 |
| T103 | 0.05 | 245 | 0.08 | 146 |
| T104 | 0.03 | 175 | 0.04 | 111 |
| T105 | 0.04 | 255 | 0.05 | 155 |
| T106 | 0.04 | 265 | 0.05 | 166 |
| T107 | 0.03 | 260 | 0.05 | 170 |
| T108 | 0.03 | 135 | 0.05 | 75 |
| T109 | 0.05 | 225 | 0.07 | 144 |
| T110 | 0.06 | 255 | 0.08 | 156 |

TABLE 2-continued

| Coated sample | 180-sec processing | | 60-sec processing | |
|---|---|---|---|---|
| No | Fog | Sensitivity | Fog | Sensitivity |
| T111 | 0.06 | 260 | 0.07 | 170 |
| TR101 | 0.02 | 110 | 0.04 | 88 |
| TR102 | 0.04 | 220 | 0.06 | 186 |
| TR103 | 0.04 | 255 | 0.06 | 198 |
| TR104 | 0.02 | 190 | 0.02 | 188 |
| TR105 | 0.03 | 253 | 0.03 | 255 |
| TR106 | 0.03 | 267 | 0.03 | 268 |
| TR107 | 0.03 | 265 | 0.03 | 250 |
| TR108 | 0.02 | 141 | 0.04 | 135 |
| TR109 | 0.03 | 228 | 0.04 | 225 |
| TR110 | 0.03 | 260 | 0.04 | 256 |
| TR111 | 0.03 | 265 | 0.04 | 256 |

The results in Table 2 demonstrates that tabular emulsions exhibited higher sensitivity than cubic emulsions, and further, and that the coating samples according to the present invention, even when rapidly processed, unexpectedly exhibited sensitivity similar to that obtained by a normal (non-rapid) processing. Increase in fogging due to a rapid processing was a serious problem particularly in emulsions in which an iodide was incorporated in the surface of grains. In contrast, even a surface-iodide type emulsion (high in sensitivity) of the coating samples according to the present invention exhibited low fogging. Occurrence of fogging was improved particularly by the use of {111} tabular grains. Further, a difference in photographic properties between a rapid processing and a normal processing was minimized by the use of small-size grains more than large-size grains amongst the cases using {111} tabular grains.

Example 2

A paper base both surfaces of which had been coated with a polyethylene resin, was subjected to surface corona discharge treatment; then it was provided with a gelatin undercoat layer containing sodium dodecylbenzensulfonate, and it was successively coated with the first to seventh photographic constitutional layers, to prepare Samples (101) of a silver halide color photographic light-sensitive material having the layer configuration shown below. The coating solutions for each photographic constitutional layer were prepared as follows.

(Preparation of Fifth-Layer Coating Solution)

300 g of a cyan coupler (ExC-1), 250 g of a color-image-stabilizer (Cpd-1), 10 g of a color-image-stabilizer (Cpd-9), 10 g of a color-image-stabilizer (Cpd-10), 20 g of a color-image-stabilizer (Cpd-12), 14 g of an ultraviolet absorbing agent (UV-1), 50 g of an ultraviolet absorbing agent (UV-2), 40 g of an ultraviolet absorbing agent (UV-3), and 60 g of an ultraviolet absorbing agent (Uv-4) were dissolved in 230 g of a solvent (Solv-6) and 350 ml of ethyl acetate, and the resulting solution was emulsified and dispersed in 6500 g of a 10% aqueous gelatin solution containing 25 g of surfactant (Cpd-20), to prepare an emulsified dispersion C.

On the other hand, a silver chlorobromide emulsion C (cubes, a mixture of a large-size emulsion C having an average grain size of 0.40 $\mu$m, and a small-size emulsion C having an average grain size of 0.30 $\mu$m (5:5 in terms of mol of silver), the deviation coefficients of the grain size distributions being 0.09 and 0.11 respectively, and each emulsion having 0.5 mol % of silver bromide locally contained in part of the grain surface whose substrate was made up of silver chloride) was prepared.

To the large-size emulsion C of this emulsion, had been added $9.0\times10^{-5}$ mol, per mol of silver, of each of red-sensitive sensitizing dyes G, and H shown below, and to the small-size emulsion C of this emulsion, had been added $12.0\times10^{-5}$ mol, per mol of silver, of each of red-sensitive sensitizing dyes G, and H shown below. The chemical ripening of this emulsion was carried out optimally with a sulfur sensitizer and a gold sensitizer being added.

The above emulsified dispersion C and this silver chlorobromide emulsion C were mixed and dissolved, and a fifth-layer coating solution was prepared so that it would have the composition shown below. The coating amount of the emulsion is in terms of silver.

The coating solutions for the first layer to forth layer and the sixth layer to seventh layer were prepared in the similar manner as that for the fifth layer coating solution. As the gelatin hardener for each layer, H-1, H-2, and H-3 were used.

Further, to each layer, were added Ab-1, Ab-2, Ab-3, and Ab-4, so that the total amounts would be 15.0 mg/m$^2$, 60.0 mg/m$^2$, 5.0 mg/m$^2$, and 10.0 mg/m$^2$, respectively.

(H-1) Hardener

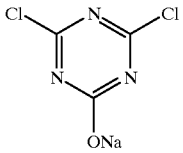

(used in 0.05 wt% per gelatin)

(H-2) Hardener

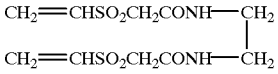

(used in 1.20 wt% per gelatin)

(H-3) Hardener

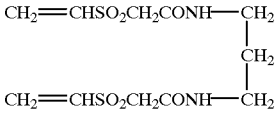

(used in 0.40 wt% per gelatin)

(Ab-1) Antiseptic

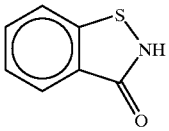

(Ab-2) Antiseptic

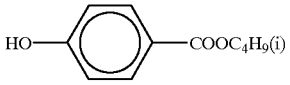

(Ab-3) Antiseptic

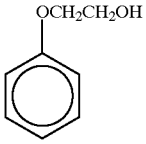

(Ab-4) Antiseptic

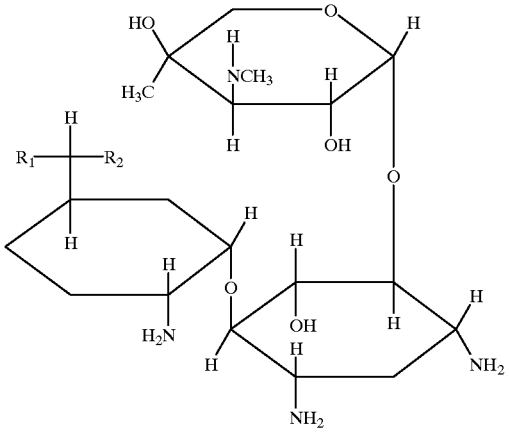

-continued

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

mixture in 1:1:1:1 (molar ratio) of a, b, c, d

For the silver chlorobromide emulsion of each photosensitive emulsion layer, the following spectral sensitizing dyes and crystal-habit-controlling agent 1 were used.

(Blue-Sensitive Emulsion Layer)

(Sensitizing dye A)

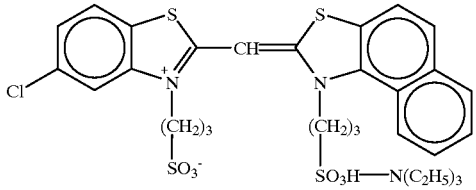

(Sensitizing dye B)

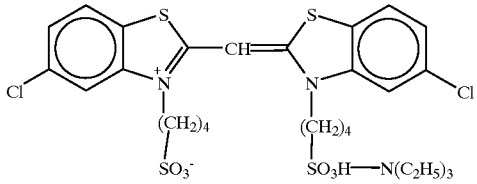

(Sensitizing dye C)

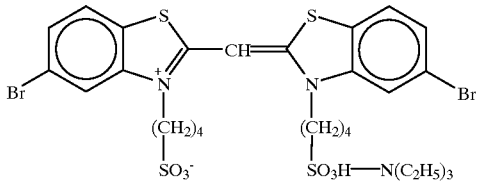

Crystal habit controlling agent 1

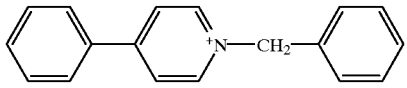

(The sensitizing dyes A and C were added, respectively, to the large-size emulsion, in an amount of $0.42\times10^{-4}$ mol per mol of the silver halide, and to the small-size emulsion in an amount of $0.50\times10^{-4}$ per mol of the silver halide. The sensitizing dyes B was added to the large-size emulsion, in an amount of $3.4\times10^{-4}$ mol per mol of the silver halide, and to the small-size emulsion in an amount of $4.1\times10^{-4}$ per mol of the silver halide.)

(Green-Sensitive Emulsion Layer)

(Sensitizing dye D)

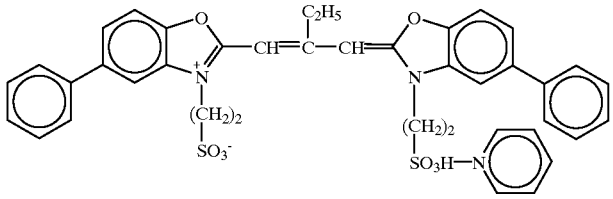

(Sensitizing dye E)

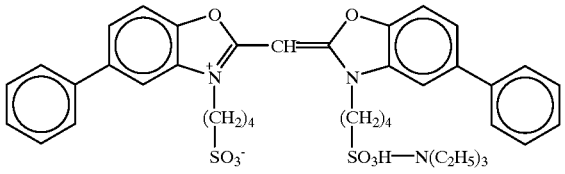

(Sensitizing dye F)

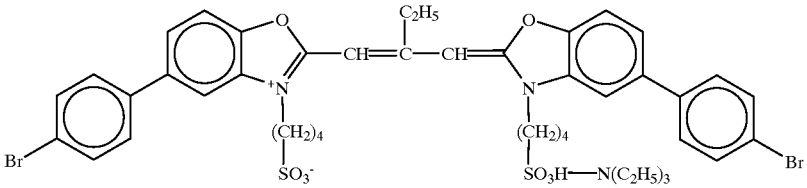

(The sensitizing dye D was added to the large-size emulsion in an amount of $3.0\times10^{-4}$ mol per mol of the silver halide, and to the small-size emulsion in an amount of $3.6\times10^{-4}$ mol per mol of the silver halide; the sensitizing dye E was added to the large-size emulsion in an amount of $4.0\times10^{-5}$ mol per mol of the silver halide, and to the small-size emulsion in an amount of $7.0\times10^{-5}$ mol per mol of the silver halide; and the sensitizing dye F was added to the large-size emulsion in an amount of $2.0\times10^{-4}$ mol per mol of the silver halide, and to the small-size emulsion in an amount of $2.8\times10^{-4}$ mol per mol of the silver halide.)

(Red-Sensitive Emulsion Layer)

(Sensitizing dye G)

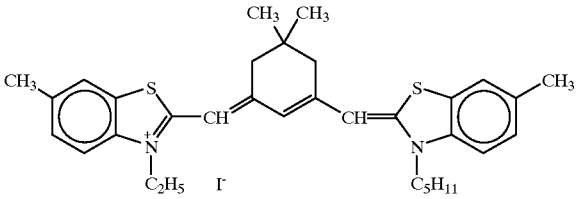

(Sensitizing dye H)

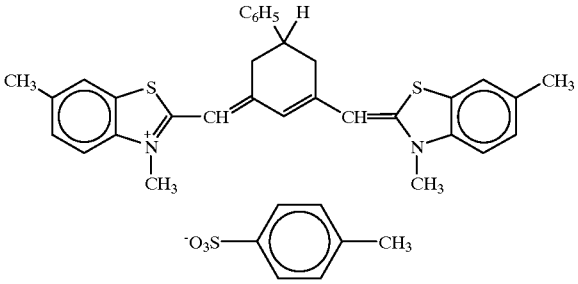

(The sensitizing dyes G and H were added, respectively, to the large-size emulsion, in an amount of $8.0\times10^{-5}$ mol per mol of the silver halide, and to the small-size emulsion in an amount of $10.7\times10^{-5}$ per mol of the silver halide.)

Further, the following Compound I was added to the red-sensitive emulsion layer, in an amount of $3.0\times10^{-3}$ mol per mol of the silver halide.

(Compound 1)

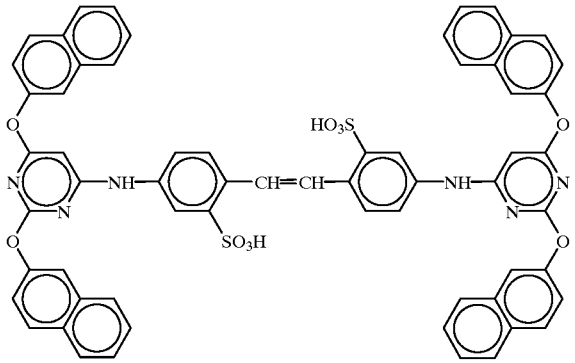

Further, to the blue-sensitive emulsion layer, the green-sensitive emulsion layer, and the red-sensitive emulsion layer, was added 1-(3-methylureidophenyl)-5-mercaptotetrazole in amounts of $3.3\times10^{-4}$ mol, $1.0\times10^{-3}$ mol, and $5.9\times10^{-4}$ mol, per mol of the silver halide, respectively.

Further, to the second layer, the fourth layer, the sixth layer, and the seventh layer, it was added in amounts of 0.2 mg/m$^2$, 0.2 mg/m$^2$, 0.6 mg/m$^2$, and 0.1 mg/m$^2$, respectively.

Further, to the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, per mol of the silver halide.

To the red-sensitive emulsion layer, was added a copolymer latex of methacrylic acid and butyl acrylate (1:1 in weight ratio; average molecular weight, 200,000 to 400,000) in an amount of 0.05 g/m$^2$.

Further, to the second layer, the fourth layer, and the sixth layer, was added disodium catechol-3,5-disulfonate in amounts of 6 mg/m$^2$, 6 mg/m$^2$, and 18 mg/m$^2$, respectively.

Further, to neutralize irradiation, the following dyes were added to the emulsion layers (the coating amount is shown in parentheses).

(2 mg./m$^2$)

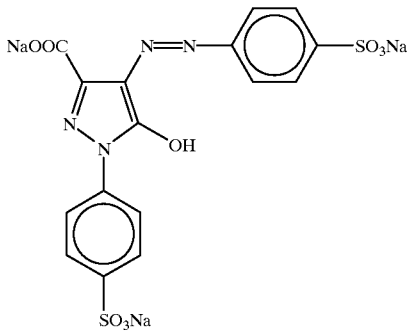

(4 mg./m$^2$)

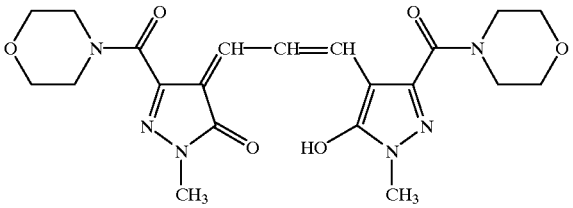

(9mg./m$^2$)

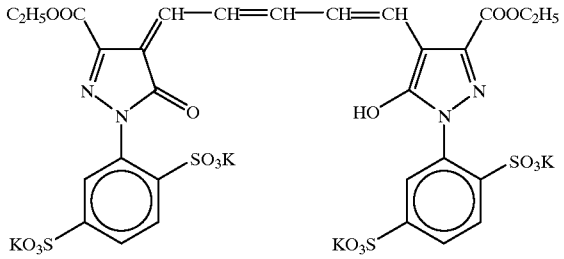

(9mg./m$^2$)

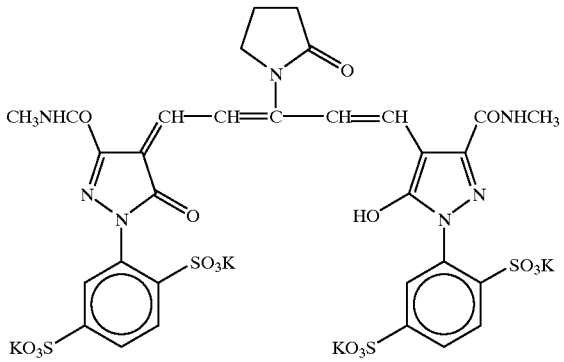

(Layer Constitution)

The composition of each layer is shown below. The numbers show coating amnounts (g/m$^2$). In the case of the silver halide emulsion, the coating amount is in terms of silver.

| | |
|---|---|
| Base | |
| Polyethylene Resin-laminated Paper | |
| [The polyethylene resin on the first layer side contained a white pigment ($TiO_2$: content of 16 wt %, ZnO: content of 4 wt %), a fluorescent whitening agent (4,4'-bis(5-methylbenzoxazoryl)stilbene: content of 0.03 wt %), and a blue dye (ultramarine)] | |
| First Layer (Blue-Sensitive Emulsion Layer) | |
| A silver chlorobromide emulsion A: (Cubes, a mixture of a large-size emulsion A having an average grain size of 0.72 μm, and a small-size emulsion A having an average grain size of 0.60 μm (5:5 in terms of mol of silver). The deviation coefficients of the grain size distributions were 0.08 and 0.10, respectively, and each emulsion had 0.3 mol % of silver bromide locally contained in part of the grain surface whose substrate was made up of silver chloride.) | 0.24 |
| Gelatin | 1.25 |
| Yellow coupler (ExY) | 0.57 |
| Color-image stabilizer (Cpd-1) | 0.07 |
| Color-image stabilizer (Cpd-2) | 0.04 |
| Color-image stabilizer (Cpd-3) | 0.07 |
| Color-image stabilizer (Cpd-8) | 0.02 |
| Solvent (Solv-1) | 0.21 |
| Second Layer (Color-Mixing Inhibiting Layer) | |
| Gelatin | 0.99 |
| Color-mixing inhibitor (Cpd-4) | 0.09 |
| Color-image stabilizer (Cpd-5) | 0.018 |
| Color-image stabilizer (Cpd-6) | 0.13 |
| Color-image stabilizer (Cpd-7) | 0.01 |
| Solvent (Solv-1) | 0.06 |
| Solvent (Solv-2) | 0.22 |
| Third Layer (Green-Sensitive Emulsion Layer) | |
| A silver chlorobromide emulsion B: (Cubes, a mixture of a large-size emulsion B having an average grain size of 0.45 μm, and a small-size emulsion B having an average grain size of 0.35 μm (1:3 in terms of mol of silver). The deviation coefficients of the grain size distributions were 0.10 and 0.08, respectively, and each emulsion had 0.4 mol% of silver bromide locally contained in part of the grain surface whose substrate was made up of silver chloride. | 0.14 |
| Gelatin | 1.36 |
| Magenta coupler (EXM) | 0.15 |
| Ultraviolet absorbing agent (UV-A) | 0.14 |
| Color-image stabilizer (Cpd-2) | 0.02 |
| Color-image stabilizer (Cpd-4) | 0.002 |
| Color-image stabilizer (Cpd-6) | 0.09 |
| Color-image stabilizer (Cpd-8) | 0.02 |
| Color-image stabilizer (Cpd-9) | 0.03 |
| Color-image stabilizer (Cpd-10) | 0.01 |
| Color-image stabilizer (Cpd-11) | 0.0001 |
| Solvent (Solv-3) | 0.11 |
| Solvent (Solv-4) | 0.22 |
| Solvent (Solv-5) | 0.20 |
| Fourth Layer (Color-Mixing Inhibiting Layer) | |
| Gelatin | 0.71 |
| Color-mixing inhibitor (Cpd-4) | 0.06 |
| Color-image stabilizer (Cpd-5) | 0.013 |
| Color-image stabilizer (Cpd-6) | 0.10 |
| Color-image stabilizer (Cpd-7) | 0.007 |
| Solvent (Solv-1) | 0.04 |
| Solvent (Solv-2) | 0.16 |
| Fifth Layer (Red-Sensitive Emulsion Layer) | |
| A silver chlorobromide emulsion C: (Cubes, a mixture of a large-size einulsion C having an average grain size of 0.40 μm, and a small-size emulsion C having an average grain size of 0.30 μm (5:5 in terms of mol of silver). The deviation coefficients of the grain size distributions were 0.09 and 0.11, respectively, and each emulsion had 0.5 mol % of silver bromide locally contained in part of the grain surface whose substrate was made up of silver chloride.) | 0.20 |

-continued

| | |
|---|---|
| Gelatin | 1.11 |
| Cyan coupler (ExC-1) | 0.30 |
| Ultraviolet absorbing agent (UV-A) | 0.29 |
| Color-image stabilizer (Cpd-1) | 0.25 |
| Color-image stabilizer (Cpd-9) | 0.01 |
| Color-image stabilizer (Cpd-10) | 0.01 |
| Color-image stabilizer (Cpd-12) | 0.02 |
| Solvent (Solv-6) | 0.23 |
| Sixth Layer (Ultraviolet Absorbing Layer) | |
| Gelatin | 0.46 |
| Ultraviolet absorbing agent (UV-B) | 0.45 |
| Solvent (Solv-7) | 0.25 |
| Seventh Layer (Protective Layer) | |
| Gelatin | 1.00 |
| Acryl-modified copolymer of polyvinyl alcohol (modification degree: 17%) | 0.04 |
| Liquid paraffin | 0.02 |
| Surface-active agent (Cpd-13) | 0.01 |

Preparation of Sample 102

Further, Sample 102 was prepared in the same manner as Sample 101 of the silver halide color photographic light-sensitive material prepared in the above, except that the constitution of the fifth layer was changed as shown below.

| | |
|---|---|
| Fifth Layer (Red-Sensitive Emulsion Layer) | |
| A silver chlorobromide einulsion C: (Cubes, a mixture of a large-size emulsion C having an average grain size of 0.40 μm, and a small-size emulsion C having an average grain size of 0.30 μm (5:5 in terms of mol of silver). The deviation coefficients ot the grain size distributions were 0.09 and 0.11, respectively, and each emulsion had 0.8 mol % of silver bromide locally contained in part of the grain surface whose substrate was made up of silver chloride.) | 0.12 |
| Gelatin | 1.11 |
| Cyan coupler (ExC-2) | 0.13 |
| Cyan coupler (ExC-3) | 0.03 |
| Color-image stabilizer (Cpd-1) | 0.05 |
| Color-image stabilizer (Cpd-6) | 0.06 |
| Color-image stabilizer (Cpd-7) | 0.02 |
| Color-image stabilizer (Cpd-9) | 0.04 |
| Color-image stabilizer (Cpd-10) | 0.01 |
| Color-image stabilizer (Cpd-14) | 0.01 |
| Color-image stabilizer (Cpd-15) | 0.12 |
| Color-image stabilizer (Cpd-16) | 0.03 |
| Color-image stabilizer (Cpd-17) | 0.09 |
| Color-image stabilizer (Cpd-18) | 0.07 |
| Solvent (Solv-5) | 0.15 |
| Solvent (Solv-8) | 0.05 |

Preparation of Sample 106

Further, Sample 106 was prepared in the same manner as Sample 101 prepared in the above, except that composition of each layer was changed as shown below.

| | |
|---|---|
| First Layer (Blue-Sensitive Emulsion Layer) | |
| A silver chlorobromide emulsion (the same emulsion as to Sample 101) | 0.24 |
| Gelatin | 1.25 |
| Yellow coupler (ExY) | 0.57 |
| Color-image stabilizer (Cpd-1) | 0.07 |
| Color-image stabilizer (Cpd-2) | 0.04 |
| Color-image stabilizer (Cpd-3) | 0.07 |
| Color-image stabilizer (Cpd-8) | 0.02 |
| Solvent (Solv-1) | 0.21 |

-continued

| | |
|---|---|
| Second Layer (Color-Mixing Inhibiting Layer) | |
| Gelatin | 0.60 |
| Color-mixing inhibitor (Cpd-19) | 0.09 |
| Color-image stabilizer (Cpd-5) | 0.007 |
| Color-image stabilizer (Cpd-7) | 0.007 |
| Ultraviolet absorbing agent (UV-C) | 0.05 |
| Solvent (Solv-5) | 0.11 |
| Third Layer (Green-Sensitive Emulsion Layer) | |
| A silver chlorobromide emulsion B (the same emulsion as to Sample 101) | 0.14 |
| Gelatin | 0.73 |
| Magenta coupler (EXM) | 0.15 |
| Ultraviolet absorbing agent (UV-A) | 0.05 |
| Color-image stabilizer (Cpd-2) | 0.02 |
| Color-image stabilizer (Cpd-7) | 0.008 |
| Color-image stabilizer (Cpd-8) | 0.07 |
| Color-image stabilizer (Cpd-9) | 0.03 |
| Color-image stabilizer (Cpd-10) | 0.009 |
| Color-image stabilizer (Cpd-11) | 0.0001 |
| Solvent (Solv-3) | 0.06 |
| Solvent (Solv-4) | 0.11 |
| Solvent (Solv-5) | 0.06 |
| Fourth Layer (Color-Mixing Inhibiting Layer) | |
| Gelatin | 0.48 |
| Color-mixing inhibitor (Cpd-4) | 0.07 |
| Color-image stabilizer (Cpd-5) | 0.006 |
| Color-image stabilizer (Cpd-7) | 0.006 |
| Ultraviolet absorbing agent (UV-C) | 0.04 |
| Solvent (Solv-5) | 0.09 |
| Fifth Layer (Red-Sensitive Emulsion Layer) | |
| A silver chlorobromide emulsion C (the same emulsion as to Sample 101) | 0.12 |
| Gelatin | 0.59 |
| Cyan coupler (ExC-2) | 0.13 |
| Cyan coupler (ExC-3) | 0.03 |
| Color-image stabilizer (Cpd-7) | 0.01 |
| Color-image stabilizer (Cpd-9) | 0.04 |
| Color-image stabilizer (Cpd-15) | 0.19 |
| Color-image stabilizer (Cpd-18) | 0.04 |
| Ultraviolet absorbing agent (UV-7) | 0.02 |
| Solvent (Solv-5) | 0.09 |
| Sixth Layer (Ultraviolet Absorbing Layer) | |
| Gelatin | 0.32 |
| Ultraviolet absorbing agent (UV-C) | 0.42 |
| Solvent (Solv-7) | 0.08 |
| Seventh Layer (Protective Layer) | |
| Gelatin | 0.70 |
| Acryl-modified copolymer of polyvinyl alcohol (modification degree: 17%) | 0.04 |
| Liquid paraffin | 0.01 |
| Surface-active agent (Cpd-13) | 0.01 |
| Polydimethylsiloxane | 0.01 |
| Silicon dioxide | 0.003 |

(ExY) Yellow coupler

A mixture in 70:30 (molar ratio) of

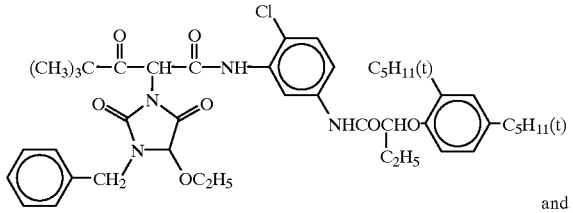

and

-continued
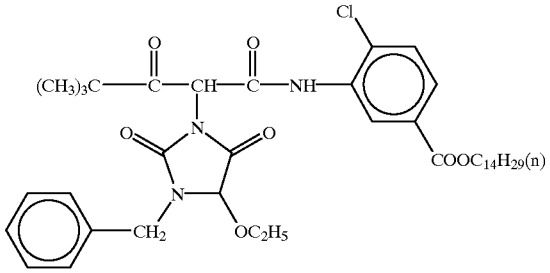
(EXM) Magenta coupler
A mixture in 40:40 (molar ratio) of
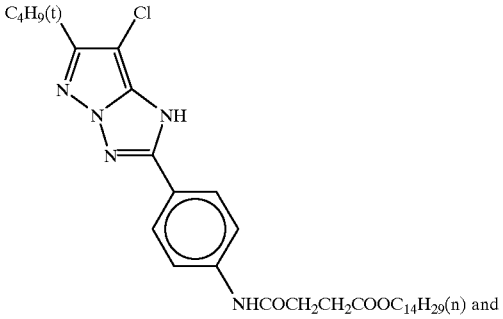
and
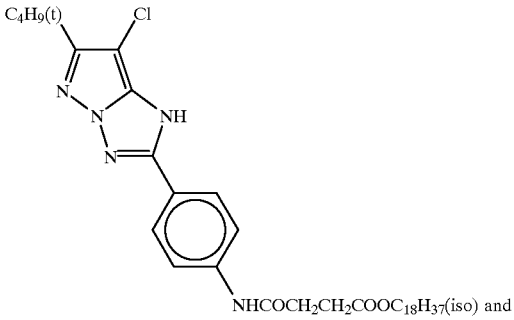
and
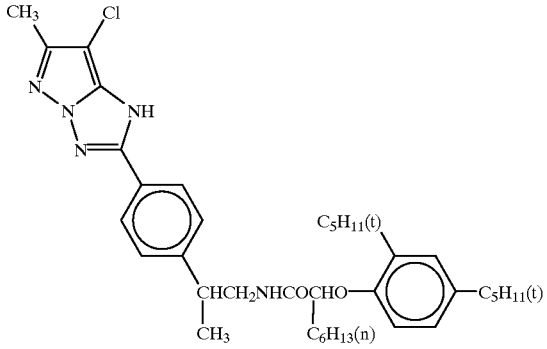
(EXC-1) Cyan coupler
A mixture in 15:85 (molar ratio) of
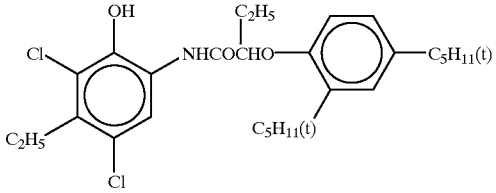
and
-continued
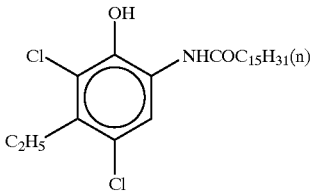
(EXC-2) Cyan coupler
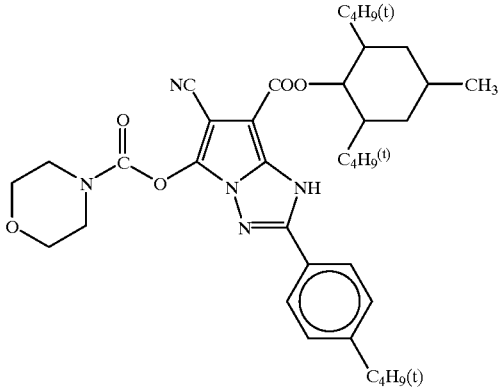
(EXC-3) Cyan coupler
A mixture in 50:25 (molar ratio) of
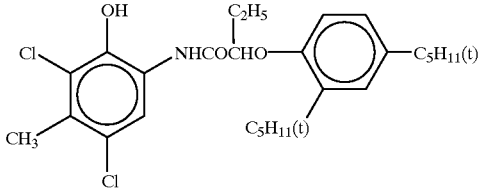
and
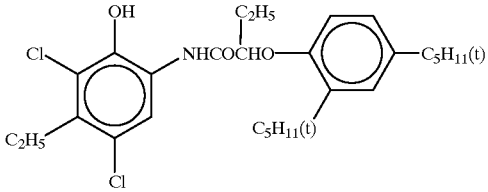
and
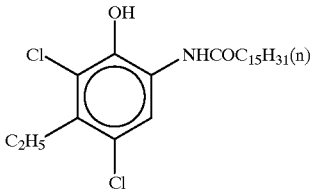
(Cpd-1) Color-image stabilizer
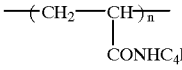
number-average molecular weight 60,000

-continued (Cpd-2) Color-image stabilizer

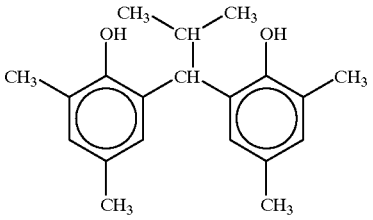

(Cpd-3) Color-image stabilizer

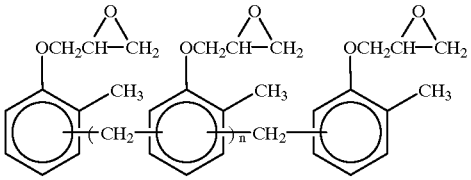

n = 7 ~ 8
(average)

(Cpd-4) Color-mixing inhibitor

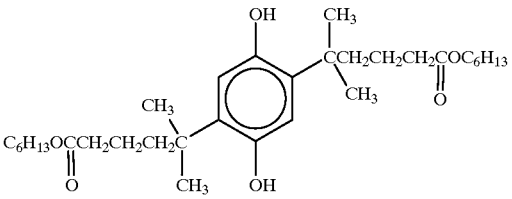

(Cpd-5) Color-mixing inhibiting auxiliary

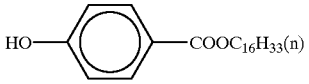

(Cpd-6) Stabilizer

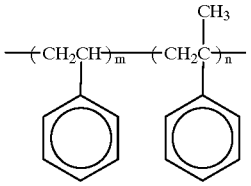

number-average
molecular weight
600
m/n = 10/90

(Cpd-7) Color-mixing inhibitor

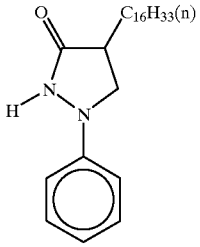

-continued (Cpd-8) Color-image stabilizer

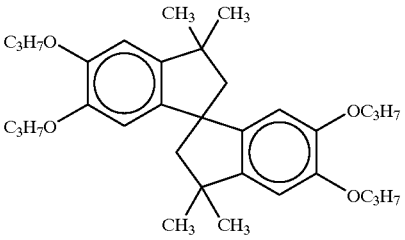

(Cpd-9) Color-image stabilizer

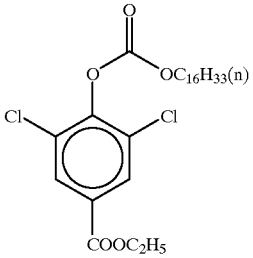

(Cpd-10) Color-image stabilizer

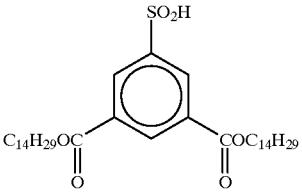

(Cpd-11)

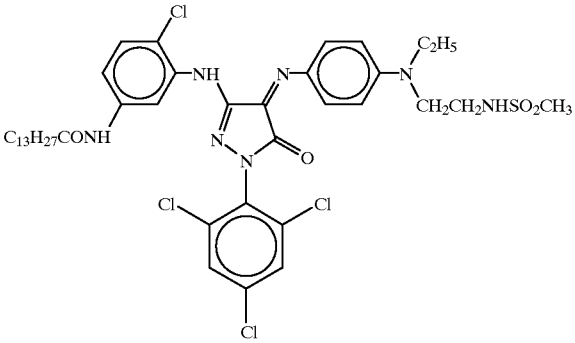

(Cpd-12) Color-image stabilizer

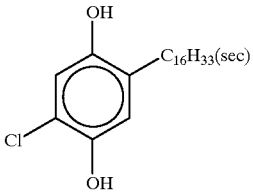

(Cpd-13) Surfactant

A mixture in 7:3 of

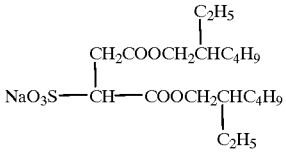

and

-continued
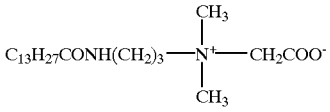
(Cpd-14)
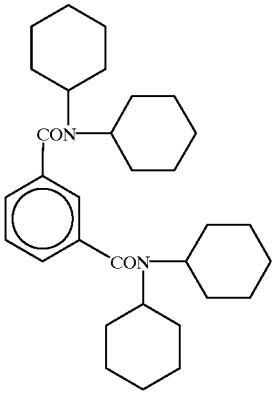
(Cpd-15)
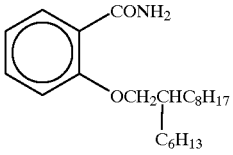
(Cpd-16)
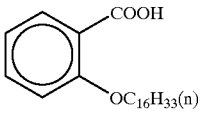
(Cpd-17)
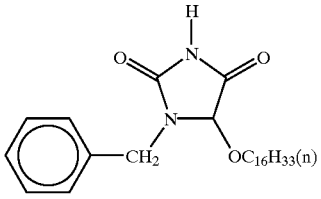
(Cpd-18)
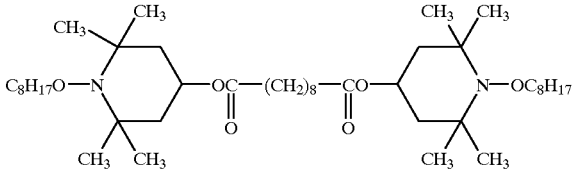
(Cpd-19) Color-mixing inhibitor
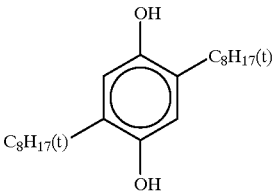
-continued
(Cpd-20) Surfactant
A mixture in 1:4 (molar ratio) of
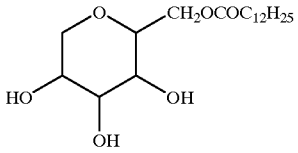
and
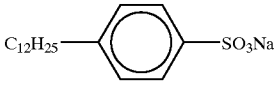
(UV-1) Ultra-violet absorbent
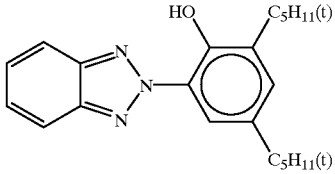
(UV-2) Ultra-violet absorbent
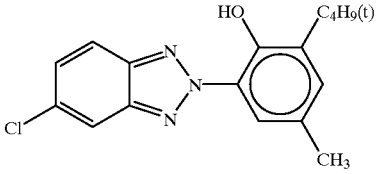
(UV-3) Ultra-violet absorbent
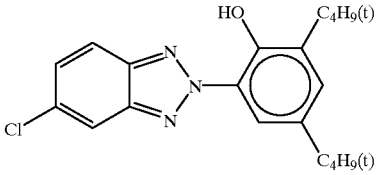
(UV-4) Ultra-violet absorbent
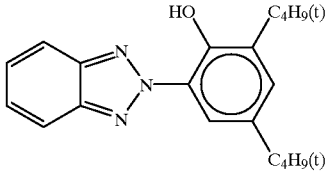
(UV-5) Ultra-violet absorbent
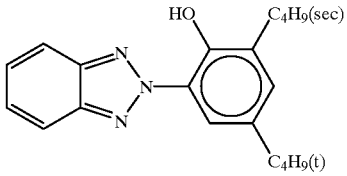

-continued (UV-6) Ultra-violet absorbent

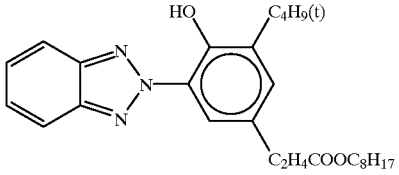

(UV-7) Ultra-violet absorbent

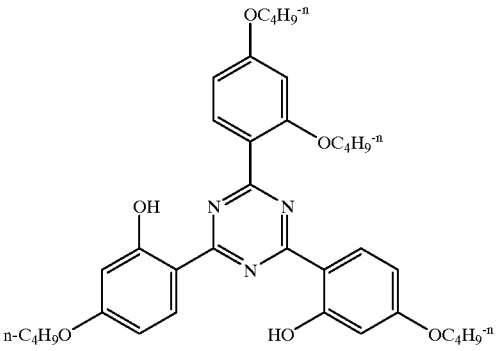

UV-A: A mixture of UV-1/UV-2/UV-3/UV-4=4/2/2/3 (weight ratio)

UV-B: A mixture of UV-1/UV-2/UV-3/UV-4/UV-5/UV-6=9/3/3/4/5/3 (weight ratio)

UV-C: A mixture of UV-2/UV-3/UV-6/UV-7=1/1/1/2 (weight ratio)

(Solv-1)

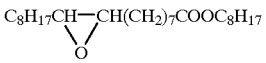

(Solv-2)

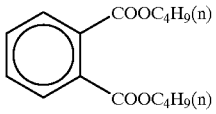

(Solv-3)

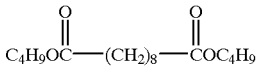

(Solv-4)

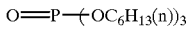

(Solv-5)

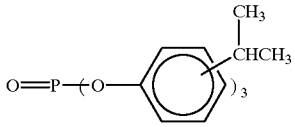

(Solv-6)

A mixture in 1:1 (weight ratio) of

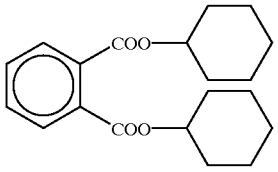

and

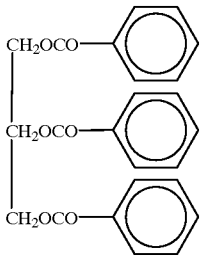

(Solv-7)

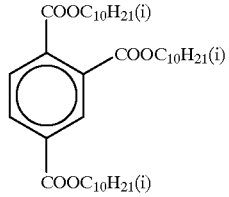

(Solv-8)

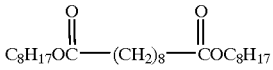

Samples 102 to 105, 110 and 111 were prepared utilizing the compositions used in each layer of the thus-prepared sample 102, except that the order of three color-coloring layers was changed as indicated in Table 3. Further, samples 106 to 109 were prepared based on the compositions of each layer of sample 106. Further, the ratio of [B/AgX] of samples 103, 105, 107, 109 and 111 was varied, respectively, by changing a silver chlorobromide emulsion of the blue-sensitive emulsion layer as shown below.

A silver chlorobromide emulsion used in Samples 103, 105, 107, 109, and 111: (Cubes, an emulsion having an average grain size of 0.85 $\mu$m, the deviation coefficient of the grain size distributions was 0.08, and the emulsion had 0.3 mol % of silver bromide locally contained in part of the grain surface whose substrate was made up of silver chloride. The amounts of sensitizing dyes to be added were adjusted so as to become the same as sample 101 in terms of the amount per surface area of emulsion grain.)

Further, the order of each coloring layer, the ratio of [B/AgX], the total amount of the binder, the total amount of oil-soluble materials, and the film thickness are shown together in Table 3.

These samples, after stored at 25° C. 55% RH for 10 days, were subjected to the following evaluation tests a to g.

Evaluation Test a (Rate of Development: DmB/DmA)

Each of the samples was subjected to graduation exposure to gray, by using a sensitometer (FWH model, manufactured by Fuji Photo Film Co., Ltd.; color temperature of the light source: 3200° K.). At this time, exposure was carried out in such a quantity that the exposure time of 0.1 second gives an exposure amount of 250 CMS. The thus-exposed samples were processed at the processing step A (color developing time 45 seconds) and the processing step B (color developing time 12 seconds), in both of which a running processing had been completed, as described hereinafter.

The ratio of yellow Dmax (DmB) at the processing step B to yellow Dmax (DmA) at the processing step A, i.e., (DmB/DmA), was calculated by a density measurement. This ratio was used as a scale of the proceeding rate of development.

The more the DmB/DmA is close to 1, the more excellent the rapid processing suitability is.

Evaluation Test b (Processing color mix: $D_G$ (B=2.0), $D_G$ (R=2.0))

Each of these samples was subjected to gradation exposure in such an exposure quantity that 0.1 second exposure would give 250 CMS, through a three-color separation sensitometric filter. The thus-exposed samples were processed by the processing step A, and thereafter a densitometric measurement of the yellow colored part was carried out. A magenta density at the exposure amount to give a yellow density of 2.0 ($D_G$ (B=2.0) was measured. The lower the $D_G$ (B=2.0) is, the less the magenta content in a yellow color is, which preferably results in less processing color mix.

Similarly the magenta color mix in the cyan color-forming part ($D_G$ (R=2.0)) was measured.

Evaluation Test c (Reduction in Cyan Density due to Blix Discoloration: (ΔR)

Each of those samples processed by the processing step A, which was used in the evaluation test a was measured to obtain a cyan Dmax density, which is defined as $D_{R1}$. Subsequently these samples, after having been immersed in a solution containing 10 g/l of potassium ferricyanide for 5 minutes, they were washed and dried. Each of the resultant samples was again measured to obtain a cyan Dmax density, which is defined as $D_{R2}$. Reduction in the cyan density due to Blix discoloration (ΔR) is calculated according to the following formula:

$$\Delta R = D_{R1} - D_{R2}$$

The more the ΔR is close to 1, the less the Blix discoloration is, which is preferable.

Evaluation Test d (Yellow stain in Processing: ΔY)

A reflection spectrum of the white background of each of those samples processed by the processing step B, which were used in the evaluation test a, was measure by a spectrophotometer (U-3410 manufactured by HITACHI CO., LTD.) to obtain a reflection density $D_{Y1}$ at 450 nm. Then, after each of these samples was washed at 40° C. for 5 minutes, a reflection spectrum of the white background thereof was again measured to obtain a reflection density $D_{Y2}$ at 450 nm. The yellow stain in the processing ΔY was calculated according to the following formula:

$$\Delta Y = D_{Y1} - D_{Y2}$$

The more the ΔY is close to 1, the more excellent the clearing of a sensitizing dye, a tar component of the developing solution, and the like is, which preferably results in less yellow stain.

Evaluation Test e (Pressure-induced fog: number/$m^2$)

Each of the samples was cut into a size of 127 mm in width and 20 m in length. Thereafter, these unexposed samples were processed by the processing step A, while enhancing a nip pressure between the conveyor rollers in a color developing bath. When a light-sensitive material is squeezed through the conveyor rollers and the like during a color development, and consequently a pressure is applied to the silver halide emulsion in the light-sensitive material, thereby a so-called pressure-induced fog sometimes occurs. Frequency in occurrence of the pressure-induced fog was evaluated with the eye, and the number of occurrence per $m^2$ (number/$m^2$) was counted.

Evaluation Test f (Light stability (fastness to light) of Cyan dye: $D/D_0$ (%))

Samples, after exposed in the same manner as in the evaluation test b and then processed by the processing step A, were exposed to xenon (100,000 luxes) using a xenon light-fading tester (light and darkness cycle consisting of 7 hr xenon irradiation and 2 hr non-irradiation; 47° C. 10% RT at the time of irradiation and 25° C. 80% RT at the time of non-irradiation), to thereby evaluate the light stability. A density after two weeks at the point having an initial cyan density of 2.0 was measured, and the degree of remaining of the cyan density ($D/D_0$ (%)) was calculated. The more the value of $D/D_0$ is close to 100%, the higher the light stability is.

Evaluation Test g (Desilvering inadequacy (failure): ΔD)

Each of the samples was exposed in the same manner as in the evaluation test b, and then processed using the processing solutions of the processing step B in the running state, except that the time of bleach-fixing was changed to 9 seconds. A densitometric measurement of the yellow dye-forming portion was carried out. A black and white density at the point of exposure amount necessary to give a yellow density of 2.0 ($D_V$ (B=2.0)) was measured. Further, the thus-measured samples were additionally processed with a bleach-fixing solution of the processing step A for 45 seconds, followed by washing and drying. Thereafter, the densitometric measurement of the yellow dye-forming portion was again carried out. A change in the black and white density at the yellow density of 2.0 before and after the additional processing (ΔD) was defined as a scale of the desilvering inadequacy. The more the ΔD is close to zero, the less the reduction in density due to an additional bleach-fixing is, which preferably results in less desilvering inadequency.

Hereinbelow, the processing steps were shown.

Processing A

The above Sample 108 was made into rolls of a 127-mm width; they were exposed to light imagewise, using a Mini-lab Printer Processor PP1258AR, trade name, manufactured by Fuji Photo Film Co., Ltd., and they were continuously processed (running test) in the following processing steps, until the replenishment reached to be equal to twice the color development tank volume. This process using the running solution was designated Processing A.

| Processing step | Temperature | Time | Replenishing volume |
|---|---|---|---|
| Color developing | 38.5° C. | 45 sec | 45 ml |
| Bleach-Fixing | 38.0° C. | 45 sec | 35 ml |
| Rinse (1) | 38.0° C. | 20 sec | — |
| Rinse (2) | 38.0° C. | 20 sec | — |
| Rinse (3) | **38.0° C. | 20 sec | — |
| Rinse (4) | **38.0° C. | 30 sec | 121 ml |

*Replenishment rates were amounts per $m^2$ of the light-sensitive material processed.

**A Rinse cleaning system RC50D, trade name, manufactured by Fuji Photo Film Co., Ltd., was installed in a rinse (3), and the rinse solution was taken out from the rinse (3) and was pumped to a reverse osmosis membrane module (RC50D) by a pump. The permeated water obtained in that tank was fed to a rinse (4), and the concentrated water was returned to the rinse (3). The pump pressure was adjusted so that the amount of the permeated water to the reverse osmosis membrane module would be kept at 50 to 300 ml/min, and circulation was conducted for 10 hours per day. (The rinse was of a tank counter-current system from the tank to the tank (4).)

The composition of each processing solution was as follows, respectively:

| [Color-developer] | Tank Solution | Replenisher |
|---|---|---|
| Water | 800.0 ml | 800.0 ml |
| Dimethylpolysiloxane-series surface active agent (Silicone KF351A, trade name: manufactured by Shinetsu Kagaku Kogyo Co.) | 0.1 g | 0.1 g |
| Tri(isopropanol)amine | 8.8 g | 8.8 g |
| Ethylenediaminetetraacetic acid | 4.0 g | 4.0 g |
| Polyethylene glycol | | |

-continued

| | | |
|---|---|---|
| (molecular weight 300) | 10.0 g | 10.0 g |
| Sodium 4,5-dihydroxybenzene-1,3-disulfonate | 0.5 g | 0.5 g |
| Potassium chloride | 10.0 g | — |
| Potassium bromide | 0.040 g | 0.010 g |
| Triazinylaminostilbene-series fluorescent whitening agent (Hacchol FWA-SF; trade name, manufactured by Showa Chemical Industry Co., Ltd.) | 2.5 g | 5.0 g |
| Sodium sulfite | 0.1 g | 0.1 g |
| Disodium-N, N-bis (sulfonatoethyl) hydroxylamine | 8.5 g | 11.1 g |
| N-Ethyl-N-(β-methanesulfonamidoethyl)-3-methyl-4-aminoaniline · 3/2 sulfuric acid monohydrate | 5.0 g | 15.7 g |
| Potassium carbonate | 26.3 g | 26.3 g |
| Water to make | 1000 ml | 1000 ml |
| pH | 10.15 | 12.50 |

(at 25° C./pH was adjusted by KOH and sulfuric acid)

| [Bleach-fixing solution] | Tank Solution | Reple-nisher |
|---|---|---|
| Water | 700.0 ml | 600.0 ml |
| Ethylenediaminetetraacetic acid iron (III) ammonium | 47.0 g | 94.0 g |
| Ethylenediaminetetraacetic acid | 1.4 g | 2.8 g |
| m-carboxybenzenesulfinic acid | 8.3 g | 16.5 g |
| Nitric acid (67%) | 16.5 g | 33.0 g |
| Imidazole | 14.6 g | 29.2 g |
| Ammonium thiosulfate (750 g/liter) | 107.0 ml | 214.0 ml |
| Ammonium sulfite | 16.0 g | 32.0 g |
| Ammonium bisulfite | 23.1 g | 46.2 g |
| water to make | 1000 ml | 1000 ml |
| pH | 6.0 | 6.0 |

(at 25° C. / pH was adjusted by acetic acid and ammonia)

| [Rinse solution] | Tank Solution | Reple-nisher |
|---|---|---|
| Sodium chlorinated isocyanurate | 0.02 g | 0.02 g |
| Deionized water (conductivity: | | |
| 5 μS/cm or below) | 1000 ml | 1000 ml |
| pH | 6.5 | 6.5 |

Processing B

The above Sample 108 was made into rolls of a 127-mm width; they were exposed to light imagewise, and they were continuously processed (running test) in the following processing steps, until the replenishment reached to be equal to twice the color development tank volume. This process using the running solution was designated Processing B. The processing was carried out using the minilabo printer processor PP1258AR (trade name, manufactured by Fuji Photo Film Co., Ltd.), which was remodeled so that the conveyor speed could be enhanced in order to shorten the time of processing steps.

| Processing step | Temperature | Time | Replenishing volume* |
|---|---|---|---|
| Color developing | 45.0° C. | 12 sec | 45 ml |
| Bleach-Fixing | 40.0° C. | 12 sec | 35 ml |
| Rinse (1) | 40.0° C. | 4 sec | — |
| Rinse (2) | 40.0° C. | 4 sec | — |
| Rinse (3) | **40.0° C. | 4 sec | — |
| Rinse (4) | **40.0° C. | 4 sec | 121 ml |

*Replenishment rates were amounts per $m^2$ of the light-sensitive material processed.

-continued

| Processing step | Temperature | Time | Replenishing volume* |
|---|---|---|---|

**A Rinse Cleaning System RC50D, trade name, manufactured by Fuji Photo Film Co., Ltd., was installed in a rinse (3), and the rinse solution was taken out from the rinse (3) and was pumped to a reverse osmosis membrane module (RC50D) by a pump. The permeated water obtained in that tank was fed to a rinse (4), and the concentrated water was returned to the rinse (3). The pump pressure was adjusted so that the amount of the permeated water to the reverse osmosis membrane module would be kept at 50 to 300 ml/min, and circulation was conducted for 10 hours per day.

(The rinse was of a tank counter-current system from the tank (1) to the tank (4).)

The composition of each processing solution was as follows, respectively:

| [Color-developer] | Tank Solution | Reple-nisher |
|---|---|---|
| Water | 800 ml | 800 ml |
| Dimethylpolysiloxane-series surface active agent (Silicone KF351A, trade name: manufactured by Shinetsu Kagaku Kogyo Co.) | 0.1 g | 0.1 g |
| Tri(isopropanol)amine | 8.8 g | 8.8 g |
| Ethylenediaminetetraacetic acid | 4.0 g | 4.0 g |
| Polyethylene glycol (molecular weight 300) | 10.0 g | 10.0 g |
| Sodium 4,5-dihydroxybenzene-1,3-disulfonate | 0.5 g | 0.5 g |
| Potassium chloride | 10.0 g | — |
| Potassium bromide | 0.040 g | 0.010 g |
| Triazinylaminostilbene-series fluorescent whitening agent (Hacchol FWA-SF; trade name, manufactured by Showa Chemical Industry Co., Ltd.) | 2.5 g | 5.0 g |
| Sodium sulfite | 0.1 g | 0.1 g |
| Disodium-N,N-bis (sulfonatoethyl) hydroxylamine | 8.5 g | 11.1 g |
| N-Ethyl-N-(β-methanesulfonamidoethyl)-3-methyl-4-amino-4-aminoaniline · 3/2 sulfuric acid · monohydrate | 10.0 g | 22.0 g |
| Potassium carbonate | 26.3 g | 26.3 g |
| Water to make | 1000 ml | 1000 ml |
| pH | 10.15 | 12.50 |

(at 25° C./pH was adjusted by KOH and sulfuric acid)

| [Bleach-fixing solution] | Tank Solution | Reple-nisher |
|---|---|---|
| Water | 700 ml | 600 ml |
| Ethylenediaminetetraacetic acid iron (III) ammonium | 75.0 g | 150.0 g |
| Ethylenediaminetetraacetic acid | 1.4 g | 2.8 g |
| m-Carboxybenzenesulfinic acid | 8.3 g | 16.5 g |
| Nitric acid (67%) | 16.5 g | 33.0 g |
| Imidazole | 14.6 g | 29.2 g |
| Ammonium thiosultate (750 g/liter) | 107.0 ml | 214.0 ml |
| Ammonium sulfite | 16.0 g | 32.0 g |
| Ammonium bisulfite | 23.1 g | 46.2 g |
| water to make | 1000 ml | 1000 ml |
| pH | 5.5 | 5.5 |

(at 25° C./pH was adjusted by acetic acid and ammonia)

| [Rinse solution] | Tank Solution | Reple-nisher |
|---|---|---|
| Sodium chlorinated isocyanurate | 0.02 g | 0.02 g |
| Deionized water (conductivity: | | |
| 5 μS/cm or below) | 1000 ml | 1000 ml |
| pH | 6.5 | 6.5 |

The results obtained by evaluation of Samples 101 to 111 are shown in Table 3.

TABLE 3

| Sample No. | Order of color-forming layers (1,3,5 layers) | [B/AgX] ratio | Total amount of binder ($g/m^2$) | Total amount of oil-soluble material ($g/m^2$) | Film thickness ($\mu m$) | Proceeding rate of development DmB/DmA | Processing color mix $D_G$ (B = 2.0) | Yellow stain ΔY | Pressure induced fog number/$m^2$ | Desilvering failure ΔD |
|---|---|---|---|---|---|---|---|---|---|---|
| 101 | YMC | 1.89 | 6.92 | 4.69 | 9.32 | 0.65 | 0.32 | 0.016 | 0.5 | 0.12 |
| 102 | YMC | 1.89 | 6.92 | 4.47 | 9.11 | 0.67 | 0.32 | 0.016 | 0.5 | 0.12 |
| 103 | YMC | 1.47 | 6.92 | 4.47 | 9.11 | 0.57 | 0.34 | 0.016 | 0.5 | 0.12 |
| 104 | CMY | 1.89 | 6.92 | 4.47 | 9.11 | 0.96 | 0.30 | 0.003 | 0.5 | 0.02 |
| 105 | CMY | 1.47 | 6.92 | 4.47 | 9.11 | 0.88 | 0.34 | 0.003 | 3.5 | 0.02 |
| 106 | YMC | 1.89 | 4.76 | 3.07 | 6.31 | 0.78 | 0.32 | 0.013 | 0.5 | 0.10 |
| 107 | YMC | 1.47 | 4.76 | 3.07 | 6.31 | 0.72 | 0.34 | 0.013 | 0.5 | 0.10 |
| 108 | CMY | 1.89 | 4.76 | 3.07 | 6.31 | 0.98 | 0.30 | 0.002 | 0.5 | 0.01 |
| 109 | CMY | 1.47 | 4.76 | 3.07 | 6.31 | 0.90 | 0.34 | 0.002 | 4.5 | 0.01 |
| 110 | CMY | 1.89 | 7.49 | 4.47 | 9.75 | 0.94 | 0.30 | 0.012 | 0.5 | 0.01 |
| 111 | CMY | 1.47 | 7.49 | 4.47 | 9.75 | 0.86 | 0.34 | 0.010 | 3.0 | 0.01 |

*) The second layer of Samples 104 and 105 had the same composition as the fourth layer of Samples 102 and 103, whereas the fourth layer of Samples 104 and 105 had the same composition as the second layer of Samples 102 and 103.
*) The second layer of Samples 108 and 109 had the same composition as the fourth layer of Samples 106 and 107, whereas the fourth layer of Samples 108 and 109 had the same composition as the second layer of Samples 106 and 107.
*) The amount of hydrophilic binder in each layer except for the yellow-color-forming layer was increased by 10% in Sample 110 as compared to Sample 104, and in Sample 111 as compared to Sample 105, respectively.

Table 3 shows that samples containing a yellow coupler in a silver halide emulsion layer further-most from a support, each have the following advantages: the value of DmB/DmA was high, rapidity of color development was excellent, yellow stain was low, speed up of the washing step was excellent, and the degree of desilvering was excellent. However, the ratio of [B/AgX] was too small, the processing color mix and the pressure-induced fog seriously become worse (samples 105, 109). Further, it shows that if the total amount of a hydrophilic binder in photographic constituent layers was too large, a yellow stain considerably occurred and consequently enhancement of rapidity of the washing step could not be achieved. Therefore, it is found that a combination of several elements defined by the second embodiment of the present invention is preferably to achieve an ultra-rapid processing, free from processing color mix, pressure-induced fog, and occurrence of yellow stain.

Example 3

Samples 201 to 217 were prepared in the same manner as Sample 108 of Example 2, except that a silver halide emulsion and a hydrophilic binder in the silver halide emulsion layer further-most from a support were change as shown in Table 4. Evaluation of these samples were carried out in the same manner as in Example 2. The results are shown in Table 4.

TABLE 4

| Sample No. | Silver halide emulsion in 5th layer: Shape | Silver halide emulsion in 5th layer: Emulsion thickness ($\mu m$) | Amount of hydrophilic binder in 5th layer ($g/m^2$) | [B/AgX] ratio | Processing color mix $D_g$ (B = 2.0) | Pressure-induced fog number/$m^2$ |
|---|---|---|---|---|---|---|
| 201 | cubic*) | 0.85 | 1.25 | 1.47 | 0.34 | 4.5 |
| 202 | cubic*) | 0.80 | 1.25 | 1.56 | 0.31 | 1.0 |
| 203 | cubic*) | 0.75 | 1.25 | 1.67 | 0.30 | 1.0 |
| 204 | cubic*) | 0.70 | 1.25 | 1.78 | 0.30 | 0.5 |
| 205 | cubic*) | 0.85 | 1.13 | 1.33 | 0.37 | 6.5 |
| 206 | cubic*) | 0.80 | 1.13 | 1.41 | 0.35 | 4.0 |
| 207 | cubic*) | 0.75 | 1.13 | 1.51 | 0.31 | 1.0 |
| 208 | cubic*) | 0.70 | 1.13 | 1.61 | 0.30 | 1.0 |
| 209 | 100 tabular*) | 0.20 | 1.25 | 6.25 | 0.29 | 1.0 |
| 210 | 100 tabular*) | 0.15 | 1.25 | 8.33 | 0.29 | 0.5 |
| 211 | 100 tabular*) | 0.13 | 1.25 | 9.62 | 0.29 | 0.5 |
| 212 | 100 tabular*) | 0.15 | 1.13 | 7.53 | 0.29 | 0.5 |
| 213 | 111 tabular*) | 0.20 | 1.25 | 6.25 | 0.29 | 0.5 |
| 214 | 111 tabular*) | 0.15 | 1.25 | 8.33 | 0.29 | 0.5 |
| 215 | 111 tabular*) | 0.13 | 1.25 | 9.62 | 0.29 | 0.5 |
| 216 | 111 tabular*) | 0.15 | 1.13 | 7.53 | 0.29 | 0.5 |
| 217 | 111 tabular*) | 0.15 | 0.88 | 5.87 | 0.30 | 0.5 |

*)The amount of sensitizing dyes to be used for cubic grains was the same as that of cubic grains of Sample 108, per the surface area.
*)Both the 100 tabular grains and the 111 tabular grains were silver chloride grains with an average aspect ratio of 5.0, containing iodide in an amount of 0.4. mol %. The amount of sensitizing dyes to be used for these tabular grains was the same as that of cubic grains of Sample 108, per the surface area.

According to the results in Table 4, it is understood that the processing color mix and occurrence of pressure-induced fog could be restrained by regulating the [B/AgX] ratio of the yellow dye-forming coupler-containing silver halide emulsion layer further-most from a support, to be a particular range.

Example 4

Samples 301 to 306 were prepared in the same manner as the sample 108 of Example 2, except that a red-sensitive emulsion layer (the first layer) was divided into two layers and their layer compositions and coating amounts were changed as shown in Table 5. Evaluation of these samples was carried out in the same manner as in Example 2. The results are shown in Table 5.

TABLE 5

| Sample No. | The first cyan color-forming layer*1) Oil-phase composition, Coated amount | Emulsion layer | The second cyan color-forming layer*1) Oil-phase composition, Coated amount | Emulsion layer | Processing color mix $D_G$ (R = 2.0) | Blix fading ΔR | Fastness to light $D/D_0$ (%) |
|---|---|---|---|---|---|---|---|
| 301 (This invention) | PTA*2) 100% | 100% | — — | — | 0.62 | 0.05 | 75 |
| 302 (This invention) | PTA*2) 70% | 70% | PH*3) 30% | 30% | 0.62 | 0.08 | 83 |
| 303 (This invention) | PH*3) 100% | 100% | — — | — | 0.71 | 0.25 | 80 |
| 304 (This invention) | PTA*2) 70% | 100% | PTA*2) 30% | 0% | 0.58 | 0.05 | 75 |
| 305 (This invention) | PTA*2) 70% | 100% | PH*3) 30% | 0% | 0.58 | 0.05 | 83 |
| 306 (This invention) | PH*3) 70% | 100% | PH*3) 30% | 0% | 0.67 | 0.27 | 80 |
| 106 (Comparative example) | (As 5th layer, a cyan color-forming layer was applied with the same composition as Sample 301.) | | | | 0.61 | 0.05 | 70 |

*1)The first cyan color-forming layer is a color-forming layer closest to the support, and the second cyan color-forming layer is a cyan color-forming layer adjacent to the first cyan color-forming layer and positioned at opposite side to the support.
*2)PTA: Oil phase and gelatin composition omitted the silver halide emulsion in the cyan color-forming layer in Sample 106 in Example 2.
*3)PH: Oil phase and gelatin composition omitted the silver halide emulsion in the cyan color-forming layer in Sample 101 in Example 2.

From Table 5, it is understood that light fastness was improved by applying a cyan-coloring layer at the position closest to a support, and the effect on the improvement in light fastness became more large by incorporating a cyan coupler represented by formula [ADF], in the second color-forming layer (samples 302, 305). Further, it is understood that the use of a cyan coupler represented by formula [I] for use in the present invention could render Blix discoloration less. Further, it is understood that in the samples having the second cyan-color-forming layer free from any silver halide emulsion, the processing color mix was smaller than that of the samples having the second cyan-color-forming layer containing a silver halide emulsion, as samples 304, 305 and 306 to be compared with samples 301, 302 and 303, respectively.

Example 5

Samples 401 to 404 and 405 to 408 were prepared in the same manner as samples 104 and 108 of Example 2, except that the yellow coupler, the magenta coupler, and the cyan coupler were change as shown in Table 6, respectively. Evaluation of these samples was carried out in the same manner as in Example 2. The obtained results were almost similar to those of Example 2.

TABLE 6

| Sample No. | Yellow coupler | Magenta coupler | Cyan coupler | Sample No. to which the changes in left columns were applied |
|---|---|---|---|---|
| 401 | ExY-1 | ExM-1 | ExC-4 | Sample 104 |
| 402 | ExY-2 | ExM-2 | ExC-4 | Sample 104 |
| 403 | ExY-2 | ExM-2 | ExC-5 | Sample 104 |
| 404 | ExY | ExM | Exemplified coupler (31) | Sample 104 |
| 405 | ExY-1 | ExM-1 | ExC-4 | Sample 108 |

TABLE 6-continued

| Sample No. | Yellow coupler | Magenta coupler | Cyan coupler | Sample No. to which the changes in left columns were applied |
|---|---|---|---|---|
| 406 | ExY-2 | ExM-2 | ExC-4 | Sample 108 |
| 407 | ExY-2 | ExM-2 | ExC-5 | Sample 108 |
| 408 | ExY | ExM | Exemplified coupler (31) | Sample 108 |

ExY-1 (Yellow coupler)

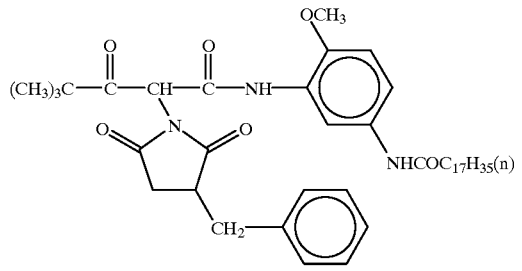

-continued

ExY-2 (Yellow coupler)

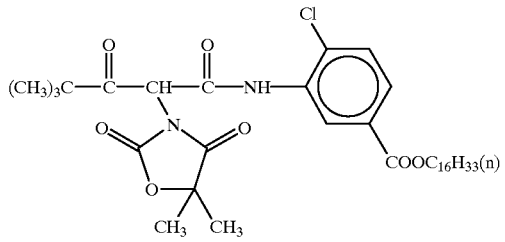

ExM-1 (Magenta coupler)

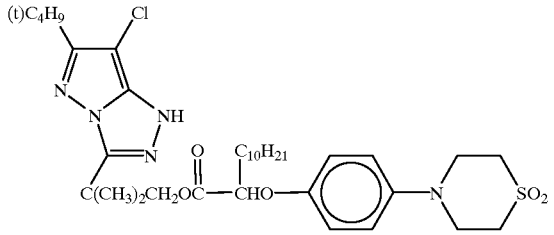

ExM-2 (Magenta coupler)

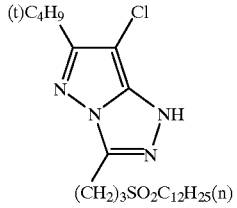

ExC-4 (Cyan coupler)

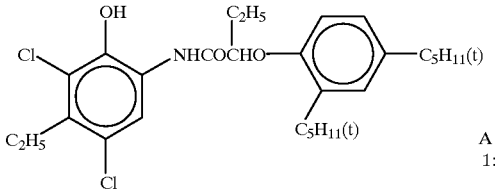

A mixture in 1:1 in molar ration

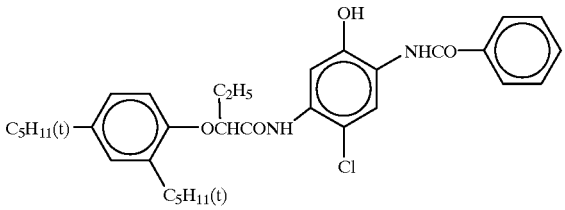

ExC-5 (Cyan coupler)

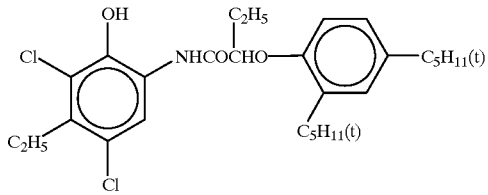

Example 6

Sample 501 to 508 were prepared in the same manner as samples 401 to 408 of Example 5, except that the red-sensitive silver halide emulsion layer and the green-sensitive silver halide emulsion layer were interchanged. Evaluation of these samples were carried out in the same manner as in Example 2. Similar results were obtained.

Example 7

At the time of evaluation of samples prepared in Examples 2 to 6, used were samples which were exposed by scanning exposure (average exposure time of $1.7\times10^{-7}$) seconds per one pixel) using a three-color laser light source and a polygon mirror in accordance with a method described in JP-A-10-232476. The obtained results demonstrates that a silver halide color photographic light-sensitive material having an ultra-rapid processing suitability could be obtained according to the present invention. Embodiments of the present invention are particularly effective to speed up color development.

Example 8

Sample 701 was prepared in the same manner as in sample 108 of Example 2, except that 0.08 g/m$^2$ of fluorescent brightening agent (W-1) was added to the second layer, and 0.02 g/m$^2$ of polyvinylpyrrolidone to the sixth layer, respectively. The sample was subjected to either the processing A and the processing B. After the processing, a white background of the sample was sensually examined under a Toshiba fluorescent lamp for color evaluation, mixed with an outdoor daylight. The obtained results demonstrate that the white background of sample 701 was less yellowish than that of sample 108, which exhibited a preferable white in the sample 701.

W-1 (Fluorescent brightening agent)

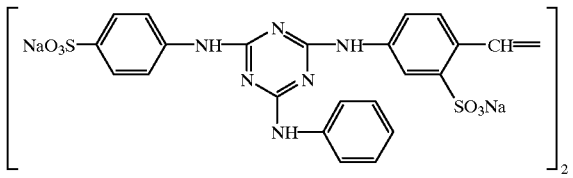

Example 9

The sample was prepare in the same manner as sample 108 of the present invention, except that emulsions a1 or b1 as shown below were used in place of the blue-sensitive silver halide emulsion of the sample 108. The sample thus-prepared was subjected to the same evaluation tests as in Example 2. As a result, more excellent effects were obtained by the sample of this Example.

(Emulsion a1. Preparation of {111} high silver chloride tabular grains)

2.0 g of sodium chloride and 2.8 g of inert gelatin were added to a container containing 1.2 l of water. To the resultant container with stirring while maintaining at the temperature of 33° C., 45 cc of an aqueous silver nitrate solution (containing 18 g of silver nitrate) and 45 cc of an aqueous sodium chloride solution (containing 6.4 g of sodium chloride) were added over one minute according to a double jet method. One minute after the completion of the addition, 0.8 mmol of appearance of crystals-habit controlling agent 1 and 560 g of a 10% aqueous solution of phthalated gelatin were added. Further one minute later, 3.0 g of sodium chloride was added. During the next 25 minutes, the temperature of the container was increased to 60° C. After a ripening of 15 minutes at 60° C., 3 g of sodium chloride and $1\times10^{-5}$ mol of sodium thiosulfonate were added. Thereafter, 295 cc of an aqueous silver nitrate solution (containing 118 g of silver nitrate), 295 cc of an aqueous sodium chloride solution (containing 50.3 g of sodium chloride and $2\times10^{-8}$ mol of hexachloro iridium), and 160 cc of a (M/50) aqueous solution containing the crystal habit controlling agent 1 were added at an accelerated flow rate over 13 minutes. Further, two minutes later, an aqueous silver nitrate solution (containing 34 g of silver nitrate) and an aqueous sodium chloride solution (containing 11.6 g of sodium chloride, 1.27 mg of potassium ferrocyanide, and 0.66 g of potassium iodide) were added over 5 minutes. Then, 33.5 cc of a 0.1 N chiocyanic acid solution, 0.32 mmol of Sensitizing dye A, 0.48 mmol of Sensitizing dye B, and 0.05 mmol of Sensitizing dye c were added.

After cooling down to 40° C., desilvering was carried out according to an ordinary flocculation method. After washing, 67 g of gelatin, 80 cc of phenol (5%) and 150 cc of distilled water were added. The pH and pAg of the resultant emulsion were adjusted to 6.2 to 7.5, respectively, using sodium hydroxide and a silver nitrate solution.

Analytical investigation demonstrated that 90% or more of total projected area of the thus-obtained grains were occupied by tabular grains having an average circle-equivalent diameter of 0.71 μm, an average thickness of 0.13 μm, an average sphere-equivalent diameter of 0.46 μm.

(Emulsion b1; Preparation of {100} silver chloroiodide grains, wherein after 95% grain formation, 0.4 mol % of iodide was added, based on the total silver amount)

To a reactor, added were 1200 ml of water ($H_2O$), 25 g of gelatin (deionized alkali-treated bone gelatin whose methionine content was 40 μmol/g), 0.4 g of sodium chloride, and 4.5 ml of a 1N nitric acid solution. The resultant mixture (pH 4.5) was kept at 40° C. Then, an Ag-1 solution (silver nitrate 0.2 g/cc) and an X-1 solution (sodium chloride 0.069 g/cc) were added and mixed with a vigorous stirring over 4 minutes at a flow rate of 48 cc/minute. Fifteen seconds later, 150 ml of an aqueous polyvinyl alcohol solution was added. The above-mentioned aqueous polyvinyl alcohol solution contained 6.7 g of polyvinylalcohol (hereinafter referred to as PVA-1) wherein an average degree of polymerization of vinyl acetate was 1700, and an average ratio of saponification to alcohol was 98% or more, and contained 1 liter of water ($H_2O$).

Further, 12.3 ml of a 1N nitric acid solution was added to adjust the pH to 3.5. After the temperature was increased to 75° C. over 15 minutes, 23 ml of a 1N sodium hydroxide solution was added to adjust the pH to 6.5. Thereafter, 4.0 ml of 1-(5-methylureidophenyl)-5-mercaptotetrazole (0.05%) and 4.0 ml of N,N-(dimethylimidazolidine-2-thion) (a 1% aqueous solution) were added. After 4 g of sodium hydroxide was added to adjust the silver electric potential [VS. room temperature saturated calomel electrode] to 100 mV, the Ag-1 solution and the X-1 solution as the course of growth were simultaneously added over 15 minutes while increasing linear-wise the flow rate from 40 cc/minute to 42 cc/minute, and keeping the silver electric potential at 100 mV. Further, 12.5 ml of a 1N nitric acid solution was added to adjust the pH to 4.0. After 28.8 g of sodium chloride was added to adjust the silver electric potential to 60 mV. Thereafter, 0.38 mmol of Sensitizing dye A, 0.56 mmol of Sensitizing dye B, and 0.06 mmol of Sensitizing dye C were added and then an Ag-2 solution (0.1 g/cc of silver nitrate) and an X-2 solution (0.0345 g/cc of sodium chloride) were added over 7 minutes and 30 seconds at the flow rate of 40 cc/minute. Then, 25 ml of an aqueous solution (X-4) containing 31.2 g/l of potassium iodide was added over 8 seconds. Further, the Ag-2 solution and the X-2 solution were added over 2 minutes and 30 seconds at the flow rate of 40 cc/minute. Thereafter, the resultant emulsion was allowed to stand at 75° C. for 10 minutes. After cooling down to 40° C., sedimentation washing was carried out for desalting. The resultant emulsion to which 79 g of gelatin was further added, was redispersed, and the pH and pAg were adjusted to 6.0 and 7.3, respectively. A part of the emulsion was picked and an electron microscopic photographic image (TEM image) of the replica of grains was observed. Such a microscopic analysis demonstrated that 90% of the total projected area of all the AgX grains was tabular grains having main planes of {100} phase, an average sphere-equivalent diameter of 0.47 μm, an average grain thickness of 0.10 μm, an average aspect ratio of 7.9, and an average adjacent side ratio of 1.2.

(Chemical sensitization)

Each of the emulsions a1 and b2 was subjected to an optimum chemical sensitization at 60° C., using sodium thiosulfonate, 1-(5-methylureidooheyl)-5-mercaptotetrazole, sodium thiosulfate and chloroauric acid.

Example 10

Samples were prepared in the same manner as samples 101 to 111 of Example 2 and the samples of Example 9, except that the support of these samples was changed to the support A or B as described below, respectively. These samples thus-prepared were subjected to the same evaluation as in Example 2. As a result, it was found that the samples of the present invention each had an excellent rapid processing suitability similar to Example 2. It was found that the use of the support A or B in particular reduces a pressure-induced fog, and further reduces a dependence on humidity of the curl occurring after a processing of the light-sensitive material. Further, it was found that the support A gives much more outstanding effects than the support B.

Preparation of Cellulose Paper Support

A photographic paper support was prepared by purifying a pulp finished paper material composed of 50% of a bleached hard stuff craft, 25% of a bleached hard stuff sulfite, and a bleached soft stuff craft, using a double disk refiner, followed by a Jordan conical refiner, until a degree of purification would reach the Canadian Standard Freeness of 200 cc. To the thus-obtained pulp finished paper material, added were 0.2% of an alkylketenedimer, 1.0% of a cationic cornstarch, 0.5% of a polyamidoepichlorohydrin, 0.26% of an anionic polyacrylamide, and 5.0% of $T_iO_2$, in terms of a dry measure standard. Approximately 225 kg/1000 $m^2$ (46.5 lbf/1000 $ft^2$ (ksf)) absolutely dried weight of a base paper was prepared using a Ford linear paper machine, and then the base paper was wet-pressed to have upto 42% of a dry content, followed by drying to have upto 10% of water content using a vapor (steam) heating dryer, and consequently 160 Sheffield unit of Sheffield Porosity and 0.70 g/cc of apparent density were achieved. Further, the surface of the thus-obtained paper base was spread with a 10% hydroxylethylated cornstarch solution, using a vertical size press, so that 3.3 wt % of starch in terms of the filling rate was achieved. The support having spread starch on its surface was subjected to calendering until the appearance density would become 1.04 g/cc.

Support A

The following sheets were extruded and laminated onto the above-described cellulose paper support having thereon a transparent polyolefin (25 g/$m^2$).

Upper-most Part Sheet: (Emulsion side)

A composite sheet (38 μm in thickness) (d=0.62 g/cc) having each one stretched polypropylene layer, which was filled with titanium oxide and which was free from microscopic pores, on both surfaces of a stretched polypropylene core sheet (about 73% of the total thickness of the sheet) carrying microscopic pores. A pore-inducing substance for use in this sheet was polybutylene terephthalate.

Bottom Part Sheet: (Backsurface)

An one side-matte finished (one side-treated) polypropylene sheet (18 μm in thickness) (d=0.9 g/cc) composed of solid-stretched polypropylene core sheet.

Support B

The following sheets were extruded and laminated onto the above-described cellulose paper support having thereon a transparent polyethylene (25 g/m$^2$).

Upper-most Part Sheet: (Emulsion side)

A polypropylene sheet (27 μm in thickness) (d=0.76 g/cc) filled with titanium oxide.

Bottom Part Sheet: (Backsurface)

An one-side matte-finished sheet (40 μm in thickness) (d=0.78 g/cc) composed of polyethylene.

Example 11

Samples were prepared in the same manner as samples 101 to 111 of Example 2, except that a coating amount of the silver halide emulsion layer was increased by 10%, 20%, or 30%, and the photographic constituent layers were coated on the support of Example 2 and the supports A or B of Example 10, respectively. These samples were subjected to the same evaluation as in Example 2.

It was found from the results that light-sensitive materials having such a constituent according to the second embodiment of the present invention, each exhibited such an excellent rapid processing suitability as observed in Example 2. Further, it was found that the use of support A or B reduced a pressure-fog, and in addition reduced a dependence-on humidity of the curl occurring after processing of the light-sensitive material. Further, it was found that the support A gave much more outstanding effects than the support B.

Example 12

A paper base both surfaces of which had been coated with a polyethylene resin, was subjected to surface corona discharge treatment; then it was provided with a gelatin undercoat layer containing sodium dodecylbenzensulfonate, and it was successively coated with the first to seventh photographic constitutional layers, to prepare Sample (1101) of a silver halide color photographic light-sensitive material having the layer configuration shown below. The coating solutions for each photographic constitutional layer were prepared as follows.

(Preparation of Fifth-Layer Coating Solution)

300 g of a cyan coupler (ExC-1), 250 g of a color-image-stabilizer (Cpd-1), 10 g of a color-image-stabilizer (Cpd-9), 10 g of a color-image-stabilizer (Cpd-10), and 290 g of an ultraviolet absorbing agent (UV-A) were dissolved in 230 g of a solvent (Solv-6) and 350 ml of ethyl acetate, and the resulting solution was emulsified and dispersed in 6500 g of a 10% aqueous gelatin solution containing 25 g of surfactant (Cpd-20), to prepare an emulsified dispersion C.

On the other hand, a silver chlorobromide emulsion C (cubes, a mixture of a large-size emulsion C having an average grain size of 0.40 μm, and a small-size emulsion C having an average grain size of 0.30 μm (5:5 in terms of mol of silver), the deviation coefficients of the grain size distributions being 0.09 and 0.11 respectively, and each emulsion having 0.5 mol % of silver bromide locally contained in part of the grain surface whose substrate was made up of silver chloride) was prepared.

To the large-size emulsion C of this emulsion, had been added $9.0\times10^{-5}$ mol, per mol of silver, of each of red-sensitive sensitizing dyes G and H shown below, and to the small-size emulsion C of this emulsion, had been added $12.0\times10^{-5}$ mol, per mol of silver, of each of red-sensitive sensitizing dyes G and H shown below. The chemical ripening of this emulsion was carried out optimally with a sulfur sensitizer and a gold sensitizer being added.

The above emulsified dispersion C and this silver chlorobromide emulsion C were mixed and dissolved, and a fifth-layer coating solution was prepared so that it would have the composition shown below. The coating amount of the emulsion is in terms of silver.

The coating solutions for the first layer to forth layer and the sixth layer to seventh layer were prepared in the similar manner as that for the fifth layer coating solution. As the gelatin hardener for each layer, H-1, H-2, and H-3 were used.

Further, to each layer, were added Ab-1, Ab-2, Ab-3, and Ab-4, so that the total amounts would be 15.0 mg/m$^2$, 60.0 mg/m$^2$, 5.0 mg/m$^2$, and 10.0 mg/m$^2$, respectively.

(H-1) Hardener

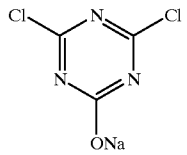

(used in 0.50 wt.% per gelatin)

(H-2) Hardener

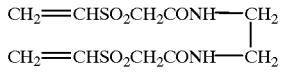

(used in 1.20 wt.% per gelatin)

(H-3) Hardener

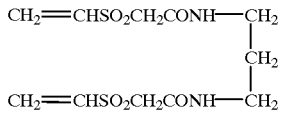

(used in 0.40 wt.% per gelatin)

(Ab-1) Antiseptic

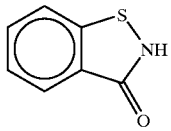

(Ab-2) Antiseptic

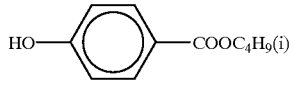

(Ab-3) Antiseptic

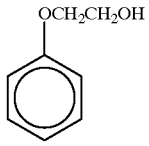

-continued (Ab-4) Antiseptic

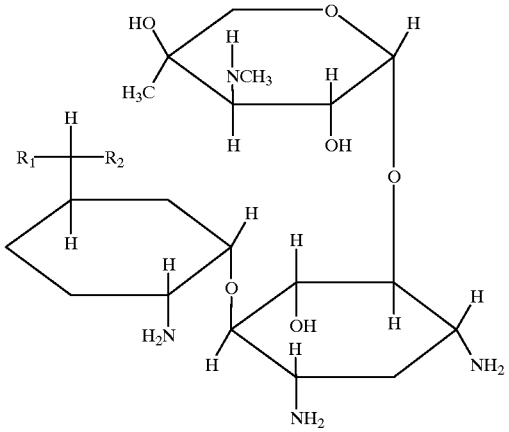

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

A mixture in 1:1:1:1 (molar ratio) of a, b, c, d

For the silver chlorobromide emulsion of each photosensitive emulsion layer, the following spectral sensitizing dyes was used.

(Blue-Sensitive Emulsion Layer)

(Sensitizing dye A)

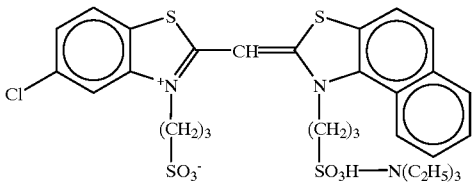

-continued (Sensitizing dye B)

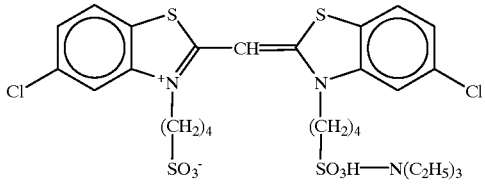

(Sensitizing dye C)

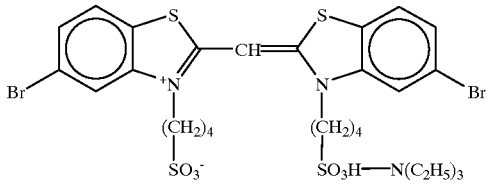

(The sensitizing dyes A and C were added, respectively, to the large-size emulsion, in an amount of $0.42\times10^{-4}$ mol per mol of the silver halide, and to the small-size emulsion in an amount of $0.50\times10^{-4}$ per mol of the silver halide. The sensitizing dyes B was added to the large-size emulsion, in an amount of $3.4\times10^{-4}$ mol per mol of the silver halide, and to the small-size emulsion in an amount of $4.1\times10^{-4}$ per mol of the silver halide.)

(Green-Sensitive Emulsion Layer)

(Sensitizing dye D)

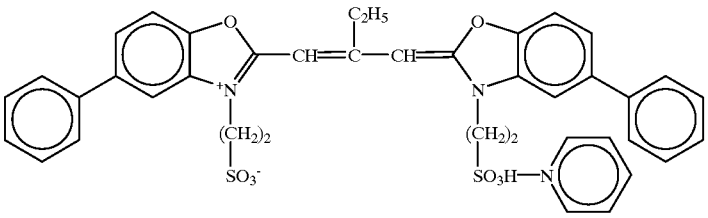

(Sensitizing dye E)

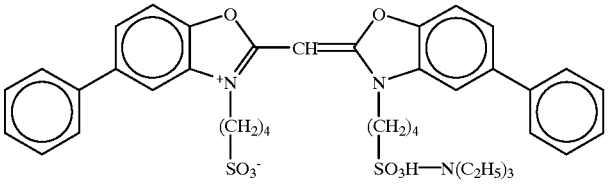

-continued (Sensitizing dye F)

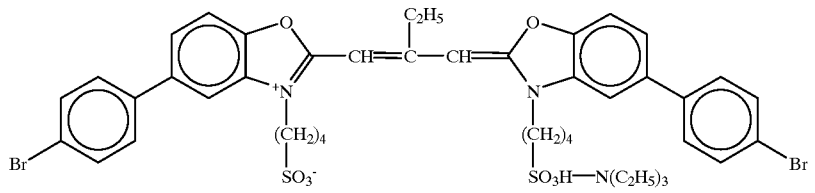

(The sensitizing dye D was added to the large-size emulsion in an amount of $3.0\times10^{-4}$ mol per mol of the silver halide, and to the small-size emulsion in an amount of $3.6\times10^{-4}$ mol per mol of the silver halide; the sensitizing dye E was added to the large-size emulsion in an amount of $4.0\times10^{-5}$ mol per mol of the silver halide, and to the small-size emulsion in an amount of $7.0\times10^{-5}$ mol per mol of the silver halide; and the sensitizing dye F was added to the large-size emulsion in an amount of $2.0\times10^{-4}$ mol per mol of the silver halide, and to the small-size emulsion in an amount of $2.8\times10^{-4}$ mol per mol of the silver halide.)

(Red-Sensitive Emulsion Layer)

(Sensitizing dye G)

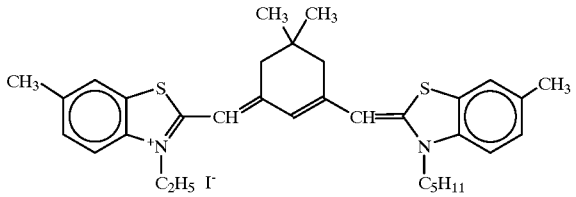

(Sensitizing dye H)

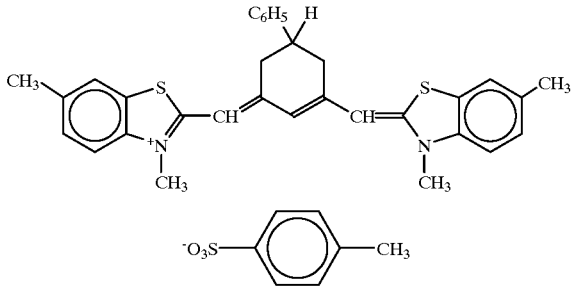

(The sensitizing dyes G and H were added, respectively, to the large-size emulsion, in an amount of $8.0\times10^{-5}$ mol per mol of the silver halide, and to the small-size emulsion in an amount of $10.7\times10^{-5}$ per mol of the silver halide.)

Further, the following compound I was added to the red-sensitive emulsion layer in an amount of $3.0\times10^{-3}$ mol, per mol of the silver halide.

(Compound I)

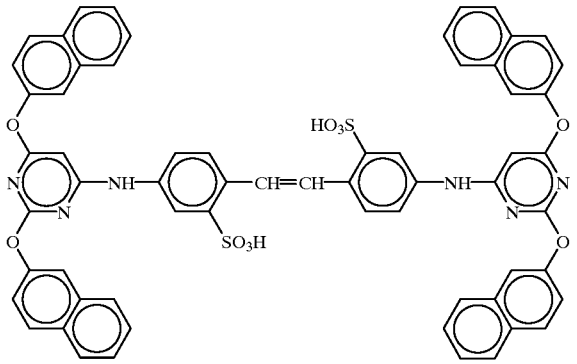

Further, to the blue-sensitive emulsion layer, the green-sensitive emulsion layer, and the red-sensitive emulsion layer, was added 1-(3-inethylureidophenyl)-5-mercaptotetrazole in amounts of $3.3\times10^{-4}$ mol, $1.0\times10^{-3}$ mol, and $5.9\times10^{-4}$ mol, per mol of the silver halide, respectively.

Further, to the second layer, the fourth layer, the sixth layer, and the seventh layer, it was added in amounts of 0.2 mg/m$^2$, 0.2 mg/m$^2$, 0.6 mg/m$^2$, and 0.1 mg/m$^2$, respectively.

Further, to the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, per mol of the silver halide.

To the red-sensitive emulsion layer, was added a copolymer latex of methacrylic acid and butyl acrylate (1:1 in weight ratio; average molecular weight, 200,000 to 400,000) in an amount of 0.05 g/m$^2$.

Further, to the second layer, the fourth layer, and the sixth layer, was added disodium catechol-3,5-disulfonate in amounts of 6 mg/m$^2$, 6 mg/m$^2$, and 18 mg/m$^2$, respectively.

Further, to neutralize irradiation, the following dyes were added to the emulsion layers (the coating amount is shown in parentheses).

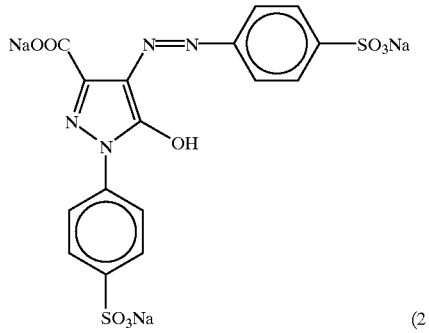

(2 mg/m²)

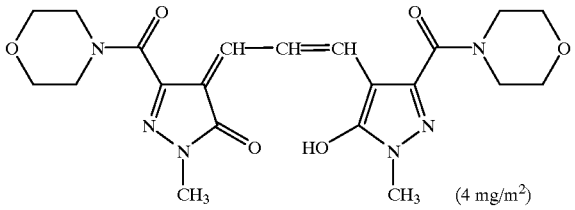

(4 mg/m²)

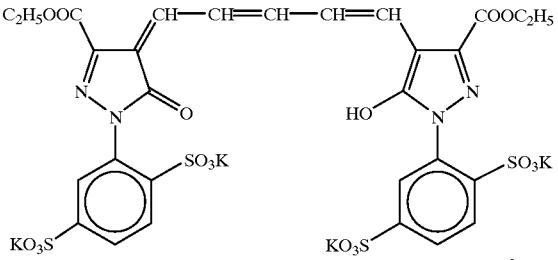

(9 mg/m²)

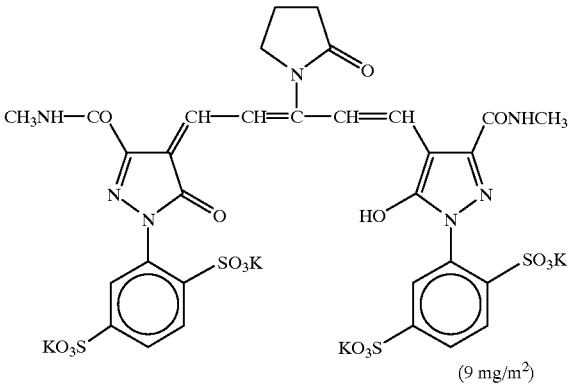

(9 mg/m²)

(Layer Constitution)

The composition of each layer is shown below. The numbers show coating amounts (g/m²). In the case of the silver halide emulsion, the coating amount is in terms of silver.

| Base | |
|---|---|
| Polyethylene Resin-Laminated Paper [The polyethylene resin on the first layer side contained a white pigment ($TiO_2$: content of 16 wt %, ZnO: content of 4 wt %), a fluorescent whitening agent (4,4'-bis(5-methylbenzoxazoryl)stilbene: content of 0.03 wt %), and a blue dye (ultramarine)] | |
| First Layer (Blue-Sensitive Emulsion Layer) | |
| A silver chlorobromide emulsion A: (Cubes, a mixture of a large-size emulsion A having an average grain size of 0.72 μm, and a small-size emulsion A having an average grain size of 0.60 μm (5:5 in terms of mol of silver). The deviation coefficients of the grain size distributions were 0.08 and 0.10, respectively, and each emulsion had 0.3 mol % of silver bromide locally contained in part of the grain surface whose substrate was made up of silver chloride.) | 0.24 |
| Gelatin | 1.25 |
| Yellow coupler (ExY) | 0.57 |
| Color-image stabilizer (Cpd-1) | 0.07 |
| Color-image stabilizer (Cpd-2) | 0.04 |
| Color-image stabilizer (Cpd-3) | 0.07 |
| Color-image stabilizer (Cpd-8) | 0.02 |
| Solvent (Solv-1) | 0.21 |
| Second Layer (Color-Mixing Inhibiting Layer) | |
| Gelatin | 0.99 |
| Color-mixing inhibitor (Cpd-4) | 0.09 |
| Color-image stabilizer (Cpd-5) | 0.018 |
| Color-image stabilizer (Cpd-6) | 0.13 |
| Color-image stabilizer (Cpd-7) | 0.01 |
| Solvent (Solv-1) | 0.06 |
| Solvent (Solv-2) | 0.22 |
| Third Layer (Green-Sensitive Emulsion Layer) | |
| A silver chlorobromide emulsion B: (Cubes, a mixture of a large-size emulsion B having an average grain size of 0.45 μm, and a small-size emulsion B having an average grain size of 0.35 μm (1:3 in terms of mol of silver). The deviation coefficients of the grain size distributions were 0.10 and 0.08, respectively, and each emulsion had 0.4 mol % of silver bromide locally contained in part of the grain surface whose substrate was made up of silver chloride.) | 0.14 |
| Gelatin | 1.36 |
| Magenta coupler (ExM) | 0.15 |
| Ultraviolet absorbing agent (UV-A) | 0.14 |
| Color-image stabilizer (Cpd-2) | 0.02 |
| Color-image stabilizer (Cpd-4) | 0.002 |
| Color-image stabilizer (Cpd-6) | 0.09 |
| Color-image stabilizer (Cpd-8) | 0.02 |
| Color-image stabilizer (Cpd-9) | 0.03 |
| Color-image stabilizer (Cpd-10) | 0.01 |
| Color-image stabilizer (Cpd-11) | 0.0001 |
| Solvent (Solv-3) | 0.11 |
| Solvent (Solv-4) | 0.22 |
| Solvent (Solv-5) | 0.20 |
| Fourth Layer (Color-Mixing Inhibiting Layer) | |
| Gelatin | 0.71 |
| Color-mixing inhibitor (Cpd-4) | 0.06 |
| Color-image stabilizer (Cpd-5) | 0.013 |
| Color-image stabilizer (Cpd-6) | 0.10 |
| Color-image stabilizer (Cpd-7) | 0.007 |
| Solvent (Solv-1) | 0.04 |
| Solvent (Solv-2) | 0.16 |
| Fifth Layer (Red-Sensitive Emulsion Layer) | |
| A silver chlorobromide emulsion C: (Cubes, a mixture of a large-size emulsion C having an average grain size of 0.40 μm, and a small-size emulsion C having an average grain size of 0.30 μm (5:5 in terms of mol of silver). The deviation coefficients of the grain size distributions were 0.09 and 0.11, respectively, and each emulsion had 0.5 mol % of silver bromide locally contained in part of the grain surface whose substrate was made up of silver chloride.) | 0.20 |
| Gelatin | 1.11 |
| Cyan coupler (ExC-1) | 0.30 |
| Ultraviolet absorbing agent (UV-A) | 0.29 |
| Color-image stabilizer (Cpd-1) | 0.25 |
| Color-image stabilizer (Cpd-9) | 0.01 |
| Color-image stabilizer (Cpd-10) | 0.01 |
| Solvent (Solv-6) | 0.23 |
| Sixth Layer (Ultraviolet Absorbing Layer) | |
| Gelatin | 0.46 |
| Ultraviolet absorbing agent (UV-B) | 0.45 |

-continued

| | |
|---|---|
| Solvent (Solv-7) | 0.25 |
| Seventh Layer (Protective Layer) | |
| Gelatin | 1.00 |
| Acryl-modified copolymer of polyvinyl alcohol (modification degree: 17%) | 0.04 |
| Liquid paraffin | 0.02 |
| Surface-active agent (Cpd-13) | 0.01 |

The ratio of [B/AgX] of the yellow coupler-containing layer of sample 1101 thus prepared (the ratio of [amount of gelatin binder/thickness of silver halide emulsion] of the yellow coupler-containing layer) was 1.89. Subsequently, samples 1102 to 1117 were prepared in the same manner as sample 1101 except for the following change. The compositions of these samples, i.e., ratio of [B/AgX], amount of gelatin binder, and order of coloring layers are shown in Table 7 described later.

1) Samples 1102 and 1103 were prepared so as to have the same composition as sample 1101, except that the total gelatin amount was changed to 7.49 g/m$^2$ or 4.76 g/m$^2$ respectively, by allowing to reduce by about 35% or to increase by about 7% of the gelatin binder amount of the layers other than the yellow coupler-containing layer of sample 1101.
2) Samples 1104 to 1106 were prepared in the same manner as samples 1101 to 1103 respectively, except that the three-coloring layers were changed to the order of cyan, magenta and yellow (CMY), in place of that of yellow, magenta and cyan (YMC), in the order near the support.
3) Samples 1107 to 1109 were prepared in the same manner as samples 1104 to 1106 respectively, except that the ratio of [B/AgX] was changed by replacing a silver chlorobromide emulsion of the blue-sensitive emulsion layer with the following emulsion:

Silver Chlorobromide Emulsion to be used in Samples 1107 to 1109 (cubes, an average grain size of 0.85 $\mu$m. The deviation coefficient of the grain size distribution was 0.08. The emulsion had 0.3 mol % of AgBr locally contained in part of the grain surface whose substrate was made up of silver chloride. The amounts of the sensitizing dyes to be added were the same as those of sample 1101, per surface area of the emulsion grains.)

4) Samples 1110 to 1117 were prepared in the same manner as sample 1106, except for a high boiling point organic solvent in the cyan coupler-containing layer.

In the preparation of the above-mentioned samples, an average grain size of each of the emulsion dispersion of fine particles containing a cyan coupler was in the range of 0.15 to 0.18 $\mu$m.

Hereinbelow, the processing steps utilized in this example were shown.

[Process A]

The above Sample 1101 was made into rolls of width 127 mm; they were exposed to light imagewise, using a Mini-lab Printer Processor PP1258AR, trade name, manufactured by Fuji Photo Film Co., Ltd., and they were continuously processed (running test) in the following processing steps, until the replenishment reached to be equal to twice the color development tank volume. This process using the running solution was designated Running test A solution.

| Processing step | Temperature | Time | Replenishing volume* |
|---|---|---|---|
| Color developing | 38.5° C. | 45 sec | 45 ml |
| Bleach-Fixing | 38.0° C. | 45 sec | 35 ml |
| Rinse (1) | 38.0° C. | 20 sec | — |
| Rinse (2) | 38.0° C. | 20 sec | — |
| Rinse (3) | **38.0° C. | 20 sec | — |
| Rinse (4) | **38.0° C. | 30 sec | 121 ml |

*Replenishment rates were amounts per m$^2$ of the light-sensitive material processed.

**A Rinse Cleaning System RC50D, trade name, manufactured by Fuji Photo Film Co., Ltd., was installed in a rinse (3), and the rinse solution was taken out from the rinse (3) and was pumped to a reverse osmosis membrane module (RC50D) by a pump. The permeated water obtained in that tank was fed to a rinse (4), and the concentrated water was returned to the rinse (3). The pump pressure was adjusted so that the amount of the permeated water to the reverse osmosis membrane module would be kept at 50 to 300 ml/min, and circulation was conducted for 10 hours per day.

(The rinse was of a tank counter-current system from the tank (1) to the tank (4).)

The composition of each processing solution was as follows, respectively:

| | Tank Solution | Replenisher |
|---|---|---|
| [Color-developer] | | |
| Water | 800.0 ml | 800.0 ml |
| Dimethylpolysiloxane-series surface active agent (Silicone KF351A, trade name: manufactured by Shinetsu Kagaku Kogyo Co.) | 0.1 g | 0.1 g |
| Tri(isopropanol)amine | 8.8 g | 8.8 g |
| Ethylenediaminetetraacetic acid | 4.0 g | 4.0 g |
| Polyethylene glycol (molecular weight 300) | 10.0 g | 10.0 g |
| Sodium 4,5-dihydroxybenzene-1,3-disulfonate | 0.5 g | 0.5 g |
| Potassium chloride | 10.0 g | — |
| Potassium bromide | 0.040 g | 0.010 g |
| Triazinylaminostilbene-series fluorescent whitening agent (Hacchol FWA-SF; trade name, manufactured by Showa Chemical Industry Co., Ltd.) | 2.5 g | 5.0 g |
| Sodium sulfite | 0.1 g | 0.1 g |
| Disodium-N,N-bis(sulfonatoethyl) hydroxylamine | 8.5 g | 11.1 g |
| N-Ethyl-N-(β-methanesulfonamidoethyl)-3-methyl-4-aminoaniline.3/2 sulfuric acid.monohydrate | 5.0 g | 15.7 g |
| Potassium carbonate | 26.3 g | 26.3 g |
| Water to make | 1000 ml | 1000 ml |
| pH (at 25° C./pH was adjusted by KOH and sulfuric acid) | 10.15 | 12.50 |
| [Bleach-fixing solution] | | |
| Water | 800.0 ml | 800.0 ml |
| Ethylenediaminetetraacetic acid iron (III) ammonium | 47.0 g | 94.0 g |
| Ethylenediaminetetraacetic acid | 1.4 g | 2.8 g |
| m-Carboxybenzenesulfinic acid | 8.3 g | 16.5 g |
| Nitric acid (67%) | 16.5 g | 33.0 g |
| Imidazole | 14.6 g | 29.2 g |
| Ammonium thiosulfate (750 g/liter) | 107.0 ml | 214.0 ml |
| Ammonium sulfite | 16.0 g | 32.0 g |
| Potassium methabisulfite | 23.1 g | 46.2 g |
| water to make | 1000 ml | 1000 ml |
| pH (at 25° C./pH was adjusted by acetic acid and ammonia) | 5.5 | 5.2 |

-continued

| | Tank Solution | Replenisher |
|---|---|---|
| [Rinse solution] | | |
| Sodium chlorinated isocyanurate | 0.02 g | 0.02 g |
| Deionized water (conductivity: 5 μS/cm or below) | 1000 ml | 1000 ml |
| pH | 6.0 | 6.0 |

[Process B]

The above Sample 1101 was made into rolls of width 127 mm; they were exposed to light imagewise, using a Mini-lab Printer Processor PP1258AR, trade name, manufactured by Fuji Photo Film Co., Ltd., and they were continuously processed (running test) in the following processing steps, until the replenishment reached to be equal to twice the color development tank volume. This process using the running solution was designated Running Test B solution.

| Processing step | Temperature | Time | Replenisher | Tank volume |
|---|---|---|---|---|
| Color developing | 47° C. | 12 sec | 35 ml | 2 liters |
| Bleach-Fixing | 40° C. | 12 sec | 38 ml | 1 liter |
| Rinse (1) | 40–50° C. | 3.2 sec | — | 0.5 liters |
| Rinse (2) | 40–50° C. | 2.0 sec | — | 0.5 liters |
| Rinse (3) | 40–45° C. | 2.0 sec | — | 0.5 liters |
| Rinse (4) | 40–45° C. | 2.0 sec | — | 0.5 liters |
| Rinse (5) | 40–45° C. | 3.2 sec | 80 ml | 0.5 liters |
| Dry | 80° C. | 10 sec | — | — |

(The rinse was of a 5-tank counter-current system from the rinse (5) to the rinse (1).)

In the above processing, the water of the Rinse (5) was pumped to the reverse osmosis membrane, the passed water was supplied to the Rinse (5), and the condensed water that did not pass through the reverse osmosis membrane was returned to the Rinse (4) to use again. To shorten the crossover time, each blade was placed between each of two rinsing tanks to pass the light-sensitive material between them.

Further, in each of the steps, a recycle processing solution was blown in a spray amount of 4 to 6 l/min based on 1 tank, by means of a spray device as shown in the above embodiment.

| | Tank Solution | Replenisher |
|---|---|---|
| [Color-developer] | | |
| Water | 700 ml | 700 ml |
| Sodium triisopropylnaphthalene(β) sulfonate | 0.1 g | 0.1 g |
| Ethylenediaminetetraacetic acid | 3.0 g | 3.0 g |
| Disodium 1,2-dihydroxybenzene-4,6-disulfonate | 0.5 g | 0.5 g |
| Tri(isopropanol)amine | 8.8 g | 8.8 g |
| Polyethylene grylcol (molecular weight: 300) | 10.0 g | 10.0 g |
| Potassium chloride | 15.8 g | — |
| Potassium bromide | 0.04 g | — |
| Potassium carbonate | 27.0 g | 27.0 g |
| Sodium sulfite | 0.1 g | 0.1 g |

-continued

| | Tank Solution | Replenisher |
|---|---|---|
| Disodium-N,N-bis(sulfonatoethyl)-hydroxylamine | 18.0 g | 35.0 g |
| N-ethyl-N-(β-methane-sulfonamidoethyl)-3-methyl-4-aminoaniline sulfate | 8.0 g | 23.0 g |
| Triazinylaminostilbene-series fluorescent whitening agent (Hacchol FWA-SF; trade name, manufactured by Showa Chemical Industry Co., Ltd.) | 2.5 g | 5.0 g |
| Water to make | 1000 ml | 1000 ml |
| pH (25° C.) | 10.35 | 12.80 |
| (pH of both solutions were adjusted in the same manner as in tank solution and replenisher of color developer.) Bleach-fix solution (a replenisher whose components were separated into the following two solutions, was used.) Bleach-fixing solution (that was used as the following two separate replenishers containing respective ingredients.) | | |
| [1st Replenisher] | | |
| Water | 150 ml | |
| Ammonium sulfite.monohydrate | 226 g | |
| Ethylenediaminetetraacetic acid | 7.5 g | |
| Ammonium bromide | 30 g | |
| Ammonium thiosulfate (700 g/l) | 340 ml | |
| Water to make | 1000 ml | |
| pH (25° C.) | 5.82 | |
| [2nd Replenisher] | | |
| Water | 140 ml | |
| Ethylenediaminetetraacetic acid | 11.0 g | |
| Ethylenediaminetetraacetic acid iron (III) ammonium | 384 g | |
| n-Butylguanidine nitrate | 30 g | |
| Acetic acid (50%) | 230 ml | |
| Water to make | 1000 ml | |
| pH (25° C.) | 3.35 | |
| Tank solution of bleach-fix solution | | |
| 1st replenisher | 260 ml | |
| 2nd replenisher | 290 ml | |
| Water to make | 1000 ml | |
| pH (25° C.) | 5.0 | |
| Replenish amount of bleach-fix solution (the following amount corresponds to 38 ml in total per $m^2$). | | |
| 1st replenisher | 18 ml | |
| 2nd replenisher | 20 ml | |
| Rinsing solution | | |
| Deionized water (calcium and magnesium each were 3 ppm or below) | | |

Next, evaluation tests are described.

(Evaluation Test of Progress of Development)

Each of the samples was subjected to a gray gradation exposure in an exposure amount of 250 cms for an exposure time of 0.1 sec., using a sensitometer (FWH Model, made by Fuji Photo Film Co., Ltd., color temperature of the light source: 3200° K.). Each of the thus-exposed samples was processed with the above-described processing A (color development time 45 sec.) and with the above-described processing B (color development time 12 sec.). Thereafter, the ratio of the yellow maximum density ($D^Y mB$) obtained with the processing B to the yellow maximum density ($D^Y mA$) obtained with the processing A, i.e., ($D^Y mB/D^Y mA$) was measured. The ratio of $D^Y mB/D^Y mA$ is defined by the formula shown below, and means that the closer 1, the higher color density can be obtained even by a color development in a short period of time.

$$0<(D^{Y}mB/D^{Y}mA)\leqq 1$$

Further, similarly the cyan maximum density was also indicated by the following formula:

$$0<(D^{c}mB/D^{c}mA)\leqq 1$$

The above-described formula indicates that the closer to 0 the ΔD is, the less reduction in density at the time of the second bleach-fixing, and consequently the less desilvering inadequacy.

Each of the samples were processed according to the processing A and the processing B which had completed a running processing, respectively, and they were evaluated according to the above-described methods. The results which were obtained are shown in Table 7.

TABLE 7

| Sample | Order of colorforming layers (support side to upper layer side) | Total coated amount of gelatin g/m$^2$ | B/AgX ratio | High boiling organic solvent | Proceeding rate of development $D^{Y}_{mB}/D^{Y}_{mA}$ | Blix discoloration (fading ratio) |
|---|---|---|---|---|---|---|
| 1101 | Y M C | 6.92 | 1.89 | S-5 | 0.65 | 2.7 |
| 1102 | Y M C | 7.49 | ″ | ″ | 0.58 | 3.0 |
| 1103 | Y M C | 4.76 | ″ | ″ | 0.78 | 2.0 |
| 1104 | C M Y | 6.92 | ″ | ″ | 0.96 | 3.3 |
| 1105 | C M Y | 7.49 | ″ | ″ | 0.94 | 5.0 |
| 1106 | C M Y | 4.76 | ″ | ″ | 0.98 | 2.2 |
| 1107 | C M Y | 6.92 | 1.47 | ″ | 0.88 | 4.3 |
| 1108 | C M Y | 7.49 | ″ | ″ | 0.86 | 5.1 |
| 1109 | C M Y | 4.76 | ″ | ″ | 0.90 | 4.0 |
| 1110 | C M Y | 4.76 | 1.89 | S-1 | 0.99 | 2.0 |
| 1111 | C M Y | ″ | ″ | S-7 | 0.97 | 2.2 |
| 1112 | C M Y | ″ | ″ | S-11 | 0.98 | 2.4 |
| 1113 | C M Y | ″ | ″ | S-24 | 0.98 | 2.5 |
| 1114 | C M Y | ″ | ″ | ExS-a | 0.98 | 7.7 |
| 1115 | C M Y | ″ | ″ | ExS-b | 0.97 | 8.5 |
| 1116 | C M Y | ″ | ″ | ExS-c | 0.98 | 9.4 |
| 1117 | C M Y | ″ | ″ | ExS-d | 0.97 | 6.5 |

(Evaluation Test of Blix Discoloration)

Following the same exposure as mentioned above, the cyan maximum density $D^{c}mB$ of each of the samples processed with the processing B was measured. Thereafter, these samples were processed with CN-16N2 made by Fuji Photo Film Co., Ltd. at 30° C. for 4 minutes, thereby to restore a leuco base of the cyan dye to the cyan dye, and then the cyan maximum density of the thus-restored dye was measured again. Based on the cyan dye density just after the processing and the cyan dye density restored from a leuco base, the fading rate in the blix discoloration was measured according to the following formula:

Fading rate=(1-[Cyan Maximum Density before Re-processing]/[Cyan Maximum Density after Re-processing])×100

This indicates that the lower fading rate, the less blix discoloration occurs and consequently the higher cyan color density can be obtained.

(Evaluation Test of Desilvering)

Each of the samples were processed according to the processing B, except that the bleach-fixing time was changed to five seconds. A black and white density ($D_vB$) at the point to give the yellow density of 2.0 was measured. Subsequently, the thus-processed samples were further processed for 45 seconds at the bleach-fixing step of the processing A. After washing and drying, a black and white density ($D_vA$) of the yellow-coloring part at the above-said point was measured again. A change in the black and white density was measured according to the following formula:

$$\Delta D=D_vB-D_vA$$

Comparative High-boiling Organic Solvent

ExS-a

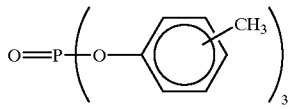

viscosity 57.6 cp

ExS-b

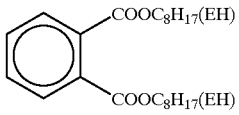

viscosity 62.7 cp

ExS-c

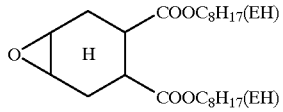

viscosity 80 cp

ExS-d

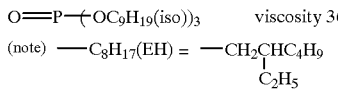

viscosity 36.3 cp

The results shown in Table 7 demonstrates the followings. Samples 1101 to 1103 each of which had a layer structure comprising a yellow coupler-containing layer which was not the upper-most layer, exhibited less blix discoloration, whereas a poor progress of development. Further, even though the yellow-coupler-containing layer was the upper-most layer, if the total gelatin amount was too large, the blix discoloration increased unpreferably (samples 1105 and 1108). On the other hand, even though both the order of coloring layers and the total gelatin-coating amount were within the above preferable ranges in the present invention, if the ratio of B/AgX was too small, the blix discoloration tended to increase (samples 1107 and 1109). Further, the results of samples 1114 to 1117 show that if a high boiling point organic solvent which does not fall within the second embodiment of the present invention was used, the blix discoloration deteriorated.

In contrast, samples 1104, 1106, 1107, 1109 to 1113 according to the second embodiment of the present invention each were excellent in the progress of development, and exhibited a sufficiently high Dmax and less blix discoloration, even though they were processed for the developing time of 12 seconds according to the processing B.

Example 13

Tank solutions for a bleach-fixing solution was prepared in the same manner as in the "processing B" of Example 12, except for allowing the pH to be changed as shown in Table 8. The exposed light-sensitive material samples 1101, 1103, 1106 and 1109 were each processed with each of these bleach-processing solutions having a different pH in the "processing B" which had completed a running processing in Example 12. The desilvering property and the blix discoloration of the thus-processed samples were evaluated.

The results shown in Table 8 demonstrate the followings:

Samples 1101 and 1103, each of which had a layer constitution comprising a yellow coupler-containing layer closest to the support, each exhibited poor desilvering property. Further, in these samples, when the pH was lowered in order to reduce a residual silver amount, the blix discoloration considerably deteriorated. Light-sensitive material sample 1109 exhibiting the ratio of B/AgX lower than that of light-sensitive material sample 1106 owing to a larger silver halide grain size than that of the sample 1106, tended to deteriorate the blix discoloration when processed using a blix solution of a pH of 4.5 to 6.0. Further, when the pH value of a bleach-fixing solution was too high or too low, even the use of sample 1106 according to the present invention could not exhibit a satisfactory result from a viewpoint of the desilvering property and the blix discoloration.

In contrast, when the sample 1106 according to the present invention was processed with a bleach-fixing solution having the pH of 4.5 to 6.0, neither the desilvering property was damaged nor the blix discoloration was deteriorated, even under a rapid processing.

TABLE 8

| Sample | Order of color-forming layers (support side to upper layer side) | Total coated amount of gelatin g/m$^2$ | B/AgX ratio | pH of bleach-fixing solution | Desilvering failure Δ Dv | Blix discoloration (fading rate) |
|---|---|---|---|---|---|---|
| 1101 | Y M C | 6.92 | 1.89 | 6.7 | 0.17 | 1.0 |
| | | | | 6.3 | 0.15 | 1.2 |
| | | | | 6.0 | 0.15 | 2.6 |
| | | | | 5.8 | 0.14 | 2.4 |
| | | | | 5.5 | 0.12 | 3.5 |
| | | | | 5.2 | 0.10 | 3.2 |
| | | | | 4.8 | 0.08 | 5.7 |
| | | | | 4.4 | 0.07 | 11.3 |
| 1103 | Y M C | 4.76 | 1.89 | 6.7 | 0.18 | 0.4 |
| | | | | 6.3 | 0.15 | 1.5 |
| | | | | 6.0 | 0.13 | 1.7 |
| | | | | 5.8 | 0.11 | 2.3 |
| | | | | 5.5 | 0.10 | 2.7 |
| | | | | 5.2 | 0.07 | 3.3 |
| | | | | 4.8 | 0.05 | 3.8 |
| | | | | 4.4 | 0.04 | 7.6 |
| 1106 | C M Y | 4.76 | 1.47 | 6.7 | 0.07 | 0.5 |
| | | | | 6.3 | 0.04 | 0.9 |
| | | | | 6.0 | 0.02 | 1.8 |
| | | | | 5.8 | 0.02 | 2.0 |
| | | | | 5.5 | 0.01 | 2.4 |
| | | | | 5.2 | 0.01 | 3.6 |
| | | | | 4.8 | 0.01 | 4.2 |
| | | | | 4.4 | 0.01 | 8.8 |
| 1109 | C M Y | 4.76 | 1.47 | 6.7 | 0.08 | 1.0 |
| | | | | 6.3 | 0.05 | 2.0 |
| | | | | 6.0 | 0.04 | 3.4 |
| | | | | 5.8 | 0.02 | 3.7 |
| | | | | 5.5 | 0.02 | 4.0 |
| | | | | 5.2 | 0.02 | 5.7 |
| | | | | 4.8 | 0.01 | 7.2 |
| | | | | 4.4 | 0.01 | 9.8 |

Example 14

Samples 1118 to.1136 were prepared in the same manner as sample 1106 in Example 12, except that in the cyan coupler containing layer, a compound of formula [II] or [III] and a compound for comparison were used, and that the average grain size of fine particles in the emulsification dispersion comprising the cyan coupler was changed. These samples were processed according to the "processing B" which had completed a running processing, except that the pH value of a bleach-fixing solution of the "processing B" was adjusted to 5.0. The blix discoloration of these samples thus processed was evaluated in the same manner as in Example 12. The results which were obtained are shown in Table 9.

TABLE 9

| Light-sensitive material | Order of color-forming layers (support side to upper layer side) | Total coated amount of gelatin g/m$^2$ | B/AgX ratio | Compound of formula [II] or formula [III] | g/m$^2$ | Average particle diameter of emulsified dispersion ($\mu$m) | Blix discoloration fading rate % |
|---|---|---|---|---|---|---|---|
| 1118 | CMY | 4.76 | 1.89 | — | — | 0.130 | 4.9 |
| 1119 | " | " | " | — | — | 0.150 | 4.0 |
| 1120 | " | " | " | — | — | 0.180 | 3.8 |
| 1121 | " | " | " | — | — | 0.230 | 3.0 |
| 1122 | " | " | " | III-6 | 0.20 | 0.130 | 4.0 |
| 1123 | " | " | " | " | " | 0.150 | 3.0 |
| 1124 | " | " | " | " | " | 0.180 | 2.8 |
| 1125 | " | " | " | " | " | 0.230 | 2.0 |
| 1126 | " | " | " | II-1 | " | 0.150 | 3.0 |
| 1127 | " | " | " | II-3 | " | 0.150 | 3.2 |
| 1128 | " | " | " | II-6 | " | " | 3.0 |
| 1129 | " | " | " | II-9 | " | " | 3.1 |
| 1130 | " | " | " | III-2 | " | " | 3.1 |
| 1131 | " | " | " | III-4 | " | " | 3.1 |
| 1132 | " | " | " | III-9 | " | " | 3.2 |
| 1133 | " | " | " | III-16 | " | " | 3.0 |
| 1134 | " | " | " | Compound for comparison ExII-a | " | " | 4.0 |
| 1135 | " | " | " | Compound for comparison ExII-b | " | " | 4.1 |
| 1136 | " | " | " | Compound for comparison ExII-c | " | " | 4.0 |

Compounds for Comparison

Ex II-a

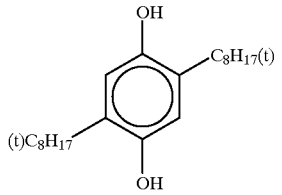

Ex II-b

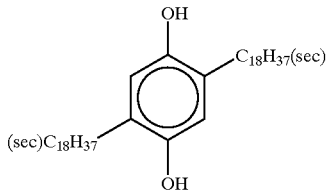

-continued

Ex II-c

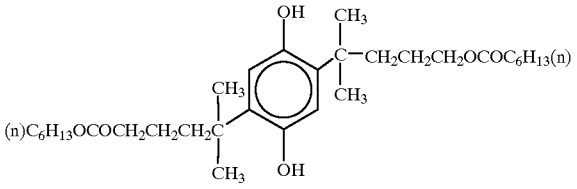

As is apparent from the results shown in Table 9, the followings can be understood. Reduction in cyan density due to the blix discoloration was further inhibited by incorporating at least one compound represented by formula [II] or [III] whereby more preferable results could be obtained according to the present invention. Further, it was preferable for obtaining the effects of the present invention that the average particle size of the emulsified dispersion was about 0.13 $\mu$m or more.

Example 15

Samples 1141 to 1150 were prepared in the same manner as the sample 1106 in Example 12, except that in the cyan coupler-containing layer, the molar ratio of silver/coupler was changed and also the amount of a water-insoluble polymer to be used when the cyan coupler was emulsified and dispersed therewith was altered, with the coating amount of the coupler, being not changed. These samples were evaluated in the same manner as in Example 14, except that the pH value of the bleach-fixing solution of the "eprocessing B" after the completion of a running processing, was adjusted to 5.5. The results which were obtained are shown in Table 10.

TABLE 10

| Sample | B/AgX ratio | Ag/Cp molar ratio | Polymer used in emulsified dispersion | g/m$^2$ | Blix discoloration fading rate % | Remarks |
|---|---|---|---|---|---|---|
| 1141 | 1.89 | 2.5 | — | — | 2.7 | This invention |
| 1142 | " | 3.0 | — | — | 3.0 | " |
| 1143 | " | 3.5 | — | — | 3.3 | " |
| 1144 | " | 4.0 | — | — | 3.9 | " |
| 1147 | " | 2.5 | P-17) | 0.25 | 2.3 | This invention |
| 1148 | " | 3.0 | " | " | 2.4 | " |
| 1149 | " | 3.5 | " | " | 2.7 | " |
| 1150 | " | 4.0 | " | " | 3.3 | " |

As is apparent from the results shown in Table 10, it is understood that the blix discoloration could be improved by using the water-insoluble polymer and that the blix discoloration could be inhibited by adjusting the ratio of Ag/Cp.

Example 16

Light-sensitive material samples were prepared in the same manner as sample 1106 in Example 12, except that a polymer latex of formula [P] and cyan couplers of formula [C-I] or [I] in the cyan coupler-containing layer were changed as shown in Table 11. These samples were evaluated in the same manner as in Example 13.

TABLE 11

| Light-sensitive material | Total coated amount of gelatin g/m$^2$ | B/AgX ratio | Polymer of formula [P] No. | Polymer of formula [P] g/m$^2$ | Cyan coupler of formula [C-I] No. | Cyan coupler of formula [C-I] g/m$^2$ | Cyan coupler of formula [C-I] No. | Cyan coupler of formula [C-I] g/m$^2$ | Cyan coupler of formula [I] No. | Cyan coupler of formula [I] g/m$^2$ | Blix discoloration fading rate % | Remarks |
|---|---|---|---|---|---|---|---|---|---|---|---|---|
| 1159 | 4.76 | 1.89 | — | — | C-4 | 0.255 | C-6 | 0.045 | — | — | 4.0 | This invention |
| 1161 | " | " | P-2 | 0.06 | " | " | " | " | — | — | 2.4 | " |
| 1162 | " | " | P-3 | " | " | " | " | " | — | — | 3.2 | " |
| 1163 | " | " | P-12 | " | " | " | " | " | — | — | 2.7 | " |
| 1164 | " | " | P-3 | " | C-2 | 0.30 | — | — | — | — | 3.3 | " |
| 1165 | " | " | P-12 | " | C-6 | " | — | — | — | — | 3.4 | " |
| 1166 | " | " | P-2 | 0.03 | C-2 | 0.10 | — | — | 1 | 0.10 | 2.0 | " |
| 1167 | " | " | " | 0.05 | " | " | — | — | 31 | 0.10 | 2.2 | " |
| 1168 | " | " | " | 0.05 | C-4 | 0.16 | — | — | 1 | 0.07 | 1.5 | " |
| 1169 | " | " | " | 0.10 | " | 0.06 | — | — | " | 0.13 | 1.5 | " |
| 1170 | " | " | " | 0.15 | " | 0.02 | — | — | " | 0.15 | 1.0 | " |
| 1171 | " | " | " | 0.10 | " | 0.02 | — | — | " | 0.15 | 1.0 | " |
| 1172 | " | " | " | 0.10 | — | — | — | — | " | 0.17 | 0.5 | " |

As is apparent from the results shown in Table 11, the followings can be understood. The blix discoloration could be inhibited by adjusting the total gelatin amount to the particular range and optionally using a polymer latex of formula [PP] or [P]. Further, the use of a cyan coupler represented by formula [I] was also preferred in the present invention.

Example 17

Sample 1201 was prepared in the same manner as Sample 1101, except that the compositions of each layer of light-sensitive material sample 1101 were changed as shown below.

(Preparation of light-sensitive material 1201)

| First Layer (Blue-Sensitive Emulsion Layer) | |
|---|---|
| Silver chlorobromide emulsion A (the same emulsion as in sample 1101) | 0.24 |
| Gelatin | 1.25 |
| Yellow coupler (ExY) | 0.57 |
| Color-image stabilizer (Cpd-1) | 0.07 |
| Color-image stabilizer (Cpd-2) | 0.04 |
| Color-image stabilizer (Cpd-3) | 0.07 |

-continued

| | |
|---|---|
| Color-image stabilizer (Cpd-8) | 0.02 |
| Solvent (Solv-1) | 0.21 |
| **Second Layer (Color-Mixing Inhibiting Layer)** | |
| Gelatin | 0.60 |
| Color-mixing inhibitor (Cpd-19) | 0.09 |
| Color-image stabilizer (Cpd-5) | 0.007 |
| Color-image stabilizer (Cpd-7) | 0.007 |
| Ultraviolet absorbing agent (UV-C) | 0.05 |
| Solvent (Solv-1) | 0.11 |
| **Third Layer (Green-Sensitive Emulsion Layer)** | |
| Silver chlorobromide emulsion B (the same emulsion as in sample 1101) | 0.14 |
| Gelatin | 0.73 |
| Magenta coupler (ExM) | 0.15 |
| ultraviolet absorbing agent (UV-A) | 0.05 |
| Color-image stabilizer (Cpd-2) | 0.02 |
| Color-image stabilizer (Cpd-7) | 0.008 |

-continued

| | |
|---|---|
| Color-image stabilizer (Cpd-8) | 0.07 |
| Color-image stabilizer (Cpd-9) | 0.03 |
| Color-image stabilizer (Cpd-10) | 0.009 |
| Color-image stabilizer (Cpd-11) | 0.0001 |
| Solvent (Solv-3) | 0.06 |
| Solvent (Solv-4) | 0.11 |
| Solvent (Solv-5) | 0.06 |
| Fourth Layer (Color-Mixing Inhibiting Layer) | |
| Gelatin | 0.48 |
| Color-mixing inhibitor (Cpd-4) | 0.07 |
| Color-image stabilizer (Cpd-5) | 0.006 |
| Color-image stabilizer (Cpd-7) | 0.006 |
| Ultraviolet absorbing agent (UV-C) | 0.04 |
| Solvent (Solv-5) | 0.09 |
| Fifth Layer (Red-Sensitive Emulsion Layer) | |
| Silver chlorobromide emulsion C (the same einulsion as in sample 1101) | 0.12 |
| Gelatin | 0.59 |
| Cyan coupler (ExC-2) | 0.13 |
| Cyan coupler (ExC-3) | 0.03 |
| Color-image stabilizer (Cpd-7) | 0.01 |
| Color-image stabilizer (Cpd-9) | 0.04 |
| Color-image stabilizer (Cpd-15) | 0.19 |
| Color-image stabilizer (Cpd-18) | 0.04 |
| Ultraviolet absorbing agent (UV-7) | 0.02 |
| Solvent (Solv-5) | 0.09 |
| Sixth Layer (Ultraviolet Absorbing Layer) | |
| Gelatin | 0.32 |
| Ultraviolet absorbing agent (UV-C) | 0.42 |
| Solvent (Solv-7) | 0.08 |
| Seventh Layer (Protective Layer) | |
| Gelatin | 0.70 |
| Acryl-modified copolymer of polyvinyl alcohol (modification degree: 17%) | 0.04 |
| Liquid paraffin | 0.01 |
| Surface-active agent (Cpd-13) | 0.01 |
| Polydimethylsiloxane | 0.01 |
| Silicon dioxide | 0.003 |

(ExY) Yellow coupler
A mixture in 70:30 of

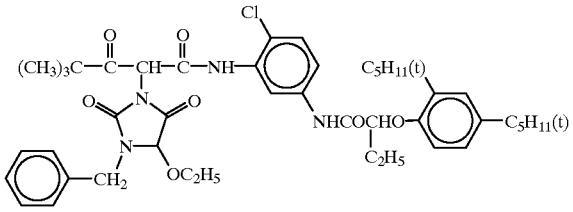

and

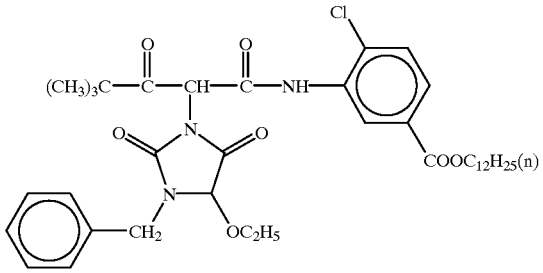

-continued (ExM) Magenta coupler
A mixture in 40:40:20 of

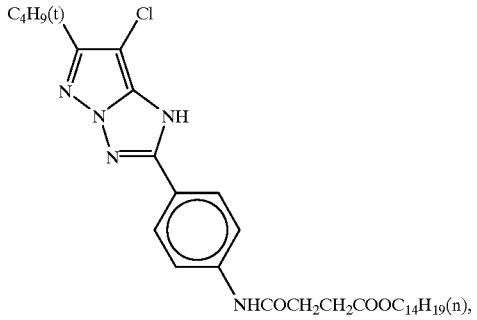

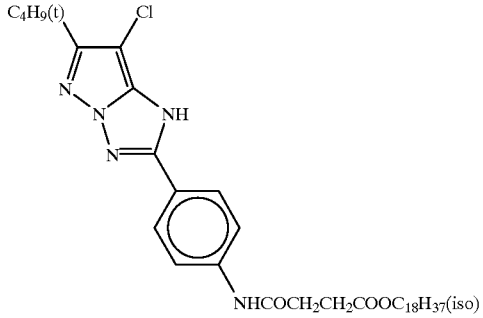

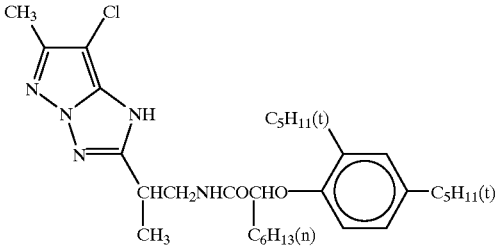

(ExC-1) Cyan coupler
A mixture in 15:85 of

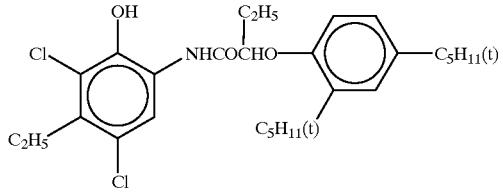

and

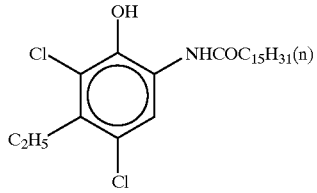

-continued (ExC-2) Cyan coupler

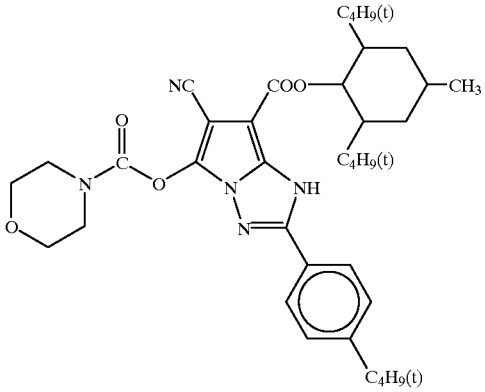

(ExC-3) Cyan coupler
A mixture in 50:25:25 of

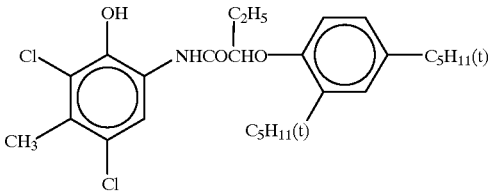

and

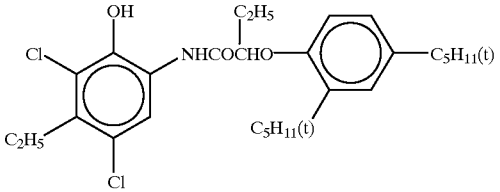

and

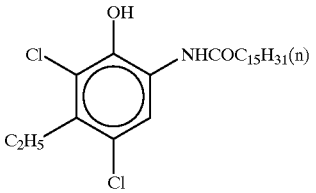

(Cpd-1) Color-image stabilizer

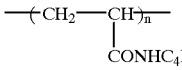

number-average
molecular weight
60,000

(Cpd-2) Color-image stabilizer

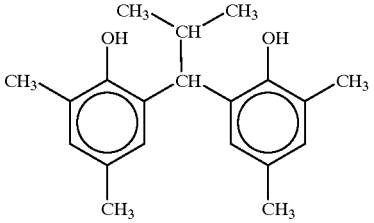

-continued (Cpd-3) Color-image stabilizer

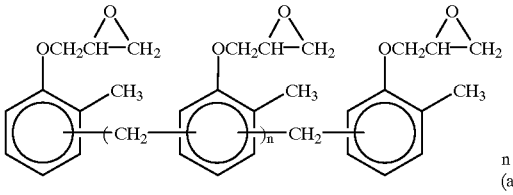

n = 7 ~ 8
(average)

(Cpd-4) Color-mixing inhibitor
A mixture in 1:1 of

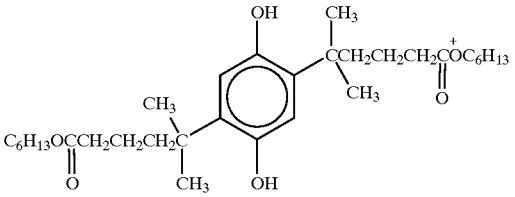

and

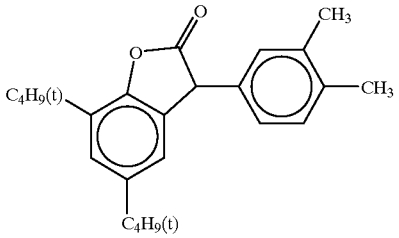

(Cpd-5) Color-mixing inhibiting auxiliary

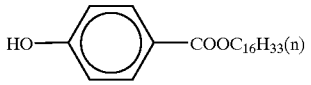

(Cpd-6) Stabilizer

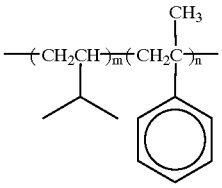

number-average
molecular
weight 600
m/n = 10/90

(Cpd-7) Color-mixing inhibitor

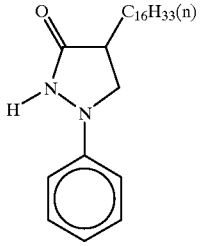

(Cpd-8) Color-image stabilizer

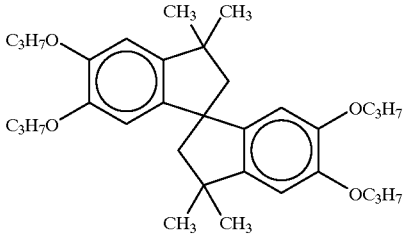

-continued
(Cpd-9) Color-image stabilizer
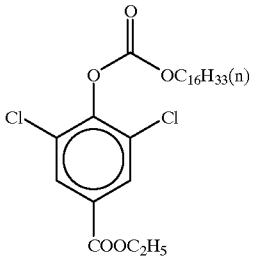
(Cpd-10) Color-image stabilizer
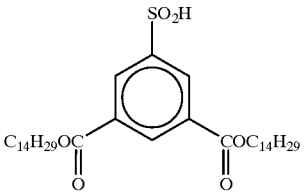
(Cpd-11)
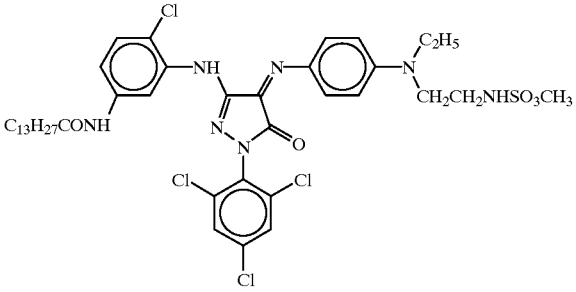
(Cpd-12) Color-image stabilizer
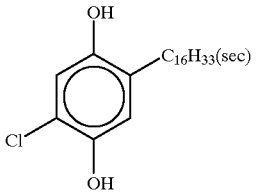
(Cpd-13) Surfactant
A mixture in 7:3 of
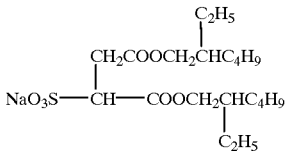
and
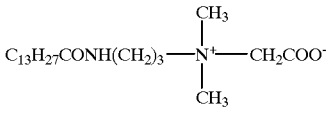
-continued
(Cpd-14)
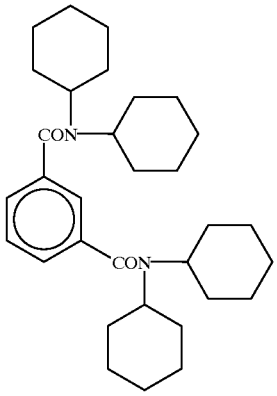
(Cpd-15)
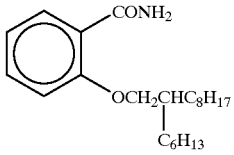
(Cpd-16)
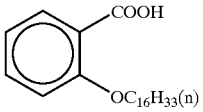
(Cpd-17)
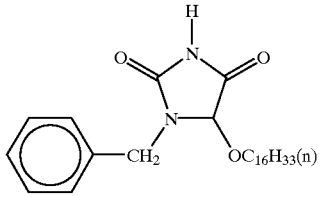
(Cpd-18)
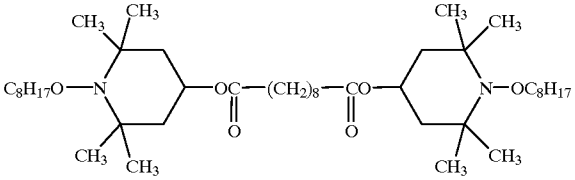
(Cpd-19) Color-mixing inhibitor
A mixture in 1:1 of
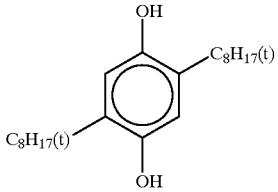
and
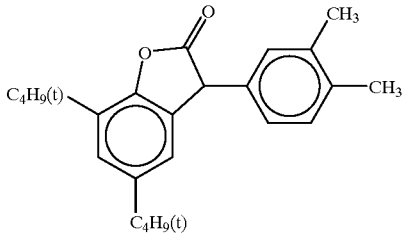

-continued (Cpd-20) Surfactant
A mixture in 1:4 of

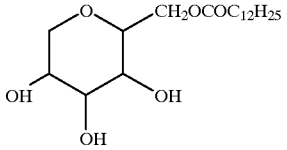

and

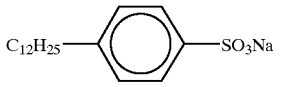

(UV-1) Ultra-violet absorbent

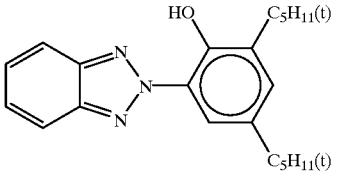

(UV-2) Ultra-violet absorbent

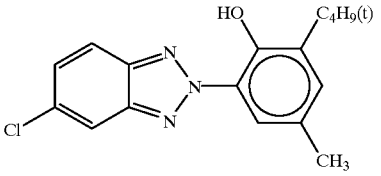

(UV-3) Ultra-violet absorbent

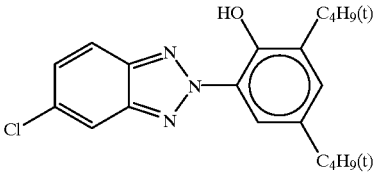

(UV-4) Ultra-violet absorbent

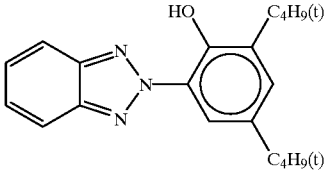

(UV-5) Ultra-violet absorbent

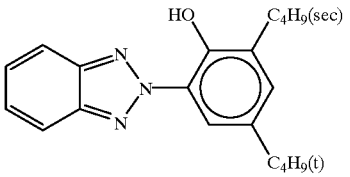

(UV-6) Ultra-violet absorbent

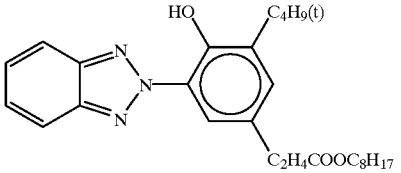

-continued (UV-7)
Ultra-violet absorbent

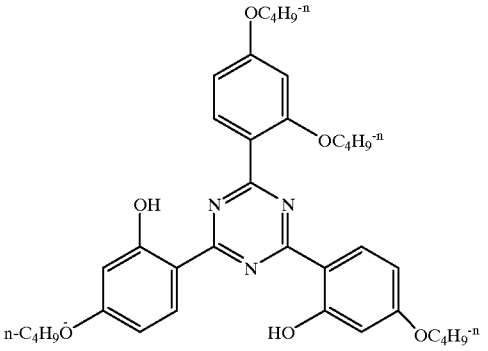

UV-A: A mixture of UV-1/UV-2/UV-3/UV-4=4/2/2/3 (weight ratio)
UV-B: A mixture of
UV-1/UV-2/UV-3/UV-4/UV-5/UV-6=9/3/3/4/5/3(weight ratio)
UV-C: A mixture of
UV-2/UV-3/UV-6/UV-7=1/1/1/2 (weight ratio)

(Solv-1)

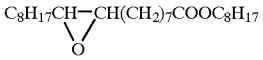

(Solv-2)

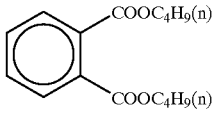

(Solv-3)

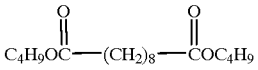

(Solv-4)

(Solv-5)

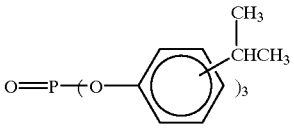

(Solv-6)

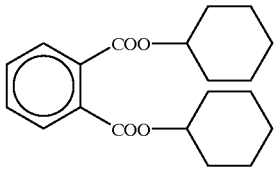

(Solv-7)

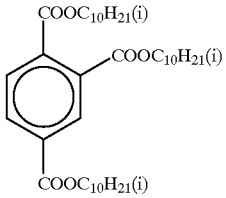

(Solv-8)

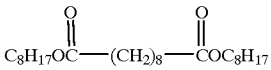

-continued

Crystal habit controlling agent 1

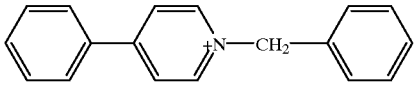

The ratio of [B/AgX] of the yellow coupler-containing layer of sample 1201 thus prepared (the ratio of [amount of gelatin binder/thickness of silver halide emulsion] of the yellowcoupler-containing layer) was 1.89, and the total gelatin amount was 4.76 g/m$^2$. Subsequently, samples 1202 to 1216 were prepared in the same manner as sample 1201 except for the following changes.

1) Samples 1202 and 1203 were prepared in the same manner as sample 1201, except that the total gelatin amount was changed to 6.92 g/m$^2$ or 7.49 g/m$^2$ respectively, by allowing to increase the amount of gelatin binder in the each of layers other than the yellow coupler-containing layer, in the same ratio in the respective layers.
2) Samples 1204 to 1206 were prepared in the same manner as samples 1201 to 1203, except that the cyan coupler was changed to Exemplified compound C-4, in the amount 2-times that of the cyan coupler in Samples 1201 to 1203 in molar amounts, respectively, whereas the ratio Ag/Cp in the cyan color-forming layer was not changed being kept constant.
3) Samples 1207 to 1212 were prepared in the same manner as samples 1201 to 1206, except that the order of the three color-forming layers was changed, respectively.
4) Samples 1213 to 1215 were prepared in the same manner as sample 1207, except that the cyan coupler was changed to a compound represented by formula [I], in an amount of the equivalent mole as that in Sample 1207.
5) Sample 1216 was prepared in the same manner as sample 1213, except that the ratio of [B/AgX] was changed, by changing the silver halide emulsion in the yellow coupler-containing layer to the cubic emulsion having the average grain size of 0.85 $\mu$m as used in samples 1107 to 1109 in Example 12.

The following evaluation tests were carried out by using the thus-prepared Samples 1201 to 1210.

(Evaluation Test of Progress of Development)

Progress of development was evaluated in the same manner as in Example 12.

(Evaluation Test of Blix Discoloration)

Blix discoloration was evaluated in the same manner as in Example 12, except that the pH value of the bleach-fixing solution in the "processing B" after running was adjusted to 5.5.

(Evaluation Test of Desilvering)

Desilvering property was evaluated in the same manner as in Example 12, except that the pH value of the bleach-fixing solution in the "processing B" after running was adjusted to 5.5.

The results of evaluations are shown in Table 12.

TABLE 12

| Sample | Order of color-forming layers (support side to upper layer side) | Total coated amount of gelatin g/m$^2$ | Cyan coupler species: Coupler of formula [I] | Cyan coupler species: Other cyan coupler(s) | [B/AgX] ratio | Proceeding rate of development $D^Y mB/D^Y mA$ | Blix discoloration (fading rate) | Disilvering failure ΔDv |
|---|---|---|---|---|---|---|---|---|
| 1201 | YMC | 4.76 | (1) | (C-2),(C-4),(C-6) | 1.89 | 80 | 1.2 | 0.10 |
| 1202 | YMC | 6.92 | (1) | (C-2),(C-4),(C-6) | 1.89 | 67 | 1.2 | 0.12 |
| 1203 | YMC | 7.49 | (1) | (C-2),(C-4),(C-6) | 1.89 | 59 | 1.2 | 0.13 |
| 1204 | YMC | 4.76 | — | (C-4) | 1.89 | 79 | 6.0 | 0.10 |
| 1205 | YMC | 6.92 | — | (C-4) | 1.89 | 66 | 6.2 | 0.12 |
| 1206 | YMC | 7.49 | — | (C-4) | 1.89 | 58 | 6.3 | 0.13 |
| 1207 | CMY | 4.76 | (1) | (C-2),(C-4),(C-6) | 1.89 | 99 | 1.2 | 0.01 |
| 1208 | CMY | 6.92 | (1) | (C-2),(C-4),(C-6) | 1.89 | 98 | 1.2 | 0.02 |
| 1209 | CMY | 7.49 | (1) | (C-2),(C-4),(C-6) | 1.89 | 94 | 1.2 | 0.06 |
| 1210 | CMY | 4.76 | — | (C-4) | 1.89 | 99 | 7.4 | 0.01 |
| 1211 | CMY | 6.92 | — | (C-4) | 1.89 | 97 | 7.6 | 0.02 |
| 1212 | CMY | 7.49 | — | (C-4) | 1.89 | 93 | 7.8 | 0.06 |
| 1213 | CMY | 4.76 | (1) | — | 1.89 | 99 | 0.5 | 0.01 |
| 1214 | CMY | 4.76 | (31) | — | 1.89 | 99 | 0.5 | 0.01 |
| 1215 | CMY | 4.76 | (25) | — | 1.89 | 99 | 0.5 | 0.01 |
| 1216 | CMY | 4.76 | (1) | — | 1.47 | 91 | 1.2 | 0.01 |

From the results shown in Table 12, it is apparent that the samples that employed the cyan coupler represented by formula [I] exhibited less blix discoloration, and less desilvering inadequacy, in comparison with the samples that employed a conventional phenol-series cyan coupler. Among these, samples that contained 3.0 to 7.4 g/m$^2$ in the total amount of the hydrophilic binder were excellent in development progress, blix discoloration resistance, and desilvering property, thereby to show the rapid processability. These results (effects of the invention) could not be attained with Samples 1201 to 1206 having the layer constitution of the coloring layers in the order of YMC from the support side to the upper layer side.

Example 18

The samples were prepare in the same manner as sample 1106 according to the present invention, except that the emulsions a1 and the emulsion b1 which were the same as in Example 9 were used in place of the blue-sensitive silver halide emulsion of the sample 1106. The sample thus-prepared was subjected to the same evaluation tests as in Examples 12 to 17. As a result, more excellent effects could be obtained by the samples of this Example.

Example 19

The evaluation tests were carried out in the same manner as in Examples 12 to 18, for the respective samples in those Examples, except that the samples each were subjected to scanning exposure (an average exposure time of $1.7\times10^{-7}$ seconds per one pixel) using a three-color laser light source and a polygon mirror, in accordance with the method described in JP-A-10-232476. As a result, similar effects could be obtained as in Examples 12 to 18.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide photographic light-sensitive material comprising at least a silver halide emulsion layer containing a yellow dye-forming coupler, a silver halide emulsion layer containing a magenta dye-forming coupler and a silver halide emulsion layer containing a cyan dye-forming coupler, on a support, wherein:

the silver halide emulsion layer containing a yellow dye-forming coupler is located more apart from the support than at least one of the silver halide emulsion layer containing a magenta dye-forming coupler or the silver halide emulsion layer containing a cyan dye-forming coupler, silver halide grains contained in the silver halide emulsion layer containing a yellow dye-forming coupler comprises a high silver chloride emulsion in which the content of silver halide is 80 mol % or more and the total amount of hydrophilic binder contained in the photographic constituent (constitutional) layers of the light-sensitive material is 7.4 g/m$^2$ or less.

2. The silver halide photographic light-sensitive material as claimed in claim 1, which comprises:

the silver halide emulsion layer containing a yellow dye-forming coupler, the silver halide emulsion layer containing a magenta dye-forming coupler, and the silver halide emulsion layer containing a cyan dye-forming coupler, on the support, with the silver halide grains of the respective silver halide emulsions of said silver halide emulsion layers, having different color sensitivities from each other, wherein the silver halide grains comprise a high silver chloride emulsion in which the content of silver chloride is 95 mol % or more.

3. The silver halide photographic light-sensitive material as claimed in claim 2, wherein the silver halide emulsion layer containing a yellow dye-forming coupler is a silver halide emulsion layer located apart-most from the support.

4. The silver halide photographic light-sensitive material as claimed in claim 2, wherein the silver halide emulsion contained in the silver halide emulsion layer containing a yellow dye-forming coupler is a tabular silver halide emulsion having 95 mol % or more of silver chloride content.

5. The silver halide photographic light-sensitive material as claimed in claim 2, wherein the silver halide emulsion contained in the silver halide emulsion layer containing a yellow dye-forming coupler is a tabular silver halide emulsion having 95 mol % or more of silver chloride content.

6. The silver halide photographic light-sensitive material as claimed in claim 2, wherein 50% or more of the total silver halide grain in terms of projected area contained in the silver halide emulsion layer containing a yellow dye-forming coupler is accounted for by tabular grains exhibiting an average aspect ratio of 2 or more and a silver chloride content of 80 mol % or more.

7. The silver halide photographic light-sensitive material as claimed in claim 2, wherein the ratio of (amount of hydrophilic binder/thickness of silver halide emulsion) of the yellow dye-forming coupler-containing layer is 1.50 or more.

8. The silver halide photographic light-sensitive material as claimed in claim 4, wherein the ratio of (amount of hydrophilic binder/thickness of silver halide emulsion) of the yellow dye-forming coupler-containing layer is 1.50 or more.

9. The silver halide photographic light-sensitive material as claimed in claim 5, wherein the ratio of (amount of hydrophilic binder/thickness of silver halide emulsion) of the yellow dye-forming coupler-containing layer is 1.50 or more.

10. The silver halide photographic light-sensitive material as claimed in claim 7, wherein the silver halide emulsion layer containing a yellow dye-forming coupler is a silver halide emulsion layer located in the further-most position from the support.

11. The silver halide photographic light-sensitive material as claimed in claim 10, wherein the total amount of a hydrophilic binder of the photographic constituent layers is 6.0 g/m$^2$ or less.

12. The silver halide photographic light-sensitive material as claimed in claim 7, wherein the total amount of oil-soluble materials in the photographic constituent layers is 4.5 g/m$^2$ or less.

13. The silver halide photographic light-sensitive material as claimed in claim 7, wherein a film thickness of the photographic constituent layers is 8.0 $\mu$m or less.

14. The silver halide photographic light-sensitive material as claimed in claim 7, wherein the silver halide emulsion layer containing a cyan dye-forming coupler contains at least one cyan dye-forming coupler represented by formula (I):

formula (I)

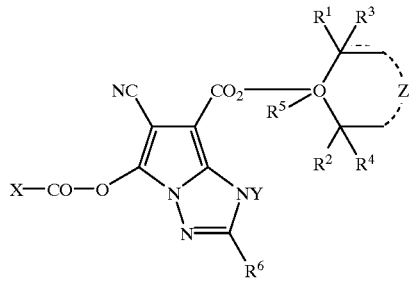

wherein $R^1$ and $R^2$ each independently represent an alkyl group, or an aryl group; $R^3$, $R^4$ and $R^5$ each independently represent a hydrogen atom, an alkyl group, or an aryl group; Z represents a group of non-metallic atoms necessary to form a saturated ring; $R^6$ represents a substituent; X represents a heterocyclic group, a substituted amino group, or an aryl group; and Y represents a hydrogen atom, or a group capable of being split-off in a process of color development.

15. The silver halide photographic light-sensitive material as claimed in claim 7, wherein the ratio of (amount of hydrophilic binder/thickness of silver halide emulsion) of the yellow coupler-containing layer is 6.0 or more.

16. The silver halide photographic light-sensitive material as claimed in claim 7, wherein a layer adjacent to the cyan dye-forming coupler-containing layer on the side further from the support, contains at least one cyan dye-forming coupler represented by formula (ADF):

formula [ADF]

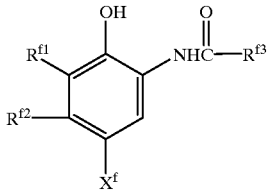

wherein $X^f$ represents a hydrogen atom, or a group capable of being split-off in a process of color development; $R^{f1}$ and $R^{f2}$, which may be the same or different from each other, each represent a hydrogen atom, or a substituent, $R^{f3}$ represents an alkyl group, an aryl group, an alkylamino group, or an arylamino group, $R^{f1}$ and $R^{f2}$ may bond together to form a 5- or 6-membered ring, with the proviso that at least one of the $R^{f1}$ to $R^{f2}$ groups contains 8 or more carbon atoms.

17. The silver halide photographic light-sensitive material as claimed in claim 14, wherein a layer adjacent to the cyan dye-forming coupler-containing layer on the side further from the support, contains at least one cyan dye-forming coupler represented by formula (ADF):

formula (ADF)

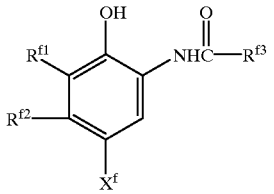

wherein $X^f$ represents a hydrogen atom, or a group capable of being split-off in a process of color development; $R^{f1}$ and $R^{f2}$, which may be the same or different from each other, each represent a hydrogen atom, or a substituent, $R^{f3}$ represents an alkyl group, an aryl group, an alkylamino group, or an arylamino group, $R^{f1}$ and $R^{f2}$ may bond together to form a 5- or 6-membered ring, with the proviso that at least one of the $R^{f1}$ to $R^{f3}$ groups contains 8 or more carbon atoms.

18. The silver halide photographic light-sensitive material as claimed in claim 17, wherein the silver halide emulsion layer closest to the support, contains at least one cyan dye-forming coupler represented by the above-described formula (I).

19. The silver halide photographic light-sensitive material as claimed in claim 7, further comprising at least one layer of a biaxially stretched polyolefin sheet having microscopic pores, between the support and the silver halide emulsion layers.

20. The silver halide photographic light-sensitive material as claimed in claim 2, wherein the silver halide emulsion layer containing a cyan dye-forming coupler contains a dispersion of lipophilic fine particles comprising at least one cyan dye-forming coupler and at least one high boiling organic solvent having a viscosity of 200 cp or more at 25° C.

21. The silver halide photographic light-sensitive material as claimed in claim 2, wherein the silver halide emulsion layer containing a cyan dye-forming coupler contains at least one cyan dye-forming coupler and at least one polymer which is insoluble in water and soluble in an organic solvent.

22. The silver halide photographic light-sensitive material as claimed in claim 20, wherein the silver halide emulsion layer containing a yellow dye-forming coupler is a silver halide emulsion layer farther-most from the support, and at least one of cyan dye-forming couplers contained in the silver halide emulsion layer containing a cyan dye-forming coupler is a cyan dye-forming coupler represented by formula (C-I):

formula [C-I]

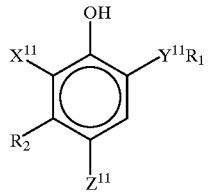

wherein, $Y^{11}$ represents —NHCO— or —CONH—; $R_1$ represents an alkyl group, an aryl group, a heterocyclic group, or an amino group; $X^{11}$ represents a hydrogen atom, a halogen atom, an alkoxy group, or an acylamino group; $R_2$ represents an alkyl group or an acylamino group; or $X^{11}$ and $R_2$ may be a group of nonmetallic atoms bound together to form a 5- to 7-membered ring, and $Z^{11}$ represents a hydrogen atom or a group capable of being split-off in the coupling reaction with an oxidized product of a developing agent.

23. The silver halide photographic light-sensitive material as claimed in claim 22, wherein the ratio of (amount of hydrophilic binder/thickness of silver halide emulsion) of the yellow dye-forming coupler-containing layer is in the range of 1.5 to 15, and the total amount of a hydrophilic binder contained in the photographic constitutional layers is in the range of 3.5 g/m$^2$ to 6.0 g/m$^2$.

24. The silver halide photographic light-sensitive material as claimed in claim 22, wherein the dispersion of lipophilic fine particles containing a cyan dye-forming coupler comprises at least one compound represented by the following formula (II) or (III):

formula (II)

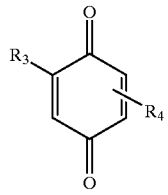

formula (III)

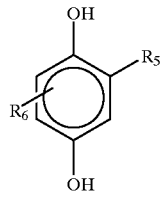

wherein $R_3$ and $R_5$ each represent a halogen atom, an acyl group, a sulfonyl group, an alkoxycarbonyl group, an aryloxycarbonyl group, a carbamoyl group, a sulfamoyl group, a sulfoxide group, a cyano group, a nitro group, or an alkyl group having at least one halogen atom at the α-position thereof; $R_4$ and $R_5$ each represent a hydrogen atom, an alkyl group, an aryl group, an alkoxy group, an aryloxy group, an alkylthio group, an arylthio group, or an amido group; and the total sum of carbon atoms of $R_3$ and $R_4$ is at least 8, and that of $R_5$ and $R_6$ is also at least 8.

25. The silver halide photographic light-sensitive material as claimed in claim 22, wherein the dispersion of lipophilic fine particles containing a cyan dye-forming coupler contains at least one polymer which is insoluble in water and soluble in an organic solvent.

26. The silver halide photographic light-sensitive material as claimed in claim 25, wherein the ratio (Ag/Cp) of a coating amount (mol/$m^2$) of the silver halide emulsion in terms of silver to a coating amount (mol/$m^2$) of the cyan dye-forming coupler, both of which are contained in a red-sensitive silver halide emulsion layer, is in the range of 1.5 to 4.0.

27. The silver halide photographic light-sensitive material as claimed in claim 26, wherein the red-sensitive silver halide emulsion layer contains a polymer represented by the following formula (P):

formula (P)

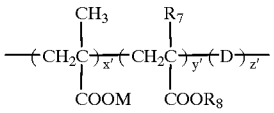

wherein, $R_7$ represents a hydrogen atom or a methyl group, $R_8$ represents an alkyl group having 1 to 10 carbon atoms, D represents a repeating unit derived from an ethylenically unsaturated monomer; x', y', and z' each represent a weight percent of the particular component in which x' is 20 to 80, y' is 80 to 20, and z' is 0 to 30, and x'+Y'+z'=100; and M represents a hydrogen atom or a cation.

28. The silver halide photographic light-sensitive material as claimed in claim 22, comprising, as at least one cyan dye-forming coupler, the cyan dye-forming coupler represented by the formula (C-I) as described in claim 24 and/or a cyan dye-forming coupler represented by formula (I):

formula (I)

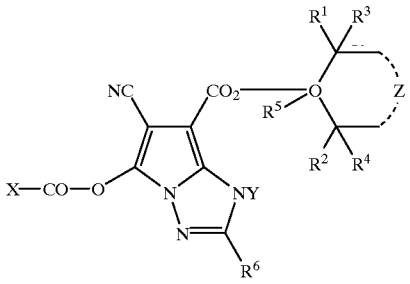

wherein $R^1$ and $R^2$ each independently represent an alkyl group, or an aryl group; $R^3$, $R^4$ and $R^5$ each independently represent a hydrogen atom, an alkyl group, or an aryl group; Z represents a group of non-metallic atoms necessary to form a saturated ring; $R^6$ represents a substituent; X represents a heterocyclic group, a substituted amino group, or an aryl group; Y represents a hydrogen atom, or a group capable of being split-off in a process of color development.

29. The silver halide photographic light-sensitive material as claimed in claim 22, wherein the total amount of a hydrophilic binder contained in the photographic constituent layers of the light-sensitive material is 3.0 g/$m^2$ or more, but 7.4 g/$m^2$ or less.

30. The silver halide photographic light-sensitive material as claimed in claim 21, wherein the silver halide emulsion layer containing a yellow dye-forming coupler is a silver halide emulsion layer located most apart from the support, and at least one cyan dye-forming coupler contained in the silver halide emulsion layer containing a cyan dye-forming coupler is a cyan dye-forming coupler represented by the following formula (I):

formula [I]

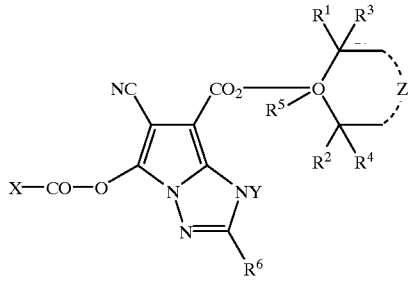

wherein $R^1$ and $R^2$ each independently represent an alkyl group or an aryl group, $R^3$, $R^4$ and $R^5$ each independently represent a hydrogen atom, an alkyl group or an aryl group, Z represents a group of non-metallic atoms required to form a saturated ring, $R^6$ represents a substituent, X represents a heterocyclic group, a substituted amino group or an aryl group, and Y represents a hydrogen atom or a group capable of being split-off in a process of color development.

31. The silver halide photographic light-sensitive material as claimed in claim 30, wherein the polymer which is insoluble in water and soluble in an organic solvent is a compound represented by the following formula [PP]:

$$-(A)_x-(B)_y- \qquad \text{Formula [PP]}$$

wherein A represents a repeating unit derived from at least one ethylenically unsaturated monomer having at least one —COOM (M represents a hydrogen atom or a cation atom) group in its molecule, B represents a repeating unit derived from at least one ethylenically unsaturated monomer having no —COOM group, and x and y each represent a percentage ratio by weight of A and B, respectively, in which x is 20 to 80 and y is 80 to 20, provided that x+y=100.

32. The silver halide photographic light-sensitive material as claimed in claim 31, wherein the compound represented by formula [PP] is a compound represented by the following formula [P]:

formula [P]

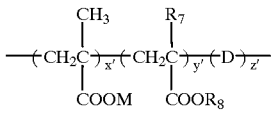

wherein $R_7$ represents a hydrogen atom or a methyl group, $R_8$ represents an alkyl group having 1 to 10 carbon atoms, D represents a repeating unit derived from an ethylenically unsaturated monomer; x', y', and z' each represent a weight percent of the particular component, in which x' is 20 to 80, y' is 80 to 20, and z' is 0 to 30, and x'+Y'+z'=100; and M represents a hydrogen atom or a cation.

33. The silver halide photographic light-sensitive material as claimed in claim 8, wherein said tabular grains have {111} major faces.

34. The silver halide photographic light-sensitive material as claimed in claim 6, wherein said tabular grains have {100} major faces.

35. The silver halide photographic light-sensitive material as claimed in claim 34, wherein the total amount of a hydrophilic binder contained in photographic constituent layers of the light-sensitive material is 7.4 $g/m^2$ or less.

36. The silver halide photographic light-sensitive material as claimed in claim 33, wherein said tabular grains contains at least 0.1 mol % of silver iodide based on total silver.

37. The silver halide photographic light-sensitive material as claimed in claim 34, wherein said tabular grains contains at least 0.1 mol % of silver iodide based on total silver.

38. The silver halide photographic light-sensitive material as claimed in claim 36, wherein an average diameter of the tabular silver halide grains is 0.6 $\mu$m or less, in which the diameter is a diameter of a sphere corresponding to the volume of an individual silver halide grain.

39. The silver halide photographic light-sensitive material as claimed in claim 37, wherein an average diameter of the tabular silver halide grains is 0.6 $\mu$m or less, in which the diameter is a diameter of a sphere corresponding to the volume of an individual silver halide grain.

40. A method of forming an image, comprising the steps of subjecting a silver halide photographic light-sensitive material to exposure, and subjecting the light-sensitive material to developing treatment, wherein the silver halide photographic light-sensitive material of claim 1 is subjected to scanning exposure with a light beam modulated based on image information, followed by developing treatment.

41. The method of forming an image as claimed in claim 40, wherein the silver halide photographic light-sensitive material is a silver halide photographic light-sensitive material of claim 7.

42. The method of forming an image as claimed in claim 40, wherein the silver halide photographic light-sensitive material is a silver halide photographic light-sensitive material of claim 20.

43. The method of forming an image as claimed in claim 42, wherein the silver halide photographic light-sensitive material is a silver halide photographic light-sensitive material of claim 19.

44. The method of forming an image as claimed in claim 40, wherein the silver halide photographic light-sensitive material is a silver halide photographic light-sensitive material of claim 21.

45. The method of forming an image as claimed in claim 40, wherein the silver halide photographic light-sensitive material is a silver halide photographic light-sensitive material of claim 6.

46. A method of forming an image, comprising the steps of subjecting a silver halide photographic light-sensitive material to exposure, and subjecting the light-sensitive material to developing treatment, wherein the silver halide photographic light-sensitive material of claim 1 is subjected to exposure, followed by performing developing treatment in the period of processing time of 25 seconds or less for color development.

47. The method of forming an image as claimed in claim 46, wherein the developing treatment is performed in the periods of time of 5 to 25 seconds for the color development step, 5 to 25 seconds for the bleach-fixing step, 10 to 45 seconds for the water-washing and/or stabilization step, and 5 to 15 seconds for the drying step.

48. The method of forming an image as claimed in claim 46, wherein the developing treatment is performed in the period of processing time of 20 seconds or less for color development.

49. The method of forming an image as claimed in claim 48, wherein the silver halide photographic light-sensitive material is a silver halide photographic light-sensitive material of claim 7.

50. The method of forming an image as claimed in claim 47, wherein the silver halide photographic light-sensitive material is a silver halide photographic light-sensitive material of claim 20.

51. The method of forming an image as claimed in claim 50, wherein the silver halide photographic light-sensitive material is a silver halide photographic light-sensitive material of claim 19.

52. The method of forming an image as claimed in claim 47, wherein the silver halide photographic light-sensitive material is a silver halide photographic light-sensitive material of claim 21.

53. The method of forming an image as claimed in claim 48, wherein the silver halide photographic light-sensitive material is a silver halide photographic light-sensitive material of claim 6.

54. The method of forming an image as claimed in claim 50, wherein the pH of a treating solution in a bleach-fixing step is in a range between 4.5 and 6.0.

55. The method of forming an image as claimed in claim 54, wherein the silver halide photographic light-sensitive material is a silver halide photographic light-sensitive material comprising at least a silver halide emulsion layer containing a yellow dye-forming coupler, a silver halide emulsion layer containing a magenta dye-forming coupler and a silver halide emulsion layer containing a cyan dye-forming coupler, on a support, wherein:

the silver halide emulsion layer containing a yellow dye-forming coupler, the silver halide emulsion layer containing a magenta dye-forming coupler, and the silver halide emulsion layer containing a cyan dye-forming coupler, on the support, with the silver halide grains of the respective silver halide emulsions of said silver halide emulsion layers, having different color sensitivities from each other, wherein the silver halide grains comprise a high silver chloride emulsion in which the content of silver chloride is 95 mol % or more, the silver halide emulsion layer containing a cyan dye-forming coupler contains a dispersion of lipophilic fine particle comprising at least one cyan dye-forming coupler and at least one high boiling organic solvent having a viscosity of 200 cp or more at 25° C., the silver halide emulsion layer containing a yellow dye-forming coupler is a silver halide emulsion layer farther-most from the support, and at least one of cyan dye-forming couplers contained in the silver halide emulsion layer containing a cyan dye-forming coupler is a cyan dye-forming coupler represented by formula (C-I):

formula (C-I)

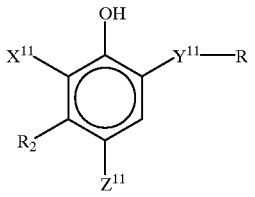

wherein, $Y^{11}$ represents —NHCO— or —CONH—; $R_1$ represents an alkyl group, an aryl group, a heterocyclic group, or an amino group; $X^{11}$ represents a hydrogen atom, a halogen atom, an alkoxy group, or an acylamino group; $R_2$ represents an alkyl group or an acylamino group; or $X^{11}$ and $R_2$ may be a group of nonmetallic atoms bound together to form a 5- to 7-membered ring, and $Z^{11}$ represents a hydrogen atom or a group capable of being split-off in the coupling reaction with an oxidized product of a developing agent, and the total amount of hydrophilic binder contained in the photographic constituent (constitutional) layers of the light-sensitive material is 7.4 g/m$^2$ or less.

56. The method of forming an image as claimed in claim 52, wherein the pH of a treating solution in a bleach-fixing step is in a range between 4.5 and 6.0.

57. The silver halide photographic light-sensitive material as claimed in claim 2, wherein the silver halide emulsion layer containing a cyan dye-forming coupler is located nearer to the support than at least one of the silver halide emulsion layer containing a yellow dye-forming coupler or the silver halide emulsion layer containing a magenta dye-forming coupler.

58. The silver halide photographic light-sensitive material as claimed in claim 57, wherein at least one cyan dye-forming coupler represented by formula (C-I) is contained in the silver halide emulsion layer containing a cyan dye-forming coupler:

formula (C-I)

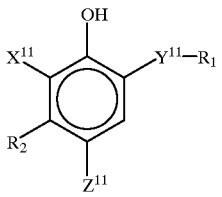

wherein, $Y^{11}$ represents —NHCO— or —CONH—; $R_1$ represents an alkyl group, an aryl group, a heterocyclic group, or an amino group; $X^{11}$ represents a hydrogen atom, a halogen atom, an alkoxy group, or an acylamino group; $R_2$ represents an alkyl group or an acylamino group; or $X^{11}$ and $R_2$ may be a group of nonmetallic atoms bound together to form a 5- to 7-membered ring, and $Z^{11}$ represents a hydrogen atom or a group capable of being split-off in the coupling reaction with an oxidized product of a developing agent.

59. The silver halide photographic light-sensitive material as claimed in claim 58, wherein the silver halide emulsion layer containing a cyan dye-forming coupler contains a dispersion of lipophilic fine particles comprising at least one cyan dye-forming coupler and at least one high boiling organic solvent having a viscosity of 200 cp or more at 25° C.

60. The silver halide photographic light-sensitive material as claimed in claim 58, wherein the dispersion of lipophilic fine particles containing a cyan dye-forming coupler comprises at least one compound represented by the following formula (II) or (III):

formula (II)

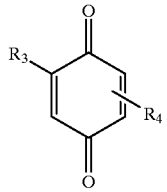

formula (III)

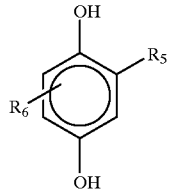

wherein $R_3$ and $R_5$ each represent a halogen atom, an acyl group, a sulfonyl group, an alkoxycarbonyl group, an aryloxycarbonyl group, a carbamoyl group, a sulfamoyl group, a sulfoxide group, a cyano group, a nitro group, or an alkyl group having at least one halogen atom at the α-position thereof; $R_4$ and $R_5$ each represent a hydrogen atom, an alkyl group, an aryl group, an alkoxy group, an aryloxy group, an alkylthio group, an arylthio group, or an amido group; and the total sum of carbon atoms of $R_3$ and $R_4$ is at least 8, and that of $R_5$ and $R_6$ is also at least 8.

61. The silver halide photographic light-sensitive material as claimed in claim 58, wherein at least one compound represented by the following formula (PP) is contained in the silver halide emulsion layer containing a cyan dye-forming coupler:

$$-(A)_x-(B)_y- \qquad \text{Formula (PP)}$$

wherein A represents a repeating unit derived from at least one ethylenically unsaturated monomer having at least one —COOM (M represents a hydrogen atom or a cation atom) group in its molecule, B represents a repeating unit derived from at least one ethylenically unsaturated monomer having no —COOM group, and x and y each represent a percentage ratio by weight of A and B, respectively, in which x is 20 to 80 and y is 80 to 20, provided that x+y=100.

62. The silver halide photographic light-sensitive material as claimed in claim 57, wherein at least one of cyan dye-forming couplers represented by the following formula (I) is contained in the silver halide emulsion layer containing a cyan dye-forming coupler:

formula (I)

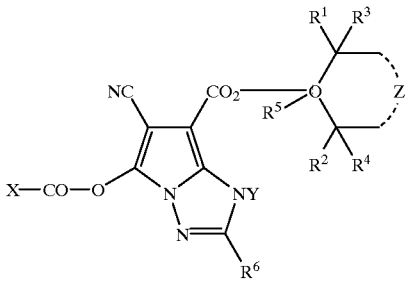

wherein $R^1$ and $R^2$ each independently represent an alkyl group, or an aryl group; $R^3$, $R^4$ and $R^5$ each independently represent a hydrogen atom, an alkyl group, or an aryl group; Z represents a group of non-metallic atoms necessary to form a saturated ring; $R^6$ represents a substituent; X represents a heterocyclic group, a substituted amino group, or an aryl group; and Y represents a hydrogen atom, or a group capable of being split-off in a process of color development.

63. The method of forming an image as claimed in claim 40, wherein the silver halide photographic light-sensitive material is a silver halide photographic light-sensitive material of claim 57.

64. The method of forming an image as claimed in claim 46, wherein the silver halide photographic light-sensitive material is a silver halide photographic light-sensitive material of claim 57.

* * * * *